US012778192B2

(12) United States Patent
Minskoff

(10) Patent No.: US 12,778,192 B2
(45) Date of Patent: Nov. 3, 2026

(54) VAPORIZING DEVICE

(71) Applicant: PHOS INNOVATIONS LLC, Miami, FL (US)

(72) Inventor: Noah Mark Minskoff, Boise, ID (US)

(73) Assignee: Phos Innovations LLC, Miami, FL (US)

( * ) Notice: Subject to any disclaimer, the term of this patent is extended or adjusted under 35 U.S.C. 154(b) by 0 days.

(21) Appl. No.: 19/578,449

(22) Filed: Mar. 25, 2026

(65) Prior Publication Data

US 2026/0215499 A1 Jul. 30, 2026

Related U.S. Application Data

(60) Division of application No. 19/411,104, filed on Dec. 5, 2025, which is a continuation-in-part of application No. 18/727,923, filed as application No. PCT/US2023/010238 on Jan. 5, 2023, said application No. 19/411,104 is a continuation-in-part of application No. PCT/US2025/020185, filed on Mar. 17, 2025.

(60) Provisional application No. 63/308,942, filed on Feb. 10, 2022, provisional application No. 63/298,935, (Continued)

(51) Int. Cl.

| | |
|---|---|
| ***A24F 40/51*** | (2020.01) |
| ***A24F 40/10*** | (2020.01) |
| ***A24F 40/42*** | (2020.01) |
| ***A24F 40/44*** | (2020.01) |
| ***A24F 40/46*** | (2020.01) |
| ***A24F 40/485*** | (2020.01) |
| ***A24F 40/57*** | (2020.01) |

(52) U.S. Cl.
CPC ..... *A24F 40/10* (2020.01); *A24F 40/42* (2020.01); *A24F 40/44* (2020.01); *A24F 40/46* (2020.01); *A24F 40/485* (2020.01); *A24F 40/51* (2020.01); *A24F 40/57* (2020.01)

(58) Field of Classification Search
CPC ..... A24F 40/00
See application file for complete search history.

(56) References Cited

U.S. PATENT DOCUMENTS

| | | | | |
|---|---|---|---|---|
| 5,325,230 | A | 6/1994 | Yamagata | |
| 7,398,165 | B1 * | 7/2008 | Miau | G01F 1/3259 702/77 |
| 2011/0226236 | A1 | 9/2011 | Buchberger | |

(Continued)

*Primary Examiner* — Philip Y Louie
*Assistant Examiner* — Charlotte Davison

(57) ABSTRACT

A vaporizing device including a reservoir to store a liquid precursor, a dispenser to regulate the flow of the liquid precursor, a chamber to receive the liquid precursor and generate vapor, and a heater to supply heat to vaporize at least a portion of the liquid precursor, an inlet to admit air, and an outlet that includes a tortuous flow path geometry configured to condition vapor or aerosol prior to delivery to a user. The chamber may include geometries that enhance thin film vaporization or induce rotational flow. A controller may be provided to regulate power delivered to the heater, estimate heater temperature, compare detected inhalation parameters to stored inhalation profiles, and responsively adapt operation. In some embodiments, the controller may operate in an idle or standby mode to maintain a minimum temperature. The device may also include valves to inhibit leakage of the liquid precursor when not in use.

30 Claims, 63 Drawing Sheets

Related U.S. Application Data filed on Jan. 12, 2022, provisional application No. 63/566,372, filed on Mar. 17, 2024.

(56) References Cited

U.S. PATENT DOCUMENTS

| | | | | |
|---|---|---|---|---|
| 2014/0190496 | A1 | 7/2014 | Wensley | |
| 2016/0138160 | A1 | 5/2016 | Lambert | |
| 2016/0262451 | A1 | 9/2016 | Liu | |
| 2017/0135401 | A1* | 5/2017 | Dickens | A61M 11/042 |
| 2017/0172210 | A1 | 6/2017 | Bright | |
| 2017/0360092 | A1 | 12/2017 | Althorpe | |
| 2017/0367407 | A1 | 12/2017 | Althorpe | |
| 2018/0072487 | A1 | 3/2018 | Bessant | |
| 2018/0104214 | A1* | 4/2018 | Raichman | A24F 40/42 |
| 2018/0140018 | A1* | 5/2018 | Hu | A24F 40/485 |
| 2018/0200458 | A1 | 7/2018 | Li | |
| 2018/0249763 | A1 | 9/2018 | Schmidt | |
| 2019/0041079 | A1* | 2/2019 | Kohn | F02C 7/052 |
| 2019/0142071 | A1 | 5/2019 | Seok | |
| 2020/0000151 | A1* | 1/2020 | Fraser | B01D 53/0407 |
| 2020/0022413 | A1 | 1/2020 | Zhang | |
| 2020/0352245 | A1 | 11/2020 | Otiaba | |
| 2021/0307402 | A1* | 10/2021 | Batley | G01L 1/16 |
| 2021/0392947 | A1 | 12/2021 | Folmann | |
| 2022/0260399 | A1* | 8/2022 | Arwatz | A24F 40/51 |
| 2022/0362489 | A1* | 11/2022 | Czapar | A61M 11/042 |
| 2023/0000166 | A1* | 1/2023 | Lee | A24F 40/51 |
| 2023/0218005 | A1* | 7/2023 | Liu | A24F 40/40 131/329 |
| 2023/0397660 | A1* | 12/2023 | Decker | A24F 40/46 |

* cited by examiner

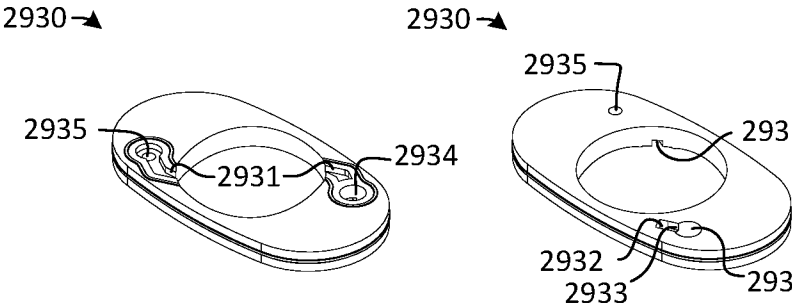
FIGURE 29B
FIGURE 29C
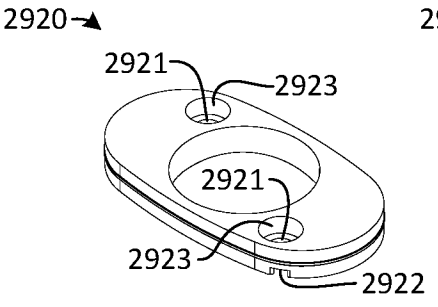
FIGURE 29D
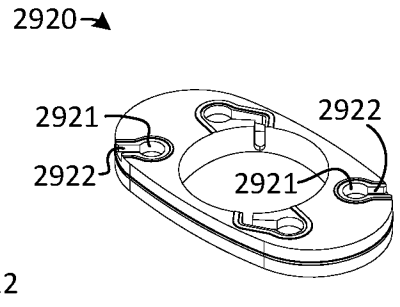
FIGURE 29E
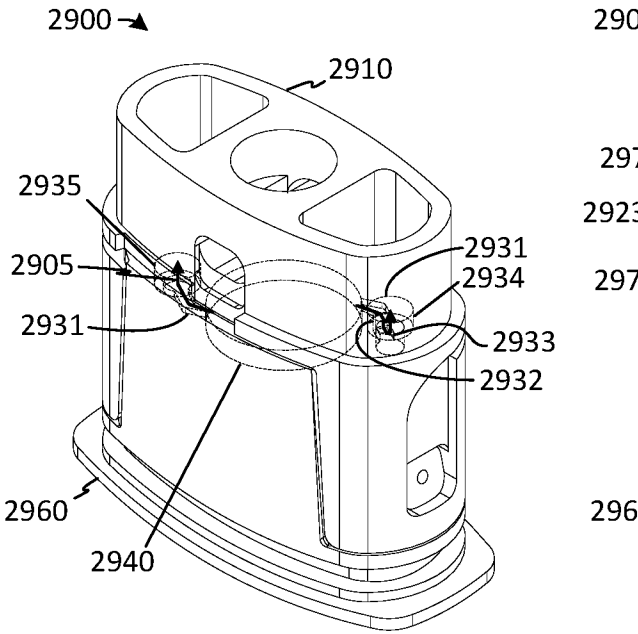
FIGURE 29F
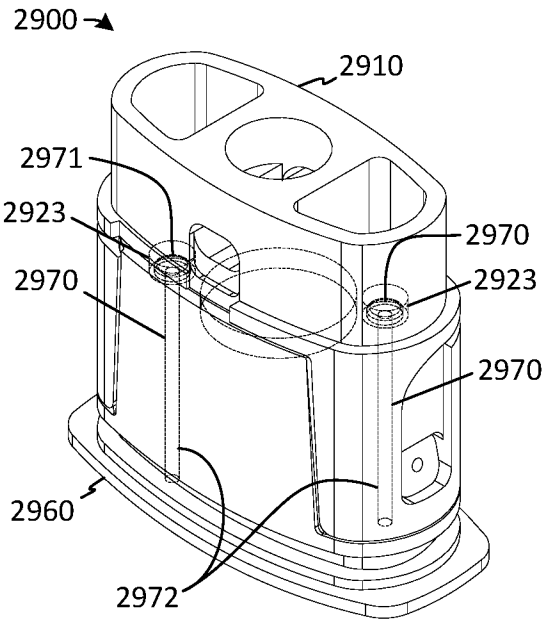
FIGURE 29G
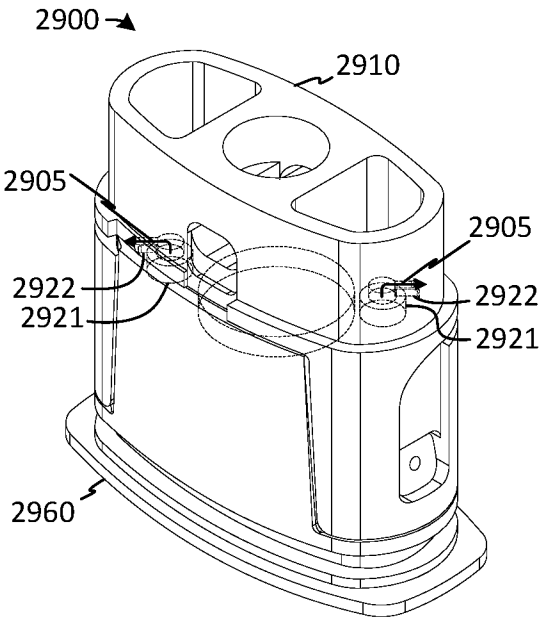
FIGURE 29H FIGURE 30B
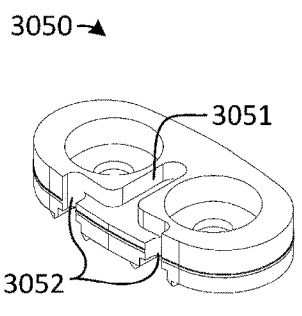
FIGURE 30C
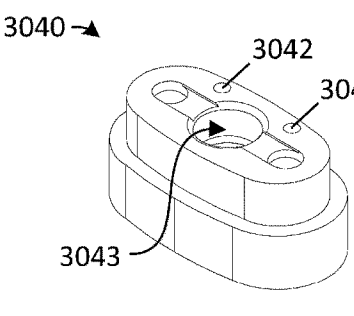
FIGURE 30D
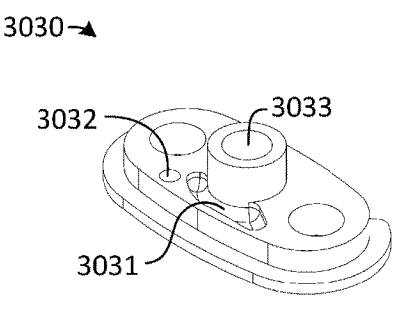
FIGURE 30E
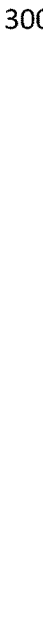
FIGURE 30F
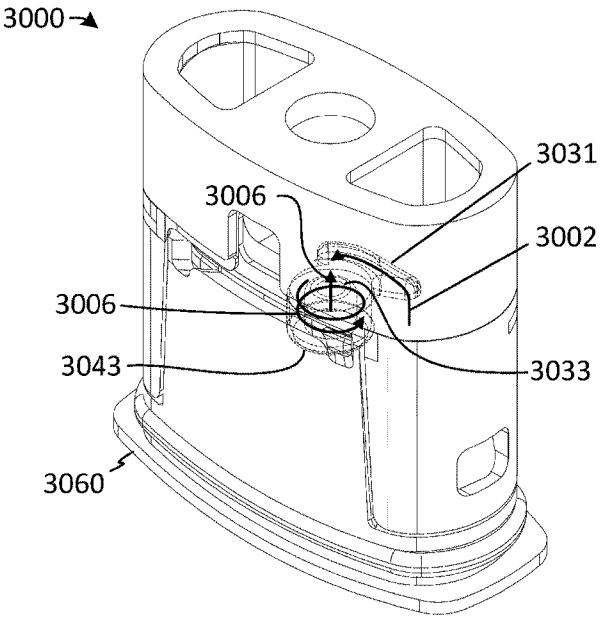
FIGURE 30G

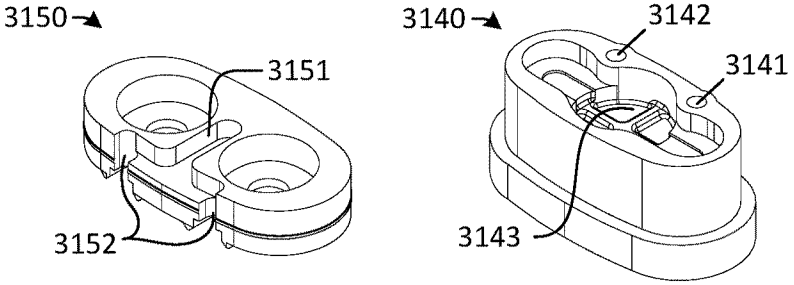
FIGURE 31B
FIGURE 31C
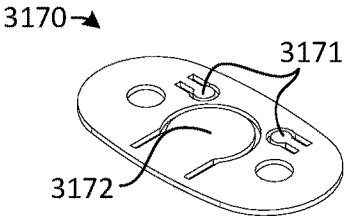
FIGURE 31D
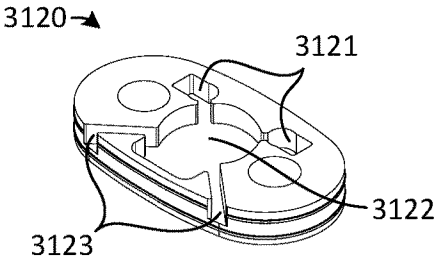
FIGURE 31E
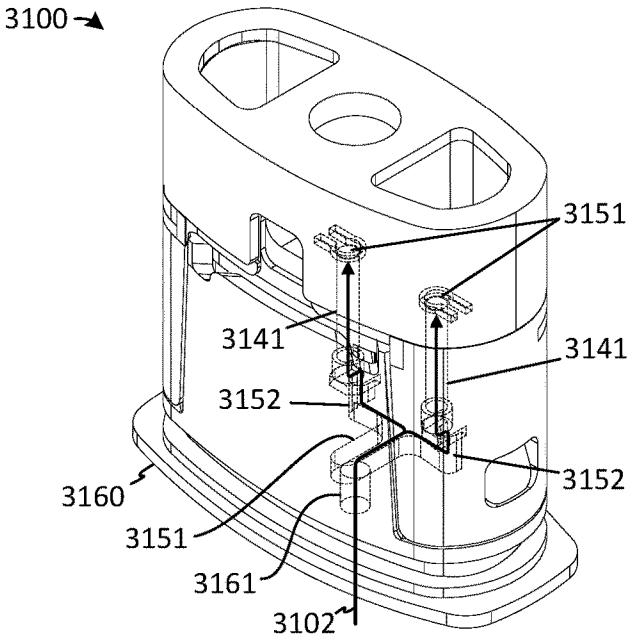
FIGURE 31F
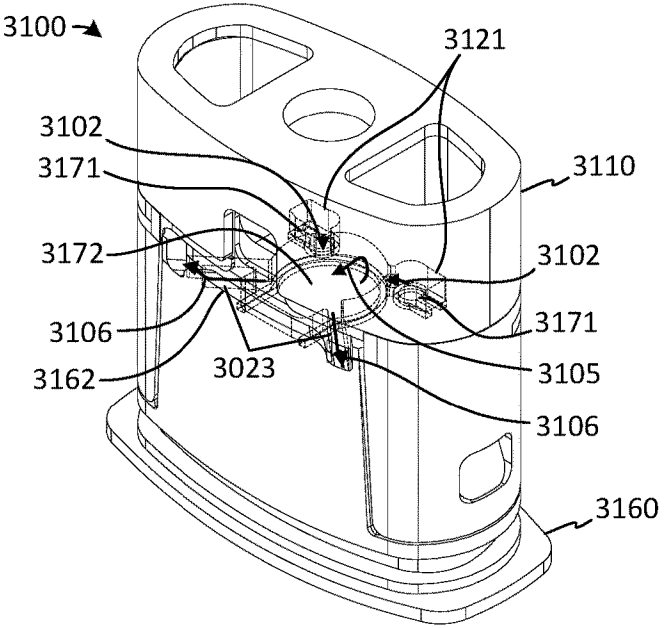
FIGURE 31G

VAPORIZING DEVICE

RELATED APPLICATIONS

This application claims the benefit of, and is a division of, U.S. patent application Ser. No. 19/411,104, titled "PERSONAL VAPORIZING UNIT", filed Dec. 5, 2025, and said Ser. No. 19/411,104 claims the benefit of, and is a continuation-in-part of U.S. patent application Ser. No. 18/727,923, titled "PERSONAL VAPORIZING UNIT", filed Jul. 10, 2024, and said Ser. No. 18/727,923 is a 371 national stage of international application number PCT/US23/10238, titled "PERSONAL VAPORIZING UNIT", filed Jan. 5, 2023, which claims the benefit of U.S. provisional application Ser. No. 63/308,942, titled "PERSONAL VAPORIZING UNIT", filed Feb. 10, 2022, and also claims the benefit of U.S. provisional application Ser. No. 63/298,935, titled "PERSONAL VAPORIZING UNIT", filed Jan. 12, 2022, said Ser. No. 19/411,104 also claims the benefit of, and is a continuation-in-part of, international application number PCT/US25/20185, titled "VAPORIZING DEVICE", filed Mar. 17, 2025, which claims the benefit of U.S. Provisional application Ser. No. 63/566,372, titled "VAPORIZING DEVICE", filed Mar. 17, 2024, which are all hereby incorporated by reference herein for all purposes.

BRIEF DESCRIPTION OF THE DRAWINGS

Many aspects of the disclosure can be better understood with reference to the following drawings. While several implementations are described in connection with these drawings, the disclosure may be not limited to the implementations disclosed herein. On the contrary, the intent may be to cover all alternatives, modifications, and equivalents.

FIG. 29B illustrates an isometric view of the top of a mid seal.

FIG. 29C illustrates an isometric view of the bottom of a mid seal.

FIG. 29D illustrates an isometric view of the top of a precursor inlet seal.

FIG. 29E illustrates am isometric view of the bottom of a precursor inlet seal.

FIG. 29F illustrates a vapor flow path extending from a chamber assembly.

FIG. 29G illustrates poppet valves in a vapor flow path.

FIG. 29H illustrates a vapor flow path after a poppet valve.

FIG. 30B illustrates a cross section of a lower chassis.

FIG. 30C illustrates an isometric view of the bottom of a lower seal.

FIG. 30D illustrates a chamber housing.

FIG. 30E illustrates an isometric view of the bottom of a flow director.

FIG. 30F illustrates an isometric view of an inlet flow path for a vaporizer.

FIG. 30G illustrates an isometric view of an outlet flow path for a vaporizer.

FIG. 31B illustrates a bottom isometric view of a lower seal.

FIG. 31C illustrates a chamber housing.

FIG. 31D illustrates an isometric view of valve assembly.

FIG. 31E illustrates a bottom isometric view of flow director.

FIG. 31F illustrates an air intake flow path.

FIG. 31G illustrates the mixing of vapor and air, aerosol generation, and the subsequent exit flow path.

FIG. 34A illustrates an isometric view of a vaporizing device.

FIG. 34B illustrates a cross section of a vaporizing device.

FIG. 35A illustrates an isometric view of a vaporizing device.

FIG. 35B illustrates an isometric view of a base unit with the housing removed.

FIG. 35C illustrates a cross section of a vaporizing device.

FIG. 35D illustrates a detail view of a chamber assembly.

FIG. 36A illustrates an isometric view of a vaporizing device.

FIG. 36B illustrates an isometric view of a vaporizing device with the housing removed.

FIG. 37A illustrates an actuator with a cartridge.

FIG. 37B illustrates an isometric view of the underside of a cartridge.

FIG. 37C illustrates an isometric view of slide plates.

FIG. 38 illustrates actuators with a cartridge.

Figure 39:
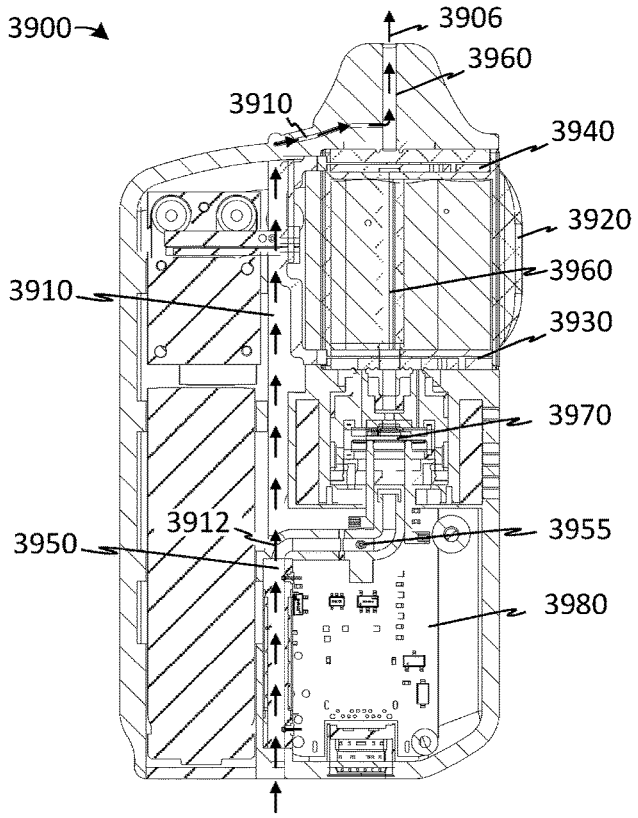

FIG. 39 illustrates a cross section of a vaporizing device.

Figure 40B:
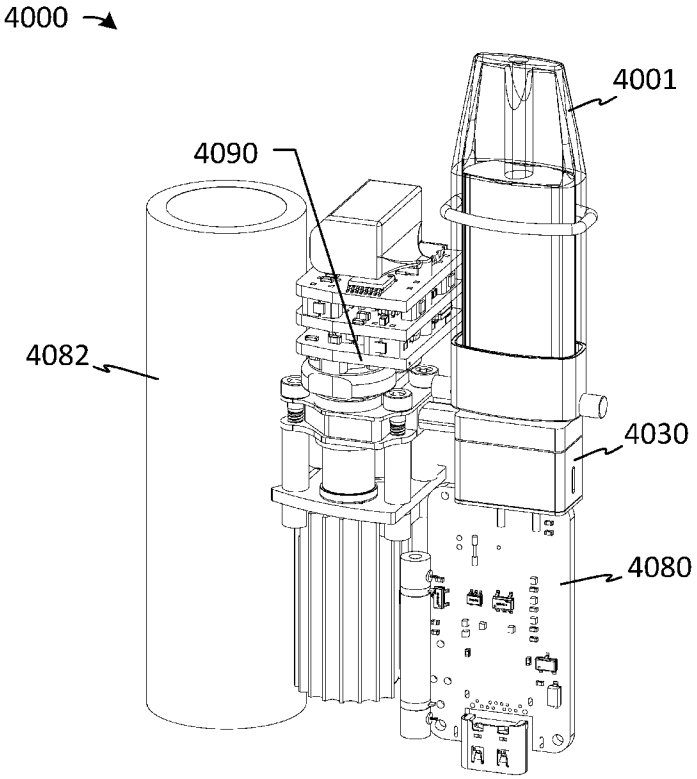
Figure 40A:
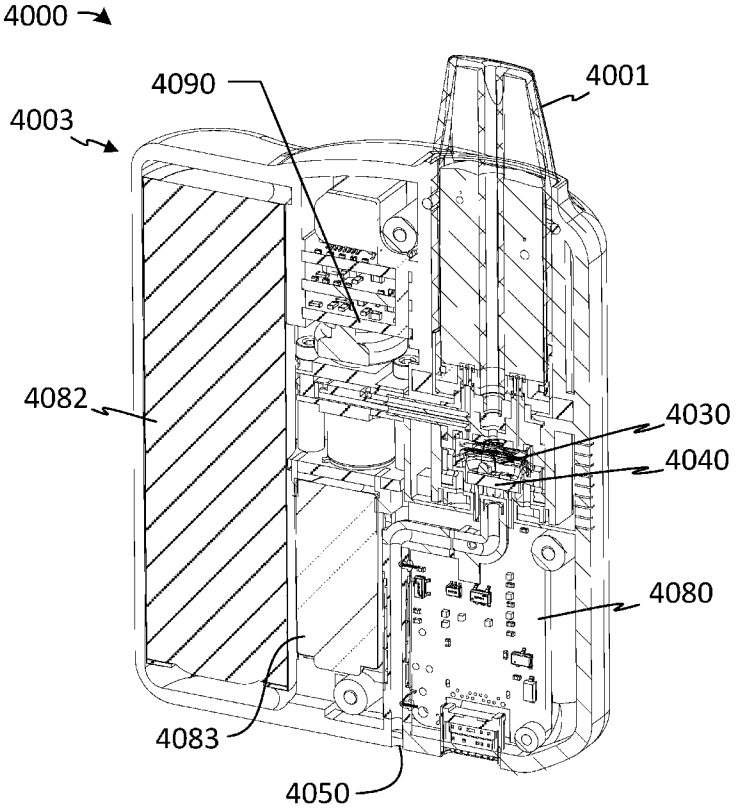

FIG. 40A illustrates a cross section of a vaporizing device.

FIG. 40B illustrates a cross section of a vaporizing device with the housing removed.

Figure 41B:
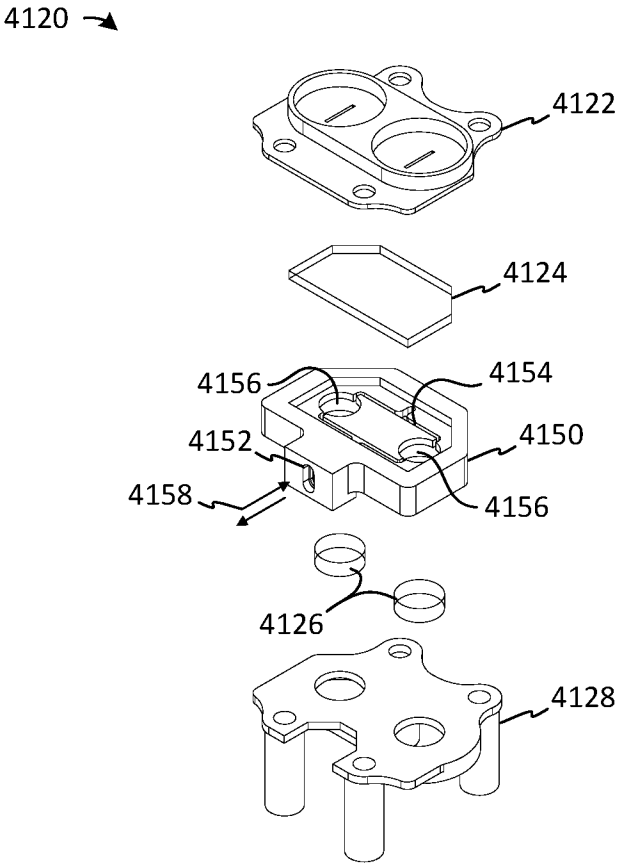
Figure 41A:
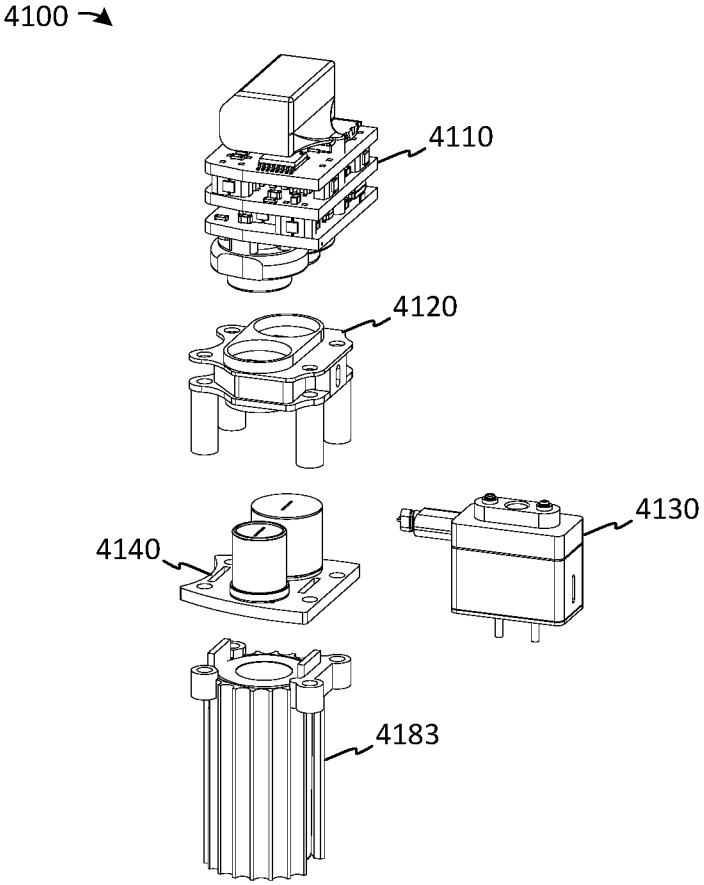

FIG. 41A illustrates an exploded view of a spectrophotometer.

FIG. 41B illustrates an exploded view of a sample chamber.

Figure 42:
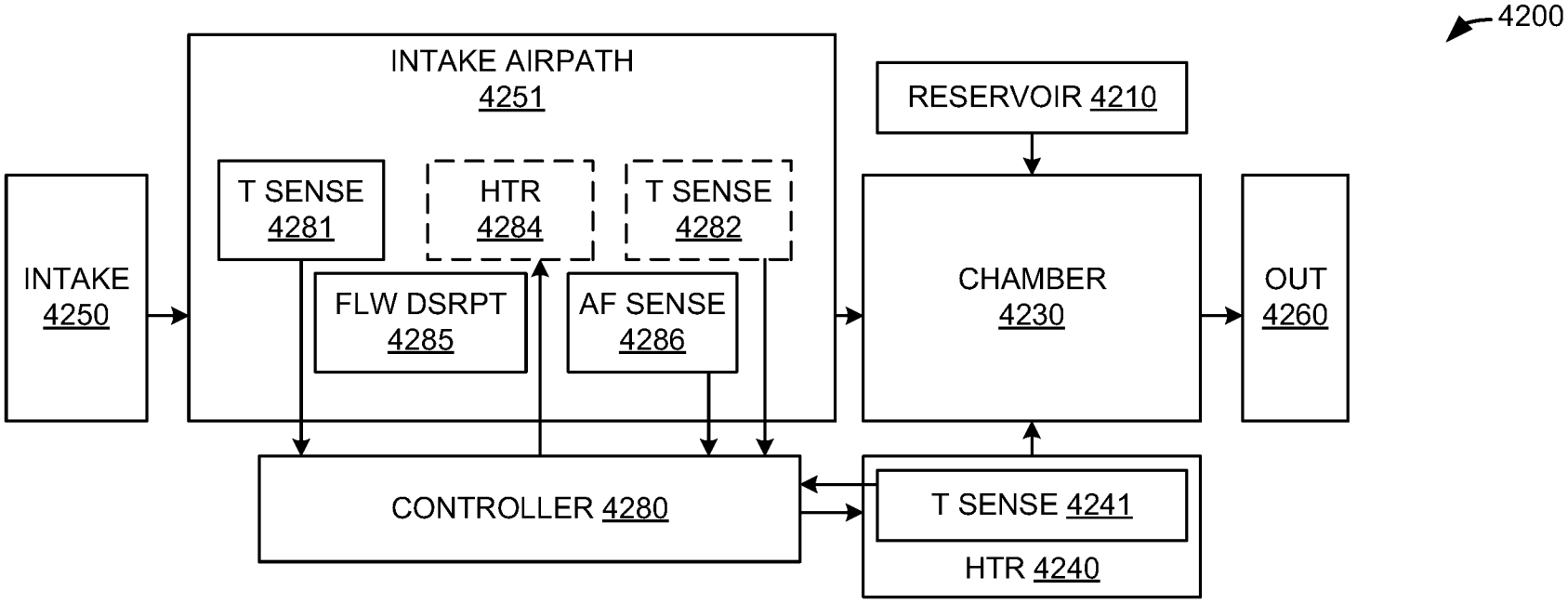

FIG. 42 is a block diagram illustrating a vaporizer.

Figure 43:
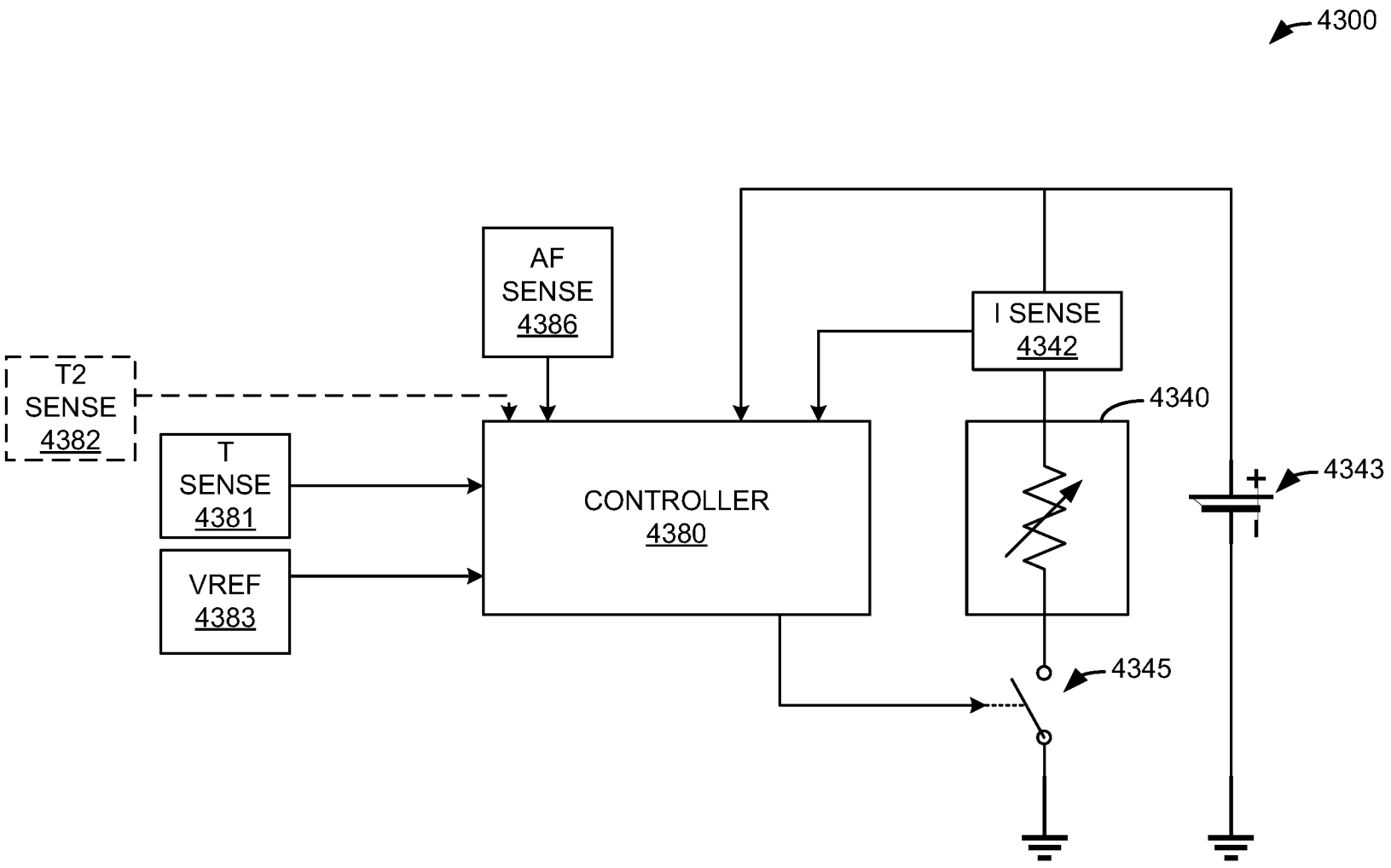

FIG. 43 is a block diagram illustrating a vaporizing chamber heater control system.

Figure 44:
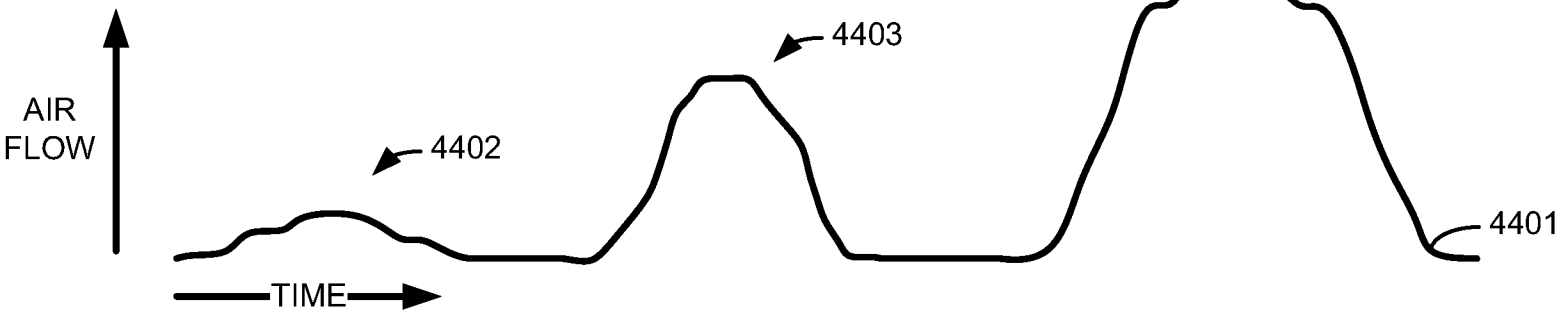

FIG. 44 illustrates example airflow versus time measurements for three successive puffs.

Figure 45:
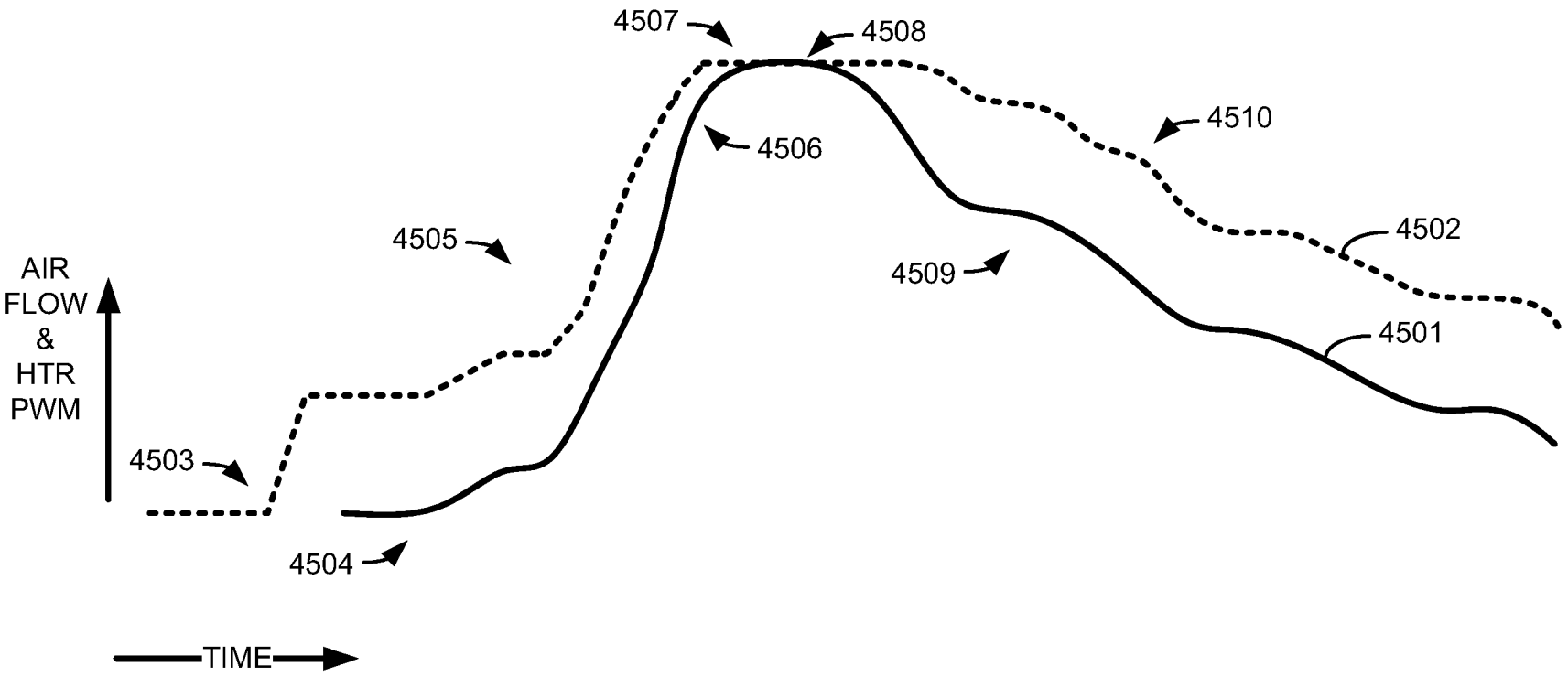

FIG. 45 illustrates example airflow and heater control system output vs time measurements.

Figure 46:
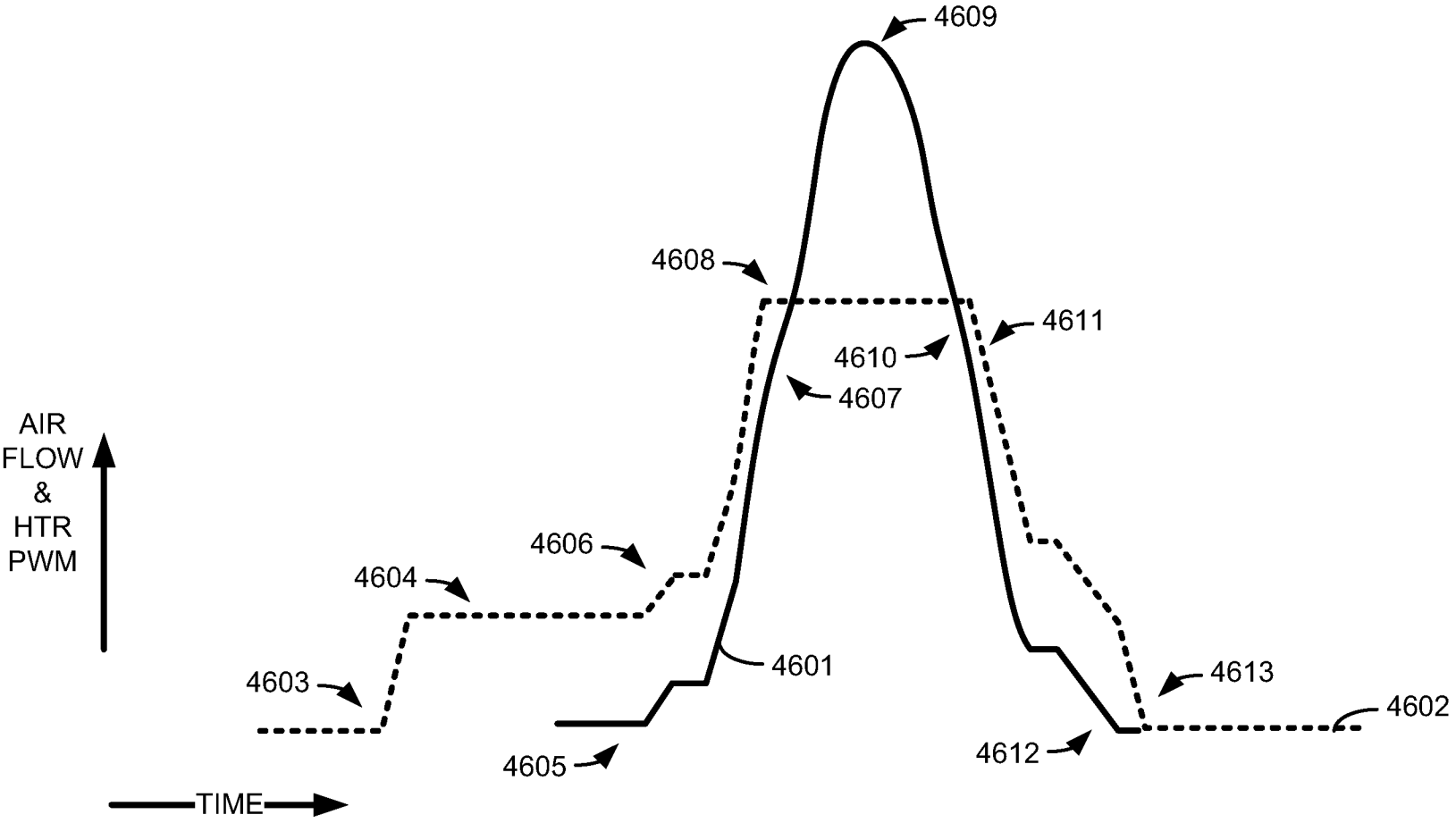

FIG. 46 illustrates another example airflow and heater control system output vs time measurements.

Figure 47:
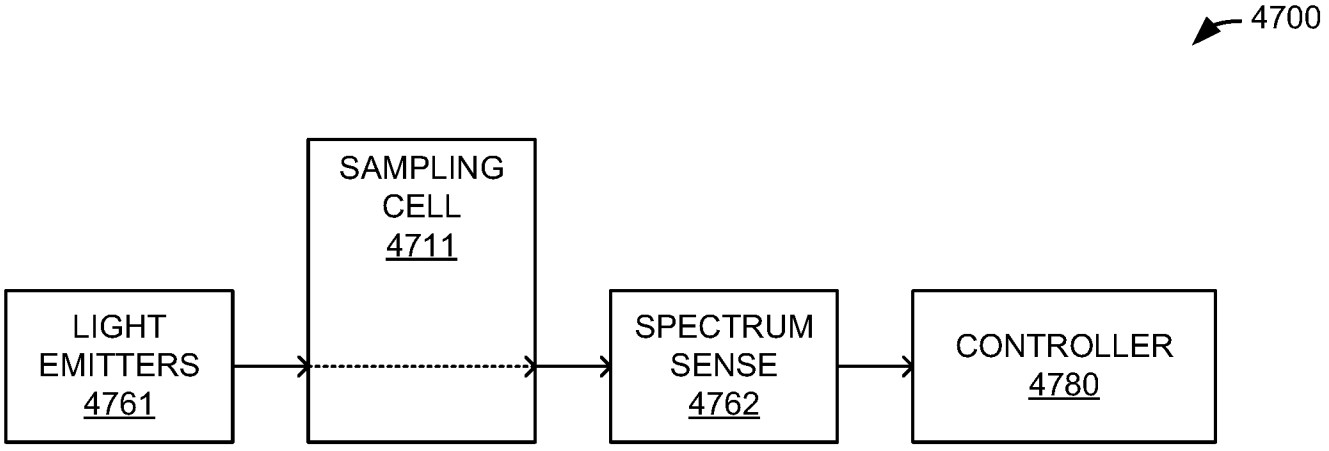

FIG. 47 is a block diagram illustrating an optical analysis subsystem.

Figure 48:
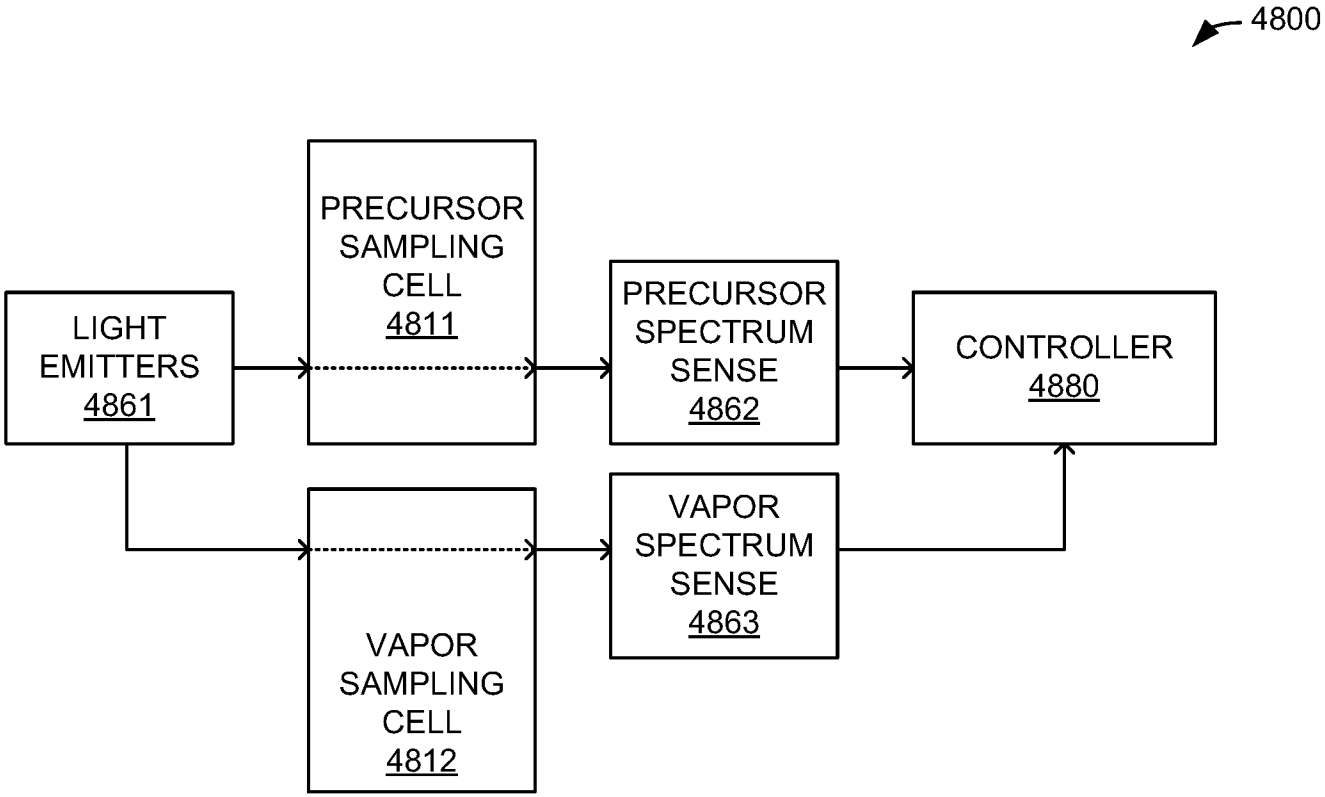

FIG. 48 is a block diagram illustrating a dual-cell optical analysis subsystem.

Figure 49:
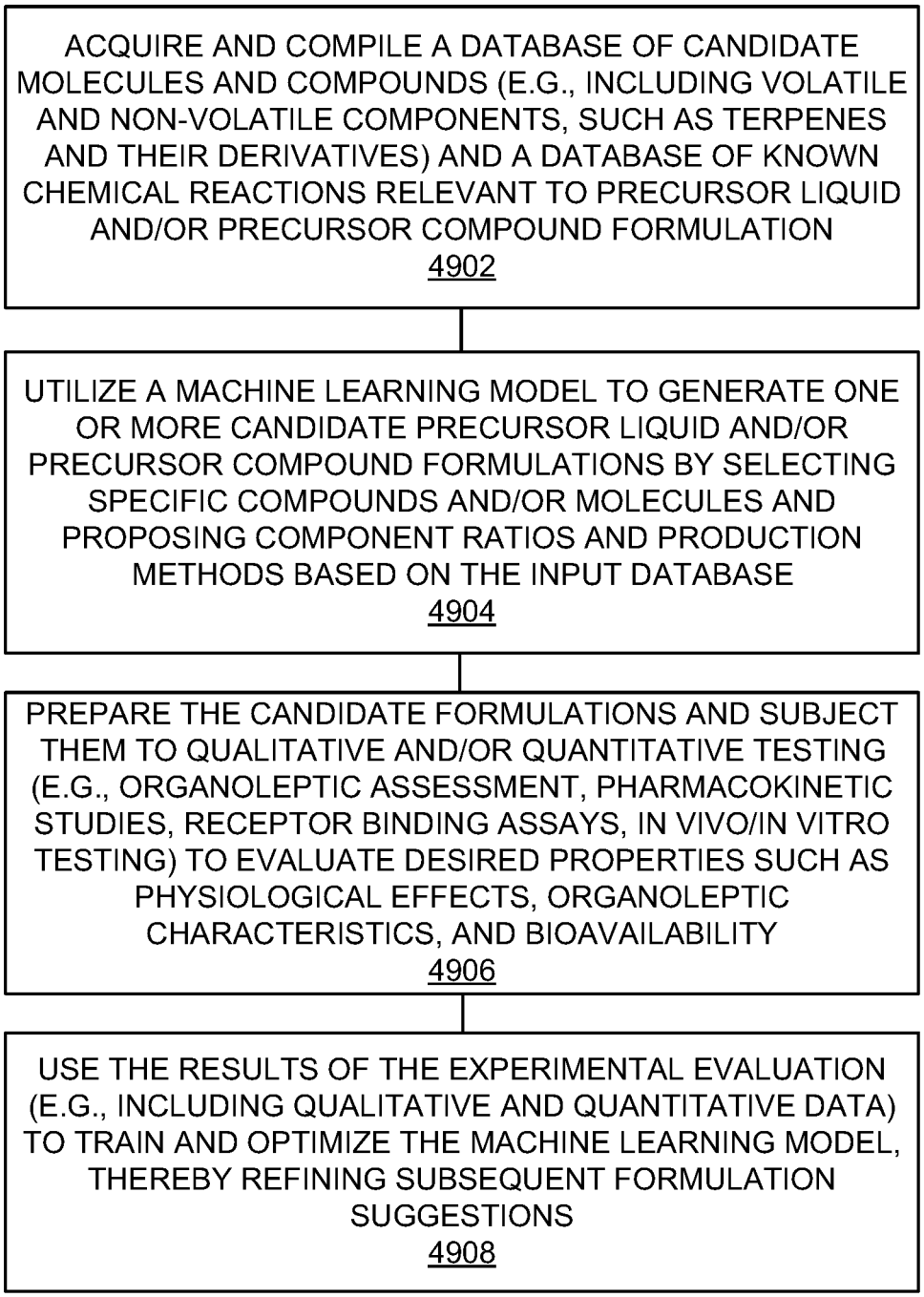

FIG. 49 is a flowchart illustrating an exemplary process for optimizing precursor liquid and/or precursor compound formulations using machine learning.

Figure 50:
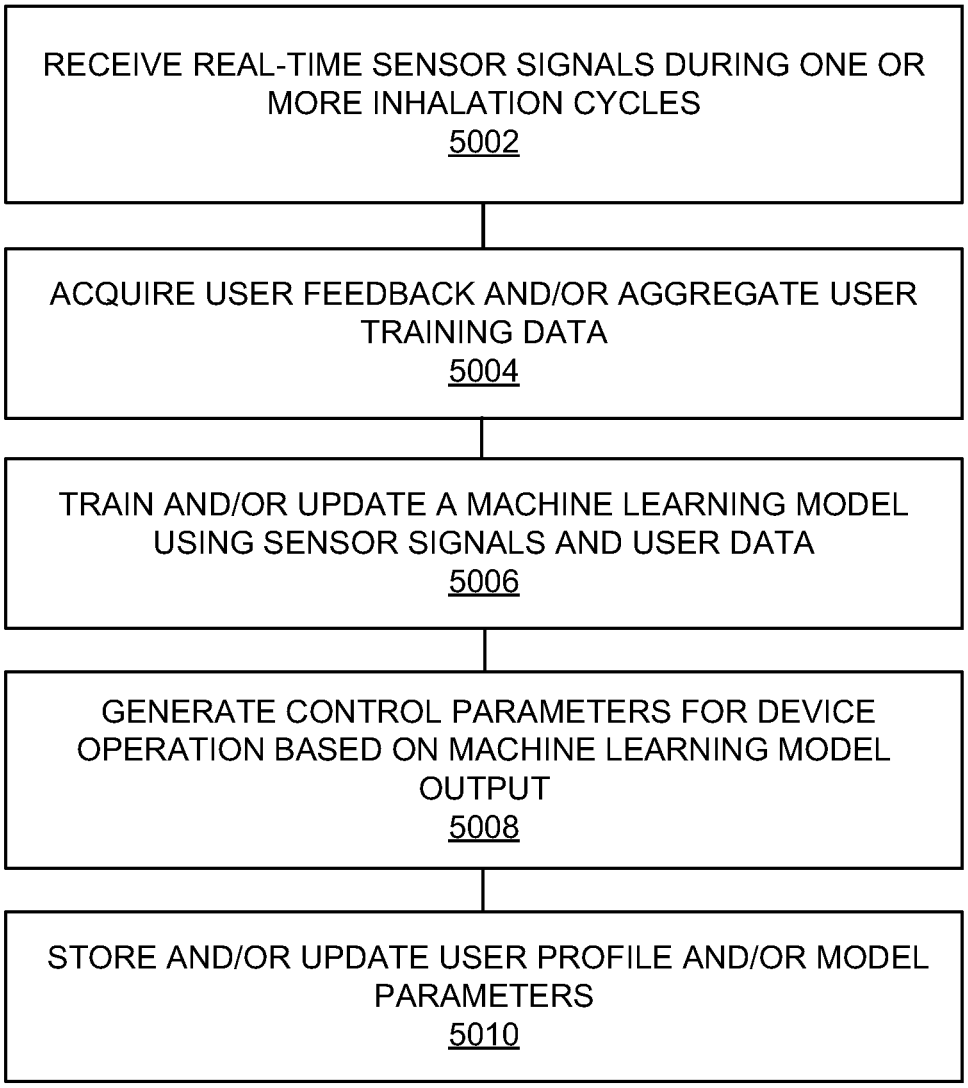

FIG. 50 is a flowchart illustrating an exemplary process for determining mappings from sensor signals to control parameters of a vaporizing device using machine learning.

Figure 51:
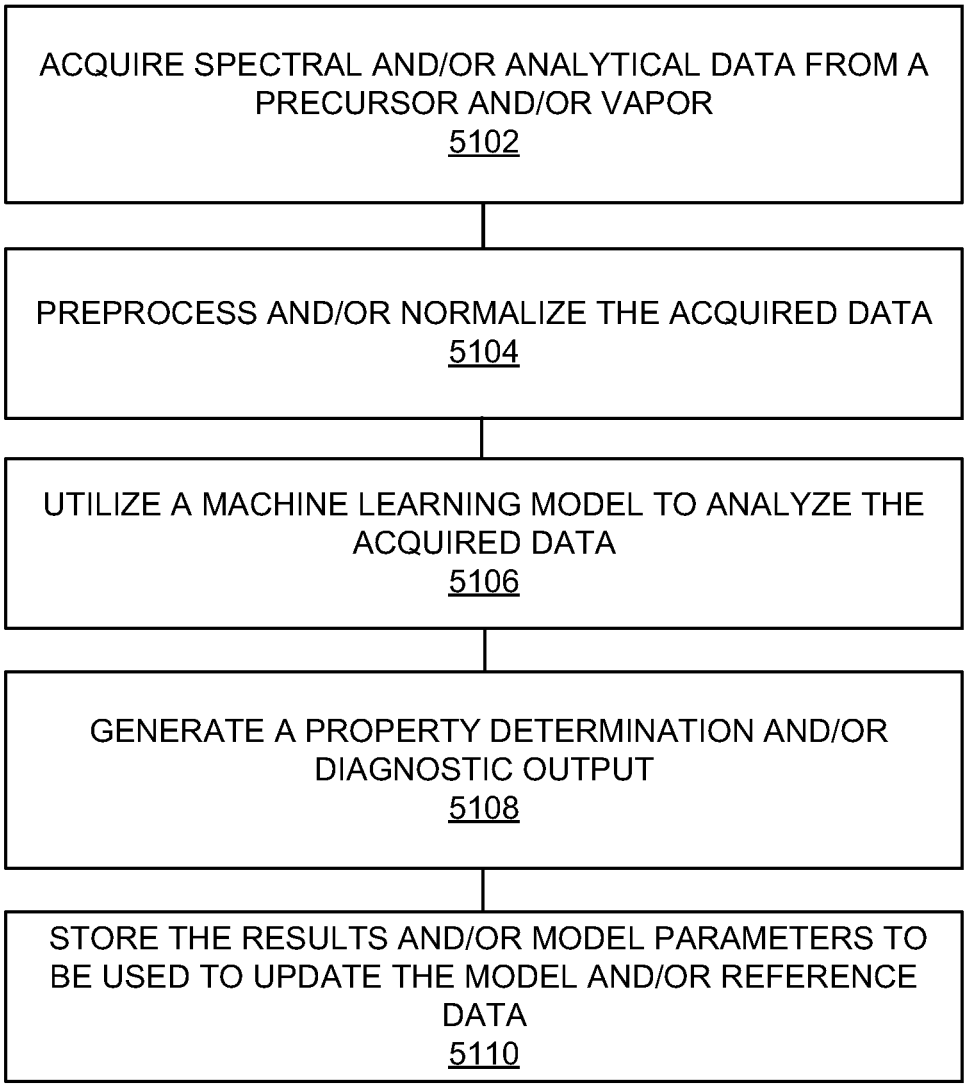

FIG. 51 is a flowchart illustrating an exemplary process for detecting properties of a precursor and/or vapor using machine learning and analytical measurements.

Figure 52:
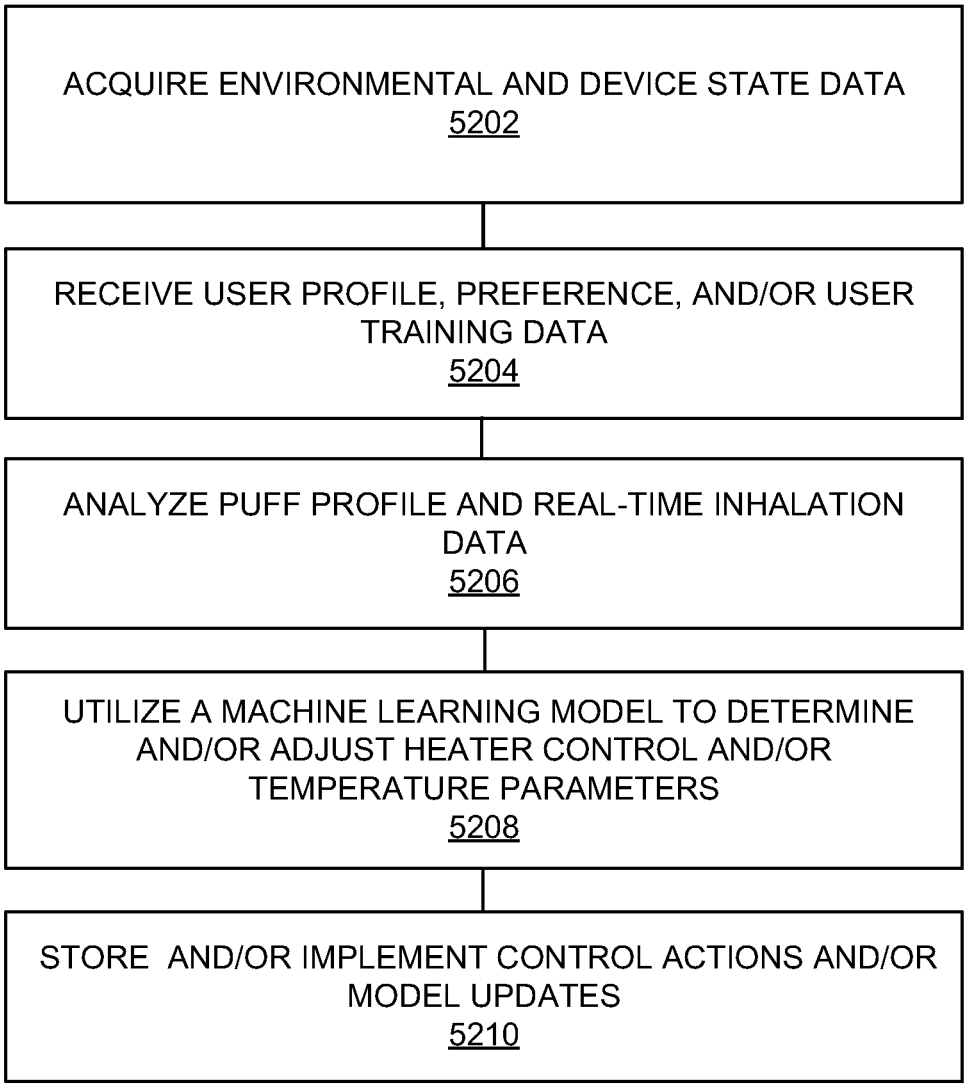

FIG. 52 is a flowchart illustrating an exemplary process for adapting heater control parameters of a vaporizing device using machine learning based on environmental conditions, device state, and/or user profile.

Figure 53:
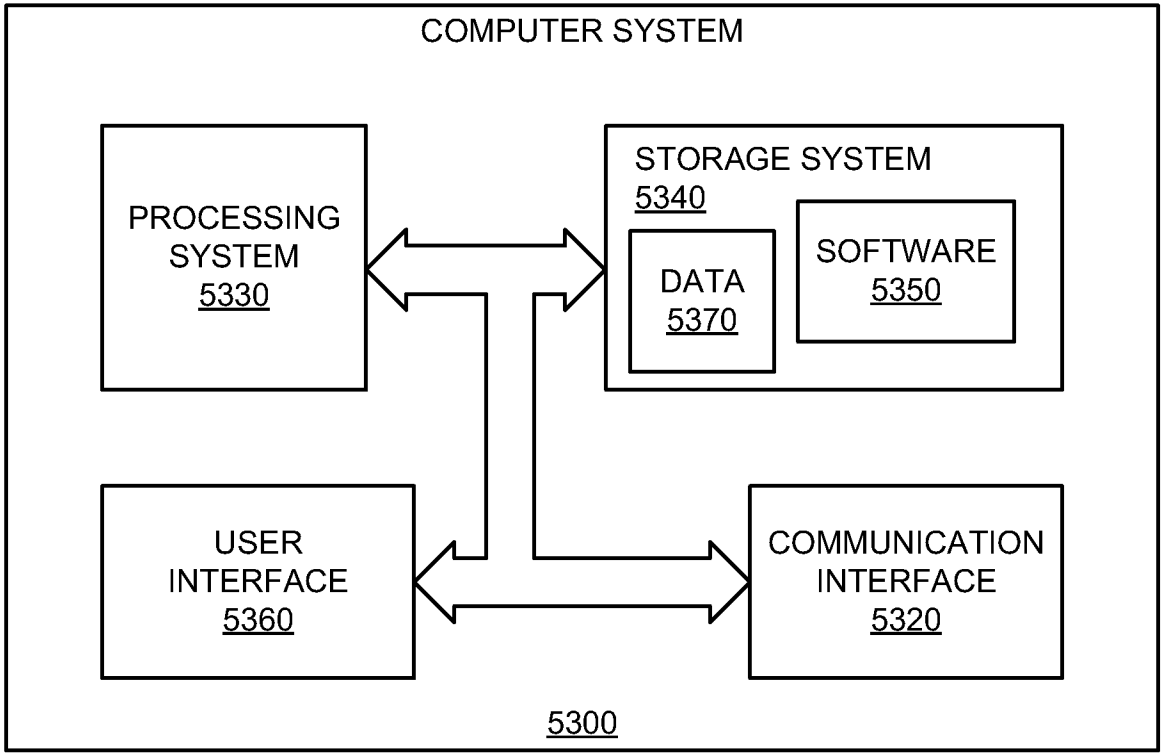

FIG. 53 illustrates a block diagram of a computer system.

DETAILED DESCRIPTION

Vaporizers or e-cigarettes offer a smokeless alternative to traditional smoking methods, potentially reducing harmful byproducts, offering controllable substance delivery, and diversifying flavor possibilities. Nevertheless, certain persistent challenges in their implementation, including uneven heat distribution, the generation of harmful by-products present in the aerosol secondary to the thermal degradation of the aerosol precursor by overheating, the presence of metals from the heating element in the aerosol, leakage of liquid precursor, residue buildup, and inhalation discomfort, necessitate further advancements in their design and operation.

Some current issues with vaporizers relate to effective heat delivery and liquid management. The relationship between the amount of liquid dispensed and the heat delivered by the heating element is important. When excessive liquid is dispensed, it may exceed the heating element's capacity to vaporize the liquid, which can lead to unvaporized liquid passing through the heating chamber. This can result in users inadvertently inhaling liquid precursor, creating an unpleasant experience. Conversely, if insufficient liquid is supplied relative to the heat produced, it may cause uneven heating. Uneven heating could affect the flavor profile and cause harmful by-products. Additionally, some vaporizers experience residue buildup on the heating elements, which compromises efficiency and contributes to uneven heating and inconsistent aerosol production, increased production of thermal degradation products from heating and reheating the buildup, ultimately affecting the overall quality and taste. Additionally, many vaporizers have metallic heating elements in direct contact with the liquid precursor, and/or in contact with the airflow path. This results in undesirable and often toxic components of the metal heating element being released into the aerosol and subsequently inhaled by the user. Furthermore, these devices may be prone to leakage under certain conditions, such as being left in a hot car or during high-altitude use, which can lead to device failure, and is an inconvenience and mess.

In various embodiments, vaporizer designs isolate heating elements, incorporate valve systems, and/or utilize responsive control systems. In an embodiment, a chamber design may be located in a reusable portion of a vaporizing device to reduce waste, or in a disposable cartridge or cartomizer for compatibility with other designs. The chamber design may include a heating element isolated from direct contact with the liquid, which helps eliminate the contribution of metals and/or compounds present in metallic heaters to the aerosol, helps prevent residue accumulation on the heater, mitigates hot spots to reduce thermal degradation, and maintains the temperature coefficient of the heating element for accurate temperature measurement. The chamber may also provide a more even heating surface for the precursor composition, ensuring consistent heating and enhancing flavor and user experience. Furthermore, in an embodiment, one or more valve systems help to prevent leakage when not in use. In an embodiment, an airflow system that entrains the aerosol generated by the heater and utilizes tortuous flow geometry including pressure and velocity differentials, impaction surfaces and directional changes to enable the selective removal of particles based on their size. The airflow system may be constructed to not be in direct contact with the heater to prevent any metallic components of the heater being present in the formed aerosol. Additionally, the vaporizer may incorporate a control system configured to dynamically adjust the power supplied to the heating element based on inhalation topography. This functionality may enable the device to measure pressure changes and corresponding user inhalation patterns, allowing for responsive adjustments in power; for instance, a strong inhalation may trigger an increase in power delivered to the heater, whereas a gentler inhale may result in reduced power output. Such features may enhance the overall efficiency and user satisfaction of the vaporizer.

Figure 1:
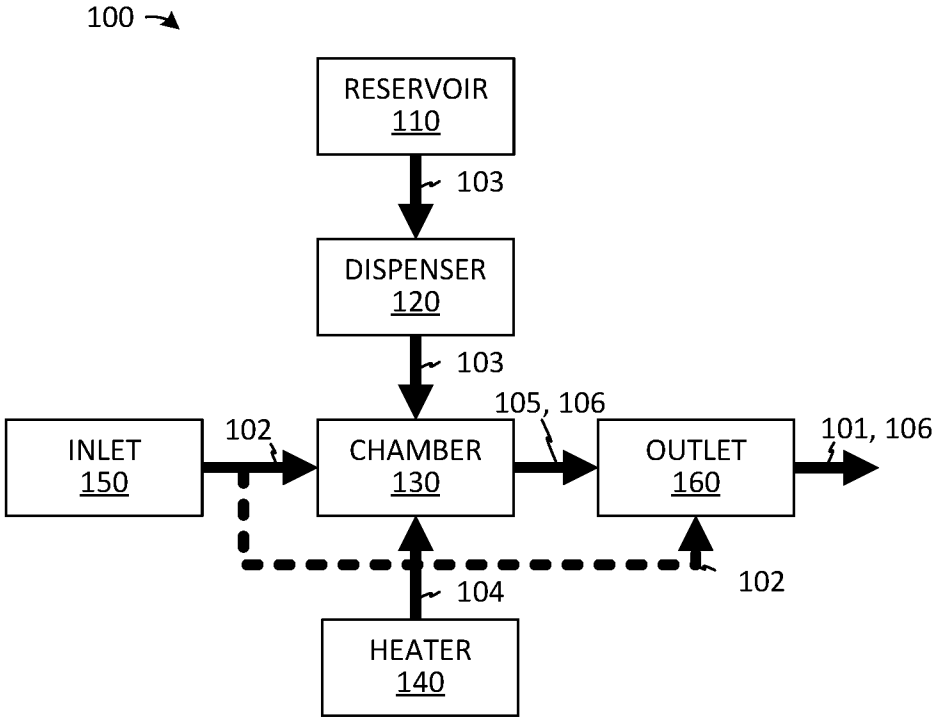
FIG. 1 illustrates a vaporizing device.

FIG. 1 illustrates a vaporizing device. Vaporizing device 100 may comprise reservoir 110, dispenser 120, chamber 130, heater 140, outlet 160, and inlet 150. The elements comprising vaporizing device 100 could be assembled to form a detachable cartridge for a vaporizing device, a vaporizing device having a detachable cartridge and a base module, or a fully integrated device.

Typical precursor compositions may exist in a liquid state within ambient temperature ranges or may transition to a liquid state within operating temperature ranges of vaporizing device 100. Propylene glycol (PG) and vegetable glycerin (VG) are commonly used as base liquids to create e-liquids sold on the market. Nicotine, cannabis extracts, and flavorings may be added to these base liquids to create the final product. Some precursors may exist in a solid or near solid state at typical ambient temperature ranges and must be heated in order to become a flowable liquid.

Reservoir 110 may be configured to store liquid precursor 103 for subsequent delivery to other elements of vaporizing device 100, such as chamber 130. Structurally, reservoir 110 may comprise an enclosure defined by walls, a base, and, in some embodiments, a closable opening or port to facilitate filling or refilling. Reservoir 110 may be coupled to dispenser 120, which can regulate a flow of liquid precursor 103 from reservoir 110 to chamber 130. In some embodiments, reservoir 110 could be permanently sealed following manufacturing to prevent tampering or contamination, while in other cases a refillable design may be preferred, possibly including a resealable cap or an access port designed for end-user convenience.

Construction materials for reservoir 110 may be selected based on chemical compatibility, mechanical durability, and user safety. For example, borosilicate glass may offer suitable chemical resistance and visibility, while food-grade polycarbonate, polycyclohexylene dimethylene terephthalate glycol-modified (PCTG), polyether ether ketone (PEEK), polypropylene (PP), polyethylene (PE), or stainless steel could also be considered. In an embodiment, reservoir 110 may be constructed of a Bisphenol A (BPA) free copolyester plastic. In an embodiment, the BPA-free copolyester plastic may be a polymer comprised of dimethyl terephthalate (DMT), cyclohexanedimethanol (CHDM), and 2,2,4,4-tetramethyl-1,3-cyclobutanediol (CBDO). These materials may be chosen for their resistance to liquid absorption, their resistance to leaching into the precursor contained in the reservoir, ability to withstand the thermal environment of the device, and compliance with relevant health and safety standards. In some embodiments, reservoir 110 may be fabricated to be transparent or semi-transparent, enabling the user to conveniently monitor liquid precursor 103 levels. The precise geometry and means for integrating reservoir 110 with other elements of vaporizing device 100 may vary depending on the intended method of assembly, refill-ability requirements, and device form factor.

Dispenser 120 may be configured to regulate a flow of a liquid precursor 103. Dispenser 120 may utilize capillary tubes or various styles of valves may be suitable for this role. Capillary tubes or capillary channels may take advantage of the flow characteristics of viscous fluids through small diameter tube(s) or channel(s) to regulate a flow of liquid precursor 103 to chamber 130, performing a similar function to a throttle valve. Capillary tubes or channels may be thermally controlled and/or thermally valved to take advantage of the temperature dependent viscosity of precursor liquid. In an embodiment, the flow tube(s) and/or channel(s) configured to regulate flow of the liquid precursor may not allow for flow of the precursor liquid at ambient temperature due to the viscous nature of the precursor and the diameter of the tube(s), and/or size and shape of the channel(s) which may be constructed to prevent the flow of the precursor liquid due to the ambient temperature viscosity of the precursor being too viscous to flow through the tube(s) and/or channel(s). In such embodiments, the capillary tube(s) or channel(s) may be heated, either directly by the primary heater, or directly from a secondary thermal source intended to heat the tube(s) and/or channel(s) such that the precursor present in the tube(s) or channel(s) may also be heated in order to reduce the viscosity of the precursor fluid such that flow through the tube(s) and/or channel(s) is achieved. Multiple valves may be combined to achieve a desired result. An on/off valve may be used to either completely stop or allow a flow, while a throttle valve may be used to control a flow rate. Some embodiments may utilize a mechanical valve. Some embodiments may utilize a thermal valve. Some embodiments may utilize a combination of valves.

In an embodiment, dispenser 120 may be combined with reservoir 110 to form a detachable cartridge for vaporizing device 100. One or more on/off valves could be used to prevent liquid precursor 103 from escaping reservoir 110 when it's detached from other components of vaporizing device 100. Dispenser 120 could include one or more on/off valves combined with one or more flow-regulating elements such that liquid precursor 103 is prevented from escaping the assembly until it is mated with a base unit, at which point the flow-regulating elements control the flow of liquid precursor 103 to other parts of vaporizing device 100.

Chamber 130 may generally be configured to contain a volume of liquid precursor 103 suitable for vapor 105 or aerosol 106 generation, and may include features to optimize both heat transfer and isolate heater 140 from liquid precursor 103. In various embodiments, chamber 130 may comprise a heating surface and a geometry intended to induce a vortical or rotational flow within it to maximize efficiency of vaporization and aerosol formation. In some embodiments, said heating surface may be configured to heat liquid precursor 103 using conduction. In some embodiments, the heating surface may be transparent to infrared radiation and/or ultraviolet radiation allowing liquid precursor 103 to be heated using radiation (or a combination of conductive and radiative heating). Some embodiments may utilize inductive heating. Chamber 130 may be constructed to promote rapid thermal equilibration, facilitate vapor 105 and/or aerosol 106 formation, and provide controlled exposure of liquid precursor 103 to a heated surface. It should be understood that alternative chamber 130 designs, shapes, or configurations, beyond the specific embodiments described herein, could be employed.

In some embodiments, chamber 130 may be configured to take advantage of unique thin film behaviors in viscous liquids, including increased shear resistance and enhanced surface effects such as surface tension and disjoining pressure, which can influence both the evaporation rate and aerosol characteristics. In such embodiment, chamber 130 may be characterized by a large surface area to height ratio, with dimensions such as 9.4 $mm^2$ by 0.75 mm, which can be considered a high surface area-to-height ratio. This arrangement may enable liquid precursor 103 to be heated more rapidly and uniformly to its vaporization temperature, providing enhanced heat transfer efficiency relative embodiments of chamber 130 with greater volume or lower surface area. The presence of a thin liquid precursor 103 layer may also permit the formation of vapor cells at the solid-liquid interface, contributing to efficient boiling and vaporization for a given temperature.

In an alternative embodiment, chamber 130 may be configured such that the volume of the chamber exceeds the liquid precursor 103 volume during normal operation. In this configuration, only a portion of chamber 130 is occupied by liquid precursor 103, while the remaining volume defines an airspace above liquid precursor 103, which may be used to facilitate vapor 105 or aerosol 106 formation and mixing. The heating surface may include geometry such as raised features, protrusions, or patterned elements, configured to increase the effective heating surface area relative to a flat surface.

Chamber 130 may include one or more intake port(s) configured to receive liquid precursor 103 from an external source, such as reservoir 110. In one embodiment, the intake port(s) may be positioned at the edge or edges, depending on the geometry, of chamber 130. In some embodiments, it may be desirable to include multiple intake ports to allow chamber 130 to fill more quickly and evenly. In an embodiment, the intake port(s) may be positioned in proximity and/or in conjunction to the air intake port(s) such that the inflow of air through the air intake port(s) may entrain the liquid precursor flowing through the liquid intake port(s) such that the entrainment may cause a correlation in the flow of the precursor liquid where the increased flow of the intake air through the port(s) may cause an increased flow in the intake of the liquid precursor flow rate through the port(s), and conversely a decreased flow of intake airflow may cause a decreased flow of the intake rate of the precursor liquid. In an embodiment the median flow rate of the precursor liquid intake may be 2 μL per second correlated to a median air intake flow rate of 10 mL per second.

Chamber 130 may include one or more exit ports to permit vapor 105 generated within to escape. In FIG. 1, certain flow paths are labeled as "105, 106" to indicate that, depending on the specific embodiment, either vapor 105 or aerosol 106 may be present at a given location (or both). This reflects the fact that mixing of air 102 and vapor 105 to form aerosol 106 may occur within chamber 130 in some embodiments, or alternatively, may take place at a downstream location, such as within outlet 160. As such, only vapor 105 or aerosol 106 may be present in particular sections of the device, with the precise composition varying according to the selected configuration. In some cases, aerosol 106 could be delivered directly from the exit ports to a user; however, it may be advantageous to further condition the aerosol by passing it through outlet 160, which could selectively remove particles based on their size prior to user delivery. In an embodiment, the generated aerosol and/or vapor may have a particle size of 2.5-5 microns and the exit path geometry and features may trap aerosol and/or vapor particles larger than 5 microns. In an embodiment, the aerosol and/or vapor particles that are larger than 5 microns may be trapped and prevented from exiting to the user and may be returned to the chamber to be present as precursor liquid to be aerosolized and/or vaporized in the subsequent activation cycle. Additionally, one or more valves may be coupled to the exit ports to prevent liquid precursor 103 from escaping chamber 130 when vapor or aerosol generation is not occurring.

Liquid precursors are commonly made from propylene glycol, vegetable glycerin or a combination of the two. Propylene glycol has a boiling point around 188 °C (370 °F) and vegetable glycerin has a boiling point around 290 °C (554 °F). Heating propylene glycol or vegetable glycerin below 188 °C (370 °F) may result in incomplete vaporization and heating above 300 °C (572 °F) may cause thermal decomposition of the ingredients and potentially produce toxic, or other undesirable, byproducts. For these reasons, optimal vaporization may occur between 188 °C (370 °F) and 250 °C (482 °F). In an embodiment, the temperature required for optimal vaporization may be decreased by the application of vacuum to chamber 130 from the passage of airflow into chamber 130 and the exit of aerosol and/or vapor from chamber 130. In an embodiment, the vacuum may be generated by the inhalation of the user when using the device. When constructing chamber 130, it may be desirable to select materials capable of exposure to these temperature ranges. Resistive heating elements manufactured from nichrome (NiCr), Kanthal® (FeCrAl), stainless steel(s), and titanium(s), may be heated to about 200 °C to 300 °C (392 °F to 572 °F) in normal operation and are capable of reaching temperatures exceeding 1,000 °C (2,192 °F). Therefore, it may be desirable to manufacture chamber 130 from a material or materials capable of withstanding these temperatures. In an embodiment, the resistive heating element(s) may have a temperature dependent electrical resistance such that measuring the resistance of the element during operation can be used to determine the temperature of the resistive heating element during operation. In an embodiment, the resistive heating element(s) may have a temperature dependent electrical resistance such that the resistance of the heating element can be used to measure the temperature of the element prior to operation.

Chamber 130 may be fabricated from a range of materials and by employing various manufacturing techniques, depending on the specific design goals of the vaporizing device 100. For instance, in cases where an infrared (IR) heating method is utilized, at least a portion of chamber 130 may be constructed from an IR-transparent material to facilitate efficient heat transfer to the precursor. In an embodiment, chamber 130 may be constructed from an IR-absorptive material to facilitate efficient heat transfer to chamber 130 in order to subsequently heat a precursor. In cases where an ultraviolet (UV) heating method is utilized, at least a portion of chamber 130 may be constructed from an UV-transparent material to facilitate efficient radiating of the precursor. In an embodiment utilizing UV radiation, chamber 130 may include selected regions configured to be transparent to UV radiation thereby allowing a precursor to be irradiated, while other regions of chamber 130 may be configured to block UV radiation in order to prevent its escape from chamber 130. In an embodiment that utilizes IR and/or UV radiation, chamber 130 may include IR and/or UV reflective surfaces in order to trap the IR and/or UV energy within chamber 130. In an embodiment utilizing IR and/or UV radiation to heat the precursor, chamber 130 may be constructed where a region of the chamber configured to allow the transmission of IR and/or UV radiation may be a lens configured to focus the IR and/or UV energy onto the precursor, where the focal length of the lens may be optimally configured to heat the precursor. In an embodiment utilizing IR and/or UV radiation to heat the precursor, chamber 130 may be constructed such that a region allowing transmission of the IR and/or UV radiation may include a diffusor. The diffusor may serve to distribute IR and/or UV energy onto the precursor, and the diffusor length may be optimally configured to evenly heat the precursor. Alternatively, if an inductive heating approach is preferred, it may be advantageous to select a conductive material, such as a ferritic stainless steel. Chamber 130 may be designed as a monolithic component, or it may comprise multiple assembled parts, which may provide greater flexibility in the selection of materials or manufacturing methods. In some embodiments, materials compatible with certain manufacturing techniques, such as injection molding, machining, or additive manufacturing, may be chosen to meet durability, cost, or performance requirements. Additionally, it is possible that many of the same materials contemplated for reservoir 110 could also be suitable for use in chamber 130, offering options for material standardization or compatibility within the device. In an embodiment, chamber 130 may be constructed from amorphous fused silica ($SiO_2$). In an embodiment, chamber 130 may be constructed using a crystalline fused silica ($SiO_2$), also called fused quartz, and quartz glass. In an embodiment, the fused silica ($SiO_2$) may be intentionally manufactured to include trapped air bubbles and/or inclusions to fabricate a diffusor. In an embodiment, chamber 130 may be constructed of fused silica ($SiO_2$) fabricated to exhibit high optical homogeneity, thereby optimizing transmission of IR and UV radiation. For embodiments utilizing high IR transmittance, chamber 130 may be constructed of a fused silica ($SiO_2$) having a low content of hydroxyl (OH), such that the hydroxyl (OH) content is below 10 ppm in the fused silica ($SiO_2$). In an embodiment, chamber 130 may be constructed using a water vapor-free plasma flame process so that the resulting fused silica ($SiO_2$) chamber 130 may have a hydroxyl (OH) content below 10 ppm. Embodiments of chamber 130 having low IR transmittance and high IR absorption may be constructed of a fused silica ($SiO_2$) including a relatively high content of hydroxyl (OH). For example, a high hydroxyl (OH) content may be greater than 10 ppm and as high as 1000 ppm. Ordinary flame processing of fused silica ($SiO_2$), also called flame fusion, may be used to construct chamber 130 having hydroxyl (OH) content in the range of 10-1000 ppm.

Chamber 130 may be configured to include a high degree of UV transmissibility. In such embodiments, chamber 130 may comprise fused silica ($SiO_2$) having low levels of metallic impurities (e.g., 1 ppm or less). Fused silica ($SiO_2$) may be selected, in part, because it is not substantially degraded by UV irradiation, exhibits favorable solarization resistance, and demonstrates low radiation-induced absorption attributable to color centers. Additionally, the material may be fabricated to possess minimal UV-induced fluorescence and phosphorescence, further supporting its suitability for such applications. In an embodiment optimized for UV transmission, the fused silica ($SiO_2$) chamber 130 may be constructed using flame hydrolyzation of silicon tetrachloride ($SiCl_4$) (also known as tetrachlorosilane) to lower the content of metallic impurities and improve UV transmission. In an embodiment where chamber 130 is constructed for UV absorption, metals can be used in the fused silica ($SiO_2$) at a ratio of 1-50 ppm. Metals that can be used to absorb UV radiation in fused silica ($SiO_2$) include, but are not limited to, Iron (Fe), Copper (Cu), Lead (Pb), Nickel (Ni), Cerium (Ce), Calcium (Ca), and Potassium (K). In an embodiment, ferric iron ($Fe^{3+}$) and or copper (II) ion, also called cupric ion ($Cu^{2+}$), are used as the metals present in the fused silica ($SiO_2$) to absorb UV radiation at a ratio of 1-50 ppm. In an embodiment different grades of fused silica ($SiO_2$) can be utilized to optimize IR and or UV transmission and or IR and UV absorption in chamber 130. For example, an embodiment comprising a fused silica ($SiO_2$) chamber 130 may be constructed to be absorptive to both IR and/or UV. In such embodiments, fused silica ($SiO_2$) may include metallic impurities present at a ratio of 1-50 ppm to help absorb UV radiation and may have high hydroxyl (OH) content (e.g., greater than 10 ppm and as high as 1000 ppm) to help absorb IR radiation for the purpose of heating chamber 130.

In an embodiment, chamber 130 may comprise a fused silica ($SiO_2$) having favorable transmission properties for IR and UV radiation, while also maintaining a low hydroxyl (OH) content (e.g., less than 10 ppm) and low levels of metallic impurities (e.g., 1 ppm or less). In an embodiment, chamber 130 may be configured to have favorable IR transmission with a hydroxyl (OH) content less than 10 ppm, while metallic impurities may be present at higher concentrations, such as greater than 1 ppm and up to 50 ppm or higher, to facilitate greater UV absorption. In yet another embodiment, chamber 130 may be configured to exhibit good IR absorption by utilizing fused silica with a hydroxyl (OH) content greater than 10 ppm and up to 1000 ppm, while maintaining good UV transmission with metallic impurity less than 1 ppm. Chamber 130 may be manufactured from a variety of types fused silica ($SiO_2$) and/or fused quartz ($SiO_2$), depending on the specific embodiment. For example, Herasil®, Homosil®, Optosil® and Vitreosil® are fabricated with flame fusion, have high OH content (usually 150 to 400 ppm) and are transmissive to visible light and UV radiation, and are absorptive to IR radiation. Suprasil® and Spectrosil® are a type of fused silica ($SiO_2$) made with flame hydrolyzation of $SiCl_4$, having a much lower content of metallic impurities, but also having a high OH content, making these types of fused silica ($SiO_2$) transmissive of UV radiation while being absorptive of IR radiation. Very low OH content (below 1 ppm) is achieved for materials like Infrasil®, Suprasil W® and Spectrosil WF®, made with a water vapor-free plasma flame which allows for transmission of IR radiation.

Heater 140 may be coupled to chamber 130 in order to heat liquid precursor 103 delivered from reservoir 110 without coming into direct contact with it. A variety of heating element types may be suitable for this application, and the selection may be influenced by the desired operational characteristics or manufacturing constraints of vaporizing device 100. In some embodiments, heater 140 may take the form of a resistive heater, which may utilize an electrical current to generate heat 104 through resistance. Manufacturing heater 140 from a material having a known temperature coefficient may allow a sensing mechanism to determine the temperature of heater 140 by measuring the resistance. Materials such as nichrome, Kanthal R, titanium, stainless steel, tungsten or similar alloys may be considered due to their stable resistance properties and durability under repeated thermal cycling. In some embodiments, one or more glass enveloped filaments such as a halogen bulb or a xenon bulb may be used as a heating element. In such embodiments, it may be desirable to enclose the bulb in quartz to protect from thermal shock. Heater 140 may comprise an infrared heating element, in which case the element may be configured to emit radiation that is absorbed by liquid precursor 103 or by an intermediary structure. Heater 140 may be constructed of two discrete emitters; the first being an IR emitter (such as an IR diode) and the second being a UV emitter (such as a UV diode). In such an embodiment, the IR and UV diodes may be constructed in a single emitter structure, or may be constructed as distinct separate emitters. Heater 140 may be constructed of coherent IR and/or UV emitters. Heater 140 may be constructed of non-coherent IR and/or UV emitters. Heater 140 may be constructed of non-coherent IR and/or UV emitters coupled with a focusing element such as a lens to increase the coherence of the emission. Heater 140 may be constructed of non-coherent IR and/or UV emitters coupled with a focusing element such as a lens to focus the emission at a determined focal point determined by the focal length of the lens.

Heater 140 may be manufactured using a range of fabrication methods. In some examples, a resistive material may be deposited onto a substrate, such as fused silica, ceramic, glass, or metal, using processes like direct writing, sputtering, screen printing, or chemical vapor deposition. The deposited layer may then be patterned, for example etched, to achieve a defined heating geometry tailored to the application. In other embodiments, wire-wound or mesh-style resistive elements may be incorporated. Heater 140 may be cut, stamped or punched out of a sheet of resistive metal such as nichrome. IR and/or UV diodes or lasers may be used to generate infrared and/or UV radiation. In an embodiment, heater 140 may be constructed using photochemical etching of a resistance metal substrate such as nichrome. In an embodiment, heater 140 may be constructed by using a process of photochemical machining of a resistive metal substrate such as nichrome. In an embodiment, a process of acid etching a resistive metal such as nichrome may be used to form heater 140. In an embodiment, a process such as photochemical etching and/or photochemical machining may be used to form a resistive element where the cross-section profile is non-round such that heater 140 has flat section in cross-section to improve surface area to contact the chamber. In an embodiment, the cross-section profile of a photochemically etched and or photochemically machined heater 140 may be polygonal with one of the sides of the polygon intended to contact a flat surface of the chamber. In an embodiment, heater 140 may be fabricated using a process such as photochemical etching and or photochemical machining from a thin ribbon or sheet of a resistive metal, for example, nichrome. Heater 140 may be retained within the metallic ribbon or sheet by one or more small tab features, enabling the heater to be handled as part of a reel or spool for high-speed or automated assembly processes, such as pick-and-place methods. The tabs may then be cut or otherwise removed at the point of assembly. In an embodiment, heater 140 may have a first resistive region intended to reach temperatures required to effect the generation of an aerosol and/or vapor from a precursor in the chamber, a second region intended to establish electrical contact such that the heater can be activated by a controller, and a third region intended to heat the precursor flow tube(s) and or flow channel(s) comprising a dispenser to facilitate flow of the precursor fluid that has a temperature dependent viscosity such that the viscosity decreases as the precursor temperature increases. The specific choice of construction and fabrication methods for heater 140 may be based on considerations such as desired resistance range, heating efficiency, manufacturability, and compatibility with other components of the vaporizing device 100.

Inlet 150 may introduce air 102 into vaporizing device 100 at one or more locations, depending on the specific embodiment, to entrain vapor generated by chamber 130 to form aerosol 106. In certain embodiments, inlet 150 may be coupled to chamber 130 to deliver air 102 directly into chamber 130. In alternative configurations, inlet 150 may couple to other elements comprising vaporizing device 100, such as outlet 160, to combine air 102 with vapor 105 at or near outlet 160. In an embodiment, the precursor inlet port(s) may be positioned in proximity and/or in conjunction to inlet 150 such that the inflow of air through inlet 150 entrains the liquid precursor flowing through the liquid intake ports such that the entrainment causes a correlation in the flow of the precursor liquid where the increased flow of the intake air through the inlet 150 causes an increased flow in the intake of the liquid precursor flow rate through the port(s), and conversely a decreased flow of intake airflow through inlet 150 causes a decreased flow of the intake rate of the precursor liquid. In an embodiment, the median flow rate of precursor liquid intake is 2 μL per second correlated to a median air intake flow rate of 10 ml per second.

In some embodiments, inlet may be configured to deliver air 102 into chamber 130 and to outlet 160, either individually or in combination, thereby enabling flexible operation and air management within vaporizing device 100.

Inlet 150 may comprise tortuous flow geometry configured to condition an incoming stream of air 102 by imposing changes in velocity and pressure, as well as introducing directional changes and impaction surfaces to increase the transit time of air 102. In certain embodiments, the tortuous flow geometry may further comprise a sequence of expansions, contractions, or baffles, in proximity to a chamber that houses heater 140. Moving air 102 over chamber 130 structure may allow for heat exchange between air 102 and chamber 130, which facilitates heating of air 102, thereby optimizing the temperature of air 102 delivered toward the chamber regions of the device. In an embodiment, inlet 150 may be in proximity to chamber 130 and may be heated due to the proximity. Air 102 passes through inlet 150 and absorbs heat from inlet 150 serving to remove excess heat from the body of chamber 130 and pre-heating air 102 prior to entering chamber 150. Pre-heating air 102 may increase the efficiency of the vapor and/or aerosol generation by reducing the amount of cooling effect air 102 has on liquid precursor 103, and/or chamber 130.

Outlet 160 may be coupled to one or more exit ports of chamber 130 and may be configured to deliver aerosol 106 to a user. In some embodiments, outlet 160 may be further configured to condition vapor 105 or aerosol 106 prior to delivery to a user. Vapor 105 or aerosol 106 may be conditioned by subjecting it to a tortuous flow geometry, which could include a series of impaction surfaces and directional changes as well as pressure and velocity changes. Such features may be designed to selectively remove particles from a stream of vapor 105 and/or aerosol 106, for example by causing larger droplets or particles to deviate from the main flow. In some cases, outlet 160 may include a flow path designed to establish changes in velocity or pressure along the route, further enhancing the selective removal of particles based on their size or inertia. In an embodiment, the generated aerosol and/or vapor has a particle size of 2.5-5 micron and outlet 160 geometry and features trap aerosol and/or vapor particles larger than 5 microns. In an embodiment, the aerosol and/or vapor particles that are larger than 5 micron may be trapped and prevented from exiting outlet 160 to the user and returned to the chamber 130 to be present as precursor liquid volume to be aerosolized and/or vaporized in chamber 130 during the subsequent activation cycle.

Selection of materials for inlet 150 and outlet 160 may be primarily guided by performance requirements and desirable physical or chemical characteristics. Materials exhibiting inertness, non-reactivity with the liquid precursor or aerosol components, and resistance to degradation under the anticipated thermal and operational conditions may be particularly advantageous. Additionally, surfaces may be textured or treated to influence flow characteristics, such as optimizing droplet deposition, minimizing unwanted condensation, or promoting specific aerosol particle behaviors. In certain embodiments, inlet 150 and outlet 160 may be integrated into other components of vaporizing device 100, such as a chassis, housing, or control system. In such cases, material selection for the supporting component may become the principal consideration. Surface finish, wall thickness, and geometric complexity may be adapted according to the chosen manufacturing method and intended aerosol delivery performance.

In operation, a user may apply suction 101 to outlet 160, which may induce a flow of air 102 into vaporizing device 100 through inlet 150. In certain embodiments, inlet 150 may incorporate conditioning features, such as tortuous flow geometry comprising impaction surfaces or pathways inducing directional changes, to selectively remove entrained particles from air 102 prior to its combination with vapor 105 generated by chamber 130. This pre-conditioning may facilitate formation of an aerosol 106 optimized for deep lung delivery and/or deposition by reducing particle load prior to mixing. Inlet 150 may be configured to deliver air 102 to chamber 130 or to outlet 160, or a combination thereof, depending upon the specific embodiment implemented.

Chamber 130 may be supplied with liquid precursor 103 from reservoir 110. The delivery of liquid precursor 103 to chamber 130 may be regulated by dispenser 120, which could include thermal and/or mechanical valves, capillary tubes and/or channels, or other flow control elements.

Heater 140 may be configured to activate in response to various triggers, such as a change in pressure, detection of an intake air flow rate, detection of an airflow sound, or manual actuation of a switch. Upon activation, heater 140 may supply heat 104 to liquid precursor 103 within chamber 130, such that at least a portion of liquid precursor 103 is vaporized. In some embodiments, liquid precursor 103 within chamber 130 may act as a hydrostatic plug, potentially restricting replenishment from reservoir 110 until the existing liquid precursor 103 is substantially vaporized and exits chamber 130. As the vaporization process reduces the volume of liquid precursor 103 contained in chamber 130, reservoir 110 may provide additional liquid precursor 103, which can be regulated or throttled by dispenser 120. In an embodiment the hydrostatic plug is also a viscosity dependent capillary plug where dispenser 120 must be heated in order to reduce the viscosity of the precursor which is comprised primarily of compounds that have viscosities that are temperature dependent, such as propylene glycol, glycerol, or cannabinoid extracts. Dispenser 120 may be heated during activation which allows for dispensing of precursor during the activation cycle, and may not be heated in between activation cycles which may prevent dispensing of precursor when the device is inactive. The heating of dispenser 120 can be performed by the primary heater 140, or by a secondary heater that is dedicated to only heating dispenser 120.

Vapor 105 generated by chamber 130 may be entrained in a stream of air 102 at chamber 130 or at outlet 106, or both, thereby forming aerosol 106. Aerosol 106 may be drawn into outlet 160 by suction 101. Outlet 160 may include geometric features-such as impaction surfaces, bends, or varying cross-sectional areas-configured to selectively separate particles from aerosol 106 based on size, mass, inertia, or other physical properties. In some embodiments, outlet 160 may further induce changes in velocity, pressure, or establish vortical and eddy formations that encourage further selection or deposition of unwanted particles prior to final aerosol 106 delivery to the user.

FIG. 1 may have presented the basic components comprising a vaporizing device but additional features may be added. For example, components may be included to prevent a liquid precursor from leaking from the device.

Figure 2:
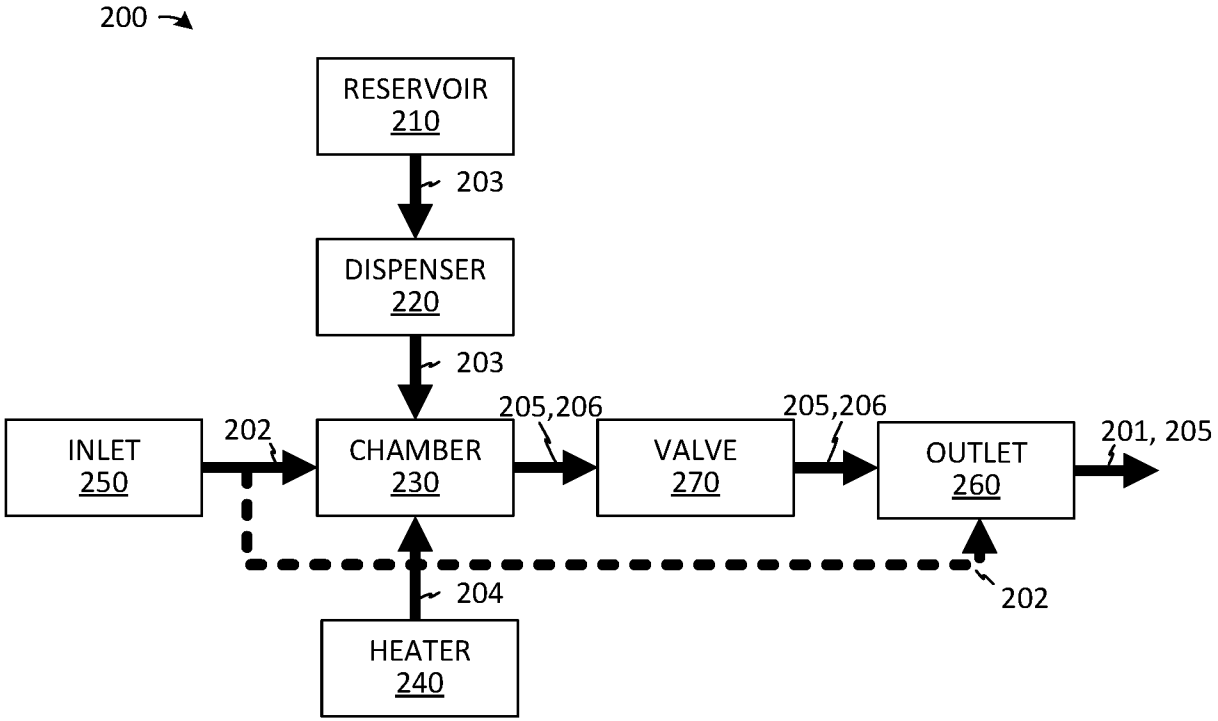
FIG. 2 illustrates a vaporizing device.

FIG. 2 illustrates a vaporizing device. Vaporizing device 200 may comprise reservoir 210, dispenser 220, chamber 230, heater 240, inlet 250, outlet 260, and valve 270. The elements comprising vaporizing device 200 could be assembled to form a detachable cartridge for a vaporizing device, a vaporizing device having a detachable cartridge and a base module, or a fully integrated device.

Vaporizing device 200 may be an embodiment of vaporizing device 100 while introducing valve 270 disposed between chamber 230 and outlet 260 to inhibit leaking of liquid precursor 203 from chamber 230 when not in use. Valve 270 may be actuated by a variety of mechanisms, including but not limited to vapor pressure buildup within chamber 230, user-applied suction 201 at outlet 260, or by mechanical or electromechanical means, depending on the specific implementation. Actuation of valve 270 may facilitate the controlled transfer of vapor 205 and/or aerosol 206 from chamber 230 to outlet 260, enabling delivery to a user while maintaining containment of liquid precursor 203 under non-operational conditions. The selection of actuation method for valve 270 may be guided by desired user experience, safety considerations, or compatibility with other system components.

In some embodiments, valve 270 may function as a one-way valve, opening in response to vapor pressure generated from applying heat 204 to chamber 230, user suction 201, or other detectable activation events. A variety of one-way, or check valve designs may be suitable for this role, including but not limited to flap valves, poppet valves, lift check valves, ball check valves, diaphragm valves, or duckbill valves. The particular choice of valve type may be guided by factors such as desired flow characteristics, ease of manufacture, or compatibility with other components comprising vaporizing device 200. Some embodiments may incorporate multiple instances of valve 270.

The operation of vaporizing device 200 may be similar to the operation of vaporizing device 100 with the addition of valve 270. Valve 270 may be configured to default to a closed position when vaporizing device 200 is not in use, thereby preventing leakage of liquid precursor 203 from the device. During operation, application of suction 201 to outlet 260 by a user may induce a flow of air 202 through inlet 250, and may also actuate valve 270 to allow aerosol formation and delivery. In alternative embodiments, valve 270 may be actuated in response to vapor pressure buildup within chamber 230 as a result of aerosol formation from precursor, mechanical actuation, electromechanical control, or another appropriate triggering event, depending on the specific system configuration. Valve 270 may be configured as a variable pressure valve where the pressure exerted against the valve due to changes in atmospheric conditions (e.g., such as when increased temperature, and/or decreased atmospheric pressure act upon the air volume present in the reservoir causing it to expand and exert pressure on the precursor present in the dispenser 220, and chamber 230) would not be of sufficient pressure to cause valve 270 to open to outlet 260. In an embodiment, vaporizing device 200 may be leak resistant and/or leak proof at a range of ambient temperatures and/or atmospheric pressures. The actuation mechanism and default state of valve 270 may be tailored to optimize user experience and to ensure secure containment of the liquid precursor under non-operational conditions when the device is not being activated.

Vaporizing device 200 included a valve disposed between chamber 230 and outlet 260 to prevent a liquid precursor from leaking through outlet 260 when the device is not in use. Some embodiments may present another avenue for leakage between a chamber and an inlet.

Figure 3:
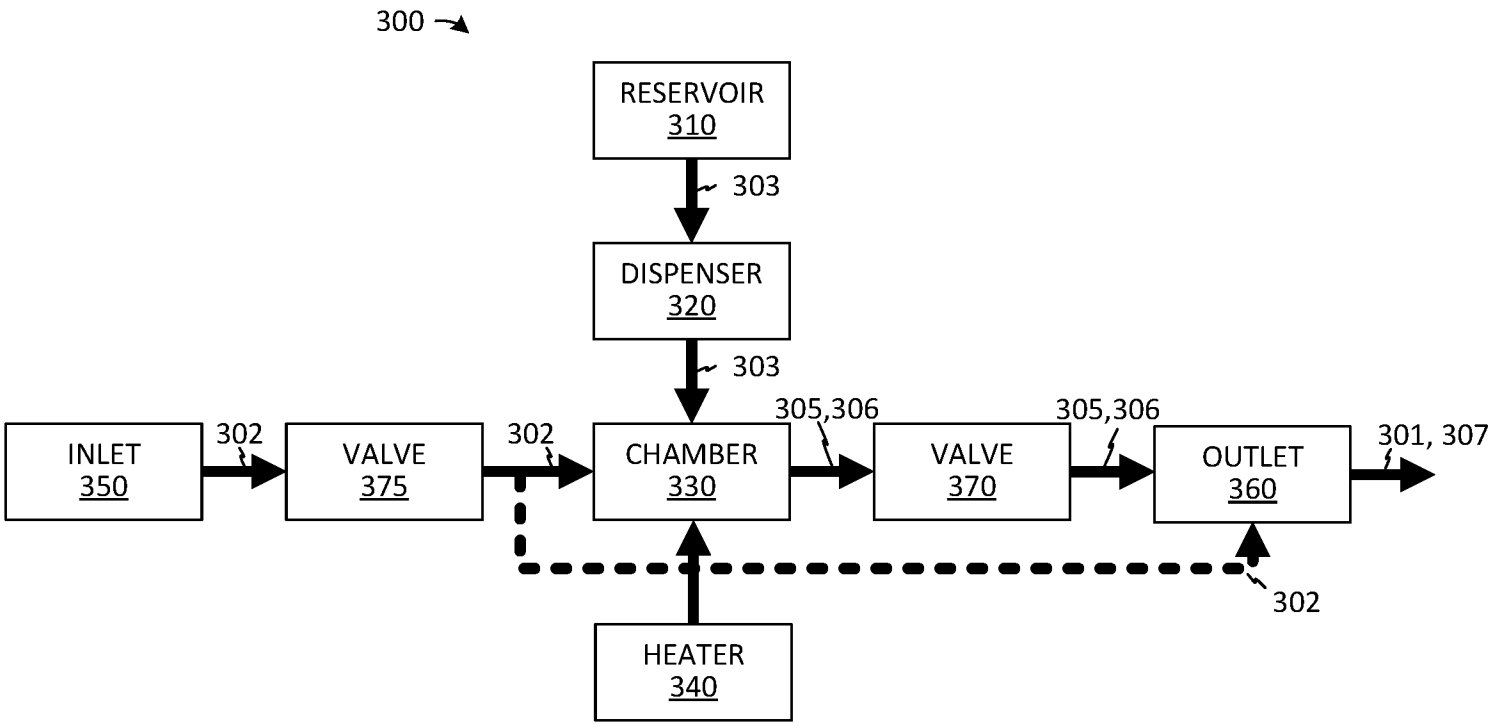
FIG. 3 illustrates a vaporizing device.

FIG. 3 illustrates a vaporizing device. Vaporizing device 300 may comprise reservoir 310, dispenser 320, chamber 330, heater 340, inlet 350, outlet 360, valve 370, and valve 375. The elements comprising vaporizing device 300 could be assembled to form a cartomizer, a detachable cartridge for a vaporizing device, a vaporizing device having a detachable cartridge and a base module, or a fully integrated device.

Vaporizing device 300 may be an embodiment of vaporizing device 100, 200, operating in a generally similar fashion but incorporating valve 375 between chamber 330 and inlet 350. Vaporizing device 300 may include valve 370 in some embodiments but not in others.

Valve 375 may be a one-way valve with an upstream port coupled to inlet 350 and a downstream port coupled to chamber 330 to prevent liquid precursor 303 leaking from chamber 330. Valve 375 may be actuated by suction 301, pressure changes, or some other detectable event. Various types of one-way, or check, valve designs may be suitable for this role, including but not limited to flap valves, poppet valves, lift check valves, ball check valves, diaphragm valves, or duckbill valves. The choice of valve type may be guided by factors such as desired flow characteristics, ease of manufacture, or compatibility with other components comprising vaporizing device 300. In an embodiment, valve 375 may be actuated to the open position by the inhalation of the user and may be in the closed position when the user is not inhaling and or vaporizing device 300 is in an inactive state. Some embodiments may include multiple instances of valve 375.

Valve 375 may be configured to default to a closed state and to open only when vaporizing device 300 is in use. For example, valve 375 may default to a closed position when vaporizing device is transported or stored to prevent liquid precursor 303 from escaping chamber 330 and may open in response to suction 301 to permit a flow of air 302 into chamber 330. Alternative embodiments may include other methods of valve actuation. For example, valve 375 may be a poppet valve including a stem that allows for remote actuation. In this case, valve 375 may be actuated in response to a sensor input or some other detectable event. In an embodiment, valve 375 may be a direction valve such that it is resistant to flow and or pressure exerted from chamber 330 toward inlet 350, and that flow and/or pressure in the direction of inlet 350 causes the valve to increase the sealing force of the valve with the increase in flow or pressure in the direction of the chamber 330 towards inlet 330, and that only flow in the direction of the inlet 350 towards the chamber 330 allows for the valve 375 to open.

The operation of vaporizing device 300 may generally correspond to that of vaporizing device 100 or 200, distinguished here by the addition of valve 375. Valve 375 may be disposed between inlet 350 and chamber 330 and is configured to default to a closed position when the device is not in use. In operation, application of suction 301 to outlet 360 by a user may result in valve 375 opening to permit a flow of air 302 into vaporizing device 300. In certain embodiments, opening of valve 375 may alternatively be triggered by a pressure differential, mechanical actuation, or a detectable operational event, depending on the implementation. This valve arrangement may function to inhibit unintended leakage of liquid precursor 303 from chamber 330 through inlet 350 during storage or transport, or due to changes in environmental conditions such as increased temperature or decreased atmospheric pressure, improving precursor containment and device integrity under non-operational conditions when the device is in an inactive state.

Operation of the remaining components may be consistent with previously described embodiments. Chamber 330 may receive liquid precursor 303 from reservoir 310 via dispenser 320 which may comprise flow control features such as valves or capillary tube(s) and/or channel(s). Heater 340 may be configured for actuation in response to user input, sensed airflow, a threshold of detected flow rate of intake air 302, or pressure changes, and upon activation may supply heat to chamber 330 to vaporize at least a portion of the received liquid precursor 303. Generated vapor 305 may be entrained in air 302 stream to form aerosol 306, which is drawn toward outlet 360. Outlet 360 may include features such as impaction surfaces, bends, or variable-area regions designed to facilitate selective removal of particles due to size and/or mass characteristics. In some embodiments, additional valves, such as valve 370, may further regulate flow or containment by opening in response to operational triggers, thus enhancing control over aerosol 306 delivery and leakage prevention.

The previously described embodiments of vaporizing devices have been particularly suitable for constructing detachable cartridges or cartomizers. In these embodiments, the heater may be configured to receive power external to the device. Vaporizing devices may include control systems to regulate delivery of power to the heating elements.

Figure 4:
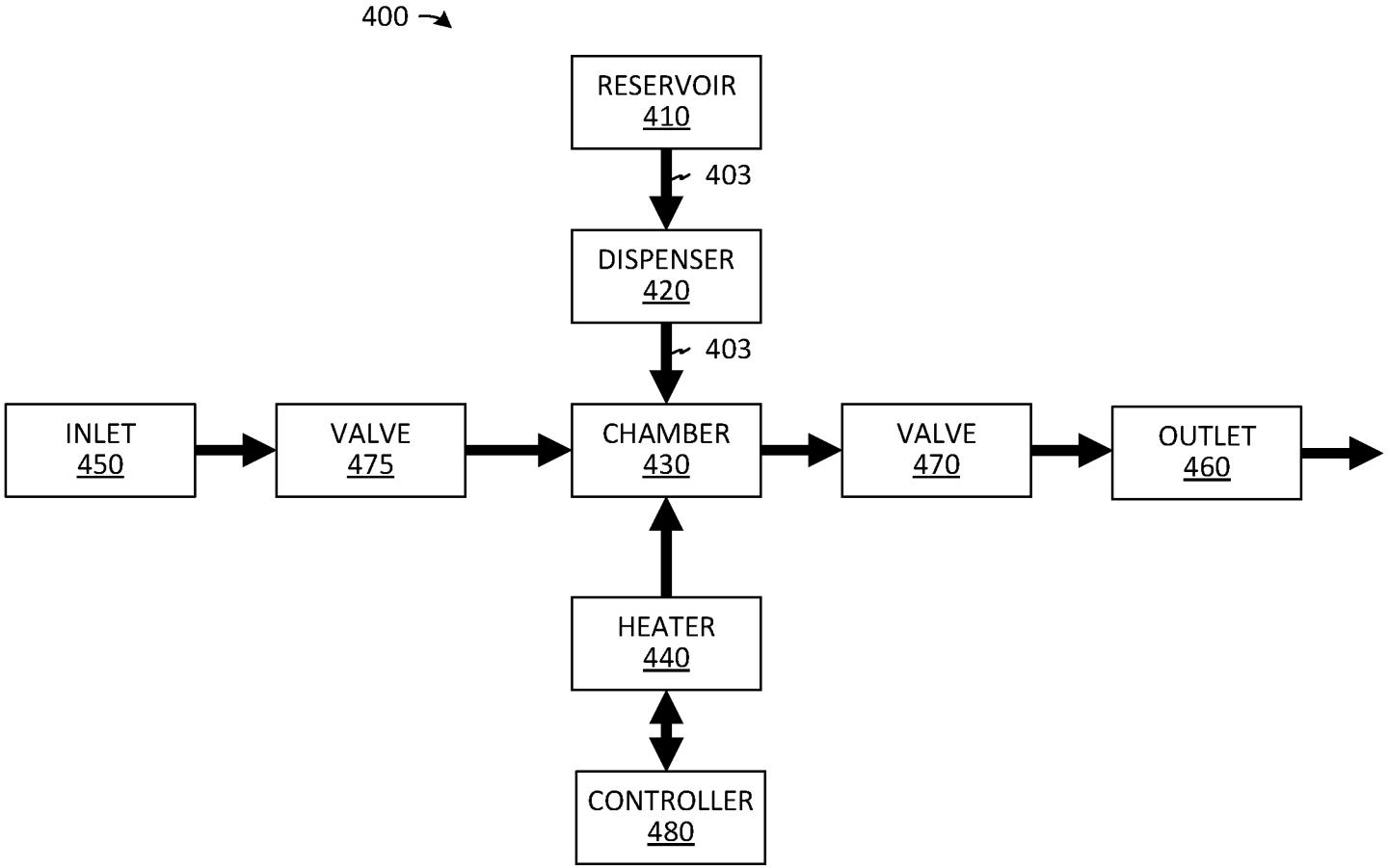
FIG. 4 illustrates a vaporizing device.

FIG. 4 illustrates a vaporizing device. Vaporizing device 400 may comprise reservoir 410, dispenser 420, chamber 430, heater 440, inlet 450, outlet 460, valve 470, valve 475, and controller 480. The elements comprising vaporizing device 400 could be assembled to form a cartomizer, a detachable cartridge for a vaporizing device, a vaporizing device having a detachable cartridge and a base module, or a fully integrated device.

Vaporizing device 400 may be an example of previously described vaporizing devices, operating in a generally similar fashion but incorporating controller 480. Controller 480 may be configured to control power delivery to heater 440 and collect data, such as air flow rate into inlet 450, inactive and active state temperature of heater 440, and pressure, which may be calculated based on the measured flow rate through inlet 450, about vaporizing device 400. Data collection may enable fine-tuning of the heating rate and ultimately the aerosol production. In an embodiment, the data collection may enable predictive control of the heating rate and ultimately the aerosol production. Data collection may enable the determination of the user's unique inhalation profile(s) and characteristics of the inhalation profile such as flow rate(s), duration, and frequency to use the unique inhalation profile of the user as the triggering event for activation.

Controller 480 may be coupled to heater 440 and configured to supply power to heater 440. Controller 480 may utilize a variety of control methods such as real time resistance measurement and/or monitoring of heater 440, real time temperature measurement and/or monitoring of heater 440, pulse-width modulation (PWM), bang-bang, voltage, or current control to regulate power delivered to heater 440. Controller 480 is assumed to include a power source for the sake of discussion.

Controller 480 may be configured to operate in either an open-loop or a closed-loop mode. In an open-loop system, the control logic may supply a fixed signal, such as a fixed PWM signal, to heater 440, without any feedback from temperature or environmental sensors. While such a system can be simple and cost-effective, it generally lacks the ability to adapt to variations in fluid properties, battery voltage, or user behavior, which can result in inconsistent vapor production, reduction in fraction of aerosol suitable for delivery and/or deposition to the deep lung, and reduced user satisfaction. By contrast, a closed-loop system may incorporate real-time feedback, such as the resistance of heater 440 for temperature estimation or data from other sensors such as flow rate of intake air flow, as well as pressure data which may be used to determine real-time boiling point temperature of the liquid precursor 403 to dynamically adjust the power delivered to heater 440 and maintain consistent performance and optimal vapor and/or aerosol formation.

One key advantage of closed-loop control is the ability to compensate for changing conditions during use. For example, if vaporizing device 400 is used in different ambient temperatures or at different altitudes, the system can automatically adjust the power supplied to heater 440 to account for these changes. This kind of adaptability may help maintain a preferred vaporization temperature, minimize the risk of overheating or burning the fluid, and ensure a reliable and repeatable user experience. Monitoring real-time parameters such as resistance of heater 440 and pressure, may allow vaporizing device 400 to optimize aerosol production dynamically. Monitoring real-time pressure values in the inlet 450 and chamber 430 allows for adjusting the real-time temperature of heater 440 and/or modulating the real-time power delivered to heater 440 to target the real-time boiling point of liquid precursor 403.

In some embodiments, controller 480 may also utilize sensors, including flow-rate through inlet 450, pressure in inlet 450 and/or chamber 430, and/or controller 480, and temperature of heater 440 and/or chamber 430, to characterize inhalation topography. For example, a sharp and heavy inhalation may be detected as a large and rapid pressure change and, possibly, a decrease in the temperature of heater 440, prompting the control system to increase the duty cycle or the power applied to heater 440 to keep up with the increased airflow and vapor demand. Conversely, a gentle inhale may require less power to achieve the desired vapor density. By mapping sensor signals to control strategies, the device may be able to deliver a more tailored and satisfying experience for a range of inhalation styles, accommodating both light and deep draws with consistent aerosol output.

In some embodiments, controller 480 may be configured to monitor sensors, such as flow rate sensor, temperature sensors and/or pressure sensors, while operating in an inactive or sleep state and may activate heater 440 to maintain liquid precursor 403 at predetermined temperature. Liquids commonly used in vaporizing devices or e-cigarettes tend to exhibit predictable thermoviscous behavior, meaning their viscosities at different temperatures and pressures can be predicted. In general, liquids tend to be more viscous at lower temperatures. Therefore, if a user is outside in the winter, liquid precursor 403 may be too viscous to reliably supply chamber 430. This problem may be solved by monitoring environmental conditions, such as temperature and/or pressure, of reservoir 410 or chamber 430 when the device is not in use and periodically activating heater 440 to heat liquid precursor 403 to a temperature that maintains an optimal viscosity. Heater 440 may serve as a resistance temperature detector and/or sensor such that heater 440 may be used to measure ambient temperature when vaporizing device 400 is otherwise in an inactive state and/or at the initiation of an activation cycle. In an embodiment, heater 440 may be used to heat liquid precursor 403, dispenser 420, and reservoir 410 in such a manner that the heating of those components causes the air present in reservoir 410 to also be heated and the expansion of the air exerts a positive pressure on the liquid precursor 403 in the reservoir 410 and the dispenser 420 causing a flow of precursor liquid 403 from the reservoir 410 though the dispenser 420 and into the chamber 430.

In an embodiment, controller 480 may utilize machine learning, based on user feedback, or user training data, to determine mappings from sensor signals to control parameters. For example, users of vaporizer 400 may provide an indication (e.g., via a button, microphone, gyroscopic sensor, puff sequence, etc.) of a satisfaction level (e.g., thumbs up, thumbs down) for inhalation cycles that is used to train a machine learning model to control, based on the sensor inputs, etc., the various parameters (e.g., heater 440 power etc.) that controller 480 can control during an inhalation cycle. In an embodiment the controller 480 may utilize machine learning without direct feedback from the user where the data input is resultant from the use of the device, where unique characteristics of the users activation of the device such as inhalation flow rate, inhalation flow rate variability during use, inhalation duration, inhalation frequency, duration of time between inhalations, relation of inhalation to time of day, inhalation characteristics related to ambient and/or environmental conditions, and other related data may be used to train the machine learning model to optimize activation cycles based on the user's unique activation characteristic(s) and/or inhalation profile(s). This method may be used to recognize a user specific inhalation profile(s) that is characteristic of the specific user such that the device recognizes a characteristic inhalation to a specific user and optimizes the specific activation cycle to match that specific inhalation profile(s).

Various components comprising vaporizing devices have been described. These components may be combined in different ways to produce alternative embodiments of vaporizing devices having similar features and functionality. Existing vaporizing devices are often comprised of a disposable cartridge, or cartomizer, and a reusable base unit. The disposable cartridge typically contains the liquid precursor along with one or more elements required for vaporization and is discarded once the liquid precursor is depleted. In practice, any of the described components, including the reservoir, chamber, dispenser, heater, or valve, may be incorporated into either the detachable portion or the reusable portion of the device. The allocation of components between these portions may be determined by factors such as manufacturing efficiency, intended device longevity, regulatory compliance, and user convenience. As a result, a variety of modular and integrated system architectures may be achieved.

Figure 5:
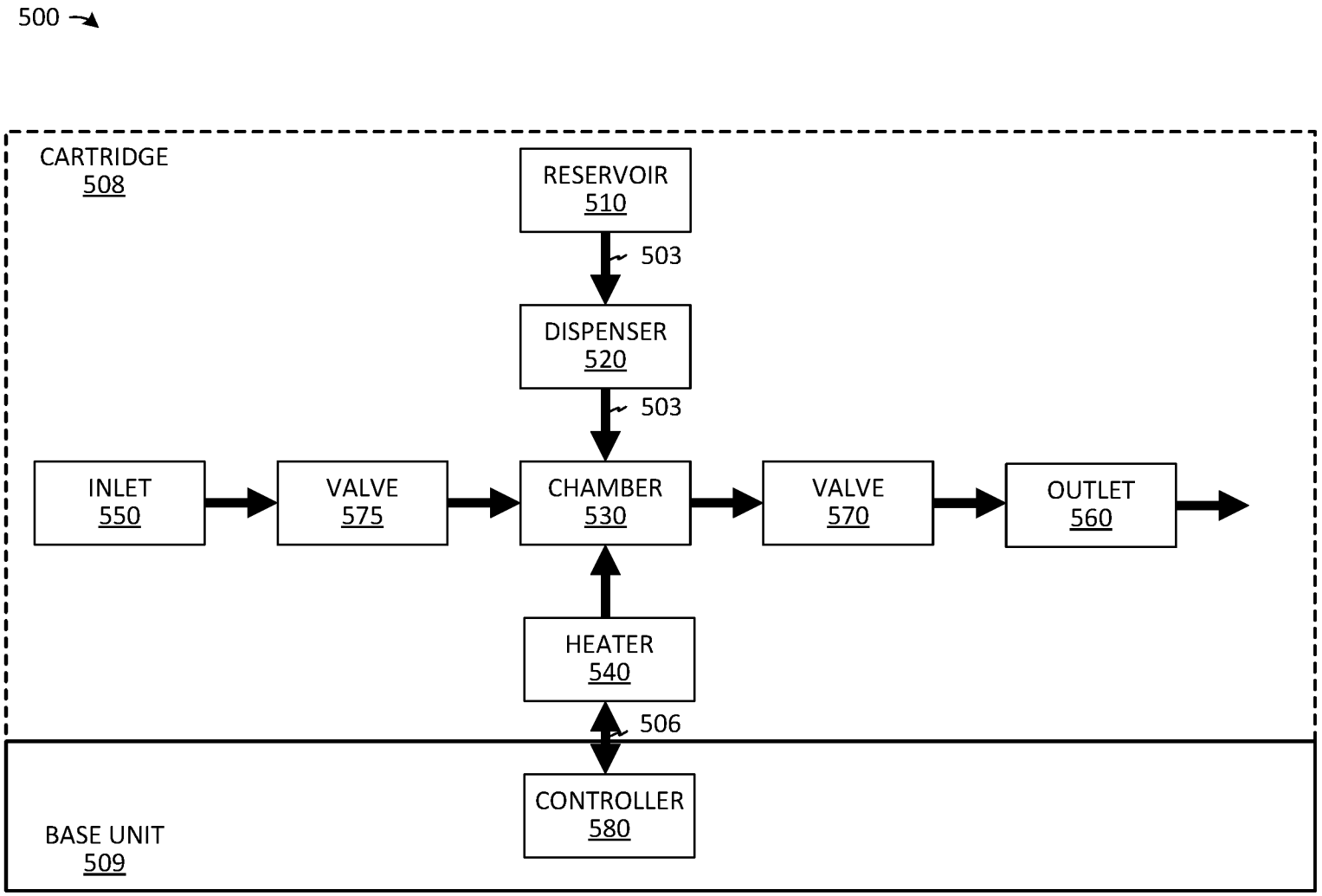
FIG. 5 illustrates a vaporizing device.
Figure 6:
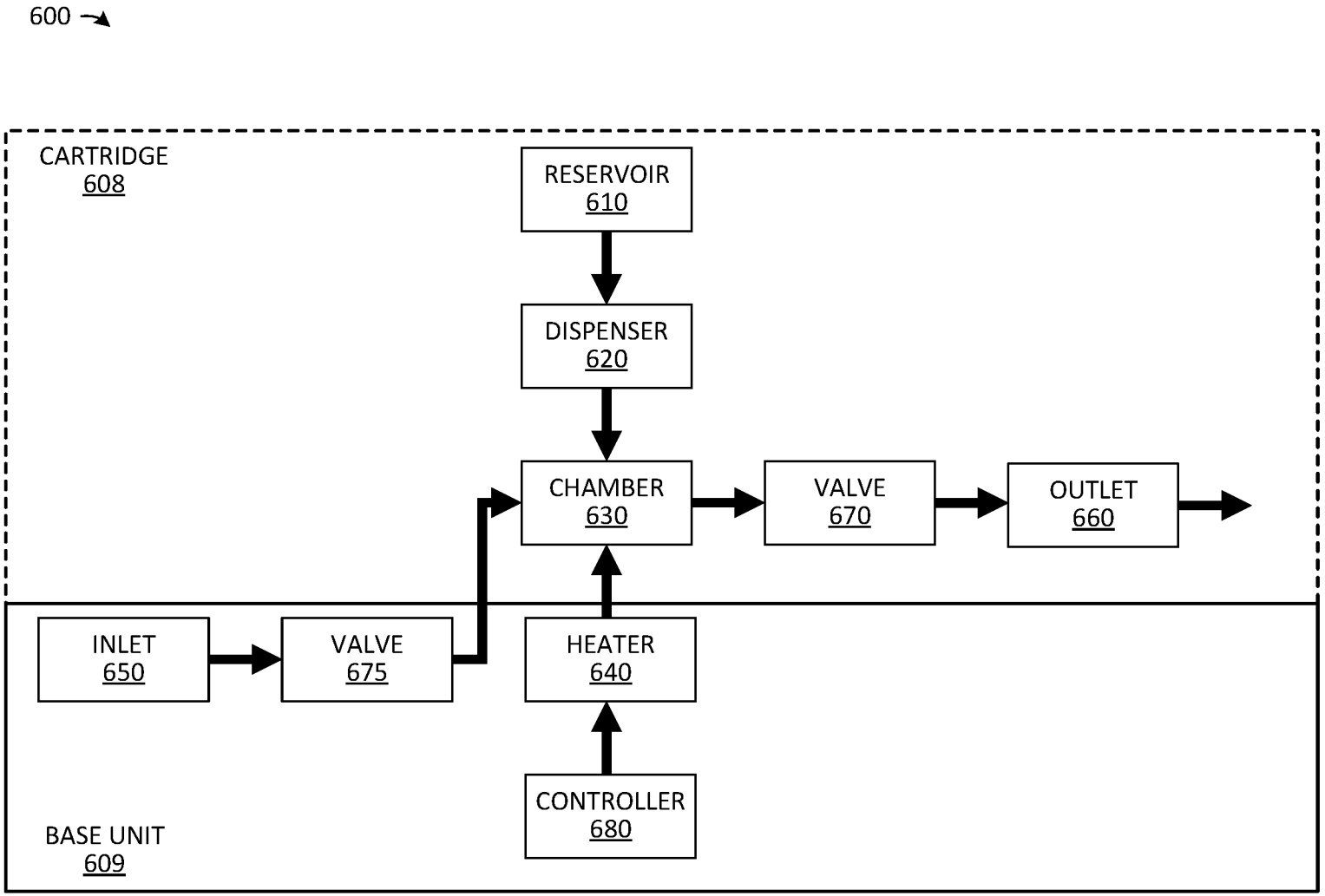
FIG. 6 illustrates a vaporizing device.
Figure 7:
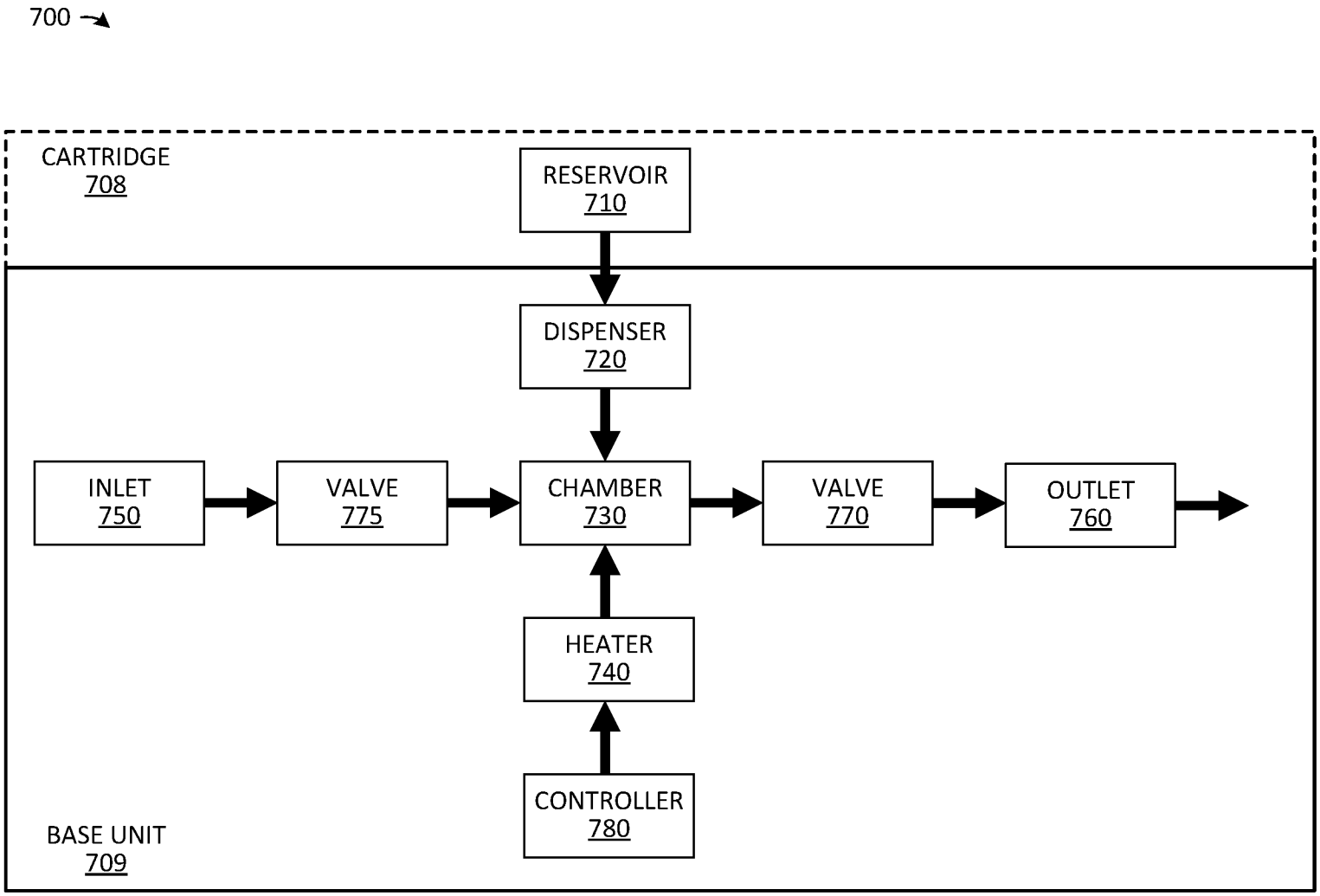
FIG. 7 illustrates a vaporizing device.

FIGS. 5 through 7 illustrate various embodiments of vaporizing devices characterized by different allocations of functional components between a disposable cartridge and a reusable base unit. Each embodiment may serve as an alternative implementation of the vaporizing devices previously described with reference to FIGS. 1-4, such as vaporizing devices 100, 200, 300, and 400. It should be appreciated that the configurations depicted in FIGS. 5-7 may be construed as exemplary and not limiting, and that further arrangements are contemplated. For example, vaporizing device 500 might be realized without valve 570 or valve 575, or with flow path variations allowing air, vapor, or aerosol to traverse a different sequence of elements, consistent with earlier descriptions.

FIG. 5 illustrates vaporizing device 500, which may be segregated into two cooperating subassemblies: cartridge 508 and base unit 509. In certain embodiments, cartridge 508 may incorporate reservoir 510 to contain a liquid precursor 503, dispenser 520 for controlled dosing, chamber 530 for vaporization, a heating element 540, inlet 550 and outlet 560 for fluid transfer, and valves 570 and 575 that may function to regulate flow or mitigate leakage risk under selected conditions. Base unit 509 could house controller 580, which may be responsible for delivering electrical power and managing operational parameters; potentially including power regulation and responsiveness to user and/or sensor input. While the configuration of cartridge 508 may resemble previously described cartridges, it could also embody one or more novel attributes intended to advance performance, reusability, or modularity.

Given that cartridge 508 may be designed for detachment from base unit 509, the establishment of electrical connections 506 with minimal user intervention may be advantageous. Such connections might include pogo pins, leaf spring contacts, blade connectors, or conductive magnets, each of which could be adapted to facilitate communication between controller 580 and heater 540. Alternatively, embodiments may centralize all electrical components within base unit 509, thereby eliminating the interconnection between cartridge 508 and base unit 509.

FIG. 6 depicts vaporizing device 600, which may similarly be divided into cartridge 608 and base unit 609. In one arrangement, cartridge 608 may comprise reservoir 610, dispenser 620, chamber 630, outlet 660, and a single valve 670, whereas base unit 609 may include heater 640, inlet 650, valve 675, and controller 680. The shifting of the heating element and inlet components into base unit 609 distinguishes this embodiment from that shown in FIG. 5.

In some embodiments of vaporizing device 600, all electrical elements such as heater 640 and controller 680 may reside within base unit 609, which may obviate the need for electrical contacts between cartridge 608 and base unit 609. Relocation of inlet 650 and valve 675 to base unit 609 may further consolidate critical components, potentially reducing disposable waste and enhancing consistency of operation through repeated use of the base unit subassembly.

FIG. 7 presents vaporizing device 700, organized into cartridge 708 and base unit 709. Here, cartridge 708 may be limited to reservoir 710 alone, while base unit 709 could accommodate dispenser 720, chamber 730, heater 740, inlet 750, outlet 760, valves 770 and 775, and controller 780.

This embodiment may represent a minimalistic configuration wherein cartridge 708 consists solely of reservoir 710. To reduce leakage risks when the cartridge is separated from the base unit, reservoir 710 may be provided with a one-way valve, self-sealing membrane, or functionally equivalent closure. This arrangement may allow for maximal reuse of device components, as the majority of functional elements are retained within the base unit and not discarded upon depletion of the liquid precursor. In an embodiment the reservoir 710 is user refillable such that no components of the device are disposed of, and the entire system is designed to be reusable. In an embodiment the reservoir 710 is refillable by the user by detaching the reservoir 710 and filling through the provided one-way valve, self-sealing membrane, or functionally equivalent closure. In an embodiment the reservoir 710 is refillable by the incorporation of a dedicated refilling port, in such an embodiment the dedicated refilling port may be configured to accept a generic filling nozzle or a specific filling nozzle that is constructed to only fluidically couple with the filling port on reservoir 710. In an embodiment the reservoir is not refillable by the user directly, but is refillable by the supplier and/or retailer using dedicated filling equipment that is not available directly to the user.

Vaporizing devices may employ modular architecture featuring detachable fluid storage elements and electronically controlled base units. Such systems may be configured to deliver a controlled flow of a liquid precursor to a vaporization chamber to generate vapor or aerosol and monitor operational parameters in real-time. Integration of sensing, power regulation, and user interface mechanisms may facilitate efficient vapor production, safety, and adaptability to particular consumption patterns.

Figure 8A:
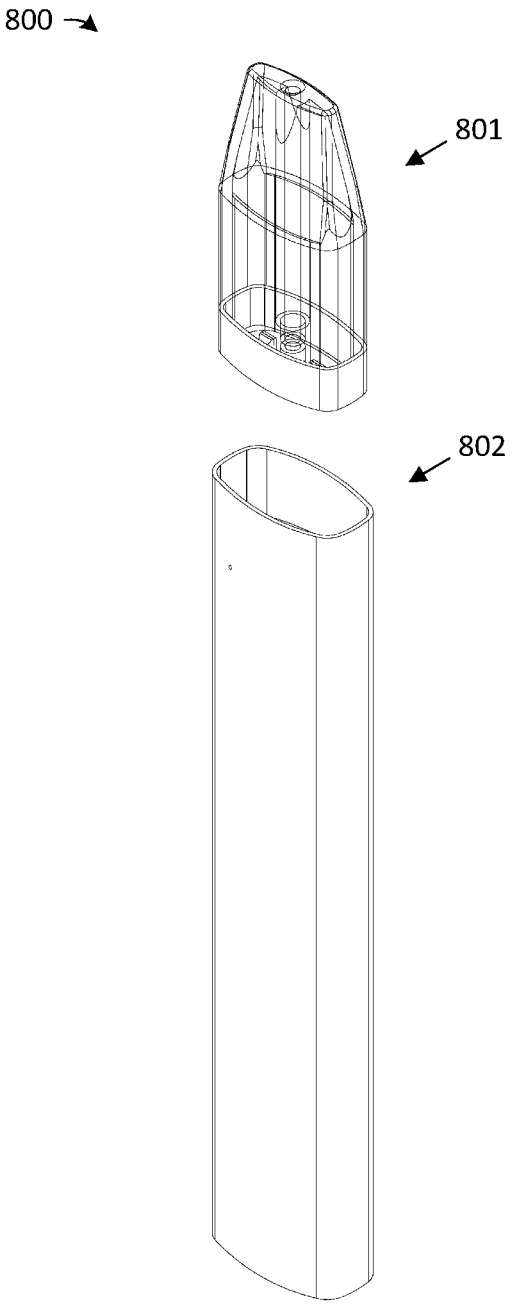
FIG. 8A illustrates a vaporizing device having a detachable cartridge.
Figure 8B:
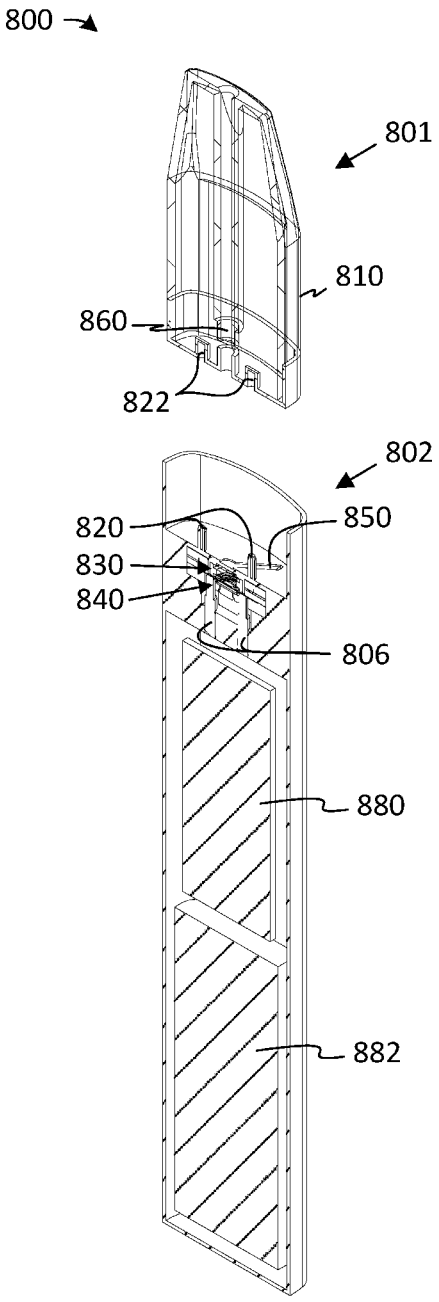
FIG. 8B illustrates a cross-section of a vaporizing device.

FIG. 8A illustrates a vaporizing device having a detachable cartridge. FIG. 8B illustrates a cross-section of a vaporizing device having a detachable cartridge. For the sake of discussion, vaporizing device 800 may be an example of vaporizing device 700; however, it should be understood, vaporizing device 800 could be an example of any vaporizing device discussed herein. Vaporizing device 800 may comprise cartridge 801 and base unit 802.

Cartridge 801 may, in various embodiments, comprise reservoir 810, valve 822, and outlet 860. Reservoir 810 may be adapted to contain a liquid precursor. Valve 822 may be configured to prevent a liquid precursor from escaping reservoir 810 when cartridge 801 is not attached to base unit 802. Although shown as a duckbill valve in FIG. 8B, it is contemplated that a variety of one-way valve types, including but not limited to a check valve, ball-and-spring valve, or flap valve, may fulfill a comparable function, with valve selection potentially influenced by the viscosity of the precursor or cartridge coupling dynamics.

The use of valves in a disposable embodiment of cartridge 801 may be economically inefficient. Some alternatives may include: capillary or surface tension-based sealing, foil or membrane seals, breakable internal seal or blister, mechanical seal, or burst seals. For example, in one embodiment, valves 822 may comprise a narrow channel or outlet through which the liquid is retained by surface tension until cartridge 801 is connected to base unit 802, whereupon capillary disruption permits flow. In another embodiment, a foil or polymer membrane may be provided over the liquid outlet, the membrane being punctured or pierced by dispenser 820 of base unit 802 upon installation. Alternatively, a frangible internal blister or compartment may contain the liquid and may be ruptured mechanically when cartridge 802 is engaged with base unit 802, thereby releasing the contents into dispenser 820. A mechanical seal, such as a deformable plug, elastomeric gasket, or collapsible nozzle, may also be used to prevent fluid leakage prior to insertion. In yet another embodiment, a burst seal or pressure-sensitive membrane may retain the liquid until sufficient pressure or deformation is applied by components of base unit 802, at which point the seal ruptures and allows fluid communication. In an embodiment, the seal may be thermally mediated flow channel(s), such that the precursor liquid, being a thermoviscous fluid, cannot flow through the channel(s) at ambient temperature due to the viscosity of the precursor liquid at ambient temperature, and only when the dispenser 820 is heated by heater 840, and/or a secondary heater, is the viscosity of the precursor liquid reduced sufficiently to allow for flow through the channels which function as the dispenser 820. These alternative sealing methods may eliminate the need for valves while maintaining adequate containment and operational reliability in disposable cartridges.

Outlet 860 may define at least a portion of tortuous flow geometry adapted for particle size selection and exclusion of an entrained aerosol such that particles of a particle size and mass are the primary component of the entrained aerosol. In an embodiment, particles having a diameter greater than 5 microns and/or a mass greater than $8.24\times10^{-14}$ kg do not remain entrained in the aerosol and/or vapor and are trapped within the outlet 860 tortuous flow geometry. In this embodiment, outlet 860 may be partially comprised of geometry included in cartridge 801, with the remaining components comprising outlet 860 integrated into base unit 802. It should be appreciated, however, that incorporation of a portion of outlet 860 within cartridge 801 is primarily a stylistic and practical choice that may facilitate assembly, replacement, or manufacturing. In alternative embodiments, the entirety of outlet 860 could be located within base unit 802, or, conversely, outlet 860 might be fully integrated into cartridge 801, depending on design preferences or functional requirements. The present arrangement is intended to illustrate one example and does not preclude other suitable configurations.

Base unit 802 may comprise inlet 850, dispenser 820, chamber assembly 830, heater 840, electrical connections 806, controller 880, and battery 882.

Vaporizers where the inlet airflow passes directly over a metal heater may result in unwanted and potentially harmful compounds and or constituents of the metallic heater being present in the formed aerosol and/or vapor. Inlet 850 does not direct the intake airflow directly over the heater and therefore helps prevent any contamination of the intake airflow with compounds and or constituents of the metallic heater. Inlet 850 may be adapted to direct ambient air from outside base unit 802 to one or more internal locations, which may vary depending on the specific configuration, to entrain vapor generated within chamber assembly 830. Inlet 850 may be in proximity to chamber assembly 850 and heater 840 and may include tortuous flow geometry incorporating regions of expansion, contraction, or directional change, for the purpose of pre-heating the air flow passing through inlet 850 during activation. In an embodiment, heater 840 may be in proximity to inlet 850 but is not in fluid communication with inlet 850 such that the inlet geometry is heated without the air flow in inlet 850 passing directly over the heater.

Dispenser 820 may comprise one or more tubes, channels, protrusions, or alternatively, deformable actuators or capillary structures, configured to engage valve 822 and regulate transfer of a liquid precursor from reservoir 810 to chamber assembly 830 upon coupling of cartridge 801 with base unit 802. In certain configurations, dispenser 820 may exploit fluidic resistance or surface tension of a liquid precursor to control a flow rate. In other configurations, dispenser 820 may exploit a thermoviscous precursor liquid and the resistance of flow through aforementioned structures at ambient temperatures due to the viscosity of the precursor liquid at ambient temperatures. Mechanical coupling of cartridge 801 to base unit 802 may be achieved by magnets, snap-fits, threaded engagements, friction interfaces, or other coupling mechanisms suitable for repeated attachment and detachment cycles.

Outlet 860 may be configured to mix vapor and air to form an aerosol, subsequently conditioning the aerosol, and routing the resultant flow to a user. In this embodiment, outlet 860 may be divided between cartridge 801 and base unit 802. Outlet 860 may include tortuous flow geometry incorporating regions of expansion, contraction, or directional change, for the selective removal of particles by size and/or mass from an aerosol entrained in a stream of air.

Chamber assembly 830 may be configured to vaporize a liquid precursor received from reservoir 810, utilizing heat provided by heater 840. Chamber assembly 830 may comprise various embodiments that will be described herein. Chamber assembly 830 may be configured to transfer heat from heater 840 to a volume of liquid precursor contained by chamber assembly 830.

Heater 840 may be configured as a resistive element, such as nichrome, mesh, or printed thick-film conductor, although other types of heaters may be contemplated including ceramic or inductive heating elements. In an embodiment, heater 840 may be a photochemically machined and or photochemically etched resistive element that is polygonal when viewed cross-sectionally, allowing for increased contact area between the surface of heater 840 and chamber assembly 830. Heater 840 may receive electrical energy from electrical connections 806, which may be specified to accommodate the appropriate current and thermal operating profiles. Heater 840 may include a first region adapted to reach temperatures sufficient to heat chamber assembly 830 and thereby thermally mobilize the precursor liquid into an aerosol and/or vapor. A second region of heater 840 may be configured to establish electrical connection with connector 106. A third region may be positioned to provide heat to dispenser 820 and/or reservoir 810, supporting delivery and pre-heating of the precursor liquid to facilitate vaporization of the precursor liquid and subsequent aerosol formation.

Electrical connections 806 may supply power to heater 840 and, in certain embodiments, may further enable measurement of heater resistance, facilitating indirect estimation of temperature during operation. Electrical connections 806 may be implemented as pogo pins, leaf springs, blade connectors, magnetic contacts, or alternative solutions, selected according to durability and compliance with relevant electrical and mechanical requirements.

Controller 880 may govern activation of heater 840 based on user input, which may be registered via manual actuation (such as push-buttons), acoustic sensors, pressure transducers, capacitive touch, or other user interfaces. Controller 880 may modulate power delivery to heater 840 responsively, possibly to ensure safety, optimize aerosol generation, and/or extend device longevity.

Controller 880 may optionally collect and process operational data, which could include temperature, pressure, flow rate, inhalation patterns, or device usage statistics. Temperature data collected may include both the operating temperature of heater 840 when the device is activated, and/or the pressure within inlet 850 during activation, and/or flow rate of the flow through the inlet 850 during activation. Collected data may also include ambient temperature of the device when inactive, and ambient pressure of the device when inactive. Such information may serve to adaptively tune device parameters to align with a user's preferences and/or characteristic inhalation profile(s) to optimize vapor density and/or aerosol characteristics to optimize formed vapor and/or aerosol for delivery and/or deposition into the deep lung. In additional embodiments, controller 880 may also manage battery 882, facilitating safe recharging, thermal protection, or compatibility with a range of rechargeable chemistries.

Battery 882 may represent any suitable rechargeable or disposable power source, such as but not limited to lithium-ion, nickel-metal hydride (NiMH), nickel-cadmium (NiCd), or lithium polymer cells. Charging of battery 882 may be managed directly by controller 880, or via an external charging circuit integrated into base unit 802.

In operation, cartridge 801 may be coupled to base unit 802 through one or more mechanical or magnetic coupling mechanisms. Upon coupling, dispenser 820 may actuate valve 822 to enable a controlled flow of liquid precursor from reservoir 810 into chamber assembly 830. Activation of heater 840, by suction at outlet 860, manual input, or other means, may prompt controller 880 to meter electrical power from battery 882 to heater 840, thereby vaporizing the precursor. Air, drawn via inlet 850, may be entrained with vapor within chamber assembly 830 to form an aerosol, which is then directed through outlet 860 for user inhalation. In certain embodiments, the resultant airflow path may be dynamically altered by features within the device to select for particle size and/or mass, optimize aerosol quality, minimize condensation, reduce aerosol temperature, or otherwise tailor user experience.

Vaporizing device 800 may have included many of the active components comprising a chamber assembly or vaporizer for a vaporizing device integrated into a base unit but these same components could be adapted for assembly into a cartridge, such as cartridge 801.

Figure 9:
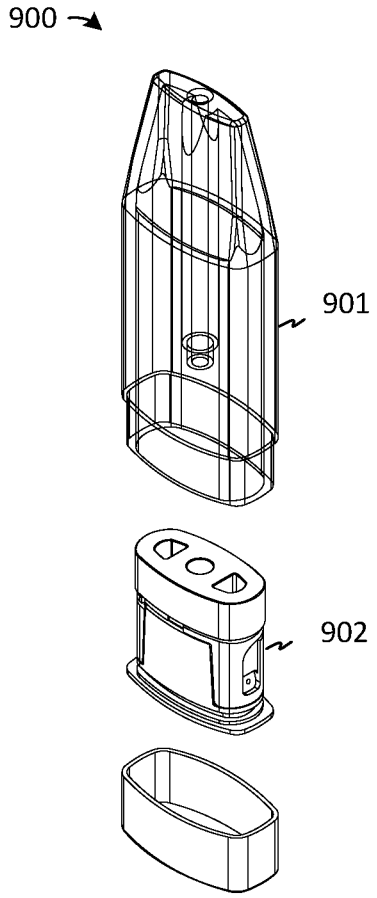
FIG. 9 illustrates a cartridge for a vaporizing device.

FIG. 9 illustrates a cartridge for a vaporizing device. Cartridge 900 may represent a specific embodiment of cartridge 801, but with the addition of vaporizer 902 disposed therein. Cartridge 900 may generally comprise reservoir 901 adapted to retain a liquid precursor and vaporizer 902 configured to convert at least a portion of the liquid precursor into vapor. Various forms, dimensional characteristics, and interfacial elements may be implemented in order to optimize compatibility with different vaporizing devices or platforms, as will be described in further detail below.

The geometry or external form factor of reservoir 901 may be selected or adapted to address aesthetic requirements, ergonomic considerations for user handling, constraints imposed by manufacturing, or limitations arising from integration with other device components. In some embodiments, the volume, cross-sectional shape, or wall material of reservoir 901 may be adjusted to account for desired precursor capacity, refillability, or transparency, while alternative configurations may prioritize compactness, robustness, or cost-effective fabrication.

Cartridge 900 may incorporate a vaporizer assembly, such as vaporizer 902. While FIG. 9 depicts one possible arrangement of vaporizer 902, it is contemplated that a range of alternative constructions may be utilized, incorporating variations in vaporizer location, mounting method, or functional features. Such alternatives may encompass different heater types (including photochemically etched resistive metal, photochemically machined resistive metal, resistive wire, ceramic, film heaters, quartz or glass enveloped filament heaters with or without noble gas surrounding the filament and with or without the filament being under vacuum, and UV and/or infrared emitter(s) and/or diode(s)), valve mechanisms (such as duckbill, check, or rotary valves), fluid dispensing means (for example, via thermally mediated flow tube(s) and/or channels, spring-loaded, gravity-fed, pressure-driven, or capillary-driven dispensers), and differing inlet or outlet geometries (including tortuous flow geometry for aerosol conditioning and/or particle size and/or particle mass selection), either alone or in combination.

Figure 10:
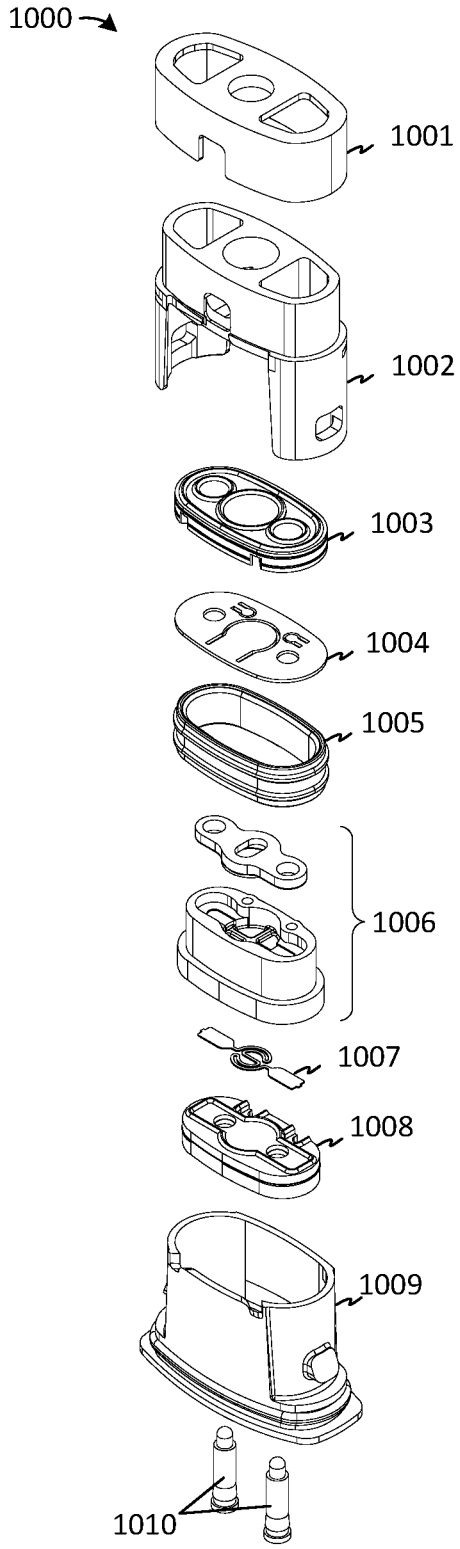
FIG. 10 illustrates an exploded view of a vaporizer.

FIG. 10 illustrates an exploded view of a vaporizer. Vaporizer 1000 represents only one embodiment of a vaporizer and it should be appreciated that vaporizer 1000 may take on a variety of different embodiments. FIG. 10 is provided to familiarize the reader with the general construction of a vaporizer assembly, such as vaporizer 1000, which may be adapted for use in either a base unit (e.g., base unit 802) or a cartridge (e.g., cartridge 900), depending upon the specific embodiment. It should be understood that the same vaporizer configuration could be implemented in various device formats, and additional configurations are contemplated.

Vaporizer 1000 may include upper seal 1001, upper chassis 1002, precursor inlet seal 1003, valves 1004, outer seal 1005, chamber assembly 1006, heater 1007, lower seal 1008, lower chassis 1009, and electrical contacts 1010.

Vaporizer 1000 may include one or more seals to prevent a liquid precursor from leaking and to seal air, vapor and aerosol flow paths. This embodiment may include upper seal 1001, precursor inlet seal 1003, airflow inlet and chamber exit seal 1004, outer seal 1005, and lower seal 1008. Other embodiments may include different seals or combinations thereof.

Upper seal 1001 may be configured to form a fluid tight seal between a reservoir (e.g., reservoir 901) and a vaporizer (e.g., vaporizer 902) interface. In some embodiments, upper seal 1001 could help to create a friction-fit assembly to structurally secure reservoir 901 to vaporizer 902 thereby eliminating the need for dedicated fasteners.

In its most basic embodiment, precursor inlet seal 1003 may be configured to direct a flow of liquid precursor between different components comprising vaporizer 1000. Other embodiments of precursor inlet seal 1003 may be additionally configured to direct and isolate air, vapor or aerosol. Valves 1004 have three valve features depicted in FIG. 10: two small flap style valves that valve the intake airflow path, and a larger central flap style valve that controls the exit of aerosol and/or vapor from chamber 1006. The two smaller air intake flap valves of valves 1004 are, in an embodiment, configured to allow the directional flow of intake airflow into the chamber assembly 1006 as a result of the suction generated by the inhalation through vaporizer 1000 by the user; where, for example, valves 1004 have features that are opened during inhalation by the user are in a closed or sealed state when the device is inactive. Additionally valves 1004 are resistant to flow or pressure in the opposite direction of the direction of flow generated by the user inhalation, such that if pressure and/or flow is applied in the opposing direction the valve 1004 is closed more tightly because of the pressure and or flow serving to further seat the air intake valves 1004 against the sealing surface of chamber 1006 that the air intake valves of valves 1004 rest against. The central larger flap style valve depicted in FIG. 10 of valves 1004 serves to seal the region of chamber assembly 1006 where aerosol and/or vapor generation occurs via heating of the precursor liquid and is in a closed position when the vaporizer 1000 is in the inactive state. In the active state of vaporizer 1000 the generation of aerosol and or vapor causes the pressure to increase inside the region of chamber assembly 1006 where aerosol and/or vapor production occurs. The increase in pressure causes the central chamber flap valve of valves 1004 to displace to an open position allowing for the generated vapor and/or aerosol to escape the chamber assembly 1006 for delivery to the user. In an embodiment, valves 1004 may be constructed of a silicone material where the compliance and/or thickness of the material that the valve part is comprised of allows for the valves 1004 to be in the closed position when the vaporizer 1000 is not in use. The compliance of the silicone material may be used to construct valves 1004 such that: (1) valves 1004 are sufficiently stiff due to the thickness of the silicone material and/or durometer of the silicone material that valves 1004 are only opened when the user is generating sufficient suction through the device 1000 by inhaling, (2) and valves 1004 valve the air intake path, such that sufficient pressure inside of chamber assembly 1006 is required from the generation of aerosol and/or vapor from the precursor liquid to displace and render open the flap valve that seals the chamber 1006.

Outer seal 1005 may be configured to form a fluid tight seal between chamber assembly 1006, upper chassis 1002, and lower chassis 1009. Lower seal 1008 may be configured to form a fluid tight seal between chamber assembly 1006 and lower chassis 1009. Lower seal 1008 may include clearance for the passage of electrical contacts 1010 or valve steams. Lower seal 1008 could also include features to direct incoming air. In some embodiments, lower seal 1008 may provide structural support for heater 1007. In an embodiment, outer seal 1005, lower seal 1008, valves 1004, and precursor inlet seal 1003 may function to completely isolate the intake airflow, the precursor liquid, and the generated aerosol and/or vapor from being in direct contact with the heater 1007.

These seals may be exposed to liquid precursor, air, vapor, or aerosol, and may be fabricated from materials exhibiting a combination of chemical resistance, thermal stability, mechanical flexibility, and compatibility with health and safety standards. Materials that are non-reactive with the contained fluids, capable of maintaining their sealing properties over a range of operating temperatures, and compliant with relevant regulatory requirements may be particularly suitable. For example, silicone may be employed due to its chemical inertness, thermal stability, and compliance with safety guidelines. Alternative materials may include fluoroelastomers, thermoplastic elastomers (TPE), or food-grade rubbers, each offering varying balances of durability, manufacturability, and resistance to fluid absorption. The selection of sealing materials may be further guided by considerations such as fabrication method, expected device lifespan, and compatibility with adjacent components.

Upper chassis 1002 and lower chassis 1009 may collectively function as a frame or structural support for the various components comprising vaporizer 1000. In addition to providing mechanical integrity, upper chassis 1002 and lower chassis 1009 may further include features or internal pathways adapted to direct streams of air, vapor, or aerosol for the purpose of conditioning, in a manner analogous to that described for various inlet and outlet configurations disclosed herein or subsequently described. In certain embodiments, the internal geometries of upper chassis 1002 and/or lower chassis 1009 may be designed to introduce tortuous flow geometry, impingement surfaces, impaction surfaces, vortices, or eddy currents to promote particle deposition or droplet removal, thereby tailoring the physical properties of the delivered aerosol, such properties may include optimization of the particle size and/or particle mass for inhalation into the deep lung and/or deposition of the particles in the deep lung, and reduction of aerosol and/or vapor temperature to facilitate inhalation without irritation due to aerosol and/or vapor temperature. In an embodiment, particles having a diameter greater than 5 microns and or a mass greater than $8.24\times10^{-14}$ kg do not remain entrained in the aerosol and/or vapor and are trapped within the upper chassis 1002 and or lower chassis 1009 flow geometry. In an embodiment, flow through upper chassis 1002 and/or lower chassis 1009 flow geometry and the flow channel present in reservoir 901 may result in a vapor and/or aerosol temperature that is close to the physiological temperature of the human airway.

Moreover, upper chassis 1002 may include all or a portion of a dispenser structure, such as those described in prior and/or subsequent embodiments, or may alternatively be configured to accommodate equivalent or functionally similar dispensing mechanisms. Such dispenser features may include, by way of example, spring-loaded valves, capillary channels, thermally mediated flow channels, deformable membranes, or other structures capable of regulating the transfer of a liquid and/or vapor precursor. The specific selection and integration of these features may be guided by considerations including, but not limited to, ease of assembly, compatibility with the intended fluids and/or precursors, replacement intervals, and applicable regulatory requirements.

The overall geometry of upper chassis 1002 and lower chassis 1009 may be tailored to suit specific embodiments and stylistic choices. Some embodiments may be configured to be assembled within a reservoir, while others may be configured to be assembled into a base unit.

Upper chassis 1002 and lower chassis 1009 may be manufactured from a variety of materials, depending on the specific embodiment. Materials that are non-reactive with liquid precursors, thermally stable, resistant to liquid absorption, capable of withstanding operating environments of the device, and compliant with relevant health and safety standards may be desirable. Material selection may be guided by desired mechanical properties, compatibility with the liquid precursor, regulatory requirements, and cost considerations. In certain embodiments, copolyesters such as Tritan® may be well-suited for manufacturing upper chassis 1002 and lower chassis 1009. Alternatively, materials such as polycarbonate, polycyclohexylene dimethylene terephthalate glycol modified (PCTG), polyethylene terephthalate glycol-modified (PETG), polymethyl methacrylate (PMMA), polypropylene (PP), or polysulfone (PSU) may also be suitable, depending upon the embodiment and manufacturing process.

Valves 1004 may be used to prevent fluids from leaking from vaporizer 1000 when not in use, though vaporizer 1000 could function without them. Different types of valves may be used. Flap valves may be desirable due to their thin profile and simple construction but other but other types of valves may be used. For example, poppet valves could be used to provide the ability to remotely actuate them. Material selection may be dependent upon the type of valve chosen.

Chamber assembly 1006 may be configured to generate a vapor or aerosol from a liquid precursor. Chamber assembly 1006 may include one or more intake ports configured to receive a liquid precursor, as well as one or more outlet ports to deliver the resulting vapor and/or aerosol. In some embodiments, these ports may be configured to direct a flow of air, vapor and/or aerosol. For example, an intake port could direct air into chamber assembly 1006 to promote a vortical flow that may allow for more efficient vaporization and controlled aerosol generation. Chamber assembly 1006 may further be configured to interface with heater 1007, such that heat is applied to the liquid precursor contained within the chamber, facilitating its conversion to a vapor phase. The geometric arrangement and positioning of intake and outlet ports may be selected to optimize fluid dynamics, maximize heat transfer efficiency, and support consistent aerosol formation. In an embodiment, chamber assembly 1006 may be constructed such that the heater is isolated from the precursor liquid and the flow of air, vapor, or aerosol, such that the heater transfers heat to the precursor liquid without having direct contact with the precursor liquid, and such that the heater transfers heat to the intake air without having direct contact with the intake air.

Chamber assembly 1006 may be manufactured from materials that are non-reactive and thermally stable at the expected vaporization temperatures, ensuring compatibility with the liquid precursor and maintaining structural integrity throughout repeated heating cycles. Material selection may be guided by several considerations, including manufacturing techniques, cost constraints, compatibility with the type of heater employed, and regulatory or safety requirements. For example, some embodiments may utilize fused silica, which is valued for its chemical inertness, strength, and thermal stability. Other embodiments may employ Macor®, a machinable ceramic, chosen for its durability, resistance to high temperatures, and ease of fabrication using machining processes. Additional suitable materials could include borosilicate glass, quartz glass, high-performance ceramics, or metallic alloys, depending on desired thermal conductivity, mechanical robustness, and manufacturability. The specific choice of material may also be influenced by the need to prevent contamination of the vapor or aerosol and to comply with applicable health and safety standards. In an embodiment, chamber assembly 1006 may be constructed of fused silica as described herein.

Heater 1007 may be configured to supply heat to chamber assembly 1006 to convert a liquid precursor to a vapor. In some embodiments, heater 1007 may comprise a resistive element; however, alternative types of heaters, such as infrared emitters, UV emitters, combination UV and IR emitters, ceramic elements, lasers, or inductive heaters, may also be utilized, depending on the specific requirements of the device. One advantage of using a resistive heater is that materials that are commonly used in their construction, such as nichrome or Kanthal®, an iron-chromium-aluminum alloy, may have a known temperature coefficient. This may allow the temperature of heater 1007 to be estimated by measuring changes in electrical resistance of the heater 1007. Selection of heater type and material may be guided by considerations such as thermal response time, durability, and energy efficiency. In an embodiment, heater 1007 may not be directly in contact with the precursor liquid, aerosol, vapor, and/or intake air. Heater 1007 may be separated from the precursor, aerosol, vapor, and/or intake air by an inert material such as glass. In an embodiment, heater 1007 may be constructed from the photochemical etching and or photochemical machining of nichrome sheet(s).

Electrical contacts 1010 may be used to supply electrical energy to heater 1007. In addition, depending upon the type of heater that is used, electrical contacts 1010 may be configured to measure electrical resistance of heater 1007 to estimate the temperature. Electrical contacts 1010 may be used to heat sink the non-resistive region(s) of heater 1007.

Vaporizer 1000, as illustrated in FIG. 10, represents a single embodiment of a vaporizer device. It should be understood that numerous alternative configurations may be employed, utilizing various combinations of seals, chassis, heaters, valves, and chambers. The elements illustrated and described herein may be arranged, omitted, or substituted in different ways to achieve desired performance, manufacturing, or user requirements. Additional embodiments, including modifications to the geometry, materials, or integration of individual components, may likewise be contemplated within the scope of the present disclosure.

It may be desirable to supply a controlled and uniform flow of a liquid precursor to a vaporization chamber in order to promote efficient and consistent vapor generation. Some embodiments may seek to deliver a liquid precursor to a vaporization chamber at a rate of approximately 2 mg/second and/or 2 μL/second in order to sustain the vaporization of 2 mg/second and/or 2 μL/second of precursor. A variety of methods may be employed to regulate the flow characteristics of the precursor liquid, with the choice of method potentially influenced by the physical properties of the liquid, desired device performance, and operational constraints. In some embodiments, flow regulation may be accomplished by exploiting the effect of fluid viscosity on movement through a channel of relatively small diameter, wherein the combination of channel length and diameter may be selected to yield a predictable flow rate. In some embodiments, flow regulation may be accomplished by exploiting the effect of fluid viscosity on movement through a channel of relatively small diameter, wherein the combination of channel length and diameter may be selected to yield a predictable flow rate under applied pressure, such as the pressure generated from the expansion of the air present in the reservoir when reservoir is heated above ambient either indirectly by heater 1007 or by a secondary heater. In some embodiments, the precursor may be a thermoviscous solid or semi-solid at ambient temperature and require the application of heat to become a liquid. In an embodiment, the inlet channels conveying the precursor from the reservoir to the chamber may be heated by the proximity of the inlet channels to heater 1007 to allow for the flow of a thermoviscous precursor when the device is activated. In an embodiment a secondary heater may be used to heat the inlet channels. In an embodiment a secondary heater serves to heat both the inlet channels and/or the reservoir.

Figure 11A:
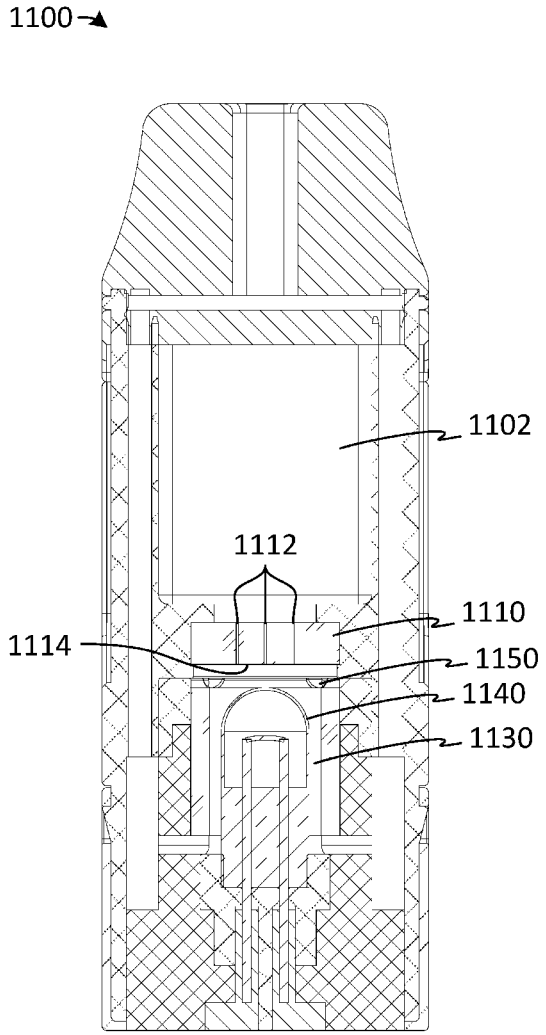
FIG. 11A illustrates a cross-section of a vaporizer including a dispenser for a vaporizing device.
Figure 11B:
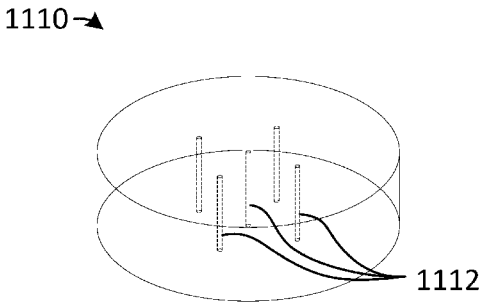
FIG. 11B illustrates an isometric view of a dispenser disk.

FIG. 11A illustrates a cross-section of a vaporizer including a dispenser for a vaporizing device. FIG. 11B illustrates an isometric view of a dispenser disk. In this embodiment, vaporizing device 1100 may include dispenser disk 1110 positioned between reservoir 1102 and chamber 1130 to regulate a flow of a liquid precursor from reservoir 1102 to chamber 1130 for vaporization. In some embodiments, dispenser disk 1110 may be configured to work with a heater, such as heater 1140, to operate as a thermally mediated valve.

Dispenser disk 1110 may comprise a body including one or more orifices 1112 configured to regulate a flow of a liquid precursor. While dispenser disk 1110 may be illustrated as a cylindrical body in FIG. 11B, its overall shape may be chosen to suit particular embodiments of vaporizing device 1100.

Orifices 1112 may be one or more small-diameter tubes passing through dispenser disk 1110. In some embodiments, orifices 11112 may be configured to take advantage of capillary action by interacting with the surface tension and wetting angle properties of a liquid precursor and the materials (e.g., borosilicate glass, fused quartz, etc.) from which capillary tubes 1112 are made. Capillary action is the process of a liquid flowing in a narrow space without the assistance of external forces like gravity. Capillary tubes are often thought of as tubes that cause liquids to act against gravity, drawing a liquid upward and creating a force balance. However, as illustrated in FIG. 11A, dispenser disk 1110 is disposed below reservoir 1102 and orifices 1112 may be configured to permit a downward flow of a liquid precursor while still resisting gravity. Capillary action may be sustained within the internal surfaces of orifices 1112, such that the cohesive and adhesive forces responsible for liquid transport are confined to the structure of the orifice itself. Upon reaching bottom 1114 of orifices 1112, the capillary effect may cease altogether, thereby restricting further precursor movement beyond this boundary.

The volumetric flow rate of a liquid precursor through a single orifice 1112 may be mathematically modeled using the Hagen-Poiseuille equation:

$$Q = \frac{\pi r^4 \Delta P}{8\,\mu L}$$

where Q is the volumetric flow rate, r is the radius of the orifice, L is the length of the orifice, ΔP is the pressure drop across that length, and μ is the dynamic viscosity of the liquid precursor. This equation applies to both capillary and non-capillary flow of a liquid precursor through an orifice, for laminar flow of Newtonian fluids.

The Hagen-Poiseuille equation shows that the dynamic viscosity of a liquid precursor affects the volumetric flow rate of the liquid through an orifice. Propylene glycol, vegetable glycerin, or combinations thereof are commonly used as precursors for vaporizers and have known temperature dependent viscosities. Therefore, for a given radius and length of an orifice, the volumetric flow rate of a liquid precursor through it may be changed by changing the temperature of the liquid precursor.

Figure 12:
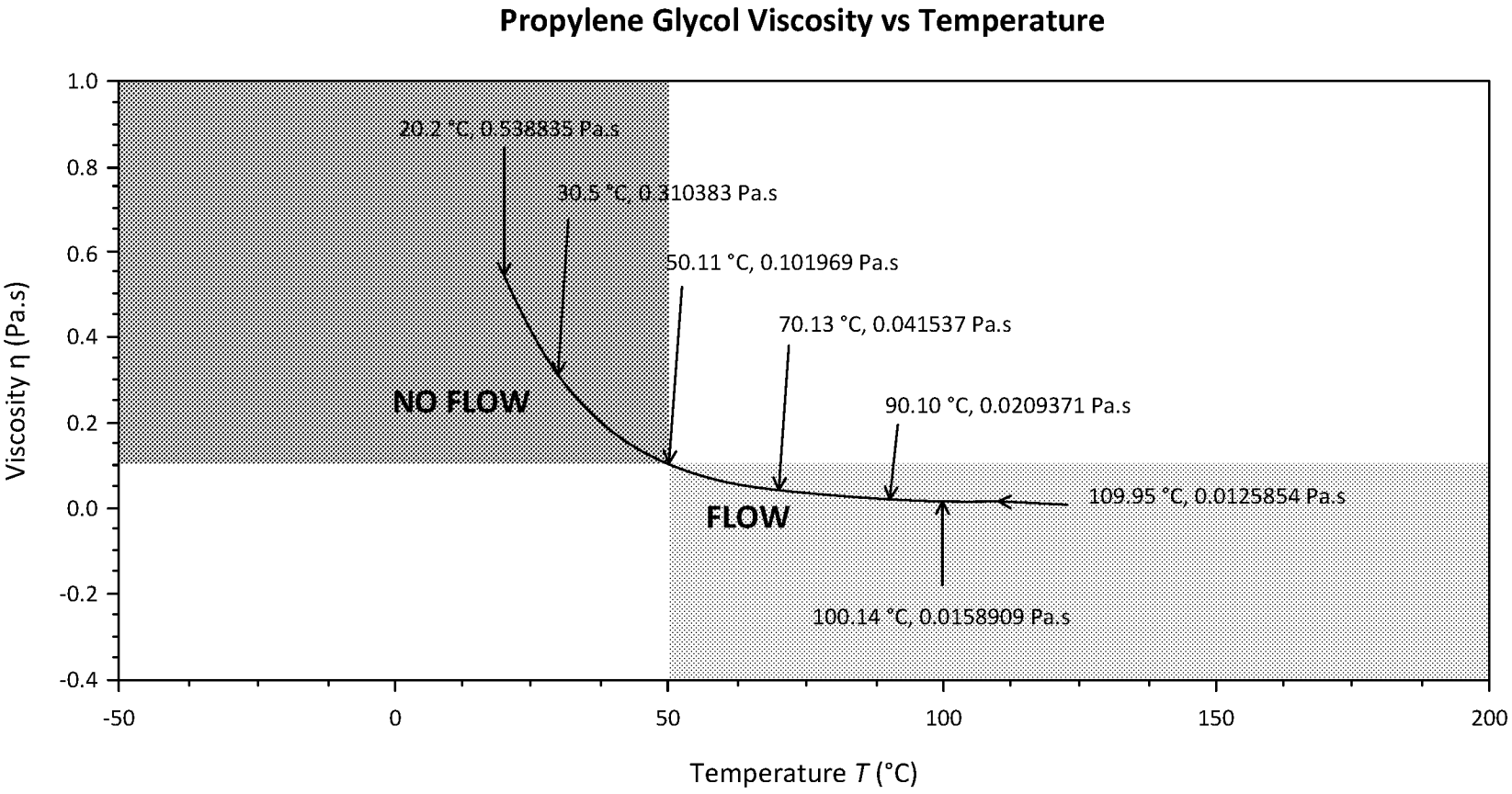
FIG. 12 illustrates a graph showing the viscosity of propylene glycol versus temperature.

FIG. 12 presents a graph showing how the viscosity of a propylene glycol sample may change depending upon temperature. This may be used to design orifices 1112 to permit a liquid precursor to flow when its viscosity is below a certain threshold. For example, orifices 1112 may be constructed having radii that blocks the flow of a liquid precursor when its viscosity is greater than 0.101969 Pa·s, which correlates to temperatures above about 50.11 °C Changing the temperature of a liquid precursor may change its flowrate through orifices 1112.

It may be desirable to control the flow speed of a liquid precursor in addition to the volumetric flow rate. The following equation may be used calculate a flow speed of a liquid precursor through one or more orifices 1112:

$$v_{avg} = \frac{Q}{NA}$$

where $v_{avg}$ is the flow speed, h Q is the volumetric flow rate, N is the number of orifices, and A is the cross-sectional area of each orifice.

A thermally mediated valve may be constructed by selecting one or more orifices having an appropriate length and radius at a given pressure differential and controlling the viscosity of a liquid precursor by adjusting its temperature. Such a valve may be constructed such that a liquid precursor is blocked from passage through orifices 1112 until heat is added to the system to decrease the viscosity of the liquid precursor. The liquid precursor may flow when heat is applied and then cease to flow a short time after heat is removed.

Looking back to FIG. 11A, we can imagine a volume of liquid precursor contained in reservoir 1102. Dispenser disk 1112 may have one or more orifices 1112 configured to block the flow of the liquid precursor until a predetermined temperature has been reached. In operation, heater 1140 may be activated transferring heat to dispenser disk 1112 and a liquid precursor contained within reservoir 1102. When the application of heat has sufficiently changed the viscosity of a liquid precursor it may begin to flow through orifices 1112 into chamber 1130. Liquid precursor may drip from bottom 1114 of dispenser disk 1110 onto heater 1140 to be vaporized. At some viscosities, a volume of liquid precursor may form a droplet clinging to the bottom 1114 of dispenser disk 1110. Inlets 1150 may be positioned in proximity to bottom 1114 of dispenser disk 1110 to deliver air flow near bottom 1114 to help dislodge a formed droplet. In an embodiment the inlets 1150 direct a high velocity flow across the dispenser disc that generates a region of high pressure that functions to entrain the liquid and/or droplets from the surface of the dispenser disc in a stream of air that passes over and/or impacts with the heater 1140.

The previous embodiment illustrated a dispenser for a vaporizing device comprised of an independent component. However, a dispenser may comprise multiple components or may be integrated into other elements comprising a vaporizing device.

Figure 13B:
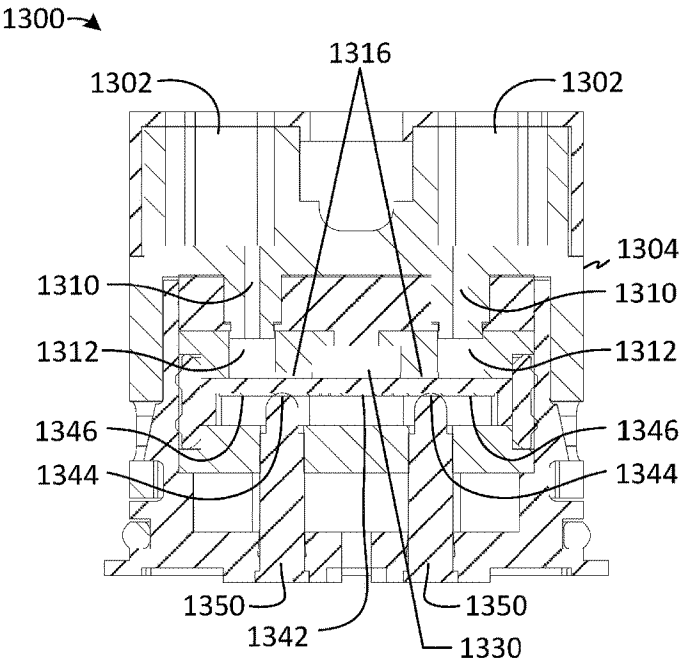
FIG. 13B illustrates a cross section of a vaporizing device including a dispenser.
Figure 13C:
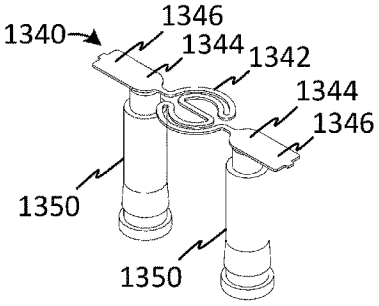
FIG. 13C illustrates an isometric view of heater assembly for a vaporizing device.
Figure 13A:
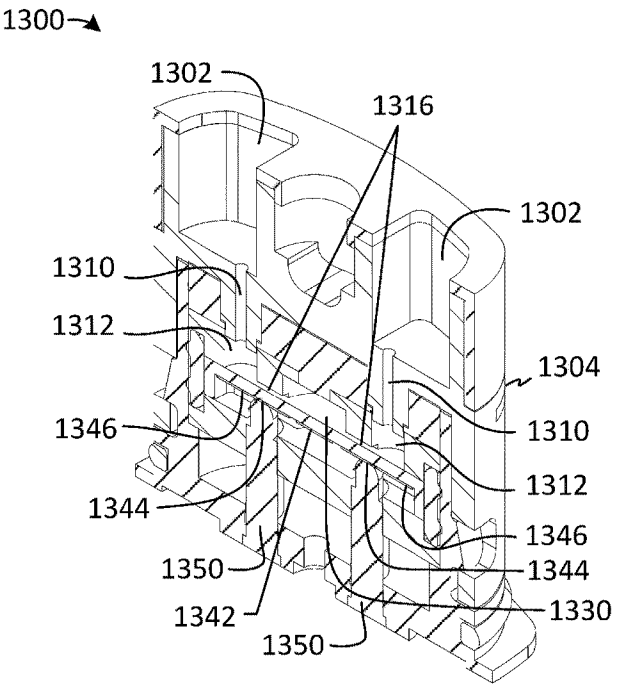
FIG. 13A illustrates a cross section of a vaporizing device including a dispenser.

FIGS. 13A and 13B illustrate cross sections of a vaporizing device including a dispenser. Dispenser 1300 may comprise upper channels 1310, secondary reservoirs 1312, lower channels 1316, and heater 1340 and be configured to regulate the delivery of a liquid precursor from reservoir 1302 to chamber 1330. While certain embodiments may include a plurality of elements such as multiple upper channels 1310, secondary reservoirs 1312, and lower channels 1316, dispenser 1300 may alternatively be constructed with only a single upper channel 1310, secondary reservoir 1312, or lower channel 1316. Dispenser 1300 may be connected to a larger reservoir such as reservoir 901 as described previously for vaporizer 902 and illustrated in FIG. 9, and may incorporate an upper seal such as upper seal 1001 to create a liquid tight seal between dispenser 1300 and a reservoir such as reservoir 901.

In this embodiment, upper channels 1310 may be integral to upper chassis 1304 and disposed between reservoir 1302 and secondary reservoirs 1312. Upper channels 1310 may or may not be configured to take advantage of capillary action depending upon the particular embodiment. In any event, upper channels 1310 may each include an inner diameter and a length configured to regulate a flow of a liquid precursor. In an embodiment, upper channels 1310 may each include an inner diameter and length configured to block a flow of a liquid precursor while the device is idle and to permit a flow of liquid precursor after heater 1340 is activated, while alternative embodiments may configure upper channels 1310 to supply a regulated flow without additional heat input. Upper channels 1310 may supply a liquid precursor from reservoir 1302 to secondary reservoirs 1312.

In an embodiment, upper channels 1310 may be configured to be thermally conductive to facilitate the flow of a thermoviscous precursor during device activation. In an embodiment, upper channels 1310 may be thermally non-conductive. In an embodiment the secondary reservoirs 1312 are heated by the proximity to the heater 1340 to such a degree as the viscosity of a thermoviscous precursor liquid is lowered sufficiently to facilitate flow through the lower channels 1316. In an embodiment, the lower channels 1316 function as a thermally mediated valve, such that when the device is inactive the area of the channels 1316 is too small and functions to prevent the flow of a thermoviscous precursor liquid, and when the device is activated the lower channels 1316 are heated by their proximity to the heater 1340 such that the viscosity of a thermoviscous precursor liquid is reduced sufficiently to allow for a flow through the lower channels 1316. In an embodiment, the flow through lower channels 1316 when the device is active is a metered flow of 2 uL and/or 2 mg per second. In an embodiment, the flow of precursor liquid through the lower channels 1316 is mediated at least in part by the proximity of the lower channels 1316 to the air inlets such that the flow rate and velocity of the intake airflow in the chamber 1330 entrains at least partially the flow of liquid precursor from lower channels 1316 such that a higher intake airflow results in a higher flow rate of precursor liquid into chamber 1330.

Secondary reservoirs 1312 may be positioned between upper channels 1310 and lower channels 1316 and be configured to contain a volume of a liquid precursor. Secondary reservoirs 1312 may supply liquid precursor to chamber 1330 via lower channels 1316. In some embodiments, secondary reservoirs 1312 may be configured to function as a hydrostatic plug to prevent a continuous flow of a liquid precursor from reservoir 1302 to chamber 1330. When secondary reservoirs 1312 are filled, they may prevent a continuous flow of precursor into chamber 1330 until a volume within chamber 1330 is reduced through vaporization.

In operation, upper channels 1310, secondary reservoirs 1312, lower channels 1316, and chamber 1330 may contain a precursor having a relatively high viscosity at ambient temperatures. This high viscosity may assist in establishing a hydrostatic barrier that prevents unintended overflow of precursor into the chamber. Upon activation of heater 1340, a portion of precursor within chamber 1330 may be vaporized, thereby reducing the total volume of precursor present and lowering the viscosity of precursor retained in lower channels 1316 and secondary reservoirs 1312. This reduction in viscosity and volume may facilitate the controlled flow of precursor into chamber 1330. In addition, chamber 1330 may be placed under a vacuum pressure during activation that functions in conjunction with the displacement of precursor liquid volume due to vaporization and/or aerosol formation that serves to facilitate the flow of precursor liquid from reservoirs 1302 to upper channels 1310 to the secondary reservoirs 1312 and lower channels 1316. In an embodiment the vacuum pressure exerted on the chamber during activation by the inhalation of the user is 300-600 pascals.

In an embodiment, secondary reservoirs 1312 may include sufficient volume to support several activation cycles, or inhalations, or "puffs" worth of liquid precursor. Secondary reservoirs 1312 may help vaporizers achieve orientation independence by ensuring that a reserve of liquid precursor remains available for delivery to chamber 1330 regardless of the device's spatial orientation. For instance, the device may be carried or stored upside down and still be ready for use.

FIG. 13C is an isometric view of heater assembly for a vaporizing device. Heater 1340 may be in communication with electrical contacts 1350. Electrical contacts 1350 may serve as a visual reference to divide heater 1340 into different regions. Resistive region 1342 may be located in the center of heater 1340 in this embodiment and be configured to convert electrical current into heat to vaporize a liquid precursor contained within chamber 1330. Heat may transfer via conduction from resistive region 1342 through contact regions 1344 to residual regions 1346 at either end of heater 1340. Contact regions 1344 may be coupled to electrical contacts 1350 so that they may supply electrical energy to be converted to heat by resistive region 1342. Electrical contacts 1350 may be constructed of a thermally conductive material and act as heat sinks for heater 1340 and some thermal energy generated by resistive region 1342 may be absorbed and drawn away from heater 1340 by electrical contacts 1350 which may function to decrease the amount of time it takes for the resistive region 1342 to cool down after activation. Electrical contacts 1350 may couple to a printed circuit board, wiring, or some form of electronic controller, thereby increasing the effective thermal mass that may enable additional heat transfer to the associated components. The use of electrical contacts 1350 as heat sinks may be particularly advantageous in cartridge or cartomizer style embodiments, where on-board thermal mass may be relatively limited and may be supplemented when the cartridge is mated with a base unit. Remaining thermal energy may transfer past conductive regions 1344 to residual regions 1346.

Heater 1340 may be located such that resistive region 1342 is in close proximity to chamber 1330 to supply heat for vaporization, conductive regions 1344 are in close proximity to lower channels 1316, and residual regions 1346 are in close proximity to secondary reservoirs 1312. In operation, the viscosity of a liquid contained by secondary reservoirs 1312 may be adjusted by the application of heat from residual regions 1346. The liquid precursor may be brought closer to its vaporization temperature in preparation for vaporization as the liquid passes through lower channels 1316. Finally, vaporization of the precursor within chamber 1330 may mobilize mass out of the system and allow more precursor liquid to flow into chamber 1330.

The ability to heat various components comprising dispenser 1300, such as upper channels 1310, secondary reservoirs 1312, and lower channels 1316, may be particularly advantageous for use with precursors containing cannabinoids. Cannabinoid precursors may have relatively high viscosities, sometimes appearing solid at room temperatures.

The previous embodiment described a dispenser system for a vaporizing device including secondary reservoirs and channels to regulate a flow of liquid precursor into a vaporization chamber. The precursor held by the secondary reservoirs may facilitate continuous delivery to the chamber regardless of the orientation of the device. Some embodiments may include secondary reservoirs and channels having alternative geometries.

Figure 14B:
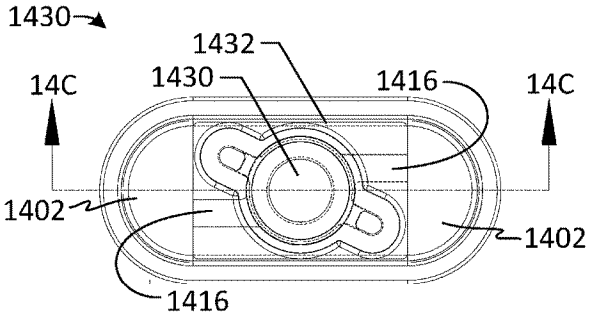
FIG. 14B illustrates a top view of a dispenser for a vaporizing device.
Figure 14C:
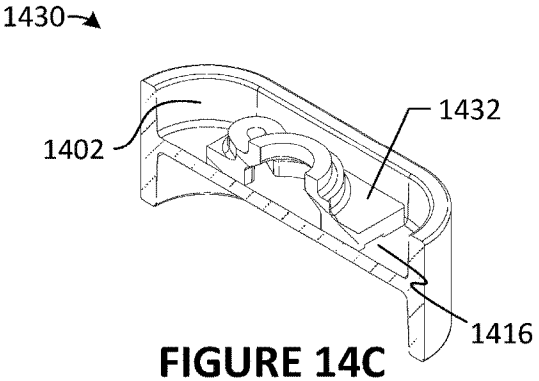
FIG. 14C illustrates a cross section of a chamber assembly.
Figure 14D:
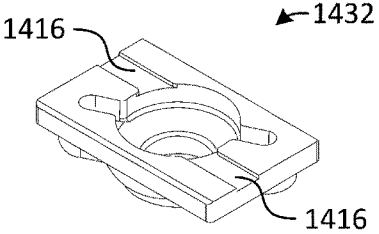
FIG. 14D illustrates an isometric view of the bottom of an upper chamber including portions of a dispenser for a vaporizing device.
Figure 14A:
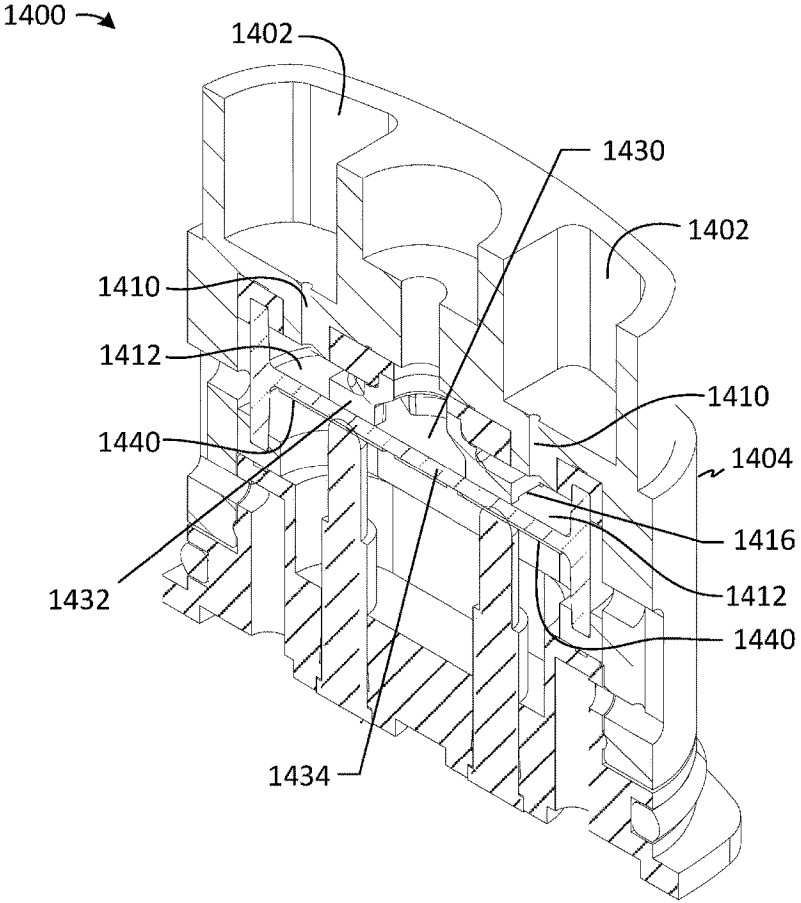
FIG. 14A illustrates a cross section of a dispenser for a vaporizing device.

FIG. 14A illustrates a cross section of a dispenser for a vaporizing device. FIG. 14B is a top view of a dispenser for a vaporizing device. FIG. 14C is a cross section of a chamber assembly and FIG. 14D is a bottom isometric view of an upper chamber including portions of a dispenser for a vaporizing device. Dispenser 1400 may be connected to a larger reservoir such as reservoir 901 as described previously for vaporizer 902 and illustrated in FIG. 9, and may incorporate an upper seal such as upper seal 1001 to create a liquid tight seal between dispenser 1400 and a reservoir such as reservoir 901.

Upper chassis 1404 may be configured similarly to upper chassis 1304 and may include the integration of upper channels 1410; however, alternative features or operational methods may also be incorporated. Depending on the embodiment, upper channels 1410 may or may not utilize capillary action. Upper channels 1410 may be positioned between reservoir 1402 and secondary reservoir 1412 and configured to regulate a flow of liquid precursor.

Secondary reservoir 1412 may comprise a volume at least partially surrounding chamber 1430. Secondary reservoir 1412 may have a greater volume than the previously described secondary reservoirs. This increased volume may provide added thermal mass, which could allow for more precise control over heating and reduce the likelihood of the precursor overheating. Overheating a precursor composition may reduce the viscosity beyond optimal levels, leading to accelerated flow into chamber 1430. Ideally, viscosity is temporarily reduced during heater 1440 activation and rapidly returned to ambient levels, with the thermal mass of secondary reservoir 1412 assisting the transition. The larger reservoir volume may allow for multiple activation cycles, inhalations, or "puffs", to be supplied from reserve volume present in secondary reservoir 1412.

Secondary reservoir 1412 may surround chamber 1430. In addition to being an efficient means for storing a volume of fluid, configuring secondary reservoir 1412 to surround chamber 1430 may enhance the orientation independence of a vaporizing device. Such a configuration may maintain consistent precursor supply to chamber 1430 across a broad range of device orientations, which may be advantageous as users frequently operate vaporizers at non-vertical angles.

Dispenser 1400 may incorporate multiple lower channels 1416 to supply precursor to chamber 1430. In this embodiment, lower channels 1416 may be integrated into chamber top 1432 and offset from one another. By distributing these channels at different positions, the device may facilitate the supply of liquid precursor to chamber 1430 irrespective of the vaporizer's orientation. For instance, when the device is rotated or tilted, at least one of the offset lower channels 1416 is likely to remain in contact with the liquid precursor within secondary reservoir 1412, thereby sustaining precursor delivery to chamber 1430. Additionally, the relatively short height of lower channels 1416 may help limit the total volume of precursor within the channels, thus enabling rapid viscosity changes and further controlling the flow of precursor into chamber 1430. In an embodiment, the chamber 1430 and the chamber top 1432 are constructed from fused silica.

Surrounding a vaporization chamber with a liquid precursor may be one method to help achieve orientation independence of a vaporizing device; however, there are other configurations that may help to achieve orientation independence. For example, precursor supply channels and secondary reservoirs may be reoriented to help maintain orientation independence.

Figures 15A, 15B, 15C:
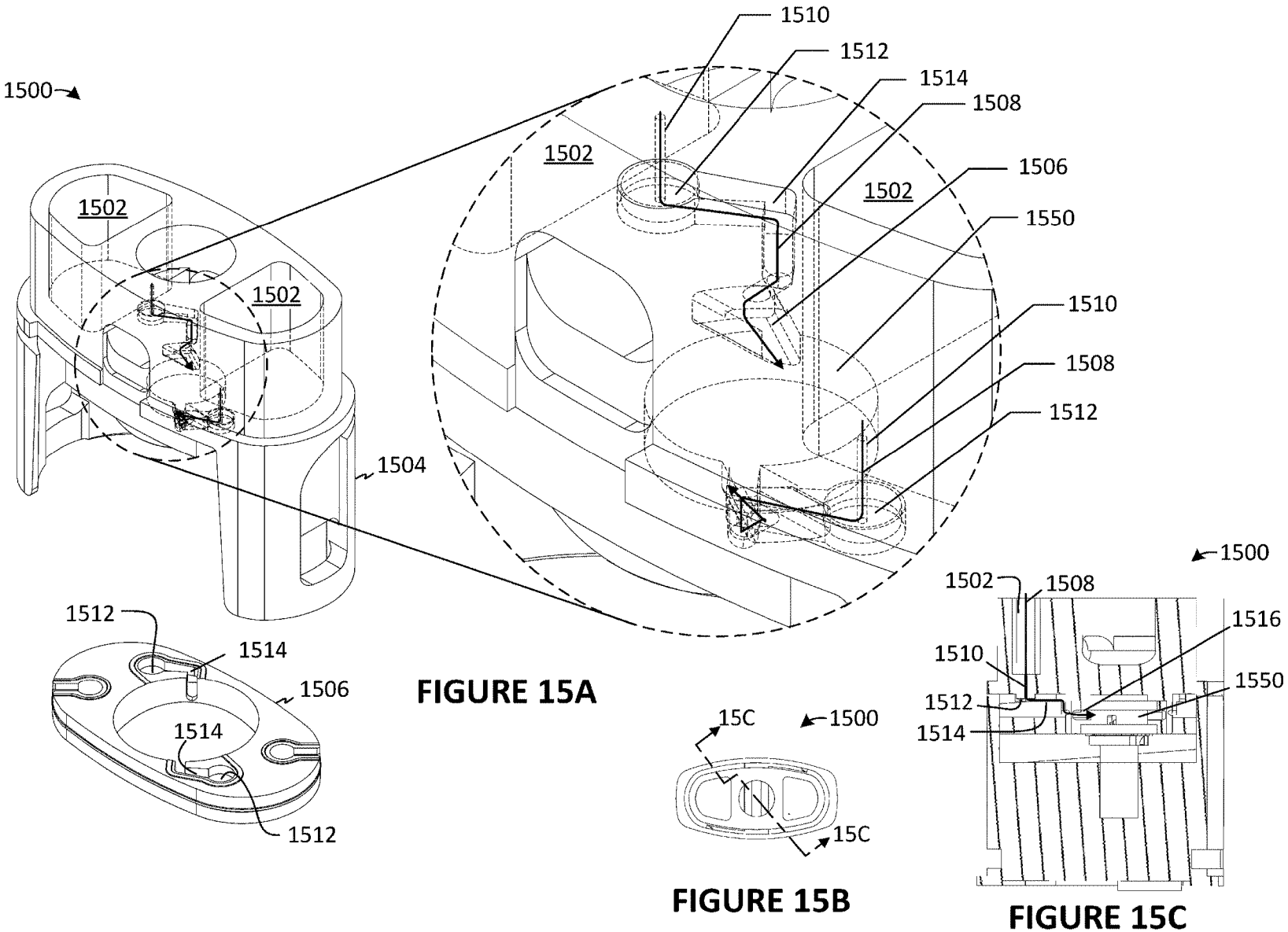
FIG. 15A illustrates a detailed isometric view of a dispenser.
FIG. 15B illustrates a top view of a dispenser.
FIG. 15C illustrates a cross section of a dispenser.

FIGS. 15A though 15C illustrate a dispenser for a vaporizing device. FIG. 15A provides a detailed isometric view of dispenser 1500. FIG. 15B presents a top view of dispenser 1500. FIG. 15C shows a cross-section of dispenser 1500. Dispenser 1500 may be configured to regulate a flow of precursor 1508 from reservoir 1502 to chamber 1550. Dispenser 1500 may be integrated into, or comprised of, other parts or subassemblies of a vaporizing device. In this example, portions of dispenser 1500 are integrated into upper chassis 1504, precursor inlet seal 1506, and chamber 1550. Additional examples of embodiments containing dispenser 1500 can be used in the embodiments described herein.

Dispenser 1500 may comprise one or more orifices 1510 configured to transfer precursor 1508 from reservoir 1502 to chamber 1550. The internal diameter of orifices 1510 may be sufficiently small to regulate liquid flow, though the precise number, size, and arrangement of orifices 1510 could be governed by the desired delivery rate.

Dispenser 1500 may or may not utilize capillary action to regulate a flow of precursor 1508 from reservoir 1502. Capillary action is often thought of as the ability of a liquid to flow through narrow spaces, like thin tubes or porous materials, without the assistance of external forces (like gravity) due to the interplay of cohesion, adhesion, and surface tension, but these same principles can also act as resistance forces in certain configurations, effectively slowing the flow of a fluid. In very narrow tubes, the surfaced-to-volume ratio may be high, and cohesive forces may dominate. This means that the viscous drag from the tube walls becomes significant and the fluid must "pull itself" through, which takes energy. The net effect is that fluids may have a slower flow rate through narrower tubes than in wider tubes, even under the same pressure.

In some embodiments, dispenser 1500 may not rely on capillary action. When the radius of orifices 1510 becomes large enough capillary effects (i.e., surface tension and adhesion) become negligible and gravitational or pressure forces dominate. Pressures higher than atmospheric levels may exist within reservoir 1502. This pressure, acting in conjunction with gravity, may draw precursor 1508 through orifices 1510. Precursor 1508 may stop advancing when it reaches the end of orifices 1510 in embodiments configured to take advantage of the capillary effect but when the radius becomes large enough and the capillary effect gives way to pressure and gravity, precursor 1508 may continuously flow from orifices 1510. In some embodiments, the pressure inside reservoir 1502 may be intentionally increased by heating reservoir 1502, where the air present in reservoir 1502 expands in response to the increase in temperature, and the pressure exerted on the liquid precursor present in the reservoir 1502 causes the flow of the precursor 1508 through orifices 1510. The volume of precursor 1508 contained in the volumetric space defined by the secondary reservoir 1512, upper channel 1514, and lower channel 1516 allows for a reserve of precursor 1508 to be available to transfer to the chamber 1550 that is resistant to orientation of the device during activation, for example the precursor 1508 is effectively contained in this region(s) due to the tortuous nature of the structure it will not readily flow back to reservoir 1502.

In some embodiments, secondary reservoir 1512 may be configured to act as a hydrostatic plug to prevent a continuous flow of precursor 1508 from reservoir 1502. When secondary reservoirs 1512 are filled with precursor 1508, it may prevent the continuous flow of the precursor until a volume contained by secondary reservoirs 1512 is reduced through vaporization within chamber 1550. Some examples of vaporizing devices presented herein may utilize residual heat from a heater to reduce the viscosity of precursor 1508 contained by secondary reservoirs 1512 to enhance flow.

Liquid precursor 1508, upon exiting orifices 1510, may collect within secondary reservoirs 1512 before passing sequentially through upper channels 1514 and lower channels 1516, which may direct, meter, or precondition the fluid, for example by preheating the fluid, as it advances into chamber 1550 for vaporization. The integration of precursor inlet seal 1506 may further serve to inhibit leakage or cross-contamination and/or fluidic communication between adjacent regions.

Dispenser 1500 thus provides flexibility in fluid delivery, allowing for both capillary-driven and non-capillary-driven embodiments. This may ensure compatibility with various liquid precursors, precursors that may be solid or semi-solid at ambient temperatures, and operational requirements, while enabling further optimization of device reliability, efficiency, and user experience.

It may be desirable for some examples of detachable cartridges to include one or more valves to prevent a liquid precursor from leaking from a reservoir when it is not coupled to a base unit.

Figure 16:
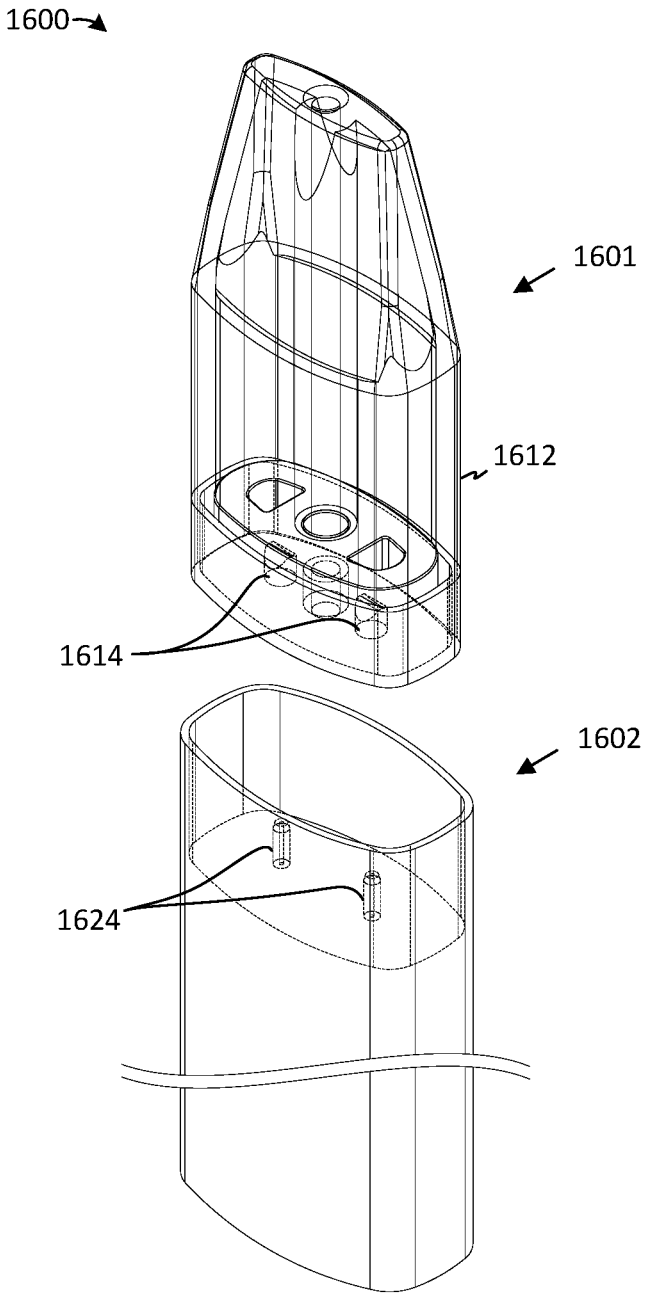
FIG. 16 illustrates a vaporizing device including a valve mechanism for a detachable cartridge.

FIG. 16 illustrates a vaporizing device including a valve mechanism for a detachable cartridge. Vaporizing device 1600 may comprise cartridge 1601 and base unit 1602. Cartridge 1601 may include one or more valves 1614 configured to prevent a liquid precursor from escaping reservoir 1612 when cartridge 1601 is not coupled to base unit 1602. In FIG. 16, valves 1614 may comprise duck bill valves; however, many different types of valves or seals may be employed to prevent a liquid precursor from escaping reservoir 1612 when it is not coupled to base unit 1602.

Base unit 1602 may include one or more valve actuators 1624 to actuate valves 1614 when cartridge 1601 is coupled to base unit 1602. In this example, valve actuators 1624 may comprise one or more tubes configured to open and mate with one or more valves 1614. Valve actuators 1624 may each include an inner diameter configured to take advantage of capillary action or the viscosity of a liquid precursor to control the flow rate from reservoir 1612 to base unit 1602. Valve actuators 1624 may be heated either directly or indirectly to facilitate the flow of a thermoviscous precursor.

Vaporizing devices may utilize a variety of chamber designs to convert a liquid precursor into a vapor or aerosol. Chamber assemblies may be configured to receive a liquid precursor and convert the liquid precursor to a vapor using heat. Vapor may be mixed with air to form an aerosol prior to delivery to a user. Vapor may be mixed with air either inside or outside of a chamber assembly to generate an aerosol. A variety of chamber assemblies will be discussed herein.

Figure 17C:
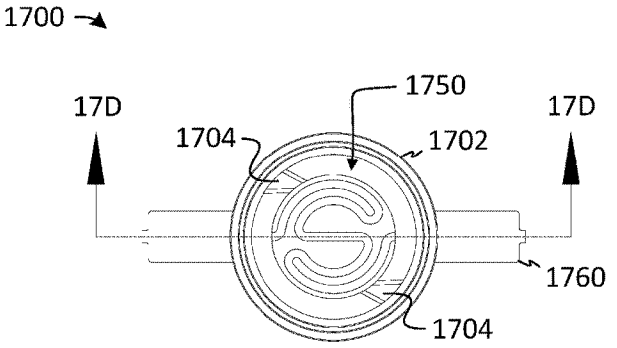
FIG. 17C illustrates a top view of a chamber assembly.
Figure 17D:
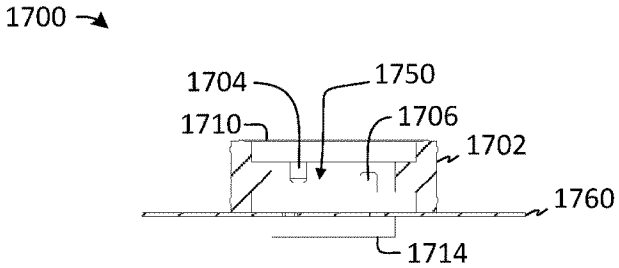
FIG. 17D illustrates a cross section of a chamber assembly.
Figure 17A:
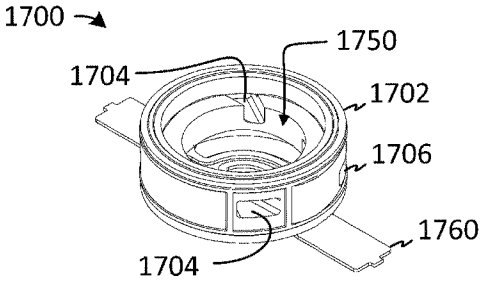
FIG. 17A illustrates an isometric view of a chamber assembly.
Figure 17B:
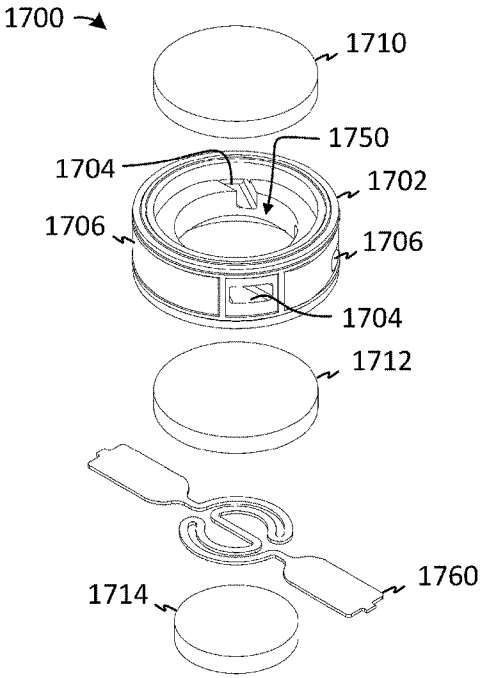
FIG. 17B illustrates an exploded view of a chamber assembly.

FIGS. 17A through 17D illustrate a chamber assembly for a vaporizing device. FIG. 17A is an isometric view of chamber assembly 1700. FIG. 17B is an exploded view of chamber assembly 1700. FIG. 17C is a top view of chamber assembly 1700. FIG. 17D is a cross-section of chamber assembly 1700. Chamber assembly 1700 may comprise chamber seal 1702, chamber top 1710, chamber bottom 1712, heater 1760, and support 1714. The combination of chamber seal 1702, chamber top 1710, and chamber bottom 1712 may define a volume referred to as chamber 1750.

Chamber seal 1702 may define an outer perimeter of chamber 1750. In certain embodiments, chamber seal 1702 may also define the depth of chamber 1750, facilitate the transfer of a liquid precursor to chamber 1750 via lower channels 1704, and deliver vapor generated within chamber 1750 via vapor port 1706. In some embodiments, chamber seal 1702 may provide a seal against a frame or chassis of a vaporizing device, such as upper chassis 1002, 1404. Chamber seal 1702 may be manufactured from a compliant material in order to create an effective seal under varying conditions. Because chamber seal 1702, and the components comprising it, may be subjected to temperature variations and exposure to liquid precursors, materials such as silicone or functionally equivalent materials may be desirable.

Chamber top 1710 and chamber bottom 1712 may define the upper and lower boundaries of chamber 1750. In some embodiments, chamber top 1710 and chamber bottom 1712 may be essentially identical. Chamber 1750 may take on a variety of geometric shapes to suit different design considerations, and chamber top 1710 and chamber bottom 1712 may be adapted accordingly. Cylindrical shapes for chamber top 1710 and chamber bottom 1712, as illustrated, may be efficiently manufactured.

Several factors may be considered when designing chamber bottom 1712. If a resistive heating element is used to heat chamber 1750, chamber bottom 1712 may be in direct contact with heater 1760 for efficient conductive heat transfer. Inorganic nonmetallic materials such as ceramics and/or glass can be used to construct chamber bottom 1712. Examples of appropriate ceramics include but are not limited to Macor®, Shapal™ alumina, aluminum nitride, boron carbide, carbon/graphite, magnesia, polycrystalline YAG, silicon, silicon carbide, silicon nitride, titanate, tungsten carbide, yttria, and zirconia, the ceramics and inorganic non-metallic material may be used individually or in combination to construct chamber bottom 1712. Examples of appropriate types of glass for the construction of chamber bottom 1712 include, but are not limited to, borosilicate glass and the borosilicate family of glasses, with common types including borosilicate 3.3 (like Duran® and Corning® 3.3), Corning® 51-V (clear), Corning® 51-L (amber), and Borofloat®. Other examples of borosilicate types include Pyrex®, Simax®, Suprax®, and Kimax®, often sold under various brand names. Another family of glass that would be appropriate for the construction of chamber bottom 1712 are silica-based glasses, commonly referred to as fused silica, including but not limited to, basic fused silica, also known as fused quartz, made from silicon dioxide ($SiO_2$). Fused silica is available in various types, each with slightly different properties, including Corning® HPFS grades, Heraeus SUPRASIL® grades, and Ohara SK grades. These can be further categorized based on production method and purity levels, such as Type I, II, III, and IV fused quartz. The ceramic or glass material used in the construction may be chosen for the material's resistance to thermal shock and or having a low coefficient of thermal expansion, and or for the thermal conductivity of the material.

In an embodiment, a glass or ceramic material with high thermal conductivity may be used to construct chamber bottom 1712 so that chamber bottom 1712 is heated rapidly by being in direct contact with heater 1760. In another embodiment, a glass or ceramic material with low thermal conductivity may be used to construct chamber bottom 1712 in order to isolate the transfer heat from heater 1760 to chamber bottom 1712 and mitigate radiant heat transfer from chamber bottom 1712 to the other components of chamber assembly 1700.

While metals are good thermal conductors, their electrical conductivity may introduce the risk of short-circuiting a resistive heating element such that if a bare metal is used to construct chamber bottom 1712 the heater 1760 must be positioned in proximity to the metallic chamber bottom 1712 but not in direct contact with chamber bottom 1712, in such embodiments, the metallic chamber bottom 1712 is heated by heater 1760 by radiative heating rather than conductive heating. If metal is used to construct chamber bottom 1712 with the metal surface in direct contact with the heater, the surface of the metal chamber bottom 1712 in contact with heater 1760 may be constructed or treated with an additional material or process such that it is not electrically conductive.

Examples of how the surface of the metallic chamber bottom 1712 may be constructed, and/or treated to result in the surface of the chamber bottom 1712 being no longer electrically conductive include but are not limited to the use of ceramic coatings like aluminum oxide (alumina), zirconium oxide (zirconia), or chromium oxide. These materials offer excellent thermal resistance and electrical insulation, making them suitable for high-temperature applications. Other examples may include the combination of a thin layer of a metal or inorganic non-metallic material such as those described previously and subsequently with a specialized high-temperature polymers such as silicones, fluoropolymers (like PTFE), polyimides, and polybenzimidazoles (PBI), or inorganic ceramic coatings. Such ceramic coatings are inherently electrically non-conductive and can withstand very high temperatures and may be chosen for specific properties in addition to being electrically non-conductive. For example, zirconia offers superior thermal and mechanical properties, while alumina is known for its wear resistance and ability to prevent corrosion. Chromium oxide coatings are chemically inert and offer high mechanical strength and microhardness. Ceramic coatings may be applied to heater 1760 facing side of chamber bottom 1712 by various methods including, but not limited to, thermal spraying or plasma spraying. Another method that may be used to construct chamber bottom 1712 such that the heater 1760 facing side of the chamber bottom 1712 is electrically non-conducting is the formation of a non-electrically conductive and or dielectric oxide layer bound to the metal surface of chamber bottom 1712.

Various methods can be employed to create an electrically non-conductive oxide surface on metal, including, but not limited to, anodization processes where the chamber bottom 1712 is constructed by: using aluminum, titanium, or magnesium for the chamber bottom 1712 component, and then immersing the metal in an acidic electrolyte bath and applying an electric current, causing oxygen ions to combine with metal atoms at the surface, thereby creating a protective oxide layer. Anodization of the chamber bottom 1712 may also have additional benefits such as enhancing the corrosion resistance, and wear resistance, in addition to the electrical insulation. Various types of anodization may be used to construct chamber bottom 1712, including but not limited to chromic acid anodizing (Type 1) in order to produce a thin, non-conductive layer with good corrosion resistance on the surface of a chamber bottom 1712. Sulfuric acid anodizing (Type 2), could be used if a thicker layer oxide is desired. Hard anodizing (Type 3) may be used which yields a very hard, abrasion-resistant, and non-conductive coating which may be desirable for improving the durability and life-cycle of chamber bottom 1712.

Another method for constructing a chamber bottom 1712 with an oxide layer that is non-conductive is chemical vapor deposition (CVD). This process uses gaseous precursors that are introduced into a heated chamber, where they react and deposit a thin, durable oxide layer on the metal surface of chamber bottom 1712. CVD may be chosen as the method for constructing chamber bottom 1712 as CVD enables precise control over coating thickness and properties, and is suitable for a wider range of metals than traditional anodization process previously described.

Another method for constructing the oxide layer on chamber bottom 1712 is the plasma electrolytic oxidation (PEO) process. PEO is similar to anodizing, and could be used on a chamber bottom 1712 comprising aluminum, magnesium, and/or titanium, but uses higher potentials, generating plasma discharges that modify the oxide layer, creating a thick, dense, and hard ceramic-like coating. PEO may be chosen to construct chamber bottom 1712 for the enhanced wear resistance, corrosion resistance, thermal stability, and dielectric properties when compared to traditional anodization.

The surface of chamber bottom 1712 constructed from metal may also be constructed to be non-conductive using a sol-gel method. This process involves applying a solution (sol) containing metal alkoxide precursors to the metal surface, which then undergoes gelation, drying, and heat treatment to form a metal oxide film. The sol-gel process may be chosen for the construction of a metal chamber bottom 1712 that has at least the surface in contact with heater 1760 being non-conductive to electricity as the sol-gel process is more environmentally friendly, requires comparatively low processing temperatures, and has the ability to coat complex shapes.

Another method that can be used to construct chamber bottom 1712 that does not require additional compounds or chemicals to form at least one non-conductive surface of chamber bottom 1712 is thermal oxidation, where simply subjecting the metal chamber bottom 1712 to high temperatures in the presence of oxygen to form a natural oxide layer on at least the surface of chamber bottom 1712 in contact with heater 1760. Another option for the formation of a non-conductive oxide layer on at least one surface of heater 1760 bottom is conversion coating, where the oxide layer is where the process is one of chemically forming a protective layer on the metal surface of chamber bottom 1712 through a reaction with specific chemical solutions. The surface of a metal chamber bottom 1712 may be oxidized using electrolytic deposition, where the chamber bottom 1712 is subjected to an electric current in order to induce the reduction of metal ions, forming a metal oxide coating. Another method of applying an oxide layer to chamber bottom 1712 is physical vapor deposition (PVD), where the vaporizing of metal oxides and depositing them as thin films on at least one surface of chamber bottom 1712 which functions as the substrate.

It may be desirable to construct the chamber bottom 1712 using one or more of the aforementioned methods such that the chamber bottom has a different surface as it relates to the coating and or oxide layer that is on the surface or face of chamber bottom 1712 that is in direct contact with the heater 1760 when compared to the surface of the chamber bottom 1712 that is in direct contact with the chamber 1750. The specific form and functionality of the method and process chosen to construct the chamber bottom 1712 out of metal and to have at least one surface of the chamber bottom 1712 non-conductive such that it may be in direct physical contact with the heater 1760 without shorting out heater 1760 while allowing the chamber bottom 1712 be heated by being in direct contact with heater 1760 may be determined by a variety of factors, including but not limited to design requirements, material selection, manufacturing methods, and economic considerations.

Resistive heating elements manufactured from nichrome (NiCr) or Kanthal® (FeCrAl) may be heated to approximately 200 °C to 300 °C (392 °F to 572 °F) during normal operation, and are capable of reaching temperatures exceeding 1,000 °C (2,192 °F). Therefore, it may be desirable to manufacture chamber bottom 1712 from a material that possesses good thermal conductivity, is not electrically conductive, and can withstand temperatures exceeding 300 °C (572 °F).

In some embodiments, heater 1760 may comprise a diode laser or a bulb (e.g., halogen or xenon) to heat chamber 1750 using radiation. In such cases, chamber bottom 1712 may be manufactured from a material that is transparent to the frequency band of the radiation utilized. In other embodiments where heater 1760 may comprise an induction heater, it may be desirable to manufacture chamber bottom 1712 from thermally conductive materials that are also inductive and/or ferritic materials.

Some examples of heater 1760 may expand and sag as they heat. Chamber assembly 1700 may include support 1714 to help maintain contact between heater 1760 and chamber bottom 1712. Support 1714 may include geometry configured to accommodate different shapes and styles of heater 1760, in addition to different variants of chamber assembly 1700. Because support 1714 may be subjected to high temperatures due to proximity to or contact with heater 1760, it may be desirable to manufacture support 1714 form a material that is not electrically conductive, particularly if heater 1760 is a resistive heating element. Support 1714 may be constructed in a similar fashion as the chamber bottom 1712 in regards to material selection and surface preparations. The material options and methods and processes described as being applicable to the construction of chamber bottom 1712 are also applicable to support 1714. Support 1714 may be constructed to such that the material used is not absorptive or transmissive to infrared (IR) radiation and functions to reflect infrared radiation being emitted from the heater 1760. Support 1714 may be constructed such that the material used is not absorptive or transmissive to ultraviolet radiation and functions to reflect ultraviolet radiation being emitted from the heater 1760. In an embodiment where support 1714 serves as a mechanical support for heater 1760 and also as a reflector to IR and/or UV radiation, the support may be constructed of a glass such as borosilicate or fused silica ($SiO_2$) such that the surface of the support 1714 in direct contact with heater 1760 is transmissive to IR and/or UV radiation and the surface of support 1714 that is not in direct contact with heater 1760 is constructed to be reflective to IR and/or UV radiation. In such embodiments, various methods could be employed to construct support 1714 such that the surface is not in direct contact with heater 1760 is reflective to IR and/or UV, for example, by coating and/or bonding and/or depositing on to the surface that is to function as a reflector a layer of metal that is reflective of IR and/or UV radiation. Suitable metals for this application include, but are not limited to, aluminum, gold, silver, rhodium, and platinum.

Another method for constructing a support 1714 that is reflective to IR and/or UV radiation is by applying a reflective oxide layer to one or more surfaces of support 1714. Suitable oxides that exhibit IR reflect-ability include, but are not limited to, IR reflective oxide layers of $TiO_2$ and $SiO_2$ multilayers, where quarter-wave stacks of crystalline anatase-phase titanium dioxide ($TiO_2$) and amorphous silicon dioxide ($SiO_2$) are used to reflect near-IR wavelengths.

Indium tin oxide (ITO), where ITO films with high carrier concentration can strongly absorb IR-B (1400-3000 nm) radiation. When ITO is combined with silver (Ag), as in ITO/Ag/ITO (IAI) coatings, they achieve high reflection for near-IR radiation. Nanocrystalline metal oxides, where nanocrystalline cerium oxide ($CeO_2$) and titanium dioxide ($TiO_2$) show higher NIR reflectance compared to their macrocrystalline counterparts, especially in the 750-1300 nm range, making them suitable for use as NIR reflective pigments. Tantalum Oxide ($Ta_2O_{5-x}$), where an oxygen-deficient tantalum oxide can be used in multilayers with silicon dioxide ($SiO_2$) as IR-shielding coatings, particularly for IR-A (760-1400 nm) radiation. Suitable oxides that exhibit IR reflect-ability include but are not limited to, UV reflective oxide layers of magnesium oxide (MgO). This material has high UV reflectance and is even used as a UV reflectance standard. Barium Sulfate ($BaSO_4$) has high intrinsic reflectance in both UV and visible wavelengths, making it a frequently used pigment in UV-reflective coatings. Zinc oxide (ZnO) and titanium dioxide ($TiO_2$) could also be utilized at wavelengths above their semiconductor band gap absorption energy levels (long UVA and visible wavelengths). They act predominantly as reflectors. Zinc tin oxide (ZTO): $Zn_2SnO_4$ (ZTO) ternary metal oxide nanoparticles can exhibit higher reflectance in the UV, visible, and near-infrared (NIR) ranges compared to $TiO_2$ and ZnO nanoparticles. ZTO CANP (cubic aggregated nanoparticles) have high reflectance due to the faceted nature of its cubic structure.

For constructing support 1714 with reflectivity of both IR and UV, a multilayer structure of oxides may be used whereby different oxide layers, together with or without other metals, may be combined in multilayer structures to create a coating(s) that are highly reflective to both UV and IR. Such multi-layer oxide structures may be constructed to be transparent in the visible range. Transparency in the visible range may be of importance if it is desirable that the emissions from heater 1760 in the visible spectrum are used to indicate the activation state of the device to the user, such that the user can see a visible emission of light from heater 1760 when activated. Oxide layers either in mono-layer or multilayer structures can be further optimized to improve IR and/or UV reflectance by constructing the oxide layer or layers with specific particle size and morphology. Many oxide materials, particularly in nanoparticle form, reflectance properties may be significantly influenced by adjusting the particle size, shape, and aggregation, and these factors can be used in the formation and/or construction of the desired oxide layer or layers in order to achieve the desired performance of the layer or layers applied to support 1714.

Furthermore, the oxide layer or layers may be doped, where the process of doping introduces dopants into metal oxides to modulate their reflectivity in specific regions, such as near-infrared. A type of dopant that may be used to construct an oxide layer on support 1714 to improve the IR reflectance include, but are not limited to, aliovalent dopants that increase free carrier concentration, where doping with ions of different valence than the host material introduces free charge carriers, such as electrons or holes, into the oxide lattice. These free carriers interact with IR radiation, leading to an increase in reflectivity, particularly in the near-infrared (NIR) range. Examples of aliovalent dopants include, but are not limited to, cerium oxide ($CeO_2$) doped with terbium (Tb) as terbium doping enhances the band gap of cerium oxide, improving its reflective properties and achieving high near-infrared reflectance. Hafnium nitride (HfN) doped with Silver (Ag) can also be used as silver doping increases the plasma energy of HfN films, shifting the reflective cutoff wavelength and expanding the high-reflectivity region towards lower wavelengths. Zinc oxide (ZnO) doped with $Al^{3+}$ (AZO) is another option as aluminum doping increase in IR reflection. Yttria-stabilized zirconia (YSZ) doped with magnesium (MgO) is yet another method for increasing IR reflectance as magnesium doping in YSZ promotes oxygen vacancy formation, enhancing ionic conductivity and reducing infrared emissivity, thereby increasing reflectivity. Another oxide that can be doped to improve IR reflectance is cadmium oxide (CdO), which can be doped with various ions, for example, a dysprosium ion in its trivalent state ($Dy^{3+}$), or an indium ion in its trivalent state ($In^{3+}$), or an yttrium ion in its trivalent state ($Y^{3+}$), or a fluoride anion ($F^-$), these dopants may be incorporated substitutionally, increasing carrier density and leading to broad spectral tunability and low optical losses in the IR range.

In an embodiment the support 1714 may be used as an IR detector and/or sensor where the doping of the surface oxide layer and/or layers present on the support 1714 may be constructed to serve as an IR detector or sensor by choosing specific dopants including, but not limited to, localized Surface plasmon resonance (LSPR) type semiconductor nanocrystals that exhibit tunable LSPR in the IR region by controlling the size and doping content. Such that support 1714 functions as an IR photodetector and or IR sensor. Another method to dope the oxide such that support 1714 can also function as an IR detector or sensor are cation exchange reactions in the oxide layer, this approach allows for the introduction of p-type dopants, including, but not limited to, copper(I) ion ($Cu^+$), or a silver ion ($Ag^+$), into n-type metal-oxide nanocrystals, causing programmed LSPR redshifts due to dopant compensation.

In some embodiments, support 1714 may also function to insulate other components comprising a vaporizing device from heater 1760. Support 1714 may function as an insulator by reflecting heat towards chamber 1750 as described herein. Support 1714 may serve as an insulator by being constructed of a thermally insulative material which may include, but is not limited to, fibrous or porous material such as mineral wool, ceramic fiber, aerogel, and glass fibers/fiber glass. It may be desirable if heater 1760 is a resistive element to construct support 1714 from materials that are both non-thermally and non-electrically conductive. Such materials include, but are not limited to, alumina ($Al_2O_3$), boron nitride (BN), zirconium phosphate, and silica ($SiO_2$) ceramics.

Another option for the construction of a non-thermally and non-electrically conductive support 1714 is to use a ceramic matrix composites (CMCs) that combine ceramic fibers, for example silicon carbide, with a ceramic matrix such as silicon carbide in SiC/SiC. Types of CMCs that may be used to construct support 1714 include, but are not limited to, oxide/oxide, carbon/carbon, and non-oxide/non-oxide CMCs. Specific examples include Carbon/Silicon Carbide (C/SiC) and Silicon Carbide/Silicon Carbide (SiC/SiC). The oxide/oxide CMCs are composed of oxide ceramic fibers embedded in an oxide ceramic matrix. Examples of oxide-based CMCs include materials such as alumina and mullite, where both the fibers and matrix are composed of oxide ceramics. In contrast, carbon/carbon CMCs are constructed using carbon fibers embedded within a carbon matrix. Non-oxide/non-oxide CMCs are composed of non-oxide ceramic fibers and matrix materials, such as silicon carbide. C/SiC are carbon fibers reinforced with silicon carbide matrix.

In some embodiments, support 1714 may be constructed to be partially or completely thermally conductive such that heater 1760 must heat both the chamber bottom 1712 and, and to some degree the support 1714 when activated. This may be desirable to improve the uniformity of the heating of the chamber bottom 1712. The specific form and functionality of the method and process chosen to construct the support 1714 to function as either a thermal insulator, or electrical insulator, or both a thermal and electrical insulator that may be in direct contact with heater 1760 may be determined by a variety of factors, including, but not limited to, design requirements, material selection, manufacturing methods, and economic considerations.

In an embodiment, heater 1760 may be isolated from the precursor, aerosol, vapor, and/or intake air by chamber bottom. Thus, the precursor, aerosol, vapor, and/or intake air are not allowed to contact the compositions that make up heater 1760 (e.g., metals). This may serve to improve the user experience by not contaminating the precursor, aerosol, vapor, and/or intake air with the constituents (e.g., metals) that make up heater 1760. This configuration may serve to reduce the thermal degradation of the precursor fluid that results from the precursor liquid being in direct contact with the heater as is a common configuration in some vaporizers. Furthermore, the separation of the heater 1760 from the chamber 1750 by chamber bottom 1712 allows for more even and uniform heating of the precursor liquid in order to generate an aerosol and/or vapor that has a more uniform particle size and a lower number of constituents in the aerosol and/or vapor that are product of thermal degradation that result from uneven heating of the precursor liquid.

In an embodiment, one or more of chamber top 1710 and chamber bottom 1712 may be comprised of, or consist of, an inert and non-reactive material. One or more of chamber top 1710 and chamber bottom 1712 may be comprise, or consist of an inert and non-reactive material to help prevent reactions with the components of chamber assembly 1700 and the precursor, aerosol, vapor, and/or intake air from occurring at the high operating temperatures of chamber assembly 1700. For example, one or more of chamber top 1710 and chamber bottom 1712 may be glass, fused silica, borosilicate glass, and the like. Chamber top 1710 may be constructed using the same materials and methods as used to construct chamber bottom 1712 as have been described previously. Furthermore, chamber top may be constructed using any of the materials and methods used to construct support 1714 that have been described herein. For example, it may be desirable for chamber top 1710 to be reflective to IR radiation and/or UV radiation such that chamber top 1710 reflects thermal radiation and/or IR radiation and/or UV radiation emitted from heater 1760 back into chamber 1750. In some embodiments, chamber top 1710 may be constructed to be a partial reflector such that some of the thermal energy emitted from heater 1760 is absorbed such that chamber top 1710 is heated above ambient temperature to thermally modulate the flow of a thermoviscous precursor liquid through lower channels 1704. In such an embodiment, chamber top 1710 may be constructed such that when heater 1760 is activated, some of the thermal energy emitted passes through the chamber 1750 and through the precursor liquid contained therein and is partially reflected and partially absorbed by chamber top 1710, where the heating of chamber top 1710 to above ambient temperature may facilitate the flow of a thermoviscous precursor through lower channels 1704. In another embodiment, chamber top 1710 may be constructed of a material that can be manufactured to absorb specific types of radiation. For example, and as previously described, fused silica may be used to construct chamber top 1710 and be able to absorb IR radiation and or UV radiation. In an embodiment, chamber top 1710 may be constructed of fused silica that contains a sufficient amount of hydroxyl groups (OH), greater than 10 ppm, to be at least partially absorptive of infrared radiation emitted from heater 1760 during activation, to allow for heating of chamber top to temperatures sufficient to facilitate the flow of a thermoviscous precursor through lower channels 1704. In such an embodiment, the surface of chamber top 1710 that is not facing the chamber 1750 may be constructed to be reflective of thermal radiation, including IR radiation and/or UV radiation, by coating, depositing, or otherwise forming a layer of aluminum onto the fused silica chamber top 1710. In such an embodiment, a layer, and/or film, and/or coating that is reflective to thermal radiation, and/or infrared radiation, and/or UV radiation may be constructed using the methods and processes described herein for the construction of support 1714 and/or chamber bottom 1712.

The specific form and functionality of the method and process chosen to construct chamber top 1710 to function as either a thermal reflector, or be absorptive or partially absorptive to thermal radiation or both a reflector of IR radiation and/or UV radiation, and/or an absorber of IR and/or UV radiation, or a mixed absorber and reflector of IR radiation and/or UV radiation emitted from heater 1760 may be determined by a variety of factors, including, but not limited to, design requirements, material selection, manufacturing methods, and economic considerations.

Chamber assembly 1700 may serve as an illustrative example of a chamber assembly suitable for use in a vaporizing device. It should be appreciated, however, that numerous alternative embodiments could be conceived, and not all possible configurations are disclosed herein. The specific form and functionality of chamber assemblies may be determined by a variety of factors, including but not limited to design requirements, material selection, manufacturing methods, and economic considerations. Variations in materials and fabrication techniques may enable the inclusion of different features or adaptations within a chamber assembly. For instance, a chamber assembly might incorporate a flow director to induce rotational flow within the chamber, which could promote more efficient vaporization of a liquid precursor and yield a more consistent aerosol output. Other features may be introduced or omitted as dictated by the particular needs of a given application or manufacturing process.

Figure 18A:
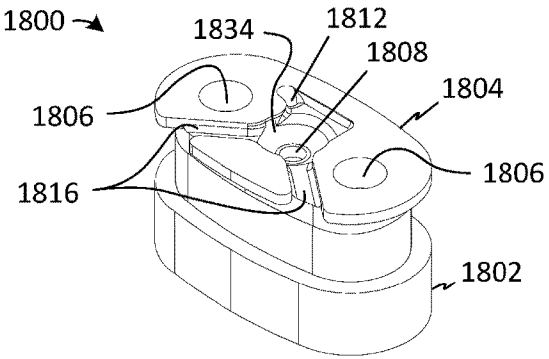
FIG. 18A illustrates an isometric view of a chamber assembly.
Figure 18C:
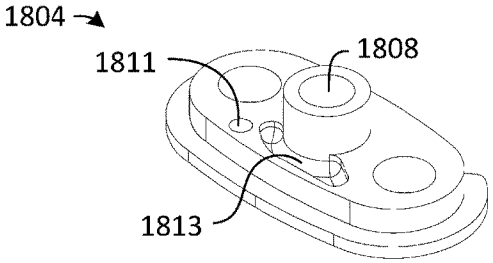
FIG. 18C illustrates an isometric view of the bottom of a flow director.
Figure 18D:
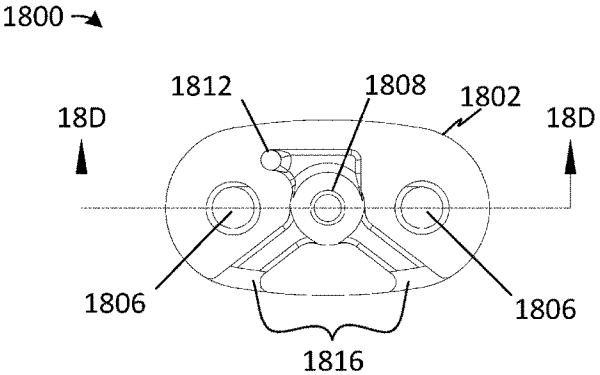
FIG. 18D illustrates a top view of a chamber assembly.
Figure 18B:
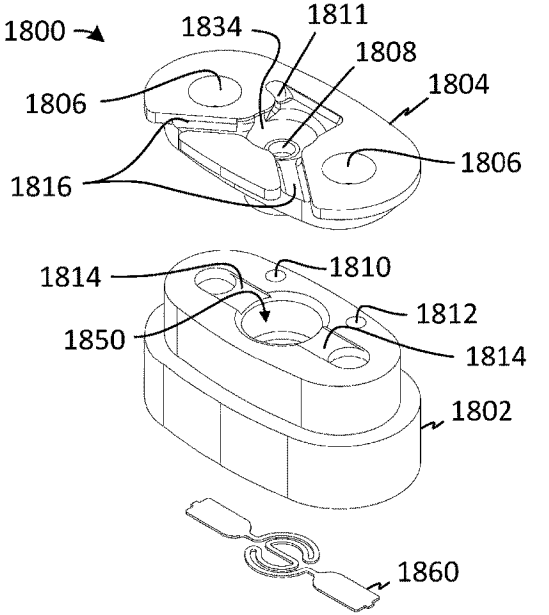
FIG. 18B illustrates an exploded view of a chamber assembly.
Figure 18E:
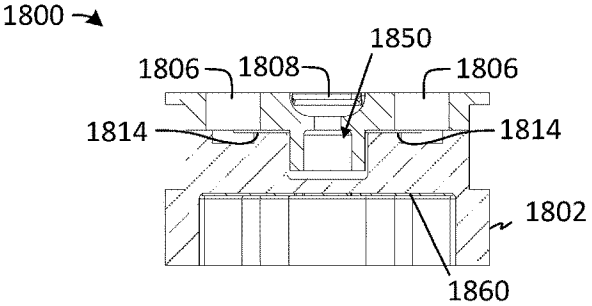
FIG. 18E illustrates a cross section of a chamber assembly.

FIGS. 18A through 18E illustrate a chamber assembly for a vaporizing device. FIG. 18A is an isometric view of chamber assembly 1800. FIG. 18B is an exploded view of chamber assembly 1800. FIG. 18C is an isometric view of the bottom of flow directors 1804. FIG. 18D is a top view of chamber assembly 1800. FIG. 18E is a cross-section of chamber assembly 1800. Chamber assembly 1800 may comprise housing 1802, flow directors 1804, and heater 1860.

Flow directors 1804 may be configured to direct flow paths of air, vapor, and aerosol. In some embodiments, flow directors 1804 may comprise a top surface of chamber 1850. Flow directors 1804 may include dispenser ports 1806 to allow for the transfer fluid into chamber assembly 1800. Aerosol port 1808 may be configured to transfer aerosol generated within chamber 1850 to depression 1834 to be combined with air before leaving chamber assembly 1800 via exit ports 1816. Flow directors 1804 may include flow path 1813 to induce a rotational flow to a stream of incoming air.

Housing 1802 may include passageway 1810. Passageway 1810 may be coupled to passageway 1811 of flow directors 1804 to transfer air from below chamber assembly 1800 to depression 1834, where the air may mix with an aerosol exiting chamber 1850 at aerosol port 1808. Passageway 1810 passes through the housing 1802 in such a way passageway 1810 is isolated from heater 1860 by a thin wall, where the exposure of the thin wall of passageway 1810 to heater 1860 located in housing 1802 allows for the airflow in passageway 1810 to be heated by the proximity to heater 1860 while not directly being in contact with heater 1860. The heating of the intake airflow traveling through the passageway 1810 may improve the efficiency of the aerosol and/or vapor being generated as the airflow does not cool down aerosol port 1808 and depression 1834 as much as it would if the airflow was at ambient temperature-thus reducing the amount of heat that would have to be provided by heater 1860 to overcome the cooling of aerosol port 1808 and depression 1834 from the intake airflow being at ambient temperature.

Increasing the temperature of the depression 1834 and aerosol port 1808 above the ambient temperature affects how quickly the precursor liquid reaches its boiling point by influencing the rate of vapor pressure increase. Additionally, heating of the intake airflow may serve to reduce the condensation and agglomeration of the small aerosol particles exiting the aerosol port 1808 into depression 1834 into larger particles that may occur when the aerosol is exposed to cooler air such as if the intake airflow was at ambient temperature. Additionally, the air flow from passageway 1810 to passageway 1811 and then to depression 1834 may serve to exert a vacuum pressure on the chamber 1850 via aerosol port 1808, where the vacuum pressure serves to reduce the boiling point temperature of the precursor liquid by lowering the vapor pressure of the precursor liquid in chamber 1850. The reduction of the vapor pressure in chamber 1850 serves to reduce the boiling point temperature of the precursor liquid by the application of a vacuum pressure on chamber 1850 may allow for the reduction in thermal energy and or heat required from heater 1860 to effect generating an aerosol and/or vapor from the precursor fluid. In an embodiment, the vacuum pressure exerted on the aerosol port 1808, passageway 1810, passageway 1811, passageway 1812, flow path 11, chamber 1850 and exit ports 1816 is 200-800 pascals.

Reducing the amount of thermal energy and/or heat required to transition the liquid precursor to an aerosol and/or vapor may allow for the aerosol and/or vapor to be generated at a lower temperature and may reduce the chances of overheating of the precursor, and subsequently reduce and/or mitigate the potential thermal degradation of the precursor liquid. In an embodiment, the vacuum pressure generated during inhalation and subsequent airflow through passageway 1810 to passageway 1811 and then to depression 1834 may exert a vacuum pressure on chamber 1850 via aerosol port 1808, for example in the range of 200-800 pascals. The relationship between the applied vacuum and the reduction in boiling point of the precursor liquid may be modeled using the Clausius-Clapeyron equation, which relates the vapor pressure and temperature at phase transition by:

$$\ln\ln\left(\frac{P_2}{P_1}\right) = -\frac{\Delta H_{vap}}{R}\left(\frac{1}{T_2} - \frac{1}{T_1}\right).$$

where $P_1$ and $T_1$ represent a reference vapor pressure and temperature pair, such as standard atmospheric pressure and the corresponding boiling point, and $P_2$ and $T_2$ represent the reduced vapor pressure in chamber 1850 and the corresponding new boiling point. By equipping the device to measure real-time airflow and thus infer vacuum conditions, the system may dynamically estimate the local boiling point of a precursor liquid. In certain embodiments, a control unit may utilize this inferred boiling point to adjust the heater 1860 output, modulating power to achieve sufficient vaporization while mitigating the risk of thermal degradation due to excessive temperatures. Depression 1834 may be a cutout in the top surface of flow directors 1804 configured to provide space for the mixing of air and aerosol and to accommodate a valve, which will be discussed in greater detail herein.

Housing 1802 may further include passageway 1812. Passageway 1812 may be coupled to flow path 1813 of flow directors 1804 to deliver a stream of air into chamber 1850. The architecture of flow path 1813 may be configured to impart a vortical rotational flow of air within chamber 1850. Passageway 1812 may be constructed in a similar fashion to the construction of passageway 1810 and the airflow transiting though passageway 1812 may be heated by the same process described for passageway 1810. The heating of the airflow transiting passageway 1812 may improve the efficiency of the aerosol and/or vapor being generated as the airflow does not cool down channels 1814 and chamber 1850 as much as it would if the airflow was at ambient temperature, thus reducing the amount of heat that would have to be provided by heater 1860 to overcome the cooling of the chamber 1850 by the intake of airflow at ambient temperature. The heating of the intake airflow transiting passageway 1812 may be important as the flow path 1813 directs the flow past channels 1814 and chamber 1850 where the precursor liquid is present. If the airflow was not heated it may serve to cool the precursor liquid and increase the viscosity of a thermoviscous precursor fluid which may reduce the desired flow and/or movement of the precursor, and by reducing the temperature of the precursor which would require additional thermal energy from heater 1860 to sufficiently heat the precursor liquid such that an aerosol and/or vapor was generated. The presence of a vortical or rotational flow path may enhance the mixing of air and vapor in chamber 1850, increase the dwell time of air and vapor, and facilitate selective removal of large particles (e.g., >5 microns) from the generated aerosol. In addition, a vortical or rotational flow within chamber 1850 may help thin or spread a liquid precursor over the heated base of chamber 1850 potentially leading to more efficient vaporization.

Flow path 1813 may be constructed such that the velocity of the airflow is increased as the airflow exits the flow path 1813 and enters into the radial space that is formed from the outer surface of the body that forms aerosol port 1808 and the wall of chamber 1850. Furthermore, the airflow from flow path 1813 sweeps across the channels at the point where precursor liquid exits channels 1814 and enters into the radial space that is formed from the outer surface of the body that forms the aerosol port 1808 and the wall of chamber 1850. This airflow from flow path 1813 may serve to modulate the flow rate of the precursor liquid exiting channels 1814 by at least partially entraining the flow of precursor liquid from channels 1814 such that there is a relationship where more airflow through flow path 1813 results in more flow of precursor liquid exiting channels 1814 into the chamber 1850. The interaction between air velocity and fluid entrainment may be characterized mathematically using Bernoulli's equation for incompressible flow:

$$P_1 + \frac{1}{2}\rho v_1^2 = P_2 + \frac{1}{2}\rho v_2^2$$

where $P_1$ and $v_1$ denote the static pressure and velocity within flow path 1813, and $P_2$, $v_2$ represent those in the radial space. As the cross-sectional area decreases, the continuity equation, $$A_1 v_1 = A_2 v_2$$

indicates that a reduction in area results in increased velocity ($v_2 > v_1$), which according to Bernoulli's principle yields a pressure drop ($P_2 < P_1$) in proximity to the opening of precursor channels 1814. This localized low-pressure region may draw precursor liquid into chamber 1850 at a rate that increases with airflow velocity. In some embodiments, monitoring or controlling the geometry of flow path 1813 and the magnitude of inlet airflow may provide a mechanism for dynamic adjustment of precursor liquid delivery, thereby enhancing atomization or vapor production as required.

In an embodiment, the inlet airflow through flow path 1813 may increase in velocity as it enters into the radial space that is formed from the outer surface of the body that forms aerosol port 1808 and the wall of chamber 1850. This increase in velocity creates a low-pressure region in proximity to the precursor liquid channels 1814 where the channel opens to the radial space that is formed from the outer surface of the body that forms the aerosol port 1808 and the wall of chamber 1850. The low-pressure air flow draws in the surrounding precursor liquid, increasing its mass flow rate and or its volume of flow into chamber 1850.

A vortical flow may exhibit higher flow velocities at larger radial distances within chamber 1850, as described by $$v = r\omega$$

where the linear (tangential) velocity may be directly proportional to the radial distance. Thus, lower velocities occur closer to the axis, while higher velocities occur farther out toward the circumference. This vortical flow may act as a particle size selector, since particles in rotational motion are subjected to centrifugal forces given by $$F = \frac{mv^2}{r}$$

where the force is directly proportional to the particle mass. Consequently, larger particles experience greater outward forces, which may increase their residence time within the rotational flow. The increase in transit time for the larger particles increases the larger particles' exposure to heater 1860 and allows for the larger particles to be thermally modulated to smaller particles that may be more ideal for a deposition aerosol intended for inhalation into the deep lung. Smaller particles may escape the rotational radial flow by moving to the axial center of the flow to be entrained in a flow of aerosol exiting chamber 1850 at aerosol port 1808.

In addition, a vortical flow established within chamber 1850 may promote spreading and thinning of a liquid precursor over the bottom surface of chamber 1850, thereby facilitating more uniform exposure of the precursor to the heating surface and potentially resulting in more consistent vaporization. Additionally, the vortical flow established within chamber 1850 may result in more even heat distribution to the precursor liquid as the precursor liquid is getting rotated or stirred within the chamber 1850 which may promote a more uniform heating that subsequently reduces the thermal degradation of the precursor liquid.

Housing 1802 may be configured to receive a liquid precursor and deliver it into chamber 1850 via channels 1814. Channels 1814 may be located above an end of heater 1860. Heater 1860 may be a resistive heating element. While the greatest concentration of heat generation occurs at the center of heater 1860 where current flow is the highest, the ends of heater 1860 may also warm due to thermal conduction. This residual heat may elevate the temperature of channels 1814 and a liquid precursor contained therein. By increasing the precursor temperature, the system may reduce the viscosity of the liquid precursor, thereby facilitating more efficient flow into chamber 1850. In an embodiment channels 1814 function as a thermally mediated valve(s) where flow of a thermoviscous precursor through channels 1814 does not occur at ambient temperatures due to the viscosity of the precursor and small cross-sectional area of the channels 1814, and that only with activation of heater 1860 and subsequent heating of channels 1814 is there flow of the precursor through the channels 1814 into the chamber 1850 due to the reduction in viscosity of the precursor when heated.

Some embodiments of chamber assembly 1800 may take advantage of the temperature-dependent viscosity of a liquid precursor to enhance device performance. For example, vaporizers may, in colder conditions, require a series of priming puffs to increase the temperature of a liquid precursor and sufficiently reduce its viscosity for reliable delivery to the chamber. The temperature of chamber assembly 1800 and a liquid precursor contained within it may be estimated by monitoring the resistance of heater 1860, even while the device is idle. A control system may be configured to periodically sample the chamber temperature and briefly activate heater 1860 to maintain an optimum chamber temperature. This approach may reduce or eliminate the need for priming puffs in cold weather, leading to improved consistency in aerosol formation, delivery, and user experience.

Housing 1802 may be configured to couple with heater 1860. Heater 1860 may comprise a resistive heating element positioned in thermal communication with housing 1802. The electrical and thermal characteristics of heater 1860 may be modulated by altering the geometry of the resistive element. For example, the electrical resistance of heater 1860 may be influenced by parameters such as the length, width, thickness, and patterning of the resistive material. Increasing the effective internal surface area of the heating element may decrease electrical resistance by providing multiple current paths or reducing the net path length for current flow. Conversely, increasing the length or reducing the cross-sectional area of the resistive path may increase electrical resistance, thereby affecting the rate of heat generation for a given applied voltage.

In addition, the physical arrangement, a spiral shape for example, of the resistive element may impact both the spatial distribution of heat and the response time of heater 1860. Different geometries may be selected to tailor heating performance to specific operational requirements, such as achieving rapid thermal equilibration, maintaining temperature uniformity, or localizing heat to targeted regions within housing 1802. The overall design of the resistive heating element may therefore be guided by considerations including desired resistance range, power requirements, efficiency of thermal transfer to adjacent components, and compatibility with the selected precursor and device architecture.

Alternative embodiments may employ other heating technologies, such as ceramic-based elements, inductive heating, or InfraRed (IR) and/or Ultraviolet (UV) heaters depending on the desired operational characteristics of the chamber assembly. Although this embodiment illustrates a resistive element it should be understood that any of the heating methods described herein may be applied to this embodiment.

Figure 19C:
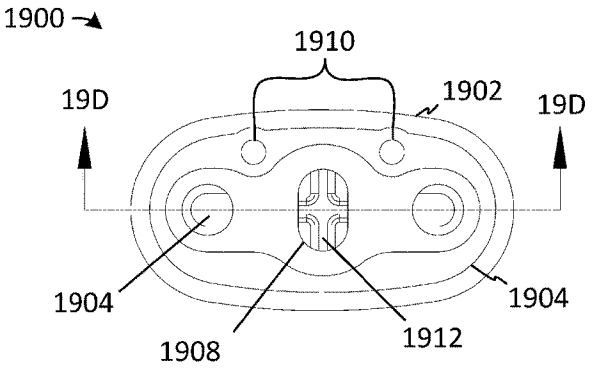
FIG. 19C illustrates a top view of a chamber assembly.
Figure 19D:
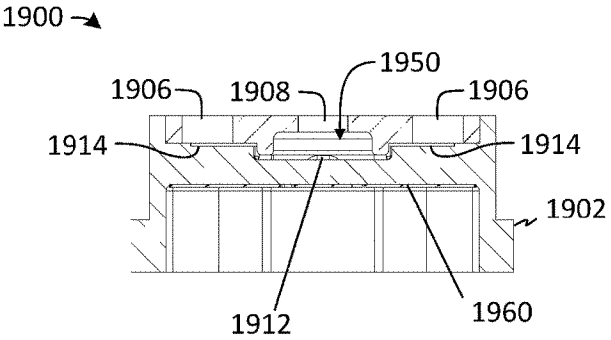
FIG. 19D illustrates a cross section of a chamber assembly.
Figure 19A:
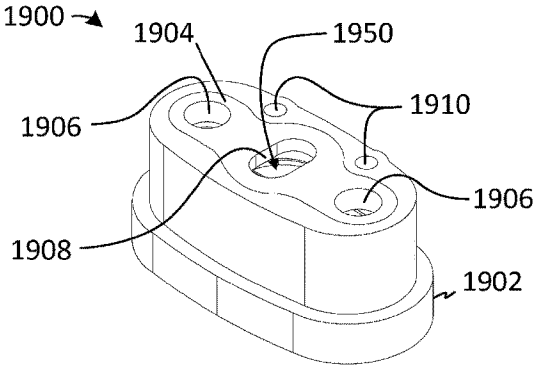
FIG. 19A illustrates an isometric view of a chamber assembly.
Figure 19B:
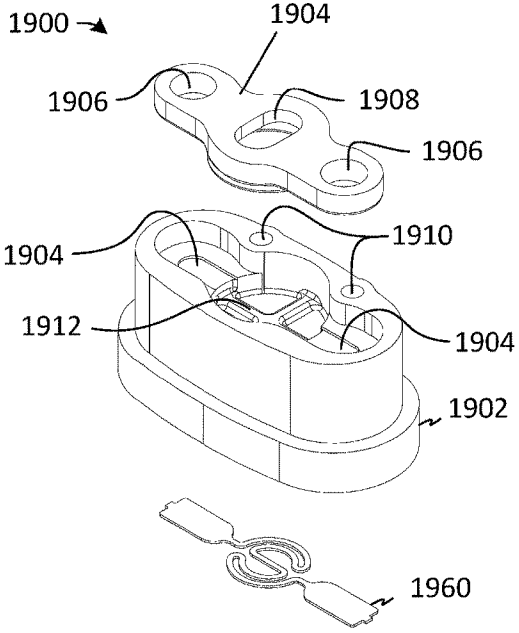
FIG. 19B illustrates an exploded view of a chamber assembly.

FIGS. 19A through 19D illustrate a chamber assembly for a vaporizing device. FIG. 19A provides an isometric view of chamber assembly 1900, FIG. 19B presents an exploded view, FIG. 19C shows a top view, and FIG. 19D depicts a cross-sectional view. Chamber assembly 1900 may comprise housing 1902, flow director 1904, and heater 1960. In the illustrated embodiment, housing 1902 and flow director 1904 together define a volume referred to as chamber 1950.

Flow director 1904 may be configured to couple with housing 1902, thereby forming an upper enclosure for chamber 1950. Flow director 1904 may include dispenser ports 1906 permitting the transfer of a liquid precursor into chamber 1950, as well as a vapor port 1908 configured to direct vapor generated within chamber 1950 toward an outlet. In some embodiments, flow director 1904 may further incorporate specific geometric features to modify the internal flow path of vapor or aerosol, for example by inducing rotational flow, promoting mixing, or facilitating the separation of larger aerosol particles from smaller aerosol particles, as well as features that may trap and/or return the larger aerosol particles back into chamber 1950.

Chamber housing 1902 may include passageways 1910 to allow intake air to be transferred from below chamber housing 1902 to above it. Passageways 1910 may be constructed to be in close proximity at one or more points to the region of housing 1902 that house heater 1960 such that passageways 1910 are heated and the intake airflow is heated in such a manner as described herein, for example, for passageways 1810 and 1812. However, in vaporizing devices configured to draw intake air from above chamber assembly 1900, or where air is delivered from lateral regions, passageways 1910 may be omitted as they are not required by those configurations.

Chamber housing 1902 may be configured to receive a liquid precursor and deliver it into chamber 1950 via channels 1914. These channels may be positioned to receive fluid that has passed through dispenser ports 1906. Channels 1914 may be located above the ends of heater 1960 to take advantage of residual heat, potentially reducing the viscosity of the precursor fluid and facilitating more efficient flow into chamber 1950. By leveraging temperature-dependent viscosity changes, chamber assembly 1900 may enhance precursor delivery and vaporization performance, in a manner similar to that previously described for channels 1814.

The bottom of chamber 1950 may further include ridges 1912 designed to increase the total surface area available for heat transfer to a liquid precursor. Such an arrangement may improve the efficiency of vaporization by maximizing the interface between the heated surface and the precursor fluid. While this may be the only embodiment of a chamber including ridges 1912, it should be understood that any embodiment of a chamber may include ridges 1912 or other such features that serve to increase the surface area of the heated region of chamber 1950. Although ridges 1912 are illustrated as being directly visible features it should be understood that microscopic features such as ridges or prominences in plurality and/or altering the surface characteristics of the material, for example, increasing the roughness of the surface, may be used to increase total effective surface area of the heated region of chamber 1950.

Heater 1960 may be implemented as a resistive heating element in thermal communication with the bottom of housing 1902. Alternative embodiments may employ other heating technologies, such as ceramic-based elements, inductive heating, or infrared (IR) and/or ultraviolet (UV) heaters depending on the desired operational characteristics of the chamber assembly. Although this embodiment illustrates a resistive element it should be understood that any of the heating methods described herein may be applied to this embodiment.

It may be undesirable for heat used to generate vapor within a vaporization chamber, or to mobilize precursor in a dispenser, to transfer to other parts of a vaporizing device. Chamber designs may be implemented that mitigate unwanted heat transfer. In some embodiments, residual heat may be used to pre-condition air before it is mixed with vapor to form an aerosol. In such embodiments, the intake air serves to absorb excess heat generated by the heater and to as a result cool the chamber during activation.

Figure 20B:
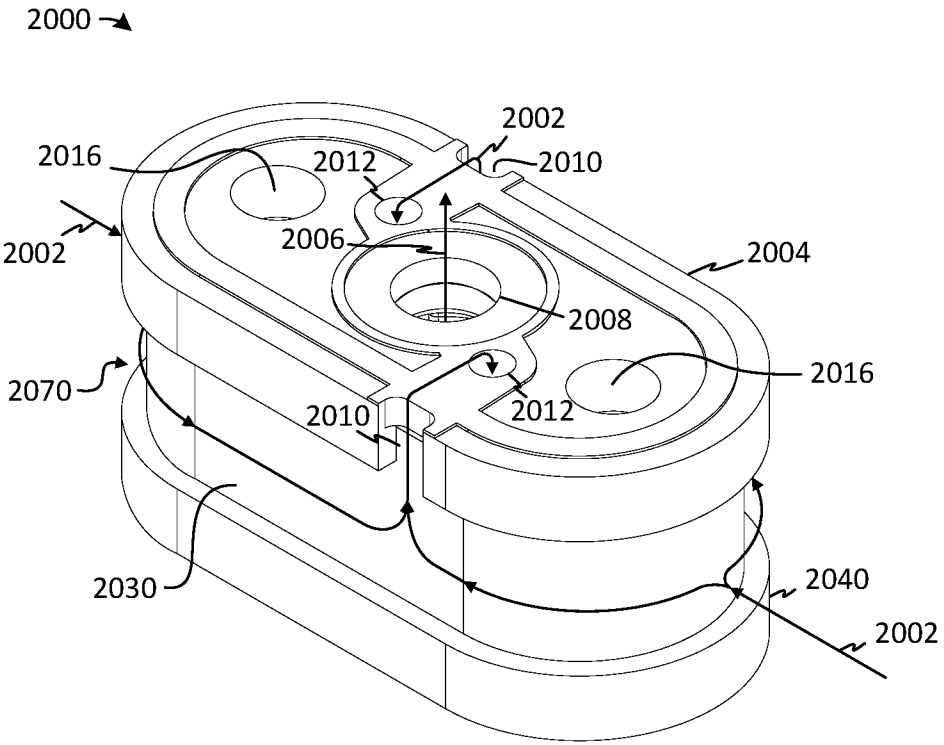
FIG. 20B illustrates an isometric view of a chamber assembly.
Figure 20A:
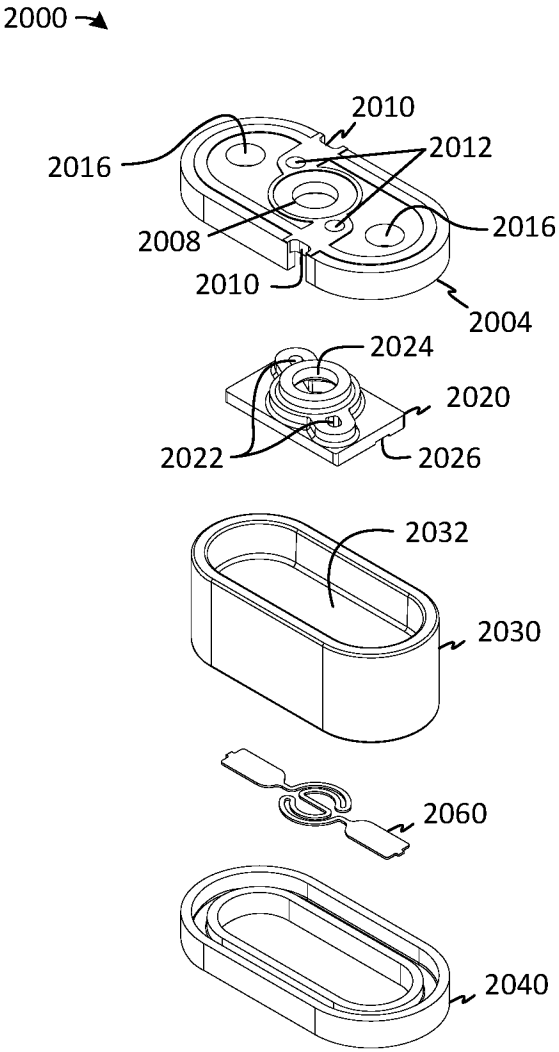
FIG. 20A illustrates an exploded isometric view of a chamber assembly.

FIG. 20A presents an exploded isometric view, and FIG. 20B a collapsed isometric view, of a chamber assembly. Chamber assembly 2000 may comprise flow director 2004, chamber top 2020, chamber bottom 2030, heater 2060, and lower seal 2040.

Flow director 2004 may be configured both to direct incoming air 2002 into a vaporization chamber and to serve as an upper lid for secondary reservoir 2032. Flow director 2004 may be configured to couple to the top surface of chamber bottom 2030. Flow director 2004 may serve as the upper seal for the chamber assembly 2000. Flow director 2004 in this embodiment serves to provide multiple sealing functions to isolate various ports and channels in its function as flow director 2004 such that it serves as the primary upper seal for the chamber assembly 2000, and seals the aerosol port 2008, and seals passageways 2010, and seals ports 2012, and seals dispenser ports 2016, and seals air ports 2022, and seals aerosol port 2024. Flow director 2004 also functions to position the chamber top 2020 inside the chamber bottom 2030 and to seat the chamber top 2020 firmly against the chamber bottom 2030 to form channel(s) 2026, which are formed by channels in chamber top 2020 and the surface chamber top 2020 is seated upon in chamber bottom 2030. In an embodiment flow director 2004 is constructed from a durable high temperature polymer such as silicone where the compliance of the silicone serves to exert a pre-load or force upon chamber top 2020 to insure it is properly positioned and seated in chamber bottom 2030. In this embodiment, flow director 2004 may include a perimeter extending beyond that of chamber bottom 2030. Lower seal 2040 may include an outer profile generally matching the outer profile of flow director 2004 and may couple to the bottom of chamber bottom 2030. In an assembled state, flow director 2004 may define an upper boundary, lower seal 2040 a lower boundary, and chamber bottom 2030 an interior boundary of surrounding cavity 2070. In a vaporizing device, chamber assembly 2000 may be assembled into a housing (not illustrated) that defines an exterior boundary of surrounding cavity 2070; this housing is omitted for clarity in the figures.

When a user applies suction, air 2002 may be drawn into the surrounding cavity 2070. While traversing the surrounding cavity 2070, air 2002 may absorb residual heat escaping from the vaporization chamber, thereby preconditioning air 2002 by increasing its temperature. This preconditioning may enhance vaporization efficiency, as air 2002 arriving at an elevated temperature is likely to draw less heat away from the vaporization process. Furthermore, surrounding cavity 2070 may serve as an insulating barrier, as the flow of air 2002 through this region during heater 2060 activation may transfer escaping heat back into the chamber, rather than to adjacent device components.

After moving through the surrounding cavity 2070, air 2002 may be directed through passageways 2010 in flow director 2004. In an assembled device, an additional component (not illustrated) may couple to flow director 2004 to form a channel that directs air from passageways 2010 to ports 2012. Ports 2012 within flow director 2004 may couple to air ports 2022 of chamber top 2020, ultimately guiding air 2002 into the chamber where it can be combined with vapor to generate aerosol 2006.

Flow director 2004 may also include one or more dispenser ports 2016, which may enable a precursor or portions of a precursor dispenser to pass into secondary reservoir 2032. Additionally, flow director 2004 may include aerosol port 2008, through which aerosol 2006 may exit chamber assembly 2000. In some embodiments, passageways 2012, and/or ports 2012, and/or aerosol port 2024 may be valved by any of the valving methods and/or valve types, and/or valve mechanisms previously and subsequently described herein.

Chamber top 2020 may define the main interior volume of a vaporization chamber, with chamber bottom 2030 forming the opposing lower surface. Chamber top 2020 may include one or more air ports 2022 distributed around the perimeter, which are configured to direct air 2002 into the vaporization chamber. In an embodiment, air ports 2022 may be configured to promote a vortical and/or rotational flow of air 2002. It may also include one or more precursor channels 2026 to supply precursor to the chamber. In an embodiment, precursor channels 2026 function as a thermally mediated valve to regulate the flow of precursor liquid, where the channels 2026 are positioned to be heated by the non-resistive region of heater 2060 such that a thermoviscous precursor has a reduction in viscosity secondary to heating to facilitate the flow through channels 2026. In an embodiment flow through channels 2026 during activation has a median flow rate of 2 uL and/or 2 mg per second. In an embodiment the air ports 2022 are positioned such that where they terminate is in proximity to where channels 2026 terminate such that flow rate and/or volume of precursor flowing through channels 2026 is at least partially mediated by the rate of air 2002 flow through air ports 2022 and the stream of air 2002 functions to at least partially entrain precursor flow exiting channels 2026.

Chamber bottom 2030 may be configured to form at least a portion of secondary reservoir 2032 and serve as a lower surface of a vaporization chamber. The secondary reservoir 2032 may serve functions such as those previously described such as facilitating consistent flow of precursor liquid to the vaporization chamber, and providing consistent flow of precursor liquid in different orientations of the device when is use, and to provide a heat sink for excess heat that may be generated by the heater 2060 where the secondary reservoir volume is heated to a degree that its viscosity is reduced sufficiently to be able to readily flow through channels 2026. Heater 2060 may be thermally coupled with chamber bottom 2030 to provide heat necessary to vaporization within the chamber.

Heater 2060 may be implemented as a resistive heating element in thermal communication with chamber bottom 2030. Alternative embodiments may employ other heating technologies, such as ceramic-based elements, inductive heating, or infrared (IR) and/or ultraviolet (UV) heaters depending on the desired operational characteristics of the chamber assembly. Although this embodiment illustrates a resistive element it should be understood that any of the heating methods described herein may be applied to this embodiment.

The previously discussed embodiments of chamber assemblies primarily utilize resistive heating elements for the bulk heating of precursor compositions. While resistive heating may be considered relatively nonselective, in that it concurrently heats all constituents present in the precursor, other types of heaters may possess the capacity to selectively heat one or more constituents comprising a precursor.

In various embodiments, different sources of radiation may be employed to vaporize a precursor. For example, lasers or diodes may be used, with some sources emitting radiation in the infrared (IR) spectrum, while others emit in the ultraviolet (UV) spectrum. Although IR or UV radiation may each be used individually, the combined use of IR and UV may yield advantageous properties that could be exploited in vaporizer applications. Where a heater or plurality of heaters comprising UV and IR emitters, or a plurality of UV and IR emitters may be used as the heater (such as heater 140, 240, 340, 440, 540, 640, 740, 840, 1007, 1140, 1340, 1440, 1760, 1860, 1960, 2060, 2160, 2350, 2550, and other heaters described herein).

Certain precursor formulations, such as those containing nicotine combined with vegetable glycerol and/or propylene glycol, and/or cannabis extracts, may be vaporized through mechanisms involving both electron excitation (via UV radiation) and vibrational excitation (via IR radiation). Molecular species such as nicotine and cannabinoids contain conjugated $\pi$-systems, which may undergo electronic excitation when exposed to UV radiation and vibrational excitation when exposed to IR radiation. When UV excitation occurs, energy is rapidly redistributed through electron redistribution to higher orbitals, and the concurrent or sequential application of IR energy may enhance absorption or facilitate selective heating of specific molecular bonds through vibration. This mechanism may potentially enable resonance-enhanced multiphoton absorption or targeted thermal mobilization of selected precursor constituents.

There are important advantages to the heating of the precursor utilizing the combination of IR and UV radiation such as the precursor is not in contact with the emitter of the radiation, and the emitted radiation may be calibrated to emit wavelengths of IR and/or UV radiation that are absorbed by the precursor. Many vaporization methods require a heating element, often a metal wire or coil, or metal trace that is heated along with the substrate, and subsequently heats a wick or porous material substrate that contains the precursor in order to effect a thermally mediated phase change of the precursor into a vapor to be combined with air to form an inhalable aerosol. These methods have been shown to introduce undesirable constituents into the aerosol such as metals from the heater element and thermal degradation products from the precursor compound(s). These undesirable constituents reduce the safety and efficacy of the inhalation aerosol and reduce user satisfaction by negatively impacting the flavor and purity of the inhaled aerosol. There are several reasons why the method of direct heating of the precursor using combined IR and UV radiation is preferable to the methods of existing systems such as the heating of the precursor liquid and/or precursor compound directly allows for the removal of the metal heating element, or metal trace, along with the associated substrate that is heated by the metal element or trace from these systems entirely. This removes the presence of metals in the systems that may contribute metal or components of the metal to the aerosol. Additionally, as a combined IR and UV radiation heating system is a contactless system, meaning that the liquid precursor and/or precursor compound is not in direct contact with the IR and UV source such as an emitter and/or diode, and is only contacted by the emitted radiation, the thermal degradation of the precursor liquid and/or compound is mitigated, and the buildup of thermal degradation products onto the heater is also mitigated, as a result the amount of thermal degradation products present in the vapor and subsequently formed aerosol is greatly reduced or completely mitigated.

The method of heating using the emission of electromagnetic radiation such as infrared (IR) radiation and/or ultraviolet (UV) radiation described herein utilizes UV radiation and IR radiation to directly thermally modulate the precursor liquid without the need for a resistive heater element or other type of joule heater, and without the need of heating a wick, or otherwise heating a porous substrate, or other substrate containing the precursor. This method uses electromagnetic IR and UV radiation to directly heat the precursor at a molecular level. Utilizing electromagnetic emissions that directly target the chemical structure of the precursor compound(s) which has a characteristic absorption to UV radiation and to IR radiation. This method of irradiating the precursor allows for the precursor to be heated and thermally mobilized without being in direct contact with a heater, wick, or heater substrate such as a porous or non-porous ceramic. UV radiation targeted at pi electrons causes the pi electrons to enter a higher energy orbital which effectively allows for more space for the molecule to vibrate, and IR radiation (also referred to as thermal radiation) excites molecular vibrations of the precursor molecules, increasing the kinetic energy of the molecules, which causes an increase in temperature that facilitates thermal mobilization of the precursor liquid and/or precursor compound. This method uses the UV radiation to excite pi (also denoted as $\pi$) electrons present in the active compound present in the precursor liquid and/or precursor compound(s) and/or the inactive constituents of the precursor liquid such as propylene glycol (PG) and/or vegetable glycerin (VG) and/or combinations/mixtures of PG and VG, which may also contain water, and may also contain an acid or acids. Molecules with conjugated pi systems (double bonds and triple bonds) absorb UV radiation at specific wavelengths. The UV energy absorbed promotes electrons from bonding pi orbitals to antibonding pi* orbitals. Moving a pi electron to a higher antibonding orbital (also denoted as $\pi^*$) weakens the pi bond, increasing the possibility of molecular vibrations by destabilizing the bond and allowing for greater atomic movement. In a pi bond, p-orbitals on adjacent atoms overlap sideways, creating two regions of high electron density above and below the internuclear axis. This overlap results in two molecular orbitals: a bonding pi orbital (lower energy) and an antibonding pi* orbital (higher energy). When a pi electron is excited to the $\pi^*$ orbital, it moves into a region where the electron density is reduced between the nuclei, leading to repulsion and weakening of the bond. The weakened bond allows for greater atomic movement and increased vibrational energy. The molecule can now vibrate more easily, as the bond is less strong and the atoms have more freedom to move. When the molecules are then also simultaneously or subsequently heated using IR radiation, the molecules have more room to vibrate and are resultantly able to be heated more efficiently by IR radiation.

The heating method utilizes the emission of UV radiation in order to excite the pi electrons to a higher energy antibonding pi* orbitals as described previously in conjunction with resonate and non-resonate IR radiation to increase the vibrational energy level of the precursor liquid and/or compound. IR radiation heats precursor molecules by causing them to vibrate more vigorously, effectively increasing their kinetic energy, which translates as heat. This process occurs when the energy of the infrared photons matches the energy of a specific molecular vibration within the precursor, causing the precursor molecules to absorb the radiation and start oscillating. IR radiation (also known as thermal radiation) at specific emitted wavelength(s) has the wavelength(s) of energy required to excite precursor molecules into higher vibrational energy levels. When a precursor molecule absorbs an infrared photon, it is excited to a higher vibrational state, causing its atoms to vibrate with greater amplitude and/or higher frequency (i.e., increasing oscillation). The increased vibrational energy translates to a higher kinetic energy for the precursor molecules, meaning the precursor molecules move faster and with more force. The increased kinetic energy of the precursor molecules leads to a rise in the temperature of the precursor liquid and/or precursor compound. Effectively IR radiation heats the precursor molecules by irradiating the molecules with the energy required to increase their vibrational state, which in turn increases their kinetic energy and the temperature of the precursor liquid and/or precursor compound to effect the phase transition of the precursor liquid and/or precursor compound to a vapor for subsequent mixing with air to form an inhalable aerosol for delivery and/or deposition into the deep lung.

The precursor liquid may be comprised of carrier fluid and/or carrier fluids that facilitate the generation of an inhalation aerosol and/or vapor where the active compound of the precursor is Nicotine. Nicotine (also known as 3-(1-methyl-2-pyrrolidinyl)pyridine)) being present as the active agent in the precursor. Nicotine's structure is characterized by two nitrogen-containing rings: a pyridine ring and a pyrrolidine ring. It is a chiral molecule, meaning it exists in two mirror-image forms, (S)-nicotine and (R)-nicotine. (S)-nicotine is the predominant form found naturally in tobacco and is responsible for nicotine's effects. A nicotine molecule ($C_{10}H_{14}N_2$) has 3 double bonds, contributing 6 pi electrons. Additionally, the pyridine ring within nicotine contributes to a 6 pi-electron system. Protonated nicotine may also be utilized as the active compound present in the precursor liquid. Both non-protonated and protonated nicotine molecules contain pi electrons within double bonds and within the aromatic ring structure. In protonated nicotine, the pi electrons in the pyridine ring remain largely intact, while the pi electrons in the pyrrolidine ring can be influenced by the protonation. Protonation typically occurs at the pyrrolidine nitrogen, and the electron configuration of the pi electrons in the pyridine ring is not significantly altered. Nicotine has two nitrogen atoms, one in a pyridine ring and one in a pyrrolidine ring. Protonation typically occurs at the pyrrolidine nitrogen, which is more basic. The pi electrons in the pyridine ring are still involved in resonance and delocalization, and their configuration doesn't change significantly upon protonation. The protonation of the pyrrolidine nitrogen alters the electron environment of the ring, potentially affecting the distribution of pi electrons. Nicotine can be mono-protonated or di-protinated, in either form the pyridine ring and pyrrolidine ring remain intact with the protonation site being the nitrogen molecule present in the respective ring structure.

Nicotine pi bonds occur at the double bond which is composed of one sigma bond and one pi bond. Since nicotine has three double bonds, it has 3 pi bonds, and each pi bond contributes two pi electrons, resulting in a total of 6 pi electrons from the double bonds. Furthermore, nicotine contains an aromatic ring, the pyridine ring in nicotine is a six-membered ring with alternating single and double bonds. This structure contributes to a 6 pi-electron system where the pi electrons are delocalized throughout the ring, making it aromatic. In total, a nicotine molecule has 6 pi electrons from the double bonds and 6 pi electrons from the aromatic ring, for a total of 12 pi electrons. This makes nicotine a pi electron rich molecule in which the pi electrons can absorb UV energy and be excited into a higher energy level orbital. In an embodiment intended to be used with a precursor liquid containing nicotine that may either protonated and/or non-protonated, the UV emitter present as part of a combined IR and UV heating system has a UV emitter with an emission range of 210-360 nm, with primary emission in the 250-260 nm range and peak emission at 254 nm. In an embodiment intended to be used with a precursor liquid containing nicotine that may either be protonated and/or non-protonated, the UV emitter present as part of a combined heater system where the UV heating system has a UV emitter with an emission range of 210-360 nm, with primary emission in the 250-260 nm range and peak emission at 254 nm. In an embodiment intended to be used with a precursor liquid containing nicotine that may either be protonated and/or non-protonated the UV emitter present has an emission range of 210-360 nm, with primary emission in the 250-260 nm range and peak emission at 254 nm.

Precursor liquids and/or precursor compounds where nicotine that may be protonated or non-protonated or a combination of protonated and non-protonated is the active compound are often composed of a mixture of propylene glycol (PG), vegetable glycerol (VG), water, and in some instances an acid. IR emission in the combined IR and UV heating system targets the covalent bonds in these compounds with IR radiation, and the pi electrons in these compounds with UV radiation. IR and UV emissions can be tuned to match the unique absorption characteristic of different precursor formulations and/or precursor compound formulations and/or mixtures that have differing ratios of aforementioned constituents.

Some precursor liquids, in some embodiments, may contain an acid, such as but not limited to, benzoic acid, levulinic acid, or lactic acid, where the addition of an acid in a precursor liquid containing nicotine functions to protonate the nicotine forming a nicotine salt. Furthermore, the presence of an acid, such as for example, benzoic acid functions to lower the pH of the precursor solution.

In some embodiments lowering the pH of the precursor liquid functions to increase absorption of IR and/or UV radiation. For example, protonation of nicotine alters the UV absorption characteristic of the nicotine present in a precursor fluid as nicotine undergoes significant conformational changes at lower pH due to protonation. Nicotine is a weak base with two nitrogen atoms, each of which can accept a proton. This protonation significantly alters the molecule's charge and shape, affecting its electronic properties and the wavelengths of UV radiation that it absorbs. Nicotine's conformational changes when protonated are due to nicotine having two ionizable nitrogens, one in a pyridine ring and one in a pyrrolidine ring, with two distinct pKa values. The protonation state of these nitrogens changes as the pH is lowered, causing conformational shifts increasing the UV absorption. At neutral to slightly acidic pH, with pKa values around 8.0 (pyrrolidine) and 3.0 (pyridine), the pyrrolidine nitrogen is the first to be protonated as the pH decreases. This process converts the uncharged, neutral nicotine into a single positively charged, or monoprotonated, form ($NicH_+$). At lower pH (highly acidic conditions), the pyridine nitrogen, having a lower pKa, becomes protonated as the pH drops further. This results in a dicationic form ($NicH_{22+}$) where both nitrogen atoms are positively charged. This also affects the stereoisomerism of nicotine as the addition of protons significantly alters nicotine's energy landscape, causing different molecular shapes (stereoisomers) to become dominant as protonation affects the rotation around the carbon-carbon bond linking the two rings. It also alters the stereochemistry of the N-methyl group on the pyrrolidine ring, which becomes a chiral center upon protonation.

Protonated nicotine has different UV absorption properties than non-protonated nicotine (also called free-base nicotine), with the absorption band associated with a n–π* transition on the pyridyl ring disappearing upon protonation. Conversely, the π-π* transition of the protonated pyridyl moiety increases significantly, similar to the UV absorption of pyridine itself. Protonated nicotine's UV absorption is also affected by its two possible protonation sites, the more basic pyrrolidine nitrogen or the less basic pyridine nitrogen, with the former being dominant at physiological pH. Key characteristics of protonated nicotine's UV absorption disappearance of n–π* transition: the positive Cotton effect associated with the n–π* transition, which results in UV absorption at 235-243 nm in neutral nicotine, vanishes when the pyridyl moiety is protonated. Increased π-π* transition absorption: the absorption of the π-π* transition on the pyridyl ring increases substantially upon protonation, a characteristic shared with pyridine itself. Protonation of the pyrrolidine ring causes a significant increase in the intensity of the π-π* transition associated with the pyridine ring, which absorbs UV radiation around 260 nm. The primary absorption region shifts to a longer wavelength (a bathochromic shift). The protonation site, and thus the UV absorption, depends on the pH of the precursor liquid. A precursor liquid with a physiological pH (~7.4), nicotine exists primarily as the protonated form on the pyrrolidine ring (Pyrro-NIC-H+), while at acidic pH, the pyridine ring also becomes protonated.

Protonating the nicotine results in enhanced UV absorption at the resulting lower pH. The increased UV absorption is associated with the π-π* transition which increases at acidic pH when the pyridyl moiety is protonated, resembling the UV absorption of pyridine. These electronic transitions in protonated nicotine alter the UV absorption wavelength to a range of 180-300 nm. In an embodiment, the precursor liquid contains a protonated nicotine, either in a mono-protonated or diprotonated or a mixture of mono-protonated and di-protonated nicotine and the UV emitter or emitters either solely or as a part of a combined heating system (e.g. in conjunction with an IR emitter or emitters) has an emission range of 180-300 nm and peak emissions at 260 nm. It should be understood that although the protonation of nicotine is described in detail that the addition of an acid to a precursor liquid may also be utilized in precursor liquid and/or precursor compound formulations that do not contain nicotine, such as precursor formulations that contain cannabinoids, or precursor liquid and/or precursor compound formulations that contain an active agent and/or active agents other than nicotine.

Precursor liquids can commonly be comprised of a mixture where the main component by volume is propylene glycol (PG, also known as propane-1,2-diol). PG chemical structure facilitates heating by IR radiation as it is a chain of three carbon atoms, with two hydroxyl (—OH) groups attached. These bonds between carbon, hydrogen, and oxygen atoms are all covalent. PG exhibits distinct IR absorption bands primarily in the regions around 3700-3000 $cm^{-1}$ and 1700-700 $cm^{-1}$. The band around 3700-3000 $cm^{-1}$ is due to O—H stretching vibrations, while bands in the 3000-2800 $cm^{-1}$ region are attributed to C—H stretching vibrations. The wide band at 3700-3000 $cm^{-1}$ corresponds to the vibration of hydroxyl (O—H) groups, including those involved in free, intermolecular, and intramolecular hydrogen bonding. The absorption between 3000 and 2800 $cm^{-1}$ are associated with the stretching of carbon-hydrogen (C—H) bonds within the propylene glycol molecule. In an embodiment the IR emitter targets the IR absorption of the hydroxyl groups and carbon-hydrogen bonding and uses an IR emitter with broad emission in the 3700-2800 $cm^{-1}$ range for the heating of PG sufficiently to cause a phase change from a liquid to a vapor. In an embodiment the IR emitter targets the IR absorption of the hydroxyl region and carbon-hydrogen region and uses an IR emitter with broad emission in the 3700-2800 $cm^{-1}$ range and a secondary band of emission in the 1700-700 $cm^{-1}$ range for the heating of PG sufficiently to cause a phase change from a liquid to a vapor.

Precursor liquids can commonly be comprised of a mixture where the main component by volume is vegetable glycerol (VG, also known as glycerol, and propane-1,2,3-triol, also referred to commonly as glycerin), which exhibits several characteristic IR absorption bands, primarily due to the C—H bonds and C—O bonds within its structure. Key IR abortion wavelengths include those associated with C—H stretching vibrations, around 2900 $cm^{-1}$, and C—O stretching vibrations, around 1000-1200 $cm^{-1}$. IR heating of VG occurs because of the effects on the C—H bonds in VG's methylene (—$CH_2$—) and methyl (—$CH_3$) groups that exhibit absorption bands in the region around 2900 $cm^{-1}$. Specifically, the asymmetric and symmetric C—H stretching vibrations contribute to these bands. Furthermore, the C—O bonds in VG's alcohol groups ($CH_2OH$ and CHOH) contribute to absorption bands in the region around 1000-1200 $cm^{-1}$. These bands can be further distinguished by the specific C—O bonds involved (C—O in $CH_2OH$ vs. C—O in CHOH). There is also absorption related to the $CH_2$ group that exhibits bending vibrations, which can appear as a shoulder on the C—H stretching band or in the lower wavenumber region. In an embodiment, the IR emitter targets the IR absorption of the carbon-hydrogen bonds and uses is an IR emitter with broad emission in the 2500-3000 $cm^{-1}$ range with peak emission in the 2900 $cm^{-1}$ range for the heating of VG sufficiently to cause a phase change from a liquid to a vapor. In an embodiment the IR emitter targets the IR absorption of the hydroxyl and carbon-hydrogen uses is an IR emitter with broad emission in the 2500-3000 $cm^{-1}$ range with peak emission in the 2900 $cm^{-1}$ range and a second band of emission in the 1000-1200 $cm^{-1}$ range for the heating of VG sufficiently to cause a phase change from a liquid to a vapor.

Prior examples of embodiments containing IR emitters constructed to emit specific emission ranges relevant to the heating of PG or VG are relevant if the carrier fluid is composed of either PG or VG, however it should be recognized that the carrier fluid may be a mix of PG and VG, and the carrier fluids that contain PG or VG or PG and VG may also contain water. When the carrier fluid contains both PG and VG it is desirable to have an IR emitter that is constructed to emit the relevant wavelengths of IR radiation to target the relevant IR absorption regions of both PG and VG. In an embodiment, an IR emitter has emission ranges of 700-1700 $cm^{-1}$, and 2500-3700 $cm^{-1}$ with a peak emission at 2900 $cm^{-1}$ for the heating of a mixture of PG and VG present in a precursor liquid. In an embodiment with a combined IR and UV heating system, the IR emitter may have emission ranges of 700-1700 $cm^{-1}$, and 2500-3700 $cm^{-1}$ with a peak emission at 2900 $cm^{-1}$, and a UV emitter with an emission range of 210-360 nm, with primary emission in the 250-260 nm range and peak emission at 254 nm.

Precursor liquids composed of PG or VG, and PG and VG mixtures can commonly contain water as a part of the formulation. Water's IR absorption is dominated by the intense O—H stretching and bending vibrations, resulting in broad absorption bands due to the extensive hydrogen bonding network in liquid form. This absorption occurs over a wide range of the electromagnetic spectrum including near-infrared (near-IR), mid-infrared (mid-IR), and far-infrared (far-IR), thus the addition of water to precursor fluids facilitates the IR heating of such precursor mixtures as water is highly absorptive of IR over a broad range of wavelengths. Water's IR absorption is primarily driven by hydrogen bonding: where the strong absorption of IR radiation is due to the dynamic nature of the hydrogen bond network in water, which constantly breaks and reforms, affecting the O—H bonds. Far-IR Absorption is due to rotational transitions and intermolecular vibrations. Mid-IR: the fundamental O—H stretching and bending vibrations cause IR absorption particularly around 3450 $cm^{-1}$, 3615 $cm^{-1}$, and 1640 $cm^{-1}$. Near-IR, R absorption occurs from overtones of the O—H stretching and combinations of stretching and bending modes, with absorption around wavelengths of 1450 nm and 1940 nm. Increasing water temperature during heating of the precursor liquid can affect the intensity and position of these absorption bands, shifting them to slightly shorter wavelengths. PG and VG are both non-ionic kosmotropes that form strong hydrogen bonds with water molecules, competing with water-water hydrogen bonds. Water and PG, or water and VG, or water and a mixture of PG and VG form an extensive hydrogen-bonding network. VG with three hydroxyl groups, and PG with two hydroxyl groups can form multiple hydrogen bonds with water molecules, leading to distinct absorption features. IR absorption of water is also temperature dependent, as temperature increases during heating, the absorption peak of water shifts to shorter wavelengths (also called a blue-shift). As the water is heated to a vapor the IR absorption characteristic changes as water vapor has strong infrared absorption in several different wavelength ranges, with prominent absorption at 2500 $cm^{-1}$, 1300 $cm^{-1}$, and 400 $cm^{-1}$. The change in IR absorption in such mixtures is concentration dependence as the ratio of PG or VG, or PG and VG to water influences the overall absorption spectrum. At different PG or VG, or PG and VG concentrations, the resulting absorption coefficients and vibrational dynamics differ.

As liquid precursor may be comprised of various ratios of PG or VG to water, or PG and VG to water, it should be understood that in some embodiments the IR emitter or plurality of IR emitters used to heat the precursor liquid may be adjusted to emit frequencies of IR radiation matched to the specific IR absorbance ranges of a specific mixture of PG or VG and water, or PG and VG and water. In an embodiment, where water is present in the precursor liquid and PG and VG are not present an IR emitter or plurality of emitters functioning as heaters in order to effect a phase change from water from a liquid phase to a vapor phase for the formation of an inhalation vapor and/or aerosol the IR emitter may have broad emission of mid-IR radiation from 1600-3650 $cm^{-1}$ and additional emissions in near-IR of 1400-2000 nm. In an embodiment where water is present in the precursor liquid and PG and VG are not present, an IR emitter or plurality of emitters functioning as heaters in order to effect a phase change from water from a liquid phase to a vapor phase for the formation of an inhalation vapor and/or aerosol the IR emitter may have emission of mid-IR radiation with peak emmisions at 3450 $cm^{-1}$, 3615 $cm^{-1}$, and 1640 $cm^{-1}$, and additional emissions in near-IR with peak emissions at 1450 nm and 1940 nm.

In an embodiment where water is present in the precursor liquid, the IR emitter or plurality of emitters may alter the emissions of IR from longer wavelengths to shorter wavelengths of IR radiation during an activation cycle to match the IR absorbance of water as it phase transitions from a liquid to a vapor, such that, for example, at the beginning of a activation cycle the emitter has emissions at 3450 $cm^{-1}$, 3615 $cm^{-1}$, and 1640 $cm^{-1}$ and then as the precursor liquid containing water transitions to a vapor phase the emitter has emissions of 2500 $cm^{-1}$, 1300 $cm^{-1}$, and 400 $cm^{-1}$. In some embodiments, the IR emitter or a plurality of IR emitters is combined with a UV emitter or plurality of UV emitters, where the UV emitter has one or more emission ranges and the range of emission may be targeted at the heating of water through the absorption of UV radiation by the water present in the precursor. For example, the UV emitter or plurality of emitters may have an emission range of 10-180 nm. It should be understood that the description of IR and UV emissions is intended to serve as examples of emissions that may be used in some embodiments and that there are additional ranges of emission of both IR and UV that may be used depending on the specific formulation and/or composition of the precursor liquid being used.

The precursor liquid may or may not be comprised of carrier fluid and/or carrier fluids that facilitate the generation of an inhalation aerosol and/or vapor where the active compound of the precursor is a cannabinoid or cannabinoids. Where cannabinoids have pi ($\pi$) electrons because their structures contain double bonds and aromatic rings. A double bond is made of a sigma ($\sigma$) bond and a pi ($\pi$) bond, where the pi bond involves the sideways overlap of p-orbitals. Cannabinoids are a group of closely related compounds which include the active constituents of cannabis, examples of cannabinoids containing pi electrons that may be heated using pi electron excitation in isolation, or in combination with IR radiation, or UV radiation and another source of thermal energy such as a joule heater, include but are not limited to: Tetrahydrocannabinol (THC), the most prominent isomer being delta-9-THC ($\Delta$9-THC), which has one double bond on a carbon ring. This double bond is formed by a pi ($\pi$) bond on top of a sigma ($\sigma$) bond, and the two electrons that make up the pi bond are pi electrons. Other isomers, such as delta-8-THC ($\Delta$8-THC), have the double bond in a different position, but they still contain pi electrons. THC's molecular structure includes an aromatic benzene ring, which is a stable, six-carbon ring with delocalized pi electrons, where instead of being confined to specific double bonds, the pi electrons in this ring are spread out in a "donut" shape above and below the plane of the carbon atoms, making the ring highly stable. This structure of THC is a conjugated system where the double bond on the non-aromatic ring of THC is in conjugation with the delocalized pi system of the adjacent aromatic ring. This conjugated system allows the electrons to spread out further through resonance, influencing the molecule's overall stability and reactivity. Another relevant cannabinoid is cannabidiol (CBD) that also has pi ($\pi$) electrons. These are found in its two distinct pi bond systems, the aromatic benzene ring and the carbon-carbon double bond in its cyclohexene ring. The benzene-like phenolic ring in CBD is aromatic, meaning it has a delocalized system of pi electrons. The ring has three double bonds that share six pi electrons among the six carbon atoms. This delocalized pi system contributes to the molecule's stability. In addition to the aromatic ring, CBD also has a cyclohexene ring, which contains one localized carbon-carbon double bond. This single double bond contributes an additional two pi electrons to the overall molecule. A final example of a cannabinoid with pi electrons is cannabinol (CBN). CBN has a fully aromatic structure, which is an example of a conjugated system with delocalized pi electrons. The structure of CBN includes two fused benzene-like rings. Each of these aromatic rings contains a conjugated system of six carbon atoms and three double bonds. There are also delocalized electrons, where the pi electrons in these rings are not confined to a specific atom or bond, instead, they are delocalized across the entire ring structure, making the rings highly stable.

THC, in both the delta-9-THC and delta-9-THC absorbs UV radiation most strongly at wavelengths around 209 nm and 279 nm. As well as significant absorption across a broad range of UV radiation, from approximately 200 to 350 nm. Cannabidiol (CBD) shows two primary UV radiation absorption regions, with one peak at 207-220 nm and another at 275-280 nm. Cannabinol (CBN) absorbs UV radiation at two primary regions, 218 nm and 283 nm. In an embodiment intended to be used with a THC precursor liquid and/or precursor compound, the UV emitter present as part of a combined IR and UV heating system may have a UV emitter with an emission range of 200-350 nm and peak emissions at 205-215 nm and 275-285 nm. In an embodiment intended to be used with a precursor liquid and/or precursor compound containing CBD, the UV emitter present as part of a combined heater system where the UV heating system may have a UV emitter with emission ranges of 200-220 nm, with secondary emission in the 270-290 nm range. In an embodiment intended to be used with a CBN precursor liquid and/or compound, the UV emitter present may have two emission ranges with the first being 215-220 nm and the second emission being at 280-285 nm. In an embodiment intended to be used with aTHC and/or CBD and/or CBN precursor liquid and/or compound, the UV emitter present may have first a broad emission range of 200-350 nm, and peak emissions at 200-220 nm, and 270-285 nm. In an embodiment, the UV emitter may be used as a stand-alone heater for use with precursor liquids and/or compounds containing THC, and/or CBD, and/or CBN where the emission ranges of UV radiation are the same as those referenced herein as they relate to the specific constituents of the precursor liquid and/or precursor compound (e.g. THC, CBD, and CBN or mixtures thereof).

Other factors such as molecular conformation may change the absorption range of THC as the spatial arrangement of THC's structure can influence the UV absorption. Different conformers, especially those stabilized by hydrogen bonds, produce distinct UV absorption ranges. Therefore the description of the absorption ranges of cannabinoids including those described for THC, CBD, and CBN to UV radiation contained herein are intended to describe some of the relevant UV wavelengths that may be utilized to heat cannabinoids utilizing targeted wavelength UV radiation but should not be considered an exhaustive description and other wavelengths of UV radiation may be used depending on the actual UV absorption characteristic of the cannabinoid(s) present in a precursor liquid and/or precursor compound. This is relevant to constructing a heater comprised of a UV emitter or plurality of UV emitters as in some embodiments the precursor liquid and/or compound containing cannabinoids the cannabinoids may be an isolated cannabinoid, or a combination of cannabinoids, with or without the presence of additional components of the precursor liquid, such as PG, VG, or a mixture of PG and VG, as well as additional components such as water, and/or constituents used for the protonation of a the precursor liquid such as an acid, for example benzoic acid.

Conformational changes in cannabinoids resulting from hydrogen bonding can affect their UV absorption. Hydrogen bonding modifies the molecule's electronic structure, which, in turn, changes the energy gap between its electronic orbitals and shifts the wavelength of UV radiation it absorbs. Hydrogen bonding affects UV absorption by altering the electronic environment as the formation of a hydrogen bond redistributes the electron density within a molecule. This changes the energy levels of the molecular orbitals, particularly the Highest Occupied Molecular Orbital (HOMO) and the Lowest Unoccupied Molecular Orbital (LUMO). Influences the HOMO-LUMO energy gap effect UV absorption as UV absorption occurs when a molecule absorbs a photon and an electron is promoted from the HOMO to the LUMO. The exact energy difference between these orbitals determines the specific wavelength of UV radiation absorbed. Such conformational changes cause a spectral shift of the UV wavelength absorption as the hydrogen bonding changes the HOMO-LUMO energy gap which causes a shift in the UV absorption spectrum. These shifts can be defined as a red shift (bathochromic shift), where the shift is to a longer wavelength (lower energy) that occurs if the hydrogen bond stabilizes the excited state more than the ground state, thereby decreasing the HOMO-LUMO energy gap. Where blue shift (hypsochromic shift) is a shift to a shorter wavelength (higher energy) that occurs if the hydrogen bond destabilizes the excited state, increasing the HOMO-LUMO energy gap. Either a red shift or a blue shift affects UV absorption intensity as the hydrogen bonding can also change the intensity of absorption, depending on how it affects the molecular structure and electronic transitions. This applies to cannabinoids, such as CBD for example, as cannabinoids such as CBD are highly susceptible to these types of conformational changes as they possess hydroxyl (—OH) groups that can form hydrogen bonds. These hydrogen bonds can be intramolecular hydrogen bonds which form within the same molecule, locking it into a specific, more rigid conformation. These hydroxyl groups can also interact with pi ($\pi$) electrons such that there is also a intramolecular O—H·$\pi$ electron interaction, which influences the molecule's spatial arrangement and rigidity and can affect its UV absorption characteristics.

Intermolecular hydrogen bonds may form between two or more cannabinoid molecules or between a cannabinoid and a solvent molecule such as may be present in a liquid precursor. This type of intermolecular hydrogen bonding can significantly alter spectral properties. For example, if the precursor liquid contains an acid as a component, and/or water it may function as protic solvent (which can form hydrogen bonds) with the cannabinoid(s) present in the precursor liquid, which can alter the UV absorption of the cannabinoid and/or precursor liquid compared to a precursor liquid that does not contain an acid, and/or water which would function as a non-protic solvent. It should be understood that the precursor liquid and/or compound may contain additional constituents that affect the UV absorption of the precursor liquid and that the emission ranges may be adjusted to match the absorbance characteristics of a specific precursor formulation and/or mixture. It should be understood that the HOMO-LUMO energy gap described herein as it relates to the heating of CBN by UV radiation, and may influence the selection of particular wavelengths of UV radiation used to heat precursor liquids and/or precursor compounds, also applies to the heating of other compounds by UV energy, such as other cannabinoids, nicotine, and other constituents of precursor liquids such as propylene glycol, vegetable glycerol, water, and acids such as benzoic acid, levulinic acid, and lactic acid. It should also be understood that red-shifting and blue-shifting that was described herein as it relates to the HOMO-LUMO energy gap is also relevant for the absorption of IR radiation and determination of IR radiation wavelengths to be used to heat precursor liquids and/or compounds, and is not solely related to the use of UV radiation for heating.

The UV emitter or plurality of emitters used to construct a UV heater either as an individual heater or as part of a combined heater system may be constructed from a single type of UV emitter, or from different types of UV emitters in order to achieve the desired output of UV radiation in terms of emitted wavelength and/or emission discharge intensity. The emitter or plurality of emitters may be non-coherent emitters, and/or coherent emitters. The UV emitter and/or emitters may be constructed into a heater system that incorporates a UV filter or filters in order to isolate the desired wavelengths of emitted UV. The UV emitter and/or emitters may be constructed into a heater system that incorporates a lens or lenses to focus the UV emissions. The UV emitter and/or emitters may be constructed into a heater system that incorporates both a UV filter or UV filters and a lens or lenses in a combined system intended to both filter out undesirable wavelengths of UV radiation and focus the remaining desirable UV radiation. The UV emitter and/or emitters may be constructed into a heater system that incorporates a combined UV filter and lens system, where a single component functions as a lens and a UV filter.

Multiple types of UV emitters may be used for the embodiments disclosed herein, including but not limited to, miniature UV light emitting diodes (LEDs), which are compact, energy-efficient, and long-lasting solid-state UV radiation sources that come in a variety of package styles that can be used individually or combined in a plurality of emitters or emitter array depending on the desired emission wavelength and/or emission intensity. Examples include, but are not limited to, UV-A LEDs that have emission wavelengths from 315-400 nm, UV-B, and UV-C LEDs, where UV-B LEDs emit wavelengths from 280-315 nm, and UV-C LEDs emit wavelengths from 100-280 nm. These types of emitters are available in various forms that are suitable for the construction of a UV emitter or UV emitter array heater as disclosed herein, including, but not limited to, through-hole, surface-mount (SMD), and chip-on-board (COB) packages. Another suitable type of UV LED is the deep-UV LEDs for deep UV light (e.g., 100-300 nm) and are a compact and low-cost alternative to lasers. Non-LED options include, but are not limited to, miniature UV gas-discharge lamps that produce UV radiation through a gas-discharge process, offering different spectral characteristics than LEDs. Additionally, there are miniature mercury lamps that can produce both shortwave (254 nm) and longwave (365 nm) UV, and also have dual-wavelength models that allow switching between longwave and shortwave UV. There are also small-scale deuterium arc lamps, and xenon lamps that can provide broad-spectrum UV in extremely compact emitters. There are also miniature excimer lamps which are high efficiency and high intensity and operate at different UV wavelength bands, including into the vacuum ultraviolet range. Additionally, the extreme UV (EUV) sources such as the electrodeless Z-Pinch, which is a type of plasma device that uses an inductively coupled magnetic field to create a Z-pinch, where a plasma is compressed and heated to generate ultrashort-wavelength UV (10-50 nm).

Additional options for suitable UV emitters include UV lasers-particularly miniature UV lasers that primarily use solid-state technology. The two most common types being diode-pumped solid-state (DPSS) lasers and microchip lasers. Their compactness is achieved through the use of solid gain mediums and frequency conversion to reach UV wavelengths. One type being the Diode-pumped solid-state (DPSS) UV lasers, DPSS lasers use laser diodes to pump a solid crystal, which creates a near-infrared (IR) laser beam. This beam then passes through a series of nonlinear crystals to convert it into UV light. The two most common types of frequency conversion are the second-harmonic generation (SHG) where a single nonlinear crystal is used to cut the wavelength in half, turning a laser from green to UV. The other common type is a third-harmonic generation (THG), where a beam is passed through two crystals to reduce its wavelength by a factor of three, often converting a standard 1064 nm beam into a 355 nm UV beam. These types of UV lasers use diodes instead of traditional lamps which allows for a smaller, more integrated system that has high efficiency and reliability that is suitable for incorporation into a hand-held portable device. Another advantage is that DPSS lasers have a longer lifespan and require less maintenance compared to gas-based UV lasers, and DPSS technology provides excellent beam quality and stability for sensitive applications such as a wavelength specific UV heater.

Another option that may be used for constructing a suitable UV emitter is a microchip UV laser which is a particularly miniature type of DPSS laser where all components are integrated into a single unit. This technology uses a tiny, passively Q-switched solid-state laser crystal with the mirrors directly coated onto the crystal's end faces. This design results in an extremely compact, rugged, and low-cost. The all-in-one design makes them ideal for portable, handheld, devices such as a personal vaporization device intended for use in forming an inhalation aerosol. The microchip UV lasers generate high peak power in short pulses by producing very short, sub-nanosecond pulses with high peak power, which is advantageous for use as a UV emitter functioning as a heater. Furthermore, the integrated monolithic structure is resistant to alignment issues and suitable for use in harsh environments such as those that a personal portable electronic device may be exposed to. It should be understood that these examples provided of UV radiation emitters may be used individually or in combination to achieve the desired UV emissions in terms of wavelength and intensity. Additionally, it should be understood that these examples do not represent an exhaustive list of possible emitter types and/or technologies that may be used to construct a UV emitter or UV emitter array for the embodiments described herein. The specific type of UV emitter or emitters selected to construct a UV heater either as a standalone heat source or combined with another heater type may be determined by a variety of factors, including, but not limited to, design requirements, precursor liquid and/or precursor compound formulation and/or precursor constituents, material selection, manufacturing methods, and economic considerations.

A heater comprised of a UV emitter, either as an individual UV emitter or a plurality of UV emitters, that is constructed to radiate a specific wavelength or wavelengths of UV radiation may be constructed or controlled such that the UV emitter or emitters is tuned to specific precursor liquid UV absorptance characteristics, where such UV absorbance characteristics are validated by direct measurement. For example, the precursor liquid could be analytically quantified for the precursor liquid's UV absorption characteristic using a method such as UV-Visible (UV-Vis) spectroscopy. This analytical technique measures how much ultraviolet (UV) and visible light, and which is absorbed by precursor liquid samples, and what wavelength or wavelengths of UV radiation are absorbed by the precursor liquid. Furthermore, the precursor liquid could be analytically quantified for the precursor liquid's UV absorption characteristic over a range of temperatures using a method such as UV-Visible (UV-Vis) spectroscopy such that the absorbance characteristics of the precursor liquid and/or precursor compound when heated from ambient to temperature required to phase change the precursor into a vapor are quantified. In an embodiment, the UV emitter or plurality of UV emitters functioning as a heater or as part of a combined heater system is tuned to emit UV radiation at a wavelength or wavelengths that match the UV absorption characteristics of a precursor liquid that has been measured by UV-Vis spectroscopy. In an embodiment the UV emitter or plurality of UV emitters functioning as a heater or as part of a combined heater system is tuned to emit UV radiation at a wavelength or wavelengths that match or approximate the UV absorption characteristics of a precursor liquid over a range of temperatures used to heat the precursor liquid in order to effect a phase change from a liquid to a vapor, that has been measured by UV-Vis spectroscopy.

In some embodiments, a miniature UV detector may be incorporated into the reservoir system of the device, or into a controller and/or control unit coupled to the reservoir, such that the UV emitter or emitters may radiate the precursor liquid and a UV sensor and/or detector may be radiated by the UV emissions once the emission have passed through the precursor liquid, in order to measure the UV absorbance characteristics of the precursor liquid. There are several types of UV detectors and/or sensors that may be incorporated into such an embodiment, including but not limited to, solid state type detectors, and miniaturized optical type detectors.

Miniature UV detectors generally fall into two main categories: solid-state semiconductor devices and compact versions of larger optical instruments. Solid-state detectors, particularly those using wide-bandgap semiconductors, are the most common and versatile for miniaturization. Solid-state semiconductor detectors use a semiconductor material that generates an electrical signal when struck by a UV photon with higher energy than the material's bandgap. These detectors are routinely constructed to have compact size, low power consumption, and robustness.

Another type of UV detector that may be used are photoconductive detectors (photoconductors) where, when exposed to UV radiation, the detector material's electrical conductivity increases generating a measurable signal for determining the wavelength or wavelengths of the UV radiation. Photoconductive detectors can be manufactured to be small, simple, and can be made from various wide-bandgap materials like zinc oxide (ZnO) nanowires, making them simple to manufacture with high internal gain. Additionally, photovoltaic detectors (photodiodes) may be utilized, these detectors operate in photovoltaic mode, generating a current at zero bias when illuminated, or can be operated with a reverse bias.

There are also suitable diode type UV detectors, such as p-n junction photodiodes, which are a simple diode structure where electron-hole pairs are created in the depletion region and swept to the terminals by the built-in electric field. Similarly, there are also suitable p-i-n photodiode UV detectors, which are an improved version with an intrinsic layer ("i") between the p- and n-type layers. The wider depletion region of the intrinsic layer improves response speed and quantum efficiency. Other diode type UV detectors may also be utilized such as Schottky barrier photodiodes, which are constructed such that a metal-semiconductor junction forms a rectifying barrier. The UV radiation must pass through a semi-transparent metal layer to reach the semiconductor. This is similar to another type of UV diode detector, the metal-semiconductor-metal (MSM) photodiodes, where there are two back-to-back Schottky barriers are formed by interdigitated electrodes on a single layer of semiconductor material, which results is this type of diode detector having low capacitance and fast response times. Additionally, there are avalanche photodiodes (APD) UV detectors which operate under high reverse bias, causing a cascade effect of internal electron multiplication, resulting in very high sensitivity. These types of diode-based UV detectors and/or solid state detectors may be constructed using common UV-sensitive materials. Materials suitable for the construction of these types of UV detectors include, but are not limited to, silicon carbide (SiC) for robust, high-temperature applications, and aluminum gallium nitride (AlGaN) for tunable deep-UV detection.

Another general class of UV detectors that could be used are compact spectroscopic detectors, which are miniature versions of laboratory-grade instruments and are used for an embodiment or embodiments requiring more detailed spectral analysis rather than just intensity measurement. In such embodiments, a miniature spectrometer may be incorporated. These devices use a diffraction grating to split incoming UV radiation into its constituent wavelengths and use a miniature diode array, like a CMOS or CCD sensor to measure the intensity of each wavelength. This type of spectrometer may be preferable and advances in optics and electronics have led to highly compact, handheld, and even on-chip versions suitable for portable applications such as a handheld vaporization device and/or handheld aerosol generator for the purpose of delivering compounds to the deep lung through inhalation. These types of spectrometers provide high spectral resolution, enabling precise analysis of a liquid precursor's UV absorption properties. These have the additional benefit that some versions offer broad spectral coverage from UV to near IR (NIR) wavelengths, which would be suitable for use in an embodiment that has a combined heater and/or emitter system that utilized both UV and IR radiation.

There are also suitable diode-based detectors that offer good spectral resolution in the UV emission range that may be desirable to incorporate such as diode array detectors (DAD) and photodiode array (PDA) detectors. When using these detectors, the liquid precursor may be illuminated with the UV emitter, which may be a broad-spectrum emitter, and an array of photodiodes simultaneously measures the absorption across a range of wavelengths. Having a photodiode array makes these diode-based detectors well-suited for smaller, more integrated systems, such as miniature detectors suitable for the applications described herein of measuring a liquid precursor sample, as these detector types are excellent for high-speed analysis and provide the entire UV spectrum simultaneously—a major advantage over older variable wavelength detectors.

There are other types of novel and integrated detectors that may be suitable for the embodiments described herein as ongoing research is developing new formats and materials to create even smaller, more versatile UV detectors-such as the development of wearable UV sensors, that may be purposed for use in a small portable handheld device as these detectors are extremely small, battery-free electronic sensors that have been designed to be worn on skin, clothing, or a fingernail. In an embodiment, this type of detector may be incorporated into a reservoir containing a precursor liquid which may be a disposable type reservoir or a reusable type reservoir, as had been previously described. In another embodiment, this type of detector may be incorporated into a pod type system and/or cartomizer type system as has been described previously herein. These detectors use semiconductor photodetectors combined with a communication chip for wireless data transfer, such data could be communicated to a controller, such as the controller(s) described herein, or alternatively to a smart phone for integration into an application that communicated with the device and/or device controller.

There are also suitable very small scale detectors such as nanowire-based detectors which use high-surface-area nanowires made from materials like ZnO or GaN to create highly sensitive and responsive UV sensors with high gain. Furthermore, there are now on-chip spectral imagers, which is an emerging technology that integrates a cascade of photodiodes with varying bandgaps directly onto a single chip which allows for real-time, high-resolution spectral imaging in a minuscule form factor. Similarly, there are also SMD package sensors, where UV sensors are available in surface-mount device (SMD) packages, with some as small as 1 mm×1 mm, for integration into smaller circuit boards and devices, such as a handheld portable device.

There are also additional types of detector and/or UV sensor systems that may be used such as those constructed from nanoscale band structure engineering using epitaxial techniques, such as molecular-beam epitaxy (MBE,) as well as atomic layer deposition (ALD). Combined with the use of 2D doping (delta-doping and superlattice-doping) MBE techniques, these sensors can achieve 100% internal quantum efficiency (QE). These methods may be combined with antireflection coatings and detector-integrated filters, using ALD, to construct silicon detectors with tailorable response and high QE in the UV/Optical/NIR spectral range which exhibit reliable and repeatable performance with a small sensor/detector footprint and low power consumption requirements.

In some embodiments, a single type of UV detector and/or sensor may be utilized for the direct measurement of a precursor liquid and determination of the UV radiation absorption characteristic of the precursor liquid such as the UV absorption wavelength(s) and intensity and/or percentage of UV absorption of the precursor liquid. In some embodiments, a plurality of UV detectors and/or sensors of the same type or of different types of UV detectors and/or sensor may be utilized for the direct measurement of a precursor liquid and determination of the UV radiation absorption characteristic of the precursor liquid such as UV absorption wavelength(s) and intensity and/or percentage of UV absorption of the precursor liquid.

In an embodiment with a disposable reservoir, pod system, and/or cartomizer type configuration, a simpler UV detector may be incorporated into the reservoir, pod, and/or cartomizer assembly such as those described previously in this section, such as those UV detectors that are extremely small, battery-free electronic sensors. In an embodiment with a disposable reservoir, or pod system and/or cartomizer type configuration a simpler UV detector may be incorporated into the reservoir, pod, and/or cartomizer assembly such as those described previously in this section, such as those UV detectors that are extremely small, battery-free electronic sensors, and additional UV detector and/or sensor or plurality of sensors may be incorporated into a control unit and/or controller such as those described previously and subsequently herein. The specific type of UV detector(s) and/or sensor(s) configuration may be determined by a variety of factors, including, but not limited to, design requirements, material selection, manufacturing methods, and economic considerations.

The IR emitter or plurality of emitters used to construct an IR heater either as an individual heater or as part of a combined heater system may be constructed from a single type of IR emitter, or from different types of IR emitters in order to achieve the desired output of IR radiation in terms of emitted wavelength and/or emission discharge intensity. The emitter or plurality of emitters may be non-coherent emitters, and/or coherent emitters. The IR emitter and/or emitters may be constructed into a heater system that incorporates an IR filter or filters in order to isolate the desired wavelengths of emitted IR radiation. The IR radiation emitter and/or emitters may be constructed into a heater system that incorporates a lens or lenses to focus the IR emissions. The IR emitter and/or emitters may be constructed into a heater system that incorporates both an IR filter or IR filters and a lens or lenses in a combined system intended to both filter out certain wavelengths of IR radiation, and focus the remaining IR radiation.

The IR emitter and/or emitters may be constructed into a heater system that incorporates a combined IR filter and lens system, where a single component functions as a lens and an IR filter. Multiple types of UV emitters may be used, including but not limited to, miniature IR light emitting diodes (LEDs), which are compact, energy-efficient, and long-lasting solid-state IR radiation sources that come in a variety of package styles that can be used individually or combined in a plurality of emitters or emitter array depending on the desired emission wavelength and/or emission intensity. Types of IR emitters that may be used in construction of an IR emitter based heater, as a single emitter or as a plurality of emitters for use as a standalone heater, or as part of a combined heating system come in a variety of different technologies and formats—which may be utilized based on the desired emitted wavelength(s) and intensity or intensities of IR radiation emission(s).

Suitable IR emitters may be stratified into three basic emission ranges based on wavelength: (a) Short-Wave Infrared (SWIR), which is a high-intensity emitter with short wavelengths and deep penetration, often produced by tungsten and halogen emitters; (b) Medium-Wave Infrared (MWIR), rapidly heats surfaces and thin layers, with high absorption by water films, and high absorption by precursor liquid constituents such as PG and VG, and/or other precursor liquid constituents such as and acid; and (c) Long-Wave Infrared (LWIR) which emit lower-frequency waves, further from visible light, and are typically used for general heating.

Suitable semiconductor emitters include compact, solid-state devices that emit specific wavelengths of infrared light. They can be designed for near-infrared (NIR), mid-infrared (MIR), or far-infrared (FIR) radiation, depending on the semiconductor material and doping. Examples of suitable semiconductor emitters include but are not limited to, Quantum-Dot emitters. Quantum-Dot emitters are semiconductor nanocrystals that can be tailored to emit a broad spectrum of near- and mid-infrared IR radiation by manipulating their size and composition, offering versatility for the emission of specific wavelengths of IR radiation. Another type of suitable semiconductor-based IR emitters are heating element based IR heating emitters. These types of IR emitters utilize semiconductor properties to generate infrared radiation for IR heating. They often feature high reflectivity and fast response times, with types of emitters including, but not limited to quartz twin-tube emitters which use quartz tubes with gold or reflective coatings for efficient, stable heat generation.

There are also suitable ceramic based emitters that are constructed with a highly emissive ceramic body and a resistive coil. These types of emitters are robust and effective for long-wave infrared heating. An example of a ceramic type heater is the ceramic blackbody type emitter which utilizes a heated ceramic tube or element, often with a resistance coil (e.g., FeCrAl) embedded in a highly emissive ceramic body, producing long-wave (far-infrared) radiation. There are also suitable kanthal and silicon-carbide emitters, which utilize materials like kanthal and silicon carbide that, when heated electrically, produce broadband IR radiation. These types of emitters are similar to wound filament emitters, where a wire filament, often nichrome, kanthal, or tungsten, is wound into coil(s) and protected by glass (e.g. quartz, fused silica) windows. These type of IR emitters produce high power output. Suitable Quartz Cassette Emitters may have quartz tubes within a housing that operate at higher front surface temperatures, emitting medium to long-wave IR radiation.

Another category of suitable IR emitters with high efficiency that are ideally suited to be utilized as an IR radiation heater include cavity blackbodies, as these emitters provide a calibrated IR thermal radiation source. Small versions of these types of emitters are available as LED cavity blackbody infrared emitters that generate highly uniform, stable, and accurate infrared IR radiation by combining the precise emission characteristics of a cavity blackbody with the pulsable, efficient features of a modern IR emitter. This technology offers a significant advance over standard IR-emitting LEDs used in consumer electronics which typically have lower and less predictable emissivity. These types of blackbody IR emitters are constructed having an enclosed cavity with a small aperture. This structure ensures that any incoming light is absorbed by the internal surfaces, and the IR radiation that does escape through the aperture closely approximates a "perfect" blackbody. This provides a highly accurate and wavelength-independent emission profile. This type of emitter is ideally suited for applications as a IR heat source as an LED cavity blackbody infrared emitter generates highly uniform, stable, and accurate infrared IR radiation by combining the precise emission characteristics of a cavity blackbody with the pulsable, efficient features of a modern IR emitter. This technology offers a significant advance over standard IR-emitting LEDs used in consumer electronics, which typically have lower and less predictable emissivity. The solid-state nature of the device allows for rapid pulsing speeds and high efficiency compared to older thermal IR emitters.

The structure of an enclosed cavity with a small aperture ensures that any incoming light is absorbed by the internal surfaces, and the IR radiation that does escape through the aperture has a highly accurate and wavelength-independent emission profile. These emitters may use a specialized solid-state monolithic radiating element, or one-piece radiating element, often with a nanostructured surface instead of a traditional wound filament. This element design improves efficiency and stability because the emitter uses a monolithic, rather than a filament-based, design, that offers superior mechanical stability and longer operating life with long-term stability. The emitting element is placed inside a cavity, where the walls of the cavity reflect and re-emit the thermal energy multiple times before it exits through an aperture. The cavity design provides very high emissivity, ensuring the emitted infrared radiation is uniform and predictable across a wide spectrum. This multi-reflection process creates a near-perfect blackbody source with an emissivity greater than 0.9. These LED blackbody emitters are often constructed to incorporate an integrated gold-plated reflector to direct any radiation emitted from the back of the element toward the front, maximizing output efficiency. The combination of a nanostructured radiating element and a gold reflector ensures that the device is highly efficient at converting electrical power into forward-directed IR radiation. Integrated controller circuitry provides the fast pulsing and stable temperature control that is characteristic of LED technology as unlike conventional thermal blackbodies that are heated with a coil, these modern emitters can be pulsed at high frequencies, with speeds up to 180 Hz.

Another category of suitable IR heaters are incandescent thermal emitters, examples of these types of emitters include, but are not limited to, tungsten element based emitters often used in quartz tubes and can operate as short-wave, medium-wave, or fast-medium wave emitters for IR heating. There are also suitable quartz element based emitters where a heated quartz element(s) are effective for medium-wave infrared heating applications. Another type of suitable IR radiation emitter that can be used as a heater are thin-film emitters which utilize thin films of materials to generate infrared radiation and are broadly categorized by their underlying technology, such as thin film emitters, where a thin foil with low thermal capacitance which allows for rapid modulation of thermal radiation.

Another category of suitable thin film emitters well suited to the application of constructing an IR heater are Micro-Electro-Mechanical Systems (MEMS)-based devices and those with deposited thin-film filaments. These technologies are used to create precise and pulsable thermal radiation emissions. Additionally, MEMS-based thin-film emitter technology is a method for creating miniature thin-film IR emitters. These devices use semiconductor manufacturing techniques to create micro-hotplates or similar suspended structures that heat up rapidly. There are several types of MEMS based emitters, including but not limited to, nanostructured amorphous carbon emitters, these emitters feature a thin-film resistor made of nanostructured carbon. Utilizing nanostructured carbon construction allows for compact, low-mass designs that can pulse at high frequencies. Other MEMS emitters are constructed using silicon with platinum which uses a silicon or other thin-film material to form a membrane, with platinum serving as the emitting material. Similar to the elements described previously in blackbody LED emitters, some MEMS emitters utilize a monolithic nanostructured element which is a free-standing radiating element with nanostructured surfaces. These monolithic nanostructured elements offer improved efficiency, enhanced emissivity, and greater mechanical stability than most other element types.

There are also suitable deposited thin-film filaments, this type of emitter consists of a resistive thin-film material deposited onto a substrate with high thermal resistance. An example of a thin film filament is thin film on alumina that is constructed using a thin film of resistance material permanently bonded to a flat alumina substrate. This construction provides a uniform radiating source and a stable platform. Other thin film emitters are constructed using metal thin films using metals with high-melting points, often enhanced with a nanostructured surface to increase emissivity. Thin film emitters can be constructed to be selective wavelength IR emitters which thin films of polar materials, such as silicon carbide, deposited on a reflective substrate like gold. This structure creates a selective IR emissivity profile.

Other methods for constructing a suitable selective IR emitter include the use of carbon, silicon-carbide, and nanostructured emitters as these materials can also be used in various emitter designs, such as those described previously herein, for different thermal and spectral characteristics. The IR emitter utilized as a heater or as part of a heater system comprised a plurality of IR emitter and other emitter types, such an a UV emitter or plurality of UV emitters includes the use of a coherent IR radiation emitter, such as an IR laser. Several types of miniature infrared (IR) lasers may be used for IR radiation heating requiring wavelength specific thermal emissions. Examples include, but are not limited to, Quantum Cascade Lasers (QCLs), Vertical Cavity Surface Emitting Lasers (VCSELs), and miniature tunable diode IR lasers. Quantum Cascade Lasers (QCLs) QCLs are a leading technology for miniature IR applications, especially for those requiring high sensitivity and accuracy and primarily operate in the mid-infrared (MIR) and long-wave infrared (LWIR) ranges (typically 3-20 μm). This range is ideal for thermal modulation of precursor liquid and/or compounds as it covers the fundamental molecular vibrational frequencies of the constituents of the precursor liquid and/or compound. Another benefit of miniature QCLs is that they can operate at or near room temperature, eliminating the need for bulky liquid nitrogen cooling systems, this allows for QCLs to be utilized in small portable devices. These types of lasers can be "chirped," or rapidly tuned, to adjust the wavelength of IR emissions in real-time which has benefits of adjusting or shifting the wavelength(s) of IR radiation emissions during an activation cycle by being able to adjust for blue-shifting and/or red-shifting of the precursor liquid or compound while being heated, and/or adjusting for precursor liquid and/or compound IR radiation absorption characteristics when phase changing to a vapor phase. These lasers can present thermal challenges as while QCLs are miniature, they generate a significant amount of heat and constructing a QCL based heater may also include specialized thermal management, such as micro-channel cooling structures, that may be required to maintain a stable operating temperature and prevent wavelength drift during activation. The need for specialized cooling of the QCL may be mitigated by having short activation cycles, and/or by pulsing the QCL during an activation cycle, and/or by heat-sinking the QCL chassis and/or housing to components of the assembly such as the controller and/or the vaporization assembly including the reservoir components.

Another type of suitable coherent IR radiation source is the Vertical Cavity Surface Emitting Lasers (VCSELs). VCSELs are a highly compact and efficient type of semiconductor laser that can be used for miniature IR thermal emission applications. Although VCSELs have common IR radiation emission wavelengths in the near-infrared (NIR) range (750-980 nm) they can also be constructed to emit at longer wavelengths. VCSELs are well-suited for miniaturization and can be integrated into arrays or combined with photodiodes for tailored IR radiation emission functionality in a compact package. This is useful for applications involving heating and even subsequent thermal detection as VCSEL arrays function as high-intensity IR heat sources for surface heating and can be used in conjunction with IR detectors, cameras, and/or pyrometers to precisely control and measure temperature during an activation cycle(s).

Another type of suitable coherent IR radiation emitter are miniature tunable diode lasers (TDLAS). These lasers operate in both the near-infrared and mid-infrared ranges, with high selectivity and sensitivity. TDLAS systems can be constructed from small, stable semiconductor laser diodes. In a TDLAS system, the laser can be tuned to an absorption band of a target precursor liquid and/or compound, and/or the precursor liquid and/or precursor compound in a vapor and/or gas phase.

It should be understood that the description of IR emitters that may be used is intended to illustrate a variety of technologies that may be suitable for construction of a heater system that includes an IR radiation emitter, either as a standalone heater, or as an array of emitters that is constructed using a plurality of IR emitters, and may or may not be combined with other emitter and/or heater types to construct a heater system, such a combined IR and UV heating system, is not intended to be an exhaustive description of all available IR emitter types and/or technologies and that other types and/or technologies of IR emitters, including both non-coherent and coherent IR radiation emitters may be used. It should also be understood that some of the heater types described herein, including but not limited to incandescent type emitters, as IR emitters may also emit other wavelengths of electromagnetic radiation, including but not limited to UV radiation, and that such emitters may be used individually, or in plurality to function as a combined emitter or emitter system and/or emitter array that emits IR radiation and UV radiation. The specific type of IR emitter(s) utilized for the construction of an IR radiation emitter-based heater, either as a standalone emitter, or as a plurality of emitters, may be determined by a variety of factors, including, but not limited to, design requirements, precursor liquid and/or precursor compound formulation and/or constituents, material selection, manufacturing methods, and economic considerations.

A heater comprised of an IR emitter, either as an individual IR emitter, a plurality of IR emitters, that are constructed to radiate a specific wavelength or wavelengths of IR radiation may be constructed or controlled such that the IR emitter or emitters is tuned to specific precursor liquid IR absorptance characteristics, where such IR absorbance characteristics are validated by direct measurement. For example, the precursor liquid could be analytically quantified for the precursor liquid's IR absorption characteristic using a method to determine the IR absorption characteristics of the precursor liquid and/or precursor compound. Multiple methods exist for measuring IR absorbance of a precursor liquid and/or precursor compound, including but not limited to, Fourier Transform Infrared Spectroscopy or FTIR (also called FT-IR) which is an analytical technique that uses infrared light to analyze the chemical composition of a material by measuring how it absorbs IR radiation. A preferred method for measuring infrared absorption in aqueous samples such as a precursor liquid formulation that contains water is Attenuated Total Reflectance Fourier Transform Infrared (ATR-FTIR) spectroscopy. The high absorbance of liquid water in the mid-infrared region makes standard transmission IR techniques difficult, but ATR-FTIR overcomes this challenge by using a very short path length. Furthermore, an FTIR spectrum can distinguish between pure glycerol (such as VG), pure glycol (such as PG), and water, as well as identify the distinct interactions in precursor liquid mixtures.

Methods that may be used for IR absorption measurement include, but are not limited to, attenuated total reflectance (ATR) and transmission spectroscopy. In ATR, which is the most prevalent technique for liquid analysis, the liquid sample may be positioned on the surface of an ATR crystal, allowing an incident infrared beam to interact with the sample at the crystal interface. Alternatively, in transmission spectroscopy, the liquid precursor sample may be placed in a transmission cell or sandwiched between two IR-transparent plates, such as sodium chloride (NaCl) or potassium bromide (KBr). The infrared beam then passes directly through the sample en route to the detector. Other methods, such as diffuse reflectance or specular reflectance, may also be employed depending on the sample characteristics and analytical requirements. FTIR and ATR-FTIR may also be used to determine the IR absorption characteristics of a non-liquid sample, such as a precursor compound that is thermoviscous and non-liquid at room temperature.

Alternatives to FTIR and/or ATR-FTIR suitable for measuring infrared absorbance of a precursor liquid and/or precursor compound include, but are not limited to, Dispersive IR (DIR) spectroscopy, Near-Infrared (NIR) spectroscopy, Raman Spectroscopy, Diffuse Reflectance Infrared Fourier Transform Spectroscopy (DRIFTS), ATR alone, and Laser Spectrometers. Dispersive systems use a prism or grating to separate wavelengths, while NIR focuses on a different region of the infrared spectrum with unique applications. Laser spectrometers are specialized for measuring specific components at very low concentrations, offering high sensitivity for certain applications. Raman Spectroscopy, which measures light scattering rather than absorption but provides complementary vibrational information. For nanoscale analysis, PiF-IR offers superior spatial resolution and surface sensitivity compared to FTIR. ATR used alone and DRIFTS are also alternatives, though DRIFTS may have lower resolution.

In an embodiment, the IR emitter or plurality of IR emitters functioning as a heater or as part of a combined heater system is tuned to emit IR radiation at a wavelength or wavelengths that match the IR absorption characteristics of a precursor liquid that has been measured by ATR-FTIR spectroscopy. In an embodiment, the IR emitter or plurality of IR emitters functioning as a heater or as part of a combined heater system is tuned to emit IR radiation at a wavelength or wavelengths that match the IR absorption characteristics of a precursor liquid at ambient temperature and/or over a range of temperatures matching the temperatures required to heat the precursor liquid in order to effect a phase change from a liquid to a vapor, that has been measured by ATR-FTIR spectroscopy.

In some embodiments, a miniature IR detector may be incorporated into the reservoir system of the device, or into a controller and/or control unit coupled to the reservoir such that the IR emitter or emitters may radiate the precursor liquid and a IR sensor and/or detector may be radiated by the IR emissions once the emission have passed through the precursor liquid, in order to measure the IR absorbance characteristics of the precursor liquid. There are several types of suitable miniature IR sensors that can be described as two primary categories of IR sensors, those that measure thermal radiation, and those that measure optical (photon) radiation. Thermal IR sensors include bolometers, these sensors change their electrical resistance with temperature. They are suitable for quick lower resolution measurements. Thermopiles are another type of IR sensor constructed from a series of thermocouples with an absorption layer. They utilize the Seebeck effect, where a temperature difference generates a voltage, providing a linear response to incident IR radiation. Pyroelectric sensors are another type of suitable IR sensor. These sensors are sensitive to changes in thermal radiation. An additional attribute of pyroelectric sensors is that special absorption layers allow some pyroelectric sensors to detect UV and even Terahertz (THz) radiation which is useful in a heater system that includes both IR and UV emissions.

Suitable Photon (Optical) IR sensors photodiodes may use the "inner photoelectric effect," where IR radiation quanta generate electron-hole pairs within a semiconductor material. Microbolometers are silicon-based detectors that are typically small and used in integrated sensors for detection and measurement of mid-wave and long-wave IR applications. The choice of specific semiconductor material determines the wavelength sensitivity, for example, InGaAs (Indium Gallium Arsenide) are commonly used for short-wavelength IR (SWIR) applications. Where InSb (Indium Antimonide) is preferred for broadband mid-wave IR (MWIR) detection, and MCT (Mercury Cadmium Telluride) and SLS (Silicon-based Germanium) are used for long-wave IR (LWIR) detection. Multiple semiconductor type sensors may be combined in order to achieve broad IR spectrum measurement sensitivity.

In an embodiment, another way to achieve broad spectrum measurement of IR radiation emissions is to utilize an IR spectrometer capable of comprehensive multi-wavelength measurement. Such suitable spectrometer based sensors include an interferometer. An interferometer works similarly to a prism to separate and resolve the IR radiation into its individual wavelengths. The interferometer works in conjunction with an IR detector to measure the separated wavelengths, creating a full spectrum of the infrared radiation. Types of suitable miniature interferometers include, but are not limited to, fiber-optic Michelson interferometers, miniature lamellar grating interferometers, and small-scale configurations of general types like Fizeau and white-light interferometers. These are miniaturized versions of well-known designs, utilizing technologies such as silicon fabrication to achieve smaller sizes for increased portability or integration into devices. Many miniature interferometers are built using silicon fabrication processes, allowing for the creation of highly integrated and compact optical systems suitable for incorporation into small electronic devices. Additionally, the use of optical fibers in some miniature designs allows for increased flexibility, remote sensing, and easier integration into device sensor systems.

In some embodiments, the IR sensor and/or IR detector may function as a thermal sensor and/or detector for the measurement of thermal energy that may or may not include IR radiation. In some embodiments, a single type of IR detector and/or sensor may be utilized for the direct measurement of a precursor liquid and determination of the IR radiation absorption characteristic of the precursor liquid such as IR absorption wavelength(s) and intensity and/or percentage of IR absorption of the precursor liquid. In some embodiments, a plurality of IR detectors and/or sensors of the same type or of different types of IR detectors and/or sensor may be utilized for the direct measurement of a precursor liquid and determination of the IR radiation absorption characteristic of the precursor liquid such as IR absorption wavelength(s) and intensity and/or percentage of IR absorption of the precursor liquid.

In an embodiment with a disposable reservoir, pod system, and/or cartomizer type configuration, a simpler IR detector may be incorporated into the reservoir, pod, and/or cartomizer assembly such as those described previously in this section, such as bolometers, and/or thermopiles, and/or pyroelectric sensors. In an embodiment with a disposable reservoir, pod system and/or cartomizer type configuration, a simpler IR detector may be incorporated into the reservoir, pod, and/or cartomizer assembly such as those described previously in this section, such as bolometers, and/or thermopiles, and/or pyroelectric sensor, and additional IR detector and/or sensor or plurality of sensors may be incorporated into a control unit and/or controller such as those described previously and subsequently herein. The specific type of IR detector(s) and/or sensor(s) and the sensor and/or detector configuration may be determined by a variety of factors, including, but not limited to, design requirements, material selection, manufacturing methods, and economic considerations.

In embodiments where the heater is comprised of an emitter or plurality of emitters that emit both IR radiation and UV radiation, the system may use a sensor that has capabilities of measuring both IR radiation and UV radiation. Such a sensor may be configured and incorporated into the device as has been previously described herein for UV sensor(s) and IR sensor(s) and/or IR detector(s) and/or UV detector(s) and may serve the same series of functions as those described herein for UV and/or IR sensors and/or detectors. These configurations include, but are not limited to, including the sensor and/or sensors and/or detector and/or detectors into precursor liquid and/or precursor compound reservoir assemblies, pod assemblies, cartomizer assemblies, control unit, and/or controllers that have been described previously and subsequently herein.

An example of a suitable combined IR and UV sensor and/or detector is a dual-band photodetector, such as a semiconductor-based dual-band photodetector for multi-spectral imaging and/or sensing and/or detection. These dual-band sensors and/or detectors are configured based on specific materials and heterojunctions, such as gallium oxide ($Ga_2O_3$) and mercury telluride (HgTe) colloidal quantum dots, to detect both UV and IR wavelengths. These devices utilize the distinct photosensitivity properties of different semiconductor materials to detect radiation across a broad emission range from UV to IR. In addition to enabling simultaneous UV and IR detection, these detectors can be used for dual-wavelength optical demultiplexing, which is a process in optical communication where a demultiplexer (Demux) device separates multiple, wavelength-division multiplexed (WDM) optical signals, each carrying different data, back into their individual wavelengths and routes them to separate output fibers or receivers. This technology enables the efficient use of a single optical fiber to transmit multiple data channels by separating them at the receiving end, such that the dual-band sensor and/or detector system data transmission components can be incorporated into small portable devices.

Suitable dual-band UV and IR sensors and/or detectors can include additional features to improve reliability and usability including programmable sensor control software for customizable features and sensitivity adjustments of the sensor and/or detector system that can be incorporated into a controller and/or control unit as has been described previously and subsequently herein. Such configurable sensor and/or detector software allows for the controller and/or control unit to adjust the sensor and/or detector settings and operational configuration for use with different precursor liquids and/or precursor compounds to maximize sensor and detector sensitivity and functionality for different liquid precursor and/or precursor compound mixtures and/or formulations. Such configurable and programmable software architecture also facilitate the use of the sensor with IR and UV emitters, or plurality of emitters that have emission control programming that adjust the emissions of the emitters or plurality of emitters to match the absorption characteristics of the precursor liquid and/or precursor compound, including changes to the absorption characteristic of the precursor liquid and/or precursor compound that may occur during an activation cycle—such as IR and UV absorption changes resultant from the heating of the precursor liquid and/or precursor compound, and/or changes in IR and UV absorption that may occur when the precursor liquid and/or precursor compound undergoes a phase transition from a liquid and/or a thermoviscous compound that appears solid and/or near solid at ambient temperature into a vapor and/or gas phase as a result of being heated. It should be understood that the description of a combined IR and UV sensor and/or detector is an example of a type of such a suitable sensor, and that other sensor types and/or sensor technologies that can measure both IR and UV may also be utilized. The specific type of combined IR and UV sensor(s) and/or detector(s) and the sensor and/or detector configuration may be determined by a variety of factors, including, but not limited to, design requirements, material selection, manufacturing methods, and economic considerations.

In some embodiments a UV emitter may be combined with different heater types other than an IR emitter and/or heater, such as any of the heater types previously disclosed herein, including but not limited to resistive heaters, ceramic heaters, and inductive heaters. In some embodiments the UV emitter may emit UV radiation that is coherent (e.g. a UV laser). In some embodiments the UV emitter may emit radiation that is non-coherent (e.g. a UV diode). In some embodiments the UV emitter may be a single emitter. In some embodiments the UV heater may include a plurality and/or array of UV emitters. In some embodiments the UV emitter may be a broad UV spectrum emitter that is filtered to emit selective wavelengths of UV radiation. In some embodiments the UV emitter may be a board spectrum emitter that is controllable to emit specific wavelengths of UV radiation. In some embodiments the UV heater may be a plurality of and/or array of UV emitters where individual emitters in the array emit specific narrow ranges of UV radiation.

In some embodiments the precursor liquid and/or compound may include cannabinoids as the active compound, where the cannabinoid may be a single cannabinoid such as THC, or CBD, or CBN, and may also be a combination of cannabinoids, including but not limited to mixtures of THC, CBD, and CBN. In some embodiments the cannabinoid is the active compound in the precursor liquid and/or precursor compound where the cannabinoid may be a single cannabinoid compound such as THC, or CBD, or CBN, and may also be a combination of cannabinoids, including but not limited to mixtures of THC, CBD, and CBN, and the cannabinoid(s) is then combined with a carrier fluid such as PG and/or VG and/or water to form the precursor liquid. In such an embodiment, a UV emitter and an IR emitter may be used in combination and the IR emission range includes the ranges previously described herein for the heating of PG and VG and PG and VG mixtures including those precursor liquids in which water is present with the PG, or VG, or mixture of PG and VG. Embodiments include, but are not limited to, precursor liquids in which water is present with the PG, or VG, or mixture of PG and VG, and an acid may be present as a component of the precursor liquid, such as benzoic acid as an example.

Cannabinoids exhibit several characteristic IR absorption bands, and due to similarities of cannabinoid molecular structure they share some overlapping characteristics in relation to the absorption of IR radiation and subsequent and/or associated vibration(s) of the molecule. However, unique attributes of the structure of cannabinoids result in unique IR absorption characteristics. Key IR absorption bands of THC that can be used for the targeted heating of THC by the emission of specific wavelengths of IR radiation are generally in the mid-IR range at 400-4000 $cm^{-1}$. This includes prominent carbon and hydrogen bond (C—H) bending vibrations in THC typically observed at 1295 $cm^{-1}$. THC also has IR absorption as a result of aromatic carbon to carbon covalent bonding (C=C) stretching vibrations at 1623 $cm^{-1}$ where the aromatic ring in THC is responsible for this key absorption. THC also has O—H stretching from the hydroxyl (—OH) groups present with absorption typically around 3300-3500 $cm^{-1}$. Additional key absorption ranges for THC that differentiate it from other cannabinoids include a phenol O—H stretch typically observed around 3477 $cm^{-1}$ due to the phenol O—H stretch in the THC molecule. There are also additional key absorption ranges from aromatic vibrations in the range of 1620-1660 $cm^{-1}$. THC, in particular, shows absorption from aromatic vibrations at 1623 $cm^{-1}$. There are characteristic cannabinoid bands, including but not limited to several specific bands around 1624, 1581, 1510, 1462, and 1374 $cm^{-1}$ are characteristic of most cannabinoids including THC. The absorption in the near IR (NIR) range in THC is weak and comes from overtones of the strong mid-IR vibrations and are less meaningful for absorption targeted IR heating of THC. Other factors such as molecular conformation may change the absorption range of THC as the spatial arrangement of THC's structure can influence the IR absorption. Different conformers, especially those stabilized by hydrogen bonds, produce distinct IR absorption ranges. Therefore the description of the absorption ranges of THC to IR radiation contained herein is intended to describe some of the relevant IR wavelengths that may be utilized to heat THC utilizing targeted wavelength IR radiation but should not be considered an exhaustive description and other wavelengths of IR radiation may be used depending on the actual IR absorption characteristic of the THC present in a precursor liquid and/or precursor compound.

In an embodiment an IR emitter may have broad emissions from 400-4000 $cm^{-1}$ for the purpose of heating a precursor liquid and/or precursor compound containing THC sufficiently to cause a phase change of the precursor to a vapor phase. In an embodiment, an IR emitter may have emissions with peak emissions at multiple ranges including 1290-1300 $cm^{-1}$, 1620-1670 $cm^{-1}$, and 3300-3500 $cm^{-1}$ for the purpose of heating a precursor liquid and/or precursor compound containing THC sufficiently to cause a phase change of the precursor to a vapor phase. In an embodiment intended to be used with a THC precursor liquid and/or precursor compound, the UV emitter present as part of a combined IR and UV heating system may have a UV emitter with an emission range of 200-350 nm and peak emissions at 205-215 nm and 275-285 nm and has an IR emitter that has broad emissions from 400-4000 $cm^{-1}$ for the purpose of heating a precursor liquid and/or precursor compound containing THC sufficiently to cause a phase change of the precursor to a vapor phase. In an embodiment intended to be used with a THC precursor liquid and/or precursor compound, the UV emitter present as part of a combined IR and UV heating system may have a UV emitter with an emission range of, for example, 200-350 nm and peak emissions at 205-215 nm and 275-285 nm and an IR emitter with emissions with peak emissions at multiple ranges including, for example, 1290-1300 $cm^{-1}$, 1620-1670 cm-1, and 3300-3500 $cm^{-1}$ for the purpose of heating a precursor liquid and/or precursor compound containing THC sufficiently to cause a phase change of the precursor to a vapor phase.

Although THC and CBD are both cannabinoids and share some similarities in their ability to absorb IR radiation, they also have distinct IR absorption ranges due to minor structural differences that affect molecular vibrations. Although both are terpenophenolic compounds with similar structures, the position of their double bonds and the arrangement of a key oxygen-containing ring create unique vibrational patterns that may be targeted by specific wavelengths of IR radiation in order to heat a precursor with CBD present as the active compound. Key IR absorption bands of CBD that can be targeted for IR radiation heating of a CBD precursor liquid and/or compound include a broad-OH stretch from 3550-3300 cm-las CBD has two hydroxyl (—OH) groups on its phenolic ring. These groups participate in hydrogen bonding, which causes the absorption band to be broad and appear in the 3550-3300 cm 1 region, however if the CBD was a component of a liquid precursor mixture where the precursor liquid was a dilute CBD solution, a sharp absorption band may also be present around 3600 $cm^{-1}$, indicating some free, non-hydrogen-bonded-OH groups. Aromatic C═C stretches absorb IR radiation at 1628 and 1586 $cm^{-1}$. Additionally, the benzene ring in CBD produces characteristic IR absorption due to the stretching of its carbon-carbon double bonds (C═C). This absorption typically occurs at 1628 $cm^{-1}$ and 1586 $cm^{-1}$. Aromatic C—H stretching causes absorption at ranges of 3085-3160 $cm^{-1}$ where these vibrations, which correspond to the C—H bonds on the aromatic ring, are typically observed in the region above 3000 $cm^{-1}$. Aliphatic C—H stretches absorb IR radiation at ranges of 3000-2850 $cm^{-1}$. CBD's aliphatic (non-aromatic) regions, which include the pentyl side chain and the cyclohexene ring, show strong C—H stretching IR absorption below 3000 $cm^{-1}$. Aliphatic C—H bends in the range of 1400-1200 cm 1 where these bending vibrations of the aliphatic —$CH_2$— and —$CH_3$ groups absorb IR in the 1400-1200 $cm^{-1}$ region. The C═C stretch of the cyclohexene ring absorbs IR radiation in the range of 1650-1670 cm 1, and the cyclohexene ring in CBD also has a C═C bond, which produces a characteristic stretching absorption in the 1650-1670 $cm^{-1}$ range.

IR absorption of CBD can be influenced by intramolecular hydrogen bonding, where the intramolecular hydrogen bonds between the hydroxyl groups and the π-electrons of the aromatic ring significantly affect the position of the —OH stretching absorption range. The strength and nature of these hydrogen bonds can cause shifts in other absorption ranges as well, such as the C═C stretch of the cyclohexene ring. Other factors such as molecular conformation can change the absorption range of CBD as the spatial arrangement of CBD's structure can influence the IR absorption. Different conformers, especially those stabilized by hydrogen bonds, produce distinct IR absorption ranges. Therefore, the description of the absorption ranges of CBD to IR radiation contained herein is intended to describe some of the relevant IR wavelengths that may be utilized to heat CBD utilizing targeted wavelength IR radiation but should not be considered an exhaustive description and other wavelengths of IR radiation may be used depending on the actual IR absorption characteristic of the CBD present in a precursor liquid and/or precursor compound. In an embodiment an IR emitter has broad emissions from 1150-3600 $cm^{-1}$ for the purpose of heating a precursor liquid and/or precursor compound containing CBD sufficiently to cause a phase change of the precursor to a vapor phase.

In an embodiment, an IR emitter has emissions with peak emissions at multiple ranges including 1190-1410 $cm^{-1}$, 1580-1630 $cm^{-1}$, and 2800-3050 $cm^{-1}$ and for the purpose of heating a precursor liquid and/or precursor compound containing CBD sufficiently to cause a phase change of the precursor to a vapor phase. In an embodiment intended to be used with a CBD precursor liquid and/or precursor compound, the UV emitter present as part of a combined IR and UV heating system may have a UV emitter with one emission range at 207-220 nm and another emission range at 275-280 nm and may have an IR emitter that has broad emissions from 1150-3600 $cm^{-1}$ for the purpose of heating a precursor liquid and/or precursor compound containing CBD sufficiently to cause a phase change of the precursor to a vapor phase. In an embodiment intended to be used with a CBD precursor liquid and/or precursor compound, the UV emitter present as part of a combined IR and UV heating system may have a UV emitter with an emission range of, for example, 200-300 nm and peak emissions at 207-220 nm and 275-280 nm and a IR emitter that has emissions with peak emissions at multiple ranges including, for example, 1190-1410 $cm^{-1}$, 1580-1630 $cm^{-1}$, and 2800-3050 $cm^{-1}$ for the purpose of heating a precursor liquid and/or precursor compound containing CBD sufficiently to cause a phase change of the precursor to a vapor phase.

Although THC, CBD, and CBN (cannabinol) are all cannabinoids and share some similarities in their ability to absorb IR radiation they also have distinct IR absorption ranges due to minor structural differences that affect molecular vibrations. For example, CBN has a stable aromatic ring system that is absent in THC. These structural variations produce distinct absorption characteristic to IR radiation. Another example is that CBN has a linear, "open-ring" structure that results from the fission of a ring in the precursor molecule. This gives CBN two distinct hydroxyl (—OH) groups, where CBN has an oxidized, fully aromatic six-membered ring, in contrast to the non-aromatic rings found in CBN. This aromatic structure affects the compound's overall electronic properties and vibrational characteristics and accounts for the differences in the IR absorption characteristic of CBN when compared to THC and CBD. CBN is also a terpenophenolic compound whose IR absorption ranges are characterized by vibrations from its unique (when compared to other cannabinoids) aromatic rings, hydroxyl group, and alkyl side chain. Specific key absorption regions for CBN are strong absorption of IR radiation at 1610 $cm^{-1}$ and 1624 $cm^{-1}$. As well as absorption associated with the aromatic ring's carbon-carbon double bonds (C═C) at 1302 $cm^{-1}$ and 1285 $cm^{-1}$. Other typical absorption regions for CBN based on its functional groups, include the aromatic C—H stretches which typically absorb IR radiation just above 3000 $cm^{-1}$, usually in the 3100-3050 $cm^{-1}$ range. Aliphatic C—H stretches, there the alkyl chain and methyl groups show strong C—H stretching vibrations when absorbing IR radiation in the 3000-2850 $cm^{-1}$ range. There is also the phenol O—H stretch as CBN contains a phenolic hydroxyl group (O—H), which appears as a broad, medium-intensity absorption region in the 3500-3300 $cm^{-1}$ range due to hydrogen bonding. There is also a phenol C—O stretch where the carbon-oxygen (C—O) stretch of the phenolic group typically absorbs IR radiation in the 1300-1000 $cm^{-1}$ range. Additionally, there are Alkane C—H bending that occurs when CBN absorbs IR radiation from the methyl (—$CH_3$) and methylene (—$CH_2$—) groups on the alkyl side chain show that have characteristic medium-intensity bending absorptions around 1450 $cm^{-1}$ and 1375 $cm^{-1}$.

Other factors such as molecular conformation may change the absorption range of CBN as the spatial arrangement of CBN's structure can influence the IR absorption. Different conformers, especially those stabilized by hydrogen bonds, produce distinct IR absorption ranges. Therefore the description of the absorption ranges of CBN to IR radiation contained herein is intended to describe some of the relevant IR wavelengths that may be utilized to heat CBN utilizing targeted wavelength IR radiation but should not be considered an exhaustive description and other wavelengths of IR radiation may be used depending on the actual IR absorption characteristic of the CBN present in a precursor liquid and/or precursor compound.

In an embodiment an IR emitter has broad emissions from 1000-3500 $cm^{-1}$ for the purpose of heating a precursor liquid and/or precursor compound containing CBN sufficiently to cause a phase change of the precursor to a vapor phase. In an embodiment, an IR emitter has emissions with peak emissions at multiple ranges including, for example, 950-1400 $cm^{-1}$, 1600-1630 $cm^{-1}$, 2800-3050 $cm^{-1}$, and 3150-3550 $cm^{-1}$ for the purpose of heating a precursor liquid and/or precursor compound containing CBN sufficiently to cause a phase change of the precursor to a vapor phase. In an embodiment intended to be used with a CBN precursor liquid and/or precursor compound, the UV emitter present as part of a combined IR and UV heating system may have a UV emitter with one emission range at 218 nm and another emission range at 283 nm and may have an IR emitter that has broad emissions from 1000-3500 $cm^{-1}$ for the purpose of heating a precursor liquid and/or precursor compound containing CBN sufficiently to cause a phase change of the precursor to a vapor phase. In an embodiment intended to be used with a CBN precursor liquid and/or precursor compound, the UV emitter present as part of a combined IR and UV heating system may have a UV emitter with an emission range of 210-290 nm and peak emissions at 215-220 nm and 275-285 nm and a IR emitter that has emissions with peak emissions at multiple ranges including, for example, 950-1400 $cm^{-1}$, 1600-1630 $cm^{-1}$, 2800-3050 $cm^{-1}$, and 3150-3550 $cm^{-1}$ for the purpose of heating a precursor liquid and/or precursor compound containing CBN sufficiently to cause a phase change of the precursor to a vapor phase.

In some applications of the device where the precursor liquid and/or precursor compound contains THC, and/or is comprised of cannabinoids including THC, the device may serve to selectively convert and/or interconvert cannabinoids as part of an activation cycle and/or preceding an activation cycle. As an example, THC may be converted to CBN, as THC and CBN have different physiological effects when inhaled, and a user may in certain use cases desire the physiological effects of THC (e.g. pain relief, euphoria, appetite stimulation) or the physiological effects of CBN (e.g. sleep promotion, relaxation, anti-inflammation effects) or a blended combination of the physiological effects of THC and CBN (e.g. 50% THC and 50% CBN, 75% THC and 25% CBN, 25% THC and 75% CBN). As THC can be converted to CBN a THC based precursor liquid and/or precursor compound may serve as the base precursor liquid and/or compound and then be converted to yield CBN at a desired ratio of CBN to THC or converted entirely or nearly entirely to CBN. Conversion of THC to CBN may occur preceding an activation cycle, or as part of an activation cycle, or as both preceding an activation cycle and in conjunction with an activation cycle.

In embodiments where a UV emitter or plurality of UV emitters is used as a heater or as part of a heater system, such as a combined UV and IR heater system, the UV radiation in combination with heating can be used to convert THC to CBN using UV radiation emission wavelengths within, for example, the UV-B range of 280-315 nm, to convert THC to CBN. Additionally, in some embodiments, the UV emitter may also emit UV-A wavelengths of 315-400 nm to facilitate the THC to CBN conversion process. This conversion process is known as photo-oxidation, which happens naturally when cannabis ages and is exposed to light and oxygen. For a controlled conversion, UV may be combined with heat and oxygen to speed up the conversion process. UV conversion of THC to CBN occurs when THC is oxidized into CBN. UV radiation causes the THC molecule to lose hydrogen atoms and converts to an oxidized, and more stable, CBN. UV absorption spectra of cannabinoids identify peak absorption for THC around 209 nm and 278 nm, and for CBN around 218 nm and 283 nm. Such wavelengths in the UV-B range, particularly near 280 nm, are effective for triggering the chemical conversion reaction of THC to CBN. Full spectrum UV radiation can also be utilized where the emission of UV-A, UV-B, and UV-C in the presence of heat and oxygen converts THC to CBN.

It should be noted that oxidation and heat are necessary as UV light alone is not the sole catalyst for the conversion reaction. The process of conversion of THC to CBN may convert precursor liquid and/or precursor compound present in the vaporization chamber (such as chamber 130, 230, 330, 430, 530, 630, 730, 1130, 1330, 1430, 2340, 2440, 2540, 2740, 2843, 3043, 3140 and other chambers described herein including chamber assembly 830, 1006, 1700, 1800, 1900, 2000, 2100, 2340, 2640, 3240 and other chamber assemblies described herein), and/or the secondary reservoirs (such as secondary reservoirs 1312, 1412, 1512, 2032 and other secondary reservoirs described herein), and/or the reservoir (such as reservoir 110, 210, 310, 410, 510, 610, 710, 810, 901, 1102, 1302, 1402, 1502, 1612, 2210 and other reservoirs described herein) of vaporization device (such as vaporization device 100, 200, 300, 400, 500, 600, 700, 800, 1100, 1600, 3100 and other vaporization device described herein including vaporizer(s) described herein including vaporizer 1000, and including vaporization assemblies including vaporization assembly 2300, 2400, 2500, 2600, 2700, 2800, 2900, 3000, 3100 and other vaporizer assemblies described herein).

It should be understood that conversion of THC to CBN may also occur in the channels, ports, and other regions, previously and subsequently described herein, where the precursor liquid and/or precursor compound are present in such structures that are in fluidic communication involving the reservoir, and/or secondary reservoir(s), and/or chamber, and or chamber assemblies. In an embodiment where the heater is comprised of a UV emitter or plurality of UV emitters combined with an IR emitter or plurality of IR emitters to form a combined heater system, the UV radiation may be utilized in combination with the IR thermal radiation to partially or entirely convert the THC present in a precursor liquid and/or precursor formulation to CBN. In an embodiment where the heater is comprised of a UV emitter or plurality of UV emitters combined with heat source to form a combined heater system, the UV radiation may be utilized in combination with the IR thermal radiation to partially or entirely convert the THC present in a precursor liquid and/or precursor formulation to CBN. In an embodiment where the heater is comprised of an emitter having at least some of the emissions being UV radiation, the emitted UV radiation may be utilized in combination with the heat generated from the heater to partially or entirely convert the THC present in a precursor liquid and/or precursor formulation to CBN.

In some embodiments, the conversion of THC to CBN from a precursor liquid and/or precursor compound containing THC may be initiated by user selection through a control unit and/or controller. In some embodiments, the conversion of THC to CBN from a precursor liquid and/or precursor compound containing THC may be initiated by user selection through a control unit and/or controller where the selection is based on the user input to related physiological effects (e.g. increasing antiinflammation, increased sleep promotion, increased pain relief). In some embodiments, the conversion of THC to CBN from a precursor liquid and/or precursor compound containing THC may be initiated by user selection through a control unit and/or controller where the conversion THC to CBN is scheduled to occur at various times, for example, if a user desires promotion of appetite than conversion does not occur during mealtimes, where the same user may desire sleep promotion in the evenings, and conversion of THC to CBN may be timed to begin in the evenings and/or increase throughout the evening.

In some embodiments, machine learning may be used to optimize activation cycles and THC to CBN conversion based on the user's patterns of activation and/or other user input. In some embodiments, UV sensors and/or detectors, and/or IR sensor and/or detectors, and/or thermal energy sensors and/or detectors, may be used in conjunction with emitted UV radiation combined with IR radiation and/or thermal energy to measure the conversion of THC to CBN through the changes and/or difference in absorption characteristics of UV radiation and/or IR radiation of THC and CBN. In some embodiments, UV sensors and/or detectors, and/or IR sensor and/or detectors, and/or thermal energy sensors and/or detectors, may be used in conjunction with emitted UV radiation combined with IR radiation and/or thermal energy to measure and/or control the conversion of THC to CBN through the changes and/or difference in absorption characteristics of UV radiation and/or IR radiation of THC and CBN such that the spectroscopic characteristics of THC and CBN are used to determine the degree and/or percentage of conversion. In some embodiments, UV sensors and/or detectors, and/or IR sensor and/or detectors, and/or thermal energy sensors and/or detectors, may be used in conjunction with emitted UV radiation combined with IR radiation and/or thermal energy to measure and/or control the conversion of THC to CBN through the changes and/or difference in absorption characteristics of UV radiation and/or IR radiation of THC and CBN such that the spectroscopic characteristics of THC and CBN are used to determine the degree and/or percentage of conversion and the IR sensors and/or thermal energy sensor is used to monitor the temperature of the conversion reaction. In some embodiments, UV sensors and/or detectors, and/or IR sensor and/or detectors, and/or thermal energy sensors and/or detectors, may be used in conjunction with emitted UV radiation combined with IR radiation and/or thermal energy to measure and/or control the conversion of THC to CBN through the changes and/or difference in absorption characteristics of UV radiation and/or IR radiation of THC and CBN such that the spectroscopic characteristics of THC and CBN are used to determine the degree and/or percentage of conversion, and the IR sensors and/or thermal energy sensor are used to monitor the temperature of the conversion reaction, where the data from the sensor or sensors is communicated to a controller and/or control unit that can modulate the output of UV radiation and IR radiation and/or thermal energy as necessary to effect a conversion of THC to CBN.

In some embodiments, UV sensors and/or detectors, and/or IR sensor and/or detectors, and/or thermal energy sensors and/or detectors, may be used in conjunction with emitted UV radiation combined with IR radiation and/or thermal energy to measure and/or control the conversion of THC to CBN through the changes and/or difference in absorption characteristics of UV radiation and/or IR radiation of THC and CBN such that the spectroscopic characteristics of THC and CBN are used to determine the degree and/or percentage of conversion, and the IR sensors and/or thermal energy sensor may be used to monitor the temperature of the conversion reaction, where the data from the sensor or sensors is communicated to a controller and/or control unit to confirm that a preprogrammed control algorithm is resulting in the desired conversion of THC to CBN. In some embodiments, UV sensors and/or detectors, and/or IR sensor and/or detectors, and/or thermal energy sensors and/or detectors, may be used in conjunction with emitted UV radiation combined with IR radiation and/or thermal energy to measure and/or control the conversion of THC to CBN through the changes and/or difference in absorption characteristics of UV radiation and/or IR radiation of THC and CBN such that the spectroscopic characteristics of THC and CBN are used to determine the degree and/or percentage of conversion, and the IR sensors and/or thermal energy sensor may be used to monitor the temperature of the conversion reaction, where the data from the sensor or sensors is communicated to a controller and/or control unit to confirm that a preprogrammed control algorithm is terminating when desired conversion percentage and/or fraction of THC to CBN has been reached.

In some embodiments, UV sensors and/or detectors, and/or IR sensor and/or detectors, and/or thermal energy sensors and/or detectors, may be used in conjunction with emitted UV radiation combined with IR radiation and/or thermal energy to measure and/or control the conversion of THC to CBN through the changes and/or difference in absorption characteristics of UV radiation and/or IR radiation of THC and CBN such that the spectroscopic characteristics of THC and CBN are used to determine the degree and/or percentage of conversion, and the IR sensors and/or thermal energy sensor may be used to monitor the temperature of the conversion reaction, where the data from the sensor or sensors is communicated to a controller and/or control unit to provide a machine learning based control algorithm with relevant data to optimize the THC to CBN conversion process.

Some precursor liquid and/or precursor compound formulations may contain tetrahydrocannabinolic acid (THCA). THCA does not readily cross the blood brain barrier and does not possess the same common physiological effects as THC. In such a formulation, it may be desirable to convert THCA to THC. IR radiation and/or thermal radiation can convert THCA to THC through decarboxylation. Decarboxylation involves removing a carboxyl group (—COOH) from THCA by applying heat, which transforms it into the psychoactive THC. IR radiation transfers energy directly to the THCA containing precursor liquid and/or compound, causing intense, rapid heating. Optimal decarboxylation for THCA occurs between 220 °F (104 °C) and 240 °F (115 °C), although higher temperatures can cause faster conversion but risk degrading other cannabinoids and aromatic terpenes. In some embodiments where a precursor liquid and/or precursor compound contains THCA, the precursor is heated sufficiently by IR radiation and/or thermal energy emission during activation to convert the THCA to THC.

Figure 21B:
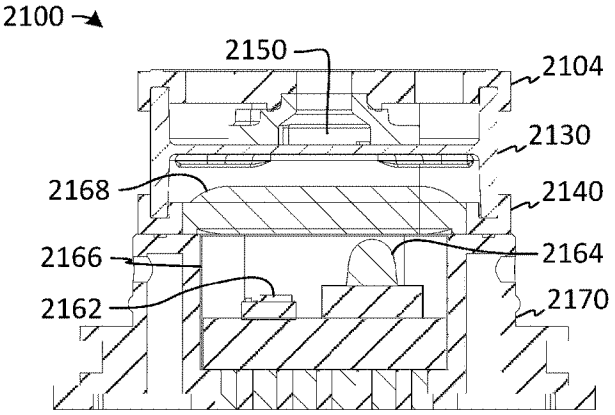
FIG. 21B illustrates a cross section of a chamber assembly.
Figure 21C:
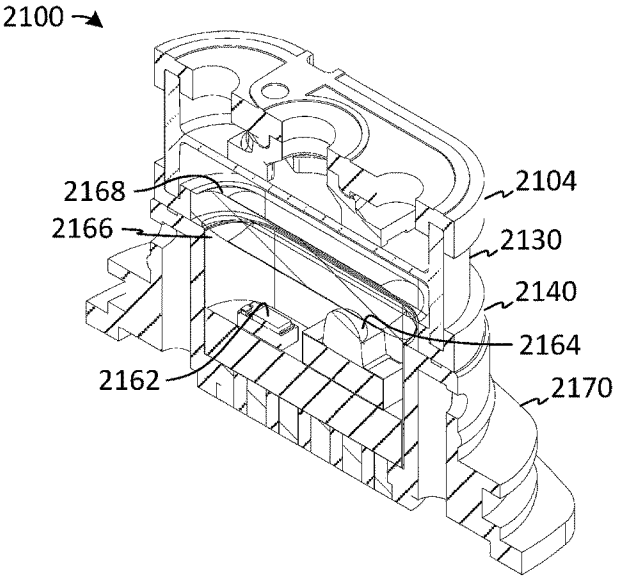
FIG. 21C illustrates an isometric cross-sectional view of a chamber assembly.
Figure 21A:
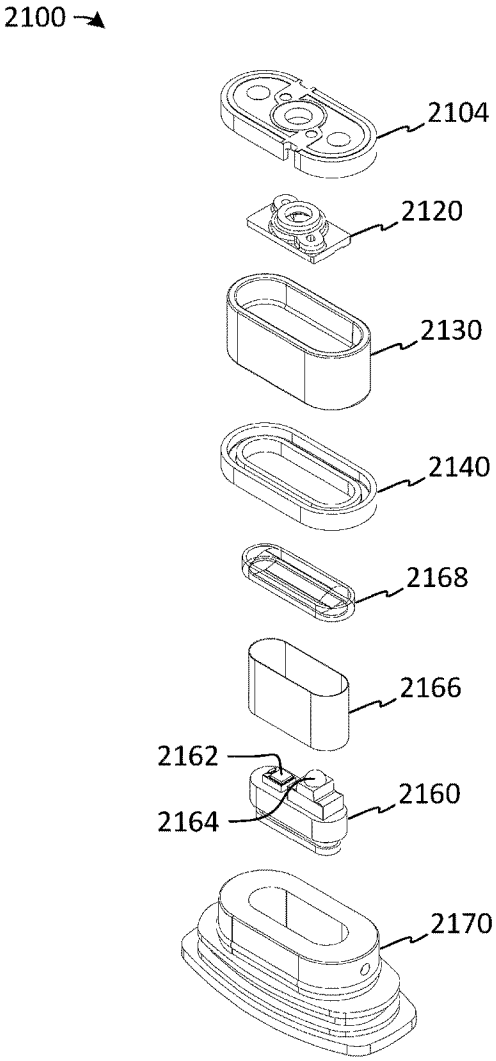
FIG. 21A illustrates an exploded isometric view of a chamber assembly.

FIGS. 21A through 21C provide various views of a chamber assembly. FIG. 21A illustrates an exploded isometric view, FIG. 21B offers a cross-sectional depiction, and FIG. 21C presents an isometric cross-sectional view. Chamber assembly 2100 may comprise flow director 2104, chamber top 2120, chamber bottom 2130, lower seal 2140, lens 2168, reflector 2166, heater assembly 2160, and lower chassis 2170. With the exception of heater assembly 2160 and associated optical elements, many structural features in chamber assembly 2100 may correspond to those previously described with respect to chamber assembly 2000. For instance, flow director 2104 may be generally analogous to flow director 2004, and chamber top 2120 and lower seal 2140 may be constructed in manners substantially similar to chamber top 2020 and lower seal 2040, respectively.

Chamber top 2120 may be designed to actively participate in the regulation, reflection, or absorption of radiant energy delivered by heater assembly 2160. In certain embodiments, chamber top 2120 may be manufactured from a base material such as borosilicate glass, fused silica, or aluminosilicate, and may further comprise coatings or doped regions to modulate the transmittance, reflectance, or absorptivity at selected wavelengths. For instance, doping chamber top 2120 glass with metallic or oxide additives may alter its transmission properties. Cerium or titanium doping can affect UV absorption, while OH-group doping in fused silica may increase absorption near the IR range. In some cases, a multilayer reflective oxide or metal oxide stack (such as quarter-wave stacks of $TiO_2$ and $SiO_2$, or layers containing indium tin oxide or zinc tin oxide) may be applied to one or more surfaces to enhance reflectivity for UV and/or IR while maintaining transparency in the visible range. These features may allow chamber top 2120 to serve either as an efficient energy barrier, reflecting thermal or photonic energy back into chamber 2150, or as a partial absorber to achieve controlled self-heating for flow modulation of a precursor. Alternatively, chamber top 2120 may be constructed to be at least partially transparent at operational wavelengths to permit diagnostic light transmission or allow user-visible emission as an activation indicator.

Chamber bottom 2130 may likewise be constructed to support selective energy delivery and/or thermal isolation. In some embodiments, chamber bottom 2130 may be manufactured from high-purity fused silica or doped glass materials, specifically chosen to transmit one or both of the UV and IR wavelengths produced by heater assembly 2160, while attenuating transmission of non-essential wavelengths or vapor-phase byproducts. Incorporating dopants such as aluminum, magnesium, or fluorine into the glass matrix may permit fine-tuning of transmission spectra; alternatively, interference coatings or nano-structured oxide layers (for example, $TiO_2$, ZnO, or multilayer stacks combining conducting oxides with metallic silver) may be deposited to achieve high reflectivity at particular spectral bands. Chamber bottom 2130 may also function as a physical barrier, preventing direct contact between liquid precursor and heater elements, thereby avoiding chemical contamination and promoting uniform heating. In yet other configurations, selective doping or functionalization may imbue chamber bottom 2130 with additional features such as IR or UV photodetection, where plasmonic nanoparticles or aliovalent dopants (e.g., Ag in cerium oxide, or Mg in yttria-stabilized zirconia) facilitate photonic sensing or feedback control.

Heater assembly 2160 may comprise UV emitter 2162 and IR emitter 2164, each positioned such that their respective emissions are directed toward chamber bottom 2130 and, ultimately, into chamber 2150. In certain embodiments, UV emitter 2162 may be a compact ultraviolet light-emitting diode (UV LED), a semiconductor diode laser emitting in the ultraviolet spectrum, or, in some cases, a miniature halogen bulb with an envelope selected to transmit UV radiation. IR emitter 2164 may be implemented as an infrared LED, a semiconductor diode laser operating in the near- or mid-infrared spectrum, or a halogen bulb that emits both UV and IR wavelengths. Although UV emitter 2162 and IR emitter 2164 may be illustrated as discrete components, alternative configurations may combine these emitters within a single package. In some cases, the output of each emitter may be modulated independently to achieve programmatic control over the intensity and duration of both UV and IR delivery to chamber 2150. This arrangement may allow for highly targeted delivery of radiant energy, thereby supporting selective molecular excitation, tailored vaporization, and enhanced control over the resulting aerosol composition and volatility.

Reflector 2166 may be disposed around heater assembly 2160, and may be constructed to maximize the reflection of both UV and IR radiation toward chamber bottom 2130. Reflector 2166 may be manufactured from highly reflective metals such as aluminum, silver, or rhodium, or from oxide-based multilayer mirror systems comprised of materials such as $TiO_2$, $SiO_2$, MgO, or hybrid stacks incorporating indium tin oxide or zinc tin oxide. In some cases, surface morphology may be tailored to further enhance reflectivity within specified spectral bands.

Lens 2168 may be positioned between heater assembly 2160 and chamber 2150, though in certain embodiments heater assembly 2160 could function effectively without lens 2168. Lens 2168 may be configured to focus or otherwise modulate the spatial distribution of emitted radiation, thereby concentrating energy delivery within selected regions of chamber 2150. In some embodiments, lens 2168 may comprise a converging optical element, for example a plano-convex or biconvex lens, to condense and direct ultraviolet or infrared radiation toward a designated target area. The focal length of lens 2168 may be selected based on the geometrical arrangement of heater assembly 2160, chamber 2150, and the intended energy profile, and could range from short-focus elements (to produce tight focal spots) to longer-focus components designed for broad, collimated energy delivery.

Lens 2168 may be fabricated from radiation-transparent materials including, but not limited to, fused silica, sapphire, or suitably engineered optical ceramics. Additional control over the transmission characteristics of lens 2168 may be achieved through the incorporation of dopants or the application of coatings to selectively block or attenuate undesirable wavelengths while enhancing passage of target emissions. Such modifications may include metal oxide doping, interference multilayer coatings, or surface treatments engineered to reduce optical losses at ultraviolet or infrared operational bands. Optional anti-reflective or wavelength-selective coatings may further be employed to maximize efficiency or to prevent back-scattering. In some embodiments, dopants such as cerium, titanium, indium tin oxide (ITO), zinc oxide (ZnO), or magnesium oxide (MgO), as previously described with regard to chamber top 2120 and chamber bottom 2130, may be incorporated into lens 2168 to modulate the transmission or reflectivity at ultraviolet or infrared wavelengths. Selection of particular dopant species or concentrations may be guided by the desired spectral selectivity, thermal stability, and compatibility with operational wavelengths targeted by heater assembly 2160.

Ultraviolet (UV) and infrared (IR) emitters may provide a novel means of heating precursor compositions and, in some cases, may present certain advantages over traditional resistive heating elements. One potential limitation, however, is that temperature may not be inferred from changes in resistance within the emitter, as is possible with resistive heating elements. Accordingly, it may be advantageous to incorporate an additional element capable of determining the chamber temperature.

Figure 22:
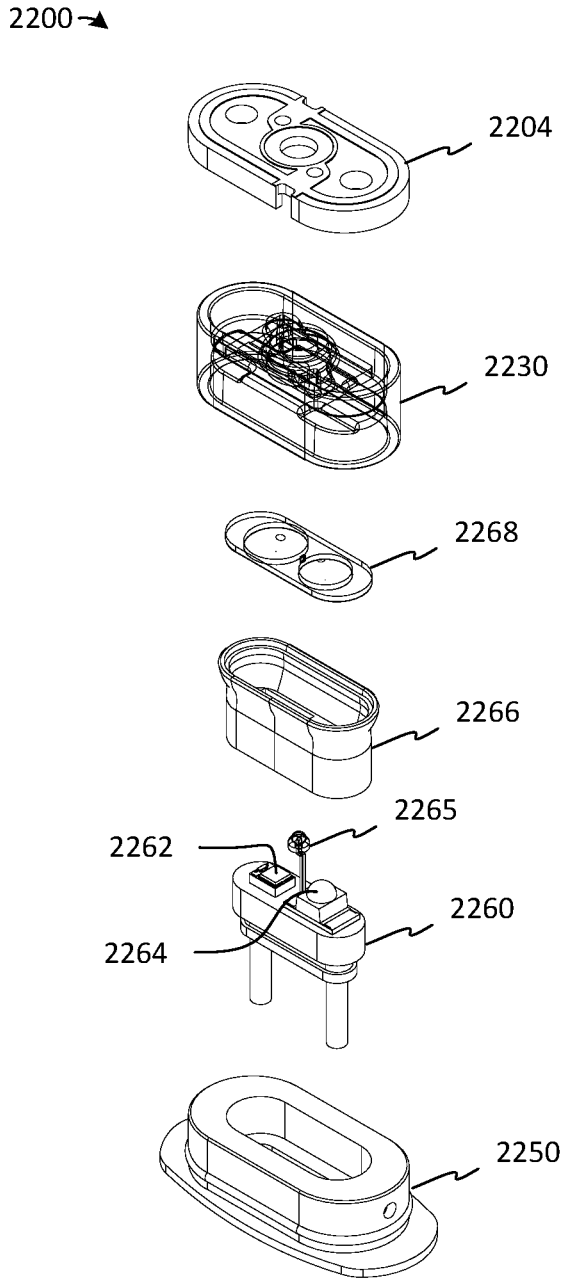
FIG. 22 illustrates an exploded view of a chamber assembly.

FIG. 22 illustrates an exploded view of a chamber assembly. Chamber assembly 2200 may comprise flow director 2204, chamber assembly 2230, optical assembly 2268, reflector 2266, heater assembly 2260, and lower chassis 2250. Many of the components forming chamber assembly 2200 may correspond to those in chamber assembly 2100, although, in alternative embodiments, different configurations or substitute components may be employed to achieve similar functionality.

Heater assembly 2260 may be implemented substantially similarly to heater assembly 2160, with the addition of sensor 2265. In certain embodiments, heater assembly 2260 may include UV emitter 2262, IR emitter 2264, and sensor 2265. Sensor 2265 may be adapted to monitor the temperature of the chamber or a sample contained therein. In various implementations, sensor 2265 may employ a range of temperature-sensing technologies, including, for example, a thermocouple, thermistor, resistance temperature detector (RTD), or semiconductor-based temperature sensor. Additionally, in some embodiments, sensor 2265 may comprise a miniature infrared (IR) sensor, such as a bolometer, thermopile, or pyroelectric sensor, which may be positioned to detect thermal or optical radiation within the chamber. The use of such sensors may enable contact or non-contact temperature monitoring, and in certain cases, allow for the detection of both IR and UV radiation, depending on the spectral emissions present within the chamber. Other suitable sensor types or configurations may be selected based on chamber geometry, desired measurement resolution, or compatibility with emitted radiation.

Optical assembly 2268 may be generally similar to lens 2168 while integrating additional functional features. Optical assembly 2268 may be configured to direct UV radiation, IR radiation, or a combination thereof, in order to facilitate heating of a precursor composition retained within chamber assembly 2200. In some implementations, optical assembly 2268 may include one or more convex lenses whose focal regions are designed to coincide at a common convergence point. Each lens may be selectively optimized for transmittance within either the UV or IR spectral ranges. The lenses may further be provided with distinct focal lengths to compensate for chromatic dispersion between the UV and IR spectral bands, thereby enabling simultaneous convergence of both wavelengths at a single spatial location.

As shown in FIG. 22, optical assembly 2268 may comprise two lenses laterally positioned along a common planar surface. In certain embodiments, only the lenses may function to direct radiant energy towards a precursor composition within the chamber, while the planar surface positions the lenses relative to one another. In some embodiments, this planar surface may be a reflective surface. This reflective surface may redirect unfocused energy toward reflector 2266, allowing further redirection through one or more lenses and thereby increasing overall efficiency. A reflective surface may be directly applied to optical assembly 2268 or may comprise an additional component.

In some embodiments, optical assembly 2268 may include a feature such as a cavity, boss, or other suitable geometry configured to couple with sensor 2265. It may be advantageous to position sensor 2265 as close to the common convergence point as physically possible, thereby enhancing the accuracy of temperature measurements in the region where radiant energy is concentrated.

While prior embodiments have disclosed the use of discrete ultraviolet (UV) and infrared (IR) emitters to provide energy for vaporizing a precursor, alternative embodiments may incorporate miniature light bulbs as a heating element. In particular, halogen light bulbs may be advantageous in this context, as they are capable of emitting both UV and IR radiation. Such bulbs frequently encase the filament in quartz, which may function to physically isolate the internal metallic filament from the precursor composition, as well as any generated vapor or aerosol. This configuration may reduce the risk of contaminant transfer from the heating element to the aerosol stream and may further enable a broader spectral emission profile to facilitate efficient vaporization.

Figure 23B:
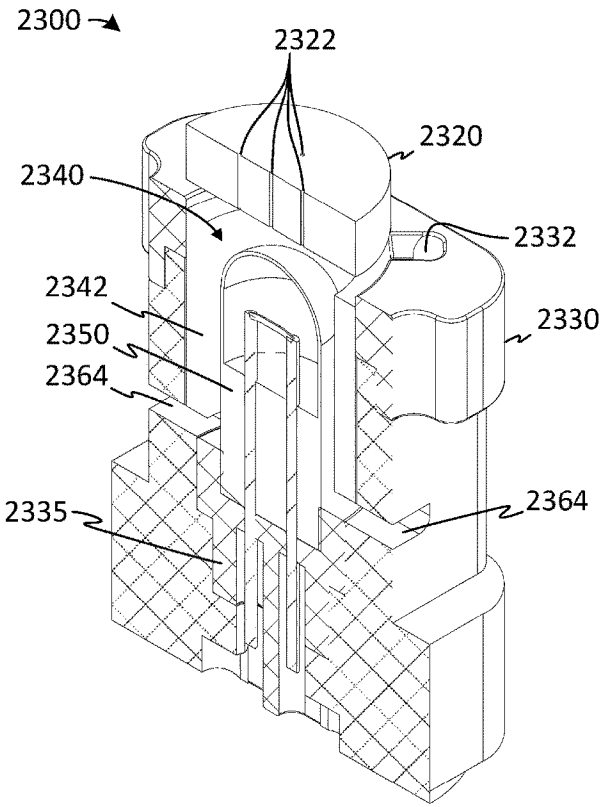
FIG. 23B illustrates an isometric view of a chamber assembly.
Figure 23A:
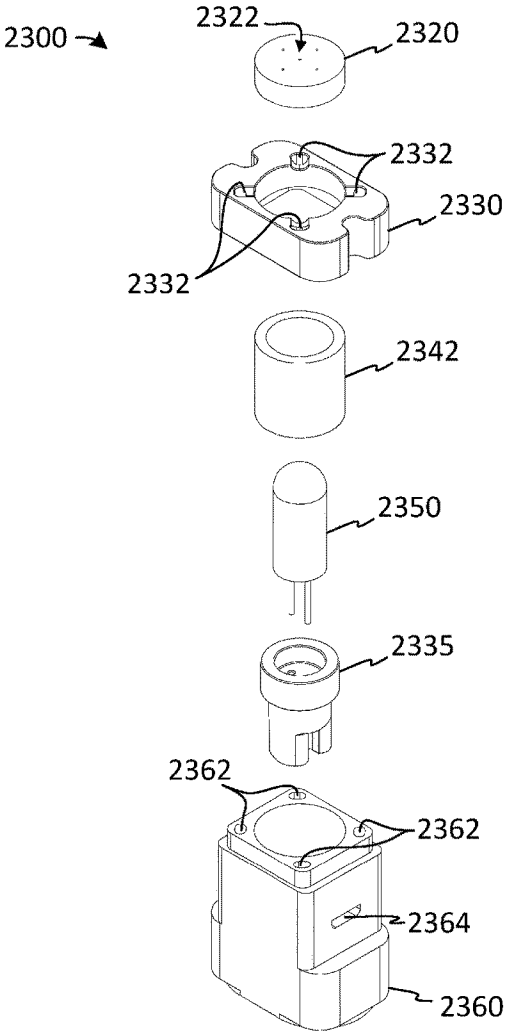
FIG. 23A illustrates an exploded view of a chamber assembly.

FIGS. 23A and 23B depict an exploded and a collapsed isometric view, respectively, of a chamber assembly. Chamber assembly 2300 may comprise dispenser 2320, upper gasket 2330, chamber sleeve 2342, heater 2350, base plug 2335, and lower chassis 2360.

Dispenser 2320 may be an example of dispenser 1100; however, alternative dispenser configurations may be suitable. Dispenser 2320 may include one or more channels 2322, which in some embodiments may take advantage of capillary action. In certain configurations, dispenser 2320 may function as a thermally mediated valve, regulating precursor flow by modulation of viscosity. In certain configurations, dispenser 2320 may function as a thermally mediated valve and entrainment mediated valve, regulating precursor flow by modulation of viscosity coupled to or in conjunction with the entrainment of the precursor by air flow through 2332 generating a high velocity flow in the region of dispenser 2320 that causes there to be a region of high pressure where the precursor is entrained in the air flow stream as has been previously described in detail herein. Dispenser 2320 may be positioned directly above chamber 2340, although other arrangements may be employed depending on device architecture.

Dispenser 2320 may be constructed out of similar materials and/or in a similar fashion as chamber top 1710 previously described herein. In an embodiment, dispenser 2320 may be constructed from fused silica that is absorptive to thermal energy, and/or IR and/or UV radiation. In an embodiment, dispenser 2320 may be constructed from a glass such a borosilicate or fused silica coated with a reflective metal layer such as aluminum, gold, or silver in order to be reflective to thermal energy, and/or IR and/or UV radiation. In an embodiment, dispenser 2322 may be constructed by fusing two or more layers of glass, such as borosilicate or fused silica with one or more layers of a metal that is reflective to thermal energy, and/or IR radiation, and/or UV radiation such as aluminum, silver, or gold such that the metal layer or layers or a metal coating or coatings is positioned between the layers of glass and then fused, by vacuum sintering or similar appropriate method, such that the top and bottom surface of the dispenser 2322 are glass, and the reflective layer is positioned between the top and bottom surfaces of dispenser 2322. In such an embodiment, it may be preferable to selectively coat, etch, or otherwise form the metal layer such that the channels 2322 are not in contact with the reflective metal layer and/or coating, to prevent the precursor from being exposed to the metal layer and/or coating when flowing through channels 2322.

Upper gasket 2330 may be configured to seal chamber 2340, lower chassis 2360, and other components comprising a vaporizing device. Upper gasket 2330 may include inlet channels 2332 to direct air flow, although alternative embodiments may include channels for directing vapor and/or aerosol. Inlet channels 2332 may receive air from corresponding inlet channels 2362 of lower chassis 2360 and transfer it into chamber 2340. Inlet air channels may be constructed to direct high velocity streams of flow across the surface of dispenser 2320 to entrain precursor liquid in the channels 2322 and/or present on the surface of dispenser 2320.

In an embodiment, inlet channels 2332 may be constructed to direct multiple high velocity streams of air across the surface of dispenser 2320 to entrain precursor liquid present in the channels in 2322 and/or present on the surface of dispenser 2320 such that the streams of air collide with each other in the central region of the surface of dispenser 2320 before passing over heater 2350 and through the chamber 2340, where the presence of multiple streams of air flow through inlet channels 2332 allow for higher flow velocities and enhanced entrainment of precursor liquid, and the collision of the multiple stream allows for the combining of the air flow streams and entrained precursor liquid for subsequent delivery to the heater 2350 and chamber 2340. In an embodiment, the inlet channels 2332 may be angled and/or offset such that the flow exiting inlet channels 2332 forms a rotation and/or vortical flow pattern across the surface of the dispenser 2320 and/or around the heater 2350 such that the flow through chamber 2340 is a rotation and/or vortical flow, where the distance traveled by the airflow and/or entrained liquid precursor in the air flow, and/or formed vapor, and/or formed aerosol through the chamber 2340 is increased by the rotational flow through the chamber 2340, and the transit time of the air flow, and/or entrained liquid precursor in the air flow, and/or formed vapor, and/or formed aerosol through the chamber 2340 is increased when compared to a non-rotation and/or non-vortical flow such that the exposure of the airflow and/or entrained liquid precursor in the air flow, and/or formed vapor, and/or formed aerosol to the heater 2350 is increased. In an embodiment, a rotational and/or vortical flow of the airflow and/or entrained liquid precursor in the air flow, and/or formed vapor, and/or formed aerosol through the chamber 2340 facilitates the conditioning of the aerosol to have smaller particle sizes (e.g., <5 micron) by prolonging the exposure of the flow to the heater, and through the entrainment of smaller particles within the vortical flow exiting through aerosol ports 2364. Detailed descriptions of the method(s) of particle size selection by vortical and/or rotational flow have been described herein. It may be desirable to manufacture upper gasket 2330 from materials that are compliant for forming a seal and chemically inert, such as silicone.

Chamber sleeve 2342 may define the internal wall(s) of chamber 2340. Chamber sleeve 2342 may be constructed to serve as a reflector such that chamber sleeve 2342 reflects thermal energy, and/or IR radiation, and/or UV radiation. Chamber sleeve 2342 may be constructed as a reflector by multiple approaches including but not limited to, constructing the chamber sleeve from a thermal, and/or IR, and/or UV reflective material such as aluminum, or by constructing the chamber sleeve 2342 from glass and applying a coating to the glass to form the reflector. Examples of materials that could be used to coat the glass include, but are not limited to, aluminum, gold, and silver coatings. Material selection for chamber sleeve 2342 may prioritize chemical inertness and thermal stability, with borosilicate glass serving as one example.

In an embodiment, the chamber sleeve 2342 may be comprised of a glass, such as borosilicate, that is coated on the external surface of the chamber sleeve 2342 with aluminum in order to reflect the thermal energy, and/or IR radiation, and/or UV radiation back into chamber 2340 in order to increase the efficiency of heating the chamber 2340 by the heater 2350 and preventing the escape of thermal energy, and/or IR radiation, and/or UV radiation from chamber 2340. The reflector may include micro-scale or nano-scale surface features to increase total surface area and/or internal reflectance of the reflector. Micro-scale and/or nano-scale features on the reflector may be constructed by surface preparation of the reflector surface that is coated and/or otherwise made reflective and/or by the reflective coating and/or reflective material and/or reflective layer directly.

While chamber sleeve 2342 may be illustrated as a cylinder in this example, other shapes or configurations may be used to suit particular embodiments. For example, chamber sleeve 2342 may have an external geometry that is cylindrical and an internal geometry that is parabolic to facilitate the reflection of thermal energy, and/or IR radiation, and/or UV radiation. In an embodiment, the chamber sleeve may have an external geometry that is cylindrical and internal geometry that is parabolic and reflective to thermal energy, and/or IR radiation, and/or UV radiation such that the chamber sleeve 2342 functions to reflect the thermal energy, and/or IR radiation, and/or UV radiation to the dispenser disc 2320. Material selection for chamber sleeve 2342 may prioritize chemical inertness and thermal stability, with borosilicate glass serving as one example.

Heater 2350 may be an example of heaters described herein. In an embodiment, heater 2350 may be configured to employ UV, IR, or combined UV/IR as a heating mechanism. Heater 2350 may include laser diodes, light emitting diode (LED), filament bulb, and/or other heater type and/or emitter types described previously and herein, or combinations thereof. For instance, combinations of lasers and LEDs may be arranged to generate both UV and IR radiation, intentionally exploiting interactions between electronic and vibrational molecular excitation.

Commonly available halogen bulbs may also serve as heater 2350, offering both UV and IR output. Such bulbs are typically encased in quartz, a generally chemically inert material, allowing precursor to be directly deposited and vaporized on its surface.

Base plug 2335 may function as a bottom boundary for chamber 2240 and provide a seal between heater 2350 and lower chassis 2360. It may also be used to position heater 2350 within chamber assembly 2300. Base plug 2335 may comprise geometry configured to suit a particular embodiment. Suitable materials for base plug 2335 may include chemically inert and compliant substances, such as silicone.

Suitable materials for base plug 2335 may include chemically inert materials such as ceramics, and glasses such as quartz, fused quartz, and fused silica. Base plug 2335 may be functionally part of heater 2350 construction such that base plug 2335 and heater 2350 are a single component of the assembly. Base plug may be metallic component and be bonded the heater 2350. Suitable metals for forming a seal and/or bond between heater 2350 and base plug 2335 include, but are not limited to, nickel, copper, gold, silver, platinum, iron, chromium, and alloys like Kovar, and metals like zirconium, titanium, and aluminum. In such a configuration it may be desirable to have the base plug 2335 constructed from an predominantly inert metal such as stainless steel or titanium, and then sealed and/or bonded to the heater 2350 using one of the aforementioned materials, and be constructed in such a fashion as the bonding and/or sealing metal is not in the flow path and is not exposed to the airflow and/or entrained liquid precursor in the air flow, and/or formed vapor, and/or formed aerosol through the chamber 2340.

Lower chassis 2360 may be configured to provide structural support for chamber assembly 2300. In this embodiment, lower chassis 2360 may be configured to mate with base plug 2335 and upper gasket 2330, and may include air inlet channels 2362 to direct air from the underside of lower chassis 2360 into inlet channels 2332. Alternative embodiments may draw air from other locations and inlet channels 2362, 2332 may be configured appropriately. Lower chassis 2360 may also include aerosol ports 2364 near the chamber's base to allow vapor and/or aerosol to exit, although outlet positions may be modified depending on the embodiment.

In operation, dispenser 2320, when configured as a thermally mediated valve, may allow a precursor to flow to the ends of channels 2322. Upon activation, heater 2350 may transfer UV, IR, or combined UV radiation and IR radiation to the precursor, and other components comprising chamber 2340. As a precursor is heated, its viscosity may decrease to a threshold allowing it to flow through channels 2322 and onto heater 2350 for vaporization. Air may be supplied to chamber 2340 via inlet channels 2362 and 2332, where it may mix with the vaporized precursor to form an aerosol. The resulting aerosol may be directed out through aerosol ports 2364 for delivery to a user.

A stream of air, vapor, or aerosol may be conditioned by selective removal by mass and/or by size of particles present in the stream. Selective removal of particles from a stream of air, vapor, or aerosol may be accomplished by subjecting the stream to a tortuous flow path that includes impaction surfaces, regions of expansion, contraction, and directional changes, including directional changes that impart a rotation and/or vortical flow. Gasses moving between regions of expansion and contraction may experience pressure and velocity changes. As the stream enters a region of contraction, the gas velocity may increase, which can keep smaller particles suspended, while larger particles with greater inertia may deviate from the main flow or impact on surfaces due to their inability to change direction as readily. Conversely, in regions of expansion, the gas velocity may decrease, allowing particles with greater mass to settle or deposit onto surfaces as their momentum carries them out of the primary airflow. Directional changes, such as bends or impaction surfaces, may further encourage the deposition of larger or denser particles by exploiting differences in particle inertia, thereby enhancing selective removal from the gas or aerosol stream. Rotational flow and/or vortical flow facilitates targeted separation of particles by size and/or mass by imparting a centrifugal force on the particles present in the gas, as has been described in detail previously herein. This combination of pressure, velocity, and directional changes along the flow path may facilitate targeted separation of particles based on their size, mass, or inertia prior to delivery to the user.

Previously described inlets and outlets may be configured to include tortuous flow geometry, which could be designed to condition streams of air, vapor, or aerosol prior to delivery or after generation. Tortuous flow geometry may take the form of one or more channels incorporating directional changes, impaction surfaces, or constrictions, and could be implemented using a variety of structural arrangements, such as spiral channels, labyrinthine inserts, expansion regions and/or chambers, and/or baffle systems. The incorporation of tortuous flow paths within vaporizing devices may enhance the selective removal of particles, promote condensation control, or otherwise modify the characteristics of the aerosolized stream.

Figure 24A:
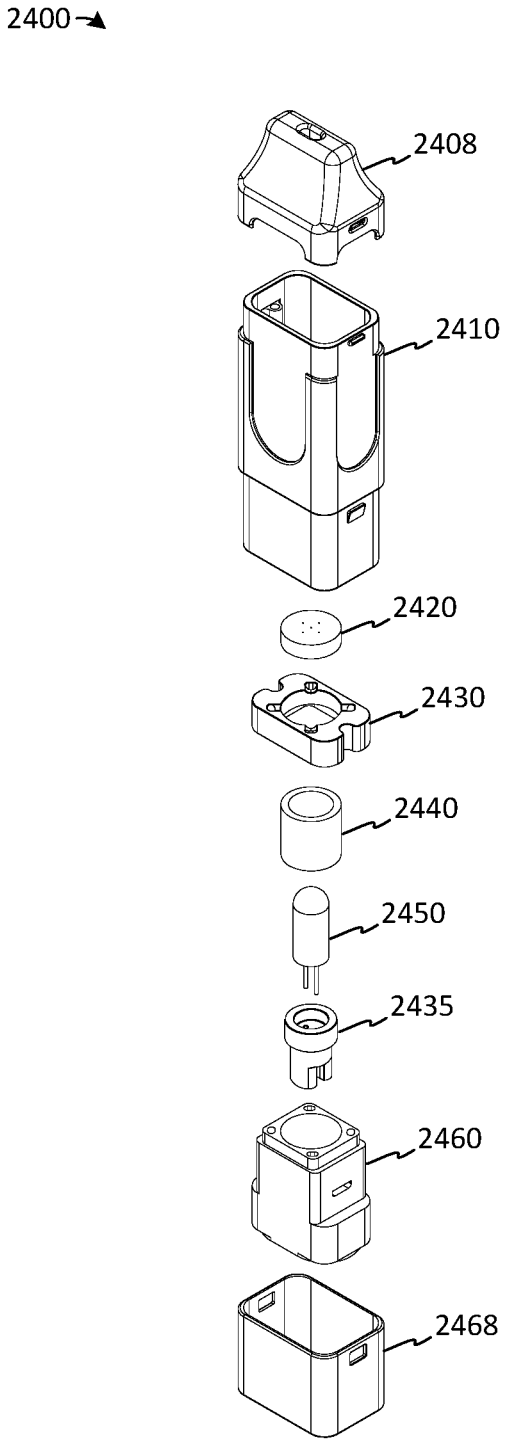
FIG. 24A illustrates an exploded view of a vaporizer assembly.
Figure 24B:
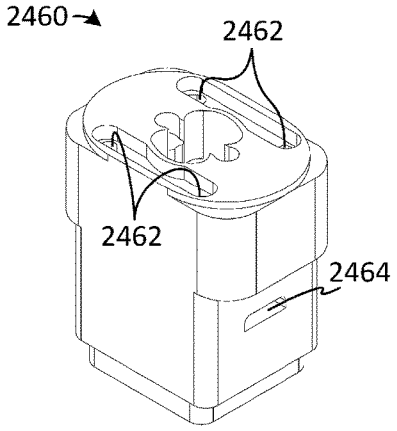
FIG. 24B illustrates an isometric view of the bottom of a lower chassis.
Figure 24C:
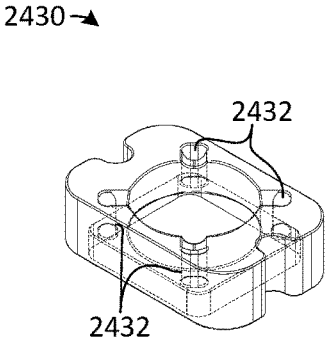
FIG. 24C illustrates an isometric view of an upper gasket.
Figure 24D:
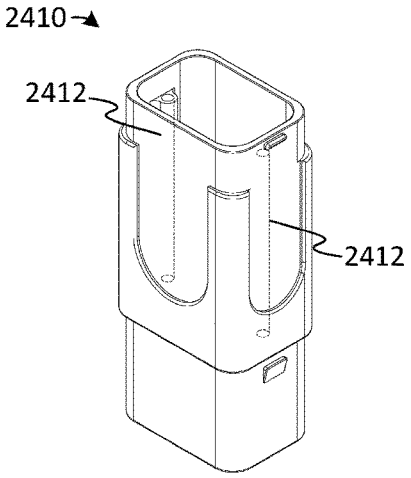
FIG. 24D illustrates an isometric view of a reservoir.
Figure 24E:
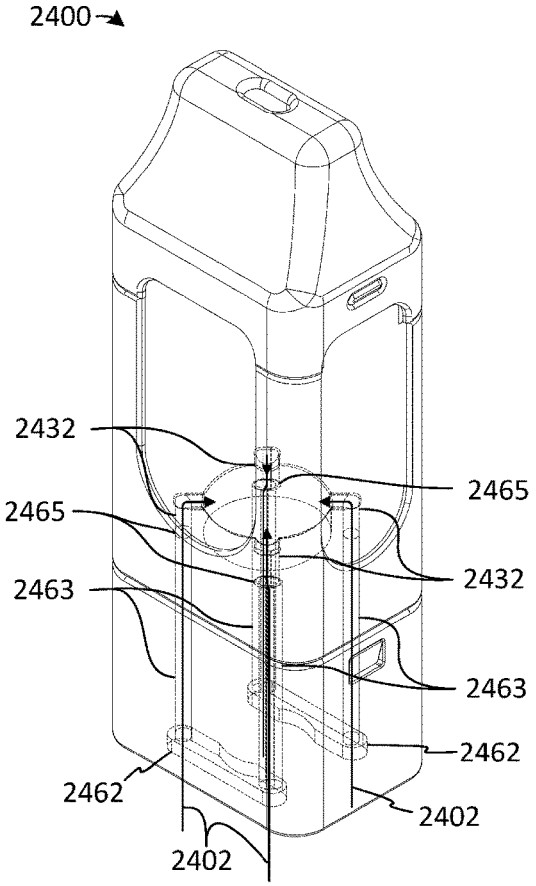
FIG. 24E illustrates an isometric view of a vaporizer assembly.
Figure 24F:
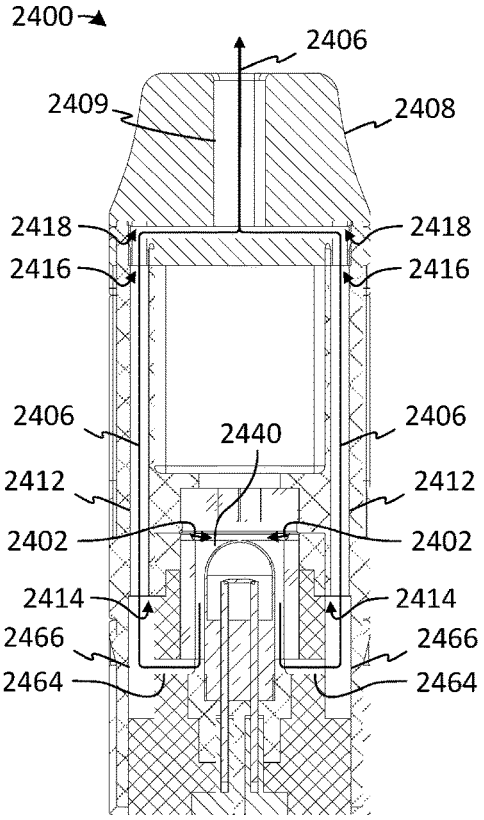
FIG. 24F illustrates a cross section of a vaporizer assembly.

FIGS. 24A through 24F illustrate air inlet, precursor liquid inlet, and outlet flow paths for a vaporizer assembly. FIG. 24A provides an exploded view of vaporizer assembly 2400. FIG. 24B presents an isometric view of the bottom of lower chassis. FIG. 24C depicts an isometric view of upper gasket 2430. FIG. 24D is an isometric view of reservoir 2410 including aerosol channels 2412. FIG. 24E is an isometric view of vaporizer assembly 2400 featuring an air inlet flow path. FIG. 24F is a cross section of vaporizer assembly 2400 illustrating an outlet flow path. Together, these figures may illustrate examples of inlets (e.g., inlet 150, 250, 350, 450, 550, 650, 750) and outlets (e.g., outlet 160, 260, 360, 460, 660, 760) for vaporizing devices. Vaporizer assembly 2400 may comprise mouthpiece 2408, reservoir 2410, dispenser 2420, chamber 2440, heater 2450, base plug 2435, lower chassis 2460, and base cap 2468.

Inlets 2462 may be positioned on the underside of lower chassis 2460 in this embodiment; however, it should be understood that inlets 2462 may be located anywhere that is convenient. Inlets 2462 may begin with an expansion region that may reduce flow velocity and promote turbulence to increase dwell time and begin pre-heating air 2302 as it enters vaporizing assembly 2400. Preheated air 2302 may prevent condensation or agglomeration of aerosolized particles downstream and help to maintain proper aerosolization at high flow velocities. As air 2302 continues forward, the flow reaches laminar region 2463, which may have a largely uniform cross-section with a gentle taper in some embodiments. This geometry may encourage laminar flow to help align air movement and limit eddy currents, while also modulating air velocity before the flow encounters impaction surfaces 2465 located at the terminal ends of laminar regions 2463.

Impaction surfaces 2465 and sharp directional changes comprising channels 2432 may be located in proximity to chamber 2440 and may disrupt laminar flow and generate localized turbulence or swirling flow patterns to increase dwell time as air 2302 passes into channels 2432, giving air 2302 time to absorb residual heat from chamber 2440. Channels 2432 may be distributed around chamber 2440 and configured to evenly distribute air 2302 into chamber 2440 for aerosol generation.

Inside chamber 2440, air 2302 may entrain liquid precursor from dispenser 3300. Inside chamber 2440, air 2302 may entrain vapor generated by heating a liquid precursor, resulting in the formation of aerosol 2406. Aerosol 2406 may exit the chamber through aerosol ports 2464 located near the bottom of chamber 2440, after which it travels to expansion regions 2466. The abrupt increase in cross-sectional area may cause aerosol 2406 velocity to decrease, resulting in a turbulent flow regime that may promote enhanced mixing and increased residence time. As a result, temperature gradients within aerosol 2406 may be minimized, and further opportunities arise for particle agglomeration, breakup, dissociation, and selective removal based on particle size and/or particle mass.

After moving through expansion regions 2466, aerosol 2406 may impinge on impaction surfaces 2414. Larger droplets and particles, unable to follow the redirected or swirling turbulent flow, may be removed from the stream via inertial impaction and gravitational settling.

Aerosol 2406 may now enter aerosol channels 2412 of reservoir 2410. These channels may comprise generally consistent cross-sections to promote laminar flow and help ensure uniform aerosol delivery. In certain embodiments, aerosol channels 2412 may taper slightly to accelerate aerosol 2406 before it encounters downstream impaction surfaces 2416 and abrupt directional changes 2418 within mouthpiece 2408. Each successive impaction surface and directional change may contribute to aerosol 2406 conditioning by removing larger particles through impaction and/or gravitational settling. Particles that are removed by impaction and/or gravitational settling may return to chamber 2440 by flowing and/or settling through aerosol channel 2412 and aerosol ports 2464 for conversion to a vapor in a subsequent activation cycle.

Opposing streams of aerosol 2406 may recombine near exit port 2409. This may be a region of turbulence, vortices, or eddy currents that may enhance mixing and increase uniformity of the aerosol 2406 stream. Aerosol may finally pass through exit port 2409, a region promoting laminar flow, for delivery to a user.

FIGS. 24A through 24F described embodiments of inlet and outlet flow paths that may be used to condition streams of air, vapor and/or aerosol. These flow paths may be adapted to suit various embodiments of vaporizers, and/or vaporizer devices, and/or vaporizer assemblies described herein.

Figure 25A:
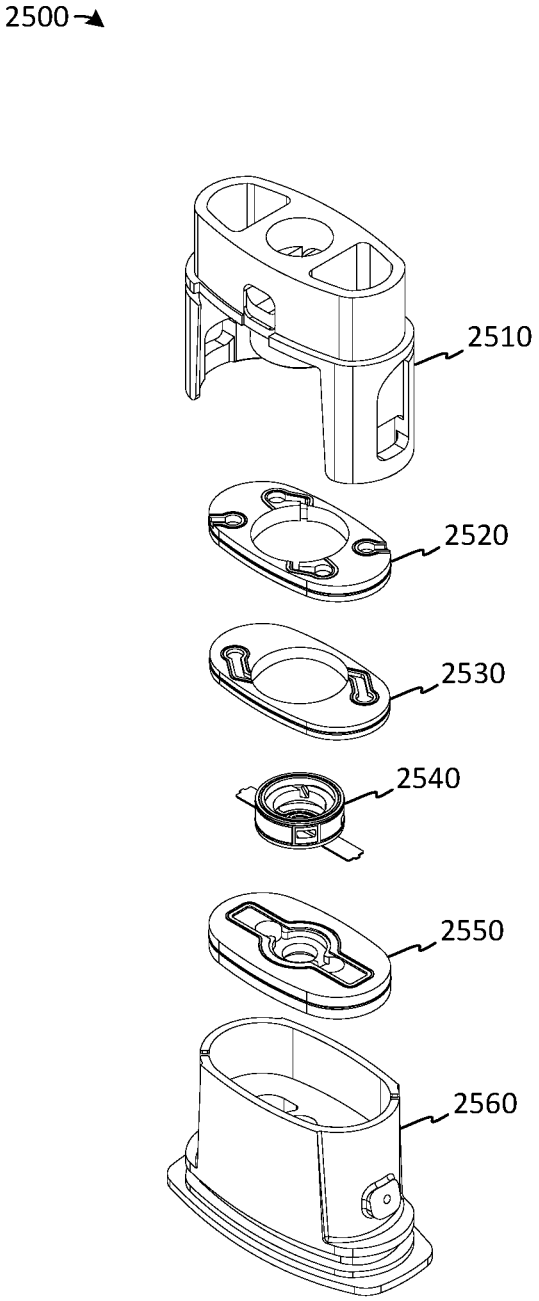
FIG. 25A illustrates an exploded view of a vaporizer assembly.
Figure 25E:
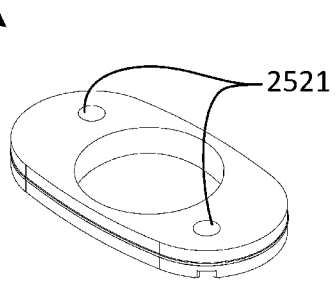
FIG. 25E illustrates an isometric view of the bottom of a precursor inlet seal.
Figure 25D:
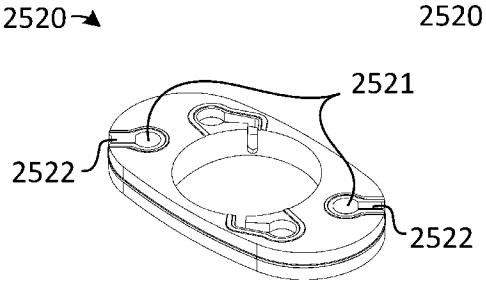
FIG. 25D illustrates an isometric view of the top of a precursor inlet seal.
Figure 25C:
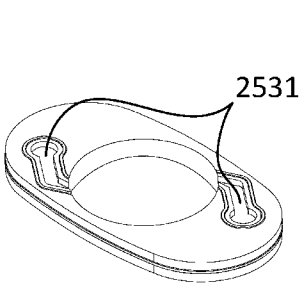
FIG. 25C illustrates an isometric view of a mid seal.
Figure 25B:
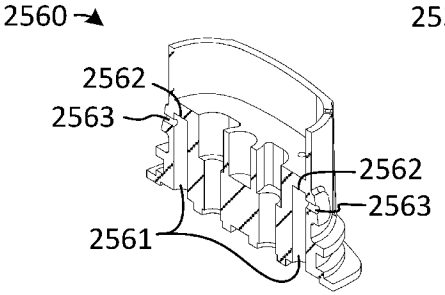
FIG. 25B illustrates a cross section of a lower chassis.
Figure 25H:
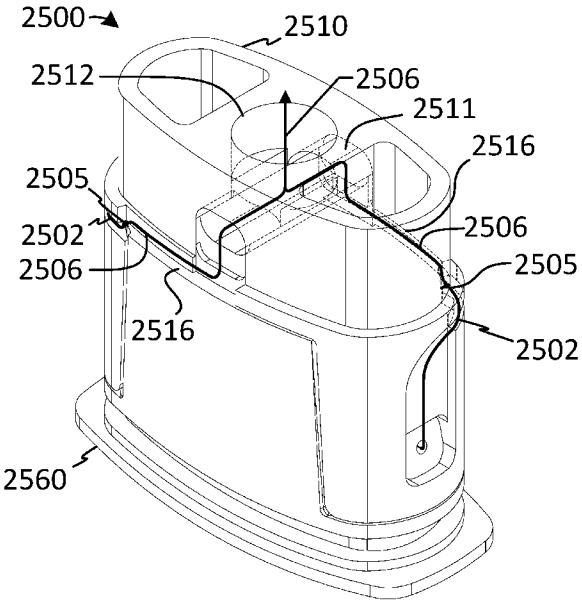
FIG. 25H illustrates an aerosol outlet flow path associated with a vaporizer assembly.
Figure 25G:
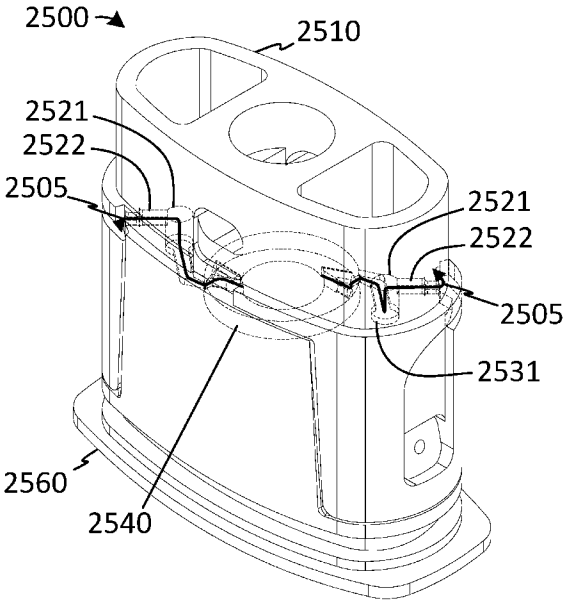
FIG. 25G illustrates a vapor flow path extending from a chamber assembly.
Figure 25F:
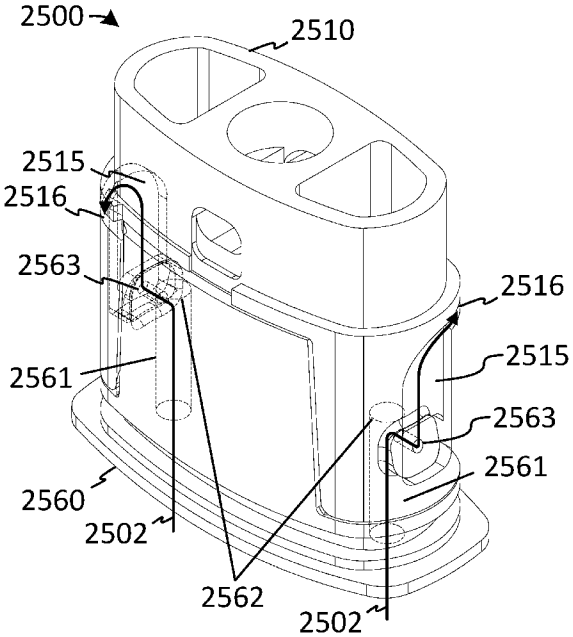
FIG. 25F illustrates an air inlet flow path within a vaporizer assembly.

FIGS. 25A through 25H illustrate air inlet, precursor liquid inlet, and outlet flow paths of vaporizer assembly. FIG. 25A provides an exploded view of vaporizer assembly 2500. FIG. 25B presents a cross-section of lower chassis 2560. FIG. 25C depicts an isometric view of mid seal 2530. FIGS. 25D and 25E show top and bottom isometric views of precursor inlet seal 2520. FIG. 25F illustrates an air inlet flow path within vaporizer assembly 2500, FIG. 25G depicts a vapor flow path extending from chamber assembly 2540, and FIG. 25H demonstrates an aerosol outlet flow path associated with vaporizer assembly 2500. Vaporizer assembly 2500 may comprise upper chassis 2510, precursor inlet seal 2520, mid seal 2530, chamber assembly 2540, lower seal 2550, and lower chassis 2560.

FIG. 25B provides a cross-sectional view of lower chassis 2560, illustrating features such as inlets 2561, impaction surfaces 2562, and lower chassis outlets 2563. During operation, when suction is applied at outlet 2512, air 2502 may be drawn through vaporizer assembly 2500. Air 2502 may enter vaporizer assembly 2500 at inlet 2561 positioned at the bottom of lower chassis 2560. Inlet 2561 may encourage laminar air flows along a relatively straight path having a consistent cross-section until the stream approaches impaction surface 2562.

Lower chassis outlet 2563 may be positioned perpendicular to inlet 2561 near impaction surface 2562. Upon encountering a directional change, such as at the junction of impaction surface 2562 and lower chassis outlet 2563, airflow of air 2502 is transitioned from a laminar flow as is present at inlets 2561 to a turbulent airflow secondary to the impaction of the laminar air 2502 airflow on impaction surface 2562. The turbulent air 2502 airflow may serve to increase the transit time of air 2502 from inlets 2561 to lower chassis outlet 2563. The flow path from inlets 2561 to lower chassis outlet 2563 is part of lower chassis 2560 which is heated during activation. Increasing the transit time of air 2502 flowing from inlets 2561 to lower chassis outlets 2563 may serve to allow for heating of air 2502 before it exits the lower chassis outlet 2563. Heating of air 2502 may serve several functions to improve aerosol 2506 production and delivery including, but not limited to: production of an inhalable aerosol that is at a temperature that is optimized for inhalation, prevention, mitigation of the aerosol 2506 particles from condensation or agglomerating that may occur if the aerosol 2506 was exposed to an airflow that is cooler than aerosol 2506, increasing the air 2502 temperature sufficiently such that the airflow remains heated even when the flow velocity is increased when the air 2502 exits lower chassis outlet 2563 into expansion region 2515, and/or is sufficiently heated that the air 2502 remains heated when it undergoes an increase in the velocity of the airflow of air 2502 when the flow exits the expansion region 2515 to the constriction region 2516. In an embodiment air 2502 is heated along the flow path between inlets 2561 and lower chassis outlets 2563 such that the air 2502 is a heated high velocity flow when the air 2502 mixes with aerosol 2506. Heating of air 2502 may also serve to cool the lower chassis 2560 and upper chassis 2510 by transferring excess heat generated during activation into intake air 2502, and then to vapor 2505, and aerosol 2506.

Impaction surface 2562 may serve to generate eddy currents or vortical patterns in the flow path between inlets 2561 and lower chassis outlets 2563. Where eddy currents or vortical patterns in the flow path are established, such as in cavities or expansion regions, the flow path is turbulent and no longer facilitates laminar flow. The residence time of the air 2502 is increased when the flow is turbulent. The increase in the residence time of the air 2502 allows for additional time to heat the air 2502 before the flow exits lower chassis outlets 2563. Although impaction surface 2562 is shown in this embodiment, other structures and/or geometries may be used to generate a turbulent flow such as regions of expansion and/or contraction along the flow path, baffles, non-laminar flow directing features such as prominences, depressions, ridges, edge features, face features and similar.

Vaporizer assembly 2500 may be integrated into a housing, such as reservoir 901 (not illustrated). The housing, together with lower chassis 2560 and upper chassis 2510, could define expansion region 2515. Upon exiting inlets 2561 and passing through lower chassis outlet 2563, air 2502 may enter expansion regions 2515. Lower chassis outlet 2563 might constitute an area of restricted flow, thereby increasing air velocity; upon release into the comparatively larger cross-section of expansion region 2515, a rapid reduction in flow velocity and dynamic pressure may ensue. Additionally, expansion region 2515 may be constructed such that the large surface area has a thin wall that is in contact with lower chassis 2560 and the surface of expansion region 2515 is heated by proximity to the heater located in lower chassis 2560. The rapid reduction in flow velocity and dynamic pressure of air 2502 in expansion region 2515 may serve to facilitate heat transfer from expansion region 2515 to air 2502. Air 2502 then exits into constriction region 2516 where air velocity is increased and laminar flow is established such that the air 2502 is a heated high velocity laminar flow when it mixes with aerosol 2506 and vapor 2505 exiting vapor channels 2522.

Expansion region 2515 may thus act to enhance turbulent flow, encourage increased transit time of air 2502 flow through expansion region 2515, and increase the heating of air 2502 airflow from interaction with the heated surface of expansion region 2515. Additional flow direction features may be present in expansion region 2515 to increase the turbulence of flow and increase transit time of air 2502 through the expansion region 2515 such as those previously described, including impaction surfaces. Additionally, expansion region 2515 may be constructed to be highly thermally conductive to facilitate heat transfer from the expansion region 2515 to air 2502. Furthermore, the expansion region may be constructed with features that increase the total surface area of expansion region 2515, including large and/or small-scale features. Large features may include ridges and/or grooves along the primary surface of expansion region 2515 which may also serve as flow directing features. Small scale features may include constructing the surface of the expansion region 2515 such that it is a rough surface to increase the surface area. Small scale features may include micro-scale and/or nano-scale surface features.

Air 2502 may subsequently transition from expansion region 2515 to a downstream constriction region 2516. Constricted region 2516 may be formed between upper chassis 2510, lower chassis 2560, and a housing (not illustrated), or, in some embodiments, entirely within one component and may accelerate the airflow, thereby preparing air 2502 for mixing with vapor 2505 generated in chamber assembly 2540. The accelerated airflow may function to increase the entrainment of vapor 2505 by generating a region of higher pressure that draws vapor 2505 into the air 2502 airflow to form aerosol 2506. The accelerated airflow exiting constricted region 2516 may also function to entrain particles of smaller mass and/or size and thus serve as a means of particle size selection for formation of aerosol 2506. Additionally, the accelerated flow of air 2502 flowing past vapor channels 2522 may exert a vacuum pressure on chamber assembly 2540, where the vacuum pressure serves to reduce the vapor pressure of the liquid precursor and thus reduce the boiling point temperature of the liquid precursor such that less thermal energy and/or heating time is required to transition the liquid precursor to a vapor.

A liquid precursor in chamber assembly 2540 may be vaporized via applied heat, producing vapor 2505 and elevating chamber pressure. Vapor 2505 may flow from chamber assembly 2540 into vapor channels 2522 due to vapor pressure resulting from heating the precursor, suction, or both. Vapor channels 2522, which may be analogous to previously described outlets, could be configured to include tortuous flow geometry, impaction surfaces, regions of expansion, regions of contraction, and other previously described features to condition vapor 2505 and/or to select for specifically sized particles and/or particles of a particular mass present in vapor 2505 to mix with air 2502 to form aerosol 2506. In the illustrated embodiment, vapor channels 2522 are defined by features 2531 of mid seal 2530 and precursor inlet seal 2520. Alternative configurations may employ other structures.

As vapor 2505 traverses these vapor channels, it may undergo sharp directional changes, such as the transition from vapor channel 2521 to vapor channel 2522 within precursor inlet seal 2520. In one embodiment, vapor channel 2521 may be substantially cylindrical, extending from the bottom to the top of precursor inlet seal 2520, and vapor channel 2521 may provide a vertical, laminar flow region. Here, larger particles may impact the top of the vapor channel which may function as an impaction surface and/or settle under gravity, facilitating their removal from the vapor stream prior to subsequent processing or delivery to a user. Larger particles that are removed from vapor 2505 by impaction, settling, agglomeration, loss of inertia, or otherwise escaping entertainment from the flow of vapor 2505 may return to chamber 2540 by flowing in the reverse direction of the flow of vapor 2505 through vapor channel 2521 and vapor channel 2231 to be returned to the precursor liquid volume present in the chamber 2540.

A further sharp directional change may occur as vapor 2505 moves from vapor channel 2521 to vapor channel 2522. Particles of relatively high mass that do not settle within vapor channel 2521 may, due to inertia, be unable to follow altered streamlines, thereby impacting upon internal surfaces, such as those defined by the upper chassis 2510. Vapor 2505 may then pass through vapor channel 2522 for introduction into constriction region 2516. Vapor 2505, when exiting vapor channel 2522, may be entrained by an accelerated high velocity flow of air 2502 passing through constriction region 2516 where the flow of air 2502 is generating a lower pressure than the flow of vapor 2505 and the vapor 2505 is drawn into the region of lower pressure where the constriction region 2516 functions as a Venturi constriction and the vapor channel 2522 exit is constructed to exit into the center region of the constriction region 2516 that functions as a Venturi constriction. This flow can be mathematically defined by Bernoulli's principle and equations, namely the compressible fluid flow equation:

$$\frac{v^2}{2} + \int_{P_1}^{P} \frac{d\underline{p}}{\rho(\underline{p})} + \psi = \text{constant (along a streamline)}$$

where p is the pressure, ρ is the density and ρ (ρ) indicates that it is a function of pressure, v is the flow speed, Ψ is the potential associated with the conservative force field, often the gravitational potential. The above equation can also be applied as it relates to the ideal gas law and becomes the following equation:

$$\frac{v^2}{2} + gz + \left(\frac{\gamma}{\gamma - 1}\right)\frac{p}{p} = \text{constant (along a streamline)}$$

where, in addition to the terms listed above, γ is the ratio of the specific heats of the fluid, g is the acceleration due to gravity, z is the elevation of the point above a reference plane.

Within constriction region 2516, air 2502, traveling at increased velocity due to prior acceleration, may encounter vapor 2505 as it exits vapor channel 2522. Owing to the Venturi effect, the high-velocity air may facilitate withdrawal of vapor 2505 from chamber assembly 2540 and promote its efficient entrainment, yielding a mixed aerosol 2506 stream. In addition, the higher velocity and lower pressure flow of air 2502 through constriction region 2516 may preferentially select for vapor 2505 particles of smaller size and/or mass due to the lower inertia of these particles. The larger particle in size and/or mass may remain in the vapor channel 2522 due to having a larger inertia and resultantly being less prone to be entrained into the flow of air 2502, and undergo agglomeration, conglomeration, condensation, impaction, collection and other interaction with other non-entrained particles such that these particles may transition from the vapor 2505 phase back into the precursor liquid form and return to vapor channel 2521 and then to chamber assembly 2540 to become part of the precursor liquid volume in chamber assembly 2540. In an embodiment, the flow of air 2502 through construction region 2516 preferentially entrains vapor 2505 particles 0.1 micron to 5 microns in diameter for mixing into formed aerosol 2506.

Aerosol 2506 may then be directed through constriction region 2516 before encountering another sharp directional change at expansion region 2511. Expansion region 2511, characterized by a relatively large cross-section, may promote a low-velocity, turbulent flow environment that encourages further particle mixing, aggregation, dissociation or breakup, and increases particle-surface collisions. As before, smaller or less dense particles remain preferentially entrained, while larger particles are more likely to deposit on interior surfaces.

Finally, aerosol 2506 may exit through outlet 2512, which may be configured to promote laminar flow in the final delivery segment. In some embodiments, outlet 2512 may have a uniform or gradually narrowing cross-section to help maintain laminar flow and potentially increase aerosol velocity prior to user delivery. Outlet 2512 may be constructed to have impaction surfaces, flow directing features, and other such features described herein to condition the aerosol 2506 prior to delivery to the user through the outlet 2512. Larger remaining particles may be removed by settling under gravity, and other methods and processes described herein while smaller constituents entrained in aerosol 2506 continue toward the outlet, thereby providing a conditioned aerosol 2506 suitable for inhalation and deposition into the deep lung.

Introducing air at ambient temperature into a vaporization chamber can reduce the efficiency of a vaporizing device, since some of the energy intended to heat precursor compositions is instead consumed in warming the incoming air. Flow paths may be constructed to capture residual heat from vaporization and use it to preheat the air before it enters the chamber. In addition, the incoming air can serve as thermal insulation, shielding certain device components from the chamber's heat as well as serving as a thermal insulating layer the flow of air may remove excess heat from the assembly as has been described previously herein. Such flow paths may direct the air around the chamber's outer perimeter, simultaneously preheating it and carrying it back into the chamber while also functioning to cool the device components by removal of excess heat from the system.

Figure 26A:
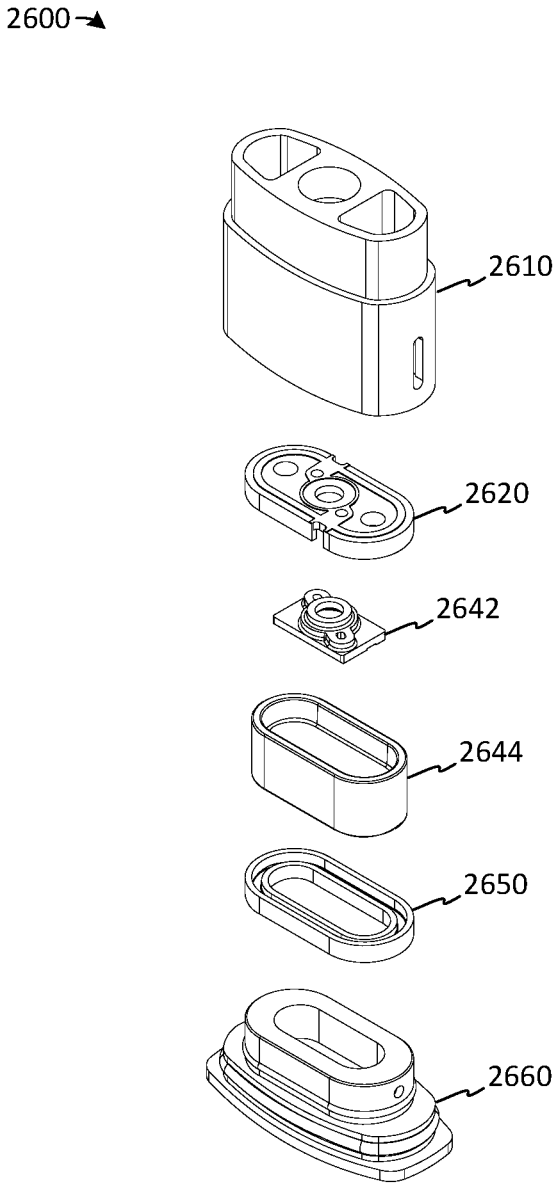
FIG. 26A illustrates an exploded view of a vaporizer assembly.
Figure 26D:
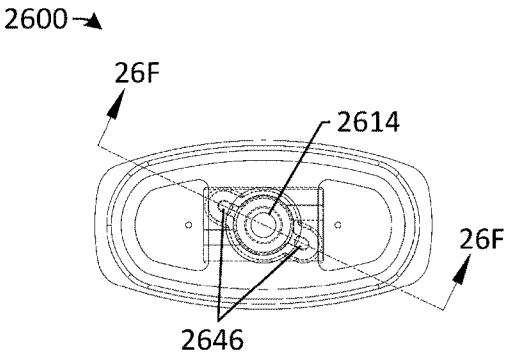
FIG. 26D illustrates a top view of a vaporizer assembly.
Figure 26C:
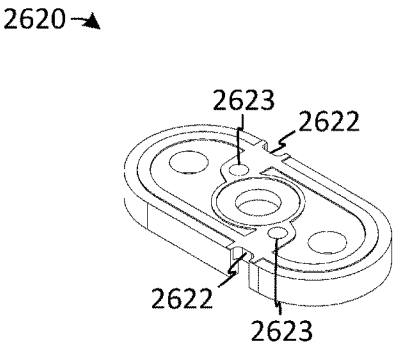
FIG. 26C illustrates an isometric view of precursor inlet seal.
Figure 26B:
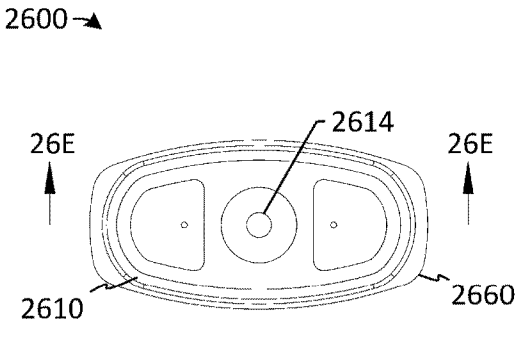
FIG. 26B illustrates a top view of a vaporizer assembly.
Figure 26F:
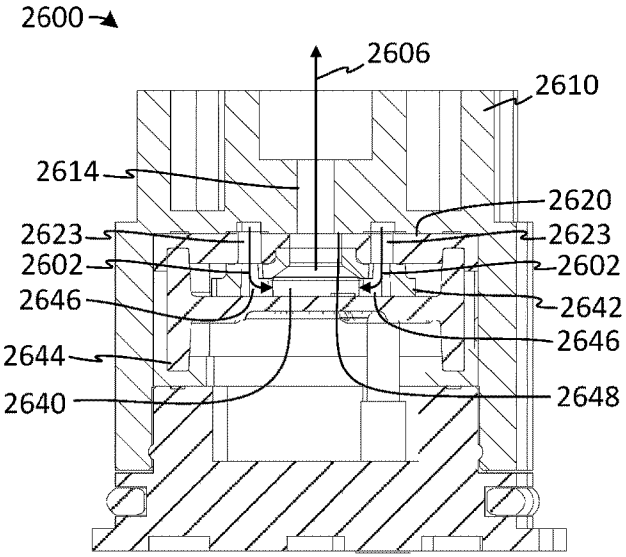
FIG. 26F illustrates a cross section of a vaporizer assembly.
Figure 26E:
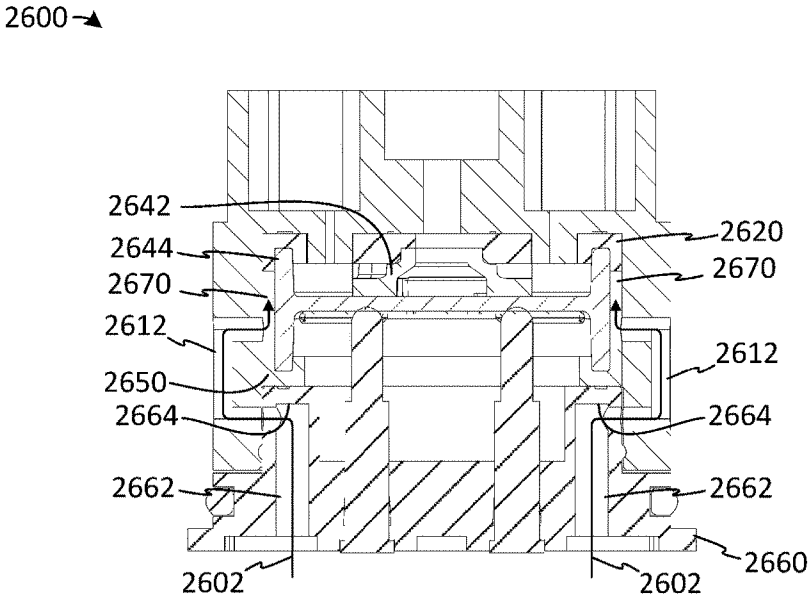
FIG. 26E illustrates a cross section of a vaporizer assembly.

FIGS. 26A through 25F illustrate an inlet and outlet flow path for a vaporizer assembly. FIG. 26A provides an exploded view of vaporizer assembly 2600. FIGS. 26B and 26D show top views of vaporizer assembly 2600. FIG. 26C is an isometric view of precursor inlet seal 2620. FIGS. 26D and 26E present cross-sections of vaporizer assembly 2600.

Vaporizer assembly 2600 may comprise upper chassis 2610, precursor inlet seal 2620, chamber top 2642, chamber housing 2644, lower seal 2650, and lower chassis 2660. Some components comprising vaporizer assembly 2600 may be analogous to chamber assembly 2000.

Lower chassis 2660 may include one or more inlets 2662 to direct a stream of incoming air 2602 into vaporizer assembly 2600. In an embodiment, inlets 2662 may be configured to draw intake air 2602 from a bottom surface of lower chassis 2660 and transfer it to channels 2612. Inlets 2662 may include an entrance promoting turbulence. Turbulence may increase the dwell time of air 2602 to bring it into thermal equilibrium with components comprising vaporizing assembly 2600. Inlets 2662 may transition from a region promoting turbulence to a region having a relatively uniform cross section promoting laminar flow. The terminal ends of inlets 2662 may include impaction surfaces 2664 and sharp directional changes directing air 2602 to channels 2612.

Channels 2612 may be integrated into upper chassis 2610 in this embodiment. Channels 2612 may subject air 2602 to one or more directional changes as it progresses through upper chassis 2610. These directional changes may promote the transition between laminar and turbulent regimes, increasing the residence time of air 2602 and encouraging more effective heat transfer or particle conditioning. While channels 2612 may appear to be open conduits in the illustrated embodiment, in practice vaporizer assembly 2600 may be enclosed, for instance, within a reservoir analogous to reservoir 901, thereby sealing channels 2612 from the outside atmosphere. In certain configurations, channels 2612 may assume tortuous geometries to further extend flow path length, or may incorporate additional impaction surfaces for enhanced particle conditioning. Channels 2612 may ultimately direct a conditioned stream of air 2602 into surrounding cavity 2670.

Surrounding cavity 2670 may be a void defined by the contiguous boundaries of upper chassis 2610, precursor inlet seal 2620, chamber housing 2540, and lower chassis 2660, forming a void encircling chamber 2640. As air 2602 traverses surrounding cavity 2670, it may absorb residual or conducted heat from an outer surface of chamber 2640, thereby serving to preheat air 2602 prior to its introduction into chamber 2640. In some embodiments, the walls of surrounding cavity 2670 may be thermally conductive and may be augmented with surface features designed to enhance convective heat transfer by promoting turbulent flow. These features may further act to extend the residence time of air 2602, allowing for more uniform thermal conditioning, while simultaneously providing an insulating barrier to reduce heat transfer to external device components and maintain system efficiency.

Preheated air 2602 may subsequently be directed from surrounding cavity 2670 into one or more air channels 2622 disposed along a side of precursor inlet seal 2620. Each air channel 2622 may be defined as a void bounded by an upper surface of precursor inlet seal 2620 and an interior surface of upper chassis 2610, and may include one or more directional changes or flow deflectors to induce tortuosity, further conditioning the flow of air 2602. Air 2602 may be transferred into air channels 2623, which in certain embodiments may comprise through-holes in precursor inlet seal 2620. As air 2602 transits from air channels 2622 to 2623, it may experience multiple abrupt directional changes, creating a series of virtual impaction regions which may facilitate removal of larger particles or promote uniform mixing prior to downstream introduction.

Air channels 2623 may transfer air 2602 from precursor inlet seal 2620 to inlet channels 2646. Inlet channels 2646 may comprise through-holes in chamber top 2642 having a relatively consistent cross section configured to maintain laminar flow and minimize pressure drop as preheated air 2602 is directed substantially perpendicular to chamber 2640. Supplying air in this manner from the peripheral margin of chamber 2640 may facilitate the generation of shear layers or induce vortical mixing, thereby enhancing the homogenization of temperature and supporting dispersion of vapor within the chamber. In alternative configurations, inlet channel cross-sections may be tapered, or additional flow conditioning features may be incorporated to further tailor flow characteristics and promote efficient vapor-air interaction.

Upon entering chamber 2640, air 2602 may be a high velocity flow that generates a region of low pressure where the proximity of air channels 2623 exit in relation to the exit of precursor inlet channels 2646 into chamber 2640 results in at least some entrainment of precursor flowing through inlet channels 2646 into air 2602 exiting air channels 2623 such that the flow rate of precursor liquid into chamber 2640 is coupled to the flow rate of air 2602 into chamber 2640. The coupling of flow rates of both the precursor liquid and the air flow entering the chamber 2640 may facilitate a user titratable delivery of aerosol by the user, such that the users inhalation rate determines the flow rate of the intake air 2602 through inlets 2662, and then through air channels 2622, and then through air channels 2623 and the flow rate through air channels 2623 determines the flow velocity of air 2602 and the flow velocity of air 2602 directly relates to the pressure change (e.g., degree of lowered pressure) that functions to at least partially entrain precursor flowing through inlet channels 2646, such that the entrainment of precursor flowing through inlet channels 2646 at least partially controls the flow rate of precursor. The inhalation flow rate of the user may further function to at least partially control the rate of precursor flow through the entire system as inlet channels 2646 may be constructed to be the flow controlling region, and/or region of lowest precursor flow rate, such that the flow rate through inlet channels 2646 directly controls the precursor flow rate through the rest of the precursor liquid dispenser assembly.

Upon entering chamber 2640, air 2602 may mix with vapor generated within chamber 2640 to form aerosol 2606. The peripheral introduction of air 2602 may give rise to vortical or turbulent rotational flow within chamber 2640, enhancing mixing between air 2602 and vapor promoting efficient aerosolization. Chamber 2640 may comprise an upper region having a tapered or gradually constricting cross-section, which, according to the continuity equation, may act to increase the velocity of the forming aerosol 2606 as it ascends. The resulting aerosol 2606 may then encounter impaction surface 2648. Larger constituents comprising aerosol 2606, due to their greater inertia, may fail to navigate the changing streamlines and thus impact upon the surface and be returned to chamber 2640 for re-vaporization. This impaction process may preferentially select for smaller particles to remain in the aerosol 2606 stream. Finally, aerosol 2606 may pass through outlet 2614, which in some embodiments may feature a region of relatively uniform cross section to foster the reestablishment of laminar flow and ensure a consistent, conditioned aerosol 2606 stream for delivery to a user. In an embodiment, the mass of aerosol delivered to the user during activation is titratable by the user where the inhalation characteristics of user during use and activation, include but are not limited to, inhalation rate, inhalation duration, and inhalation variation. One or more of these characteristics, in an embodiment, correlate to the velocity of intake airflow into the chamber, and the intake airflow velocity at least partially controls the flow rate of precursor liquid into the chamber that is then heated to a vapor to then be mixed with intake airflow to form the aerosol for inhalation by the user.

Figure 27A:
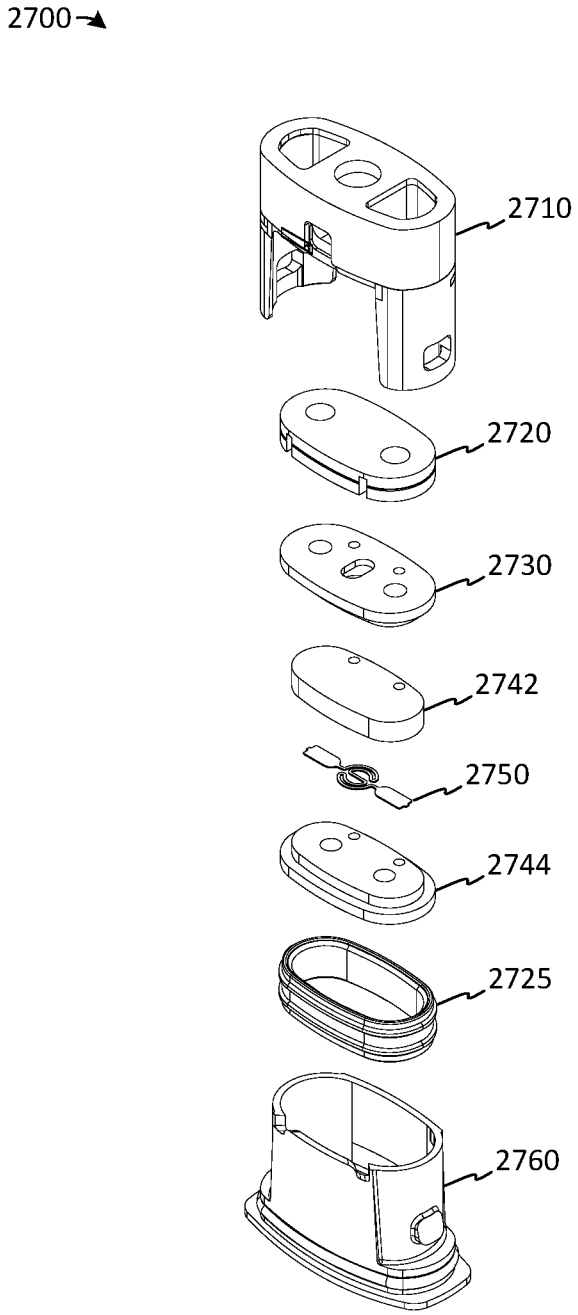
FIG. 27A illustrates an exploded view of a vaporizer assembly.
Figure 27D:
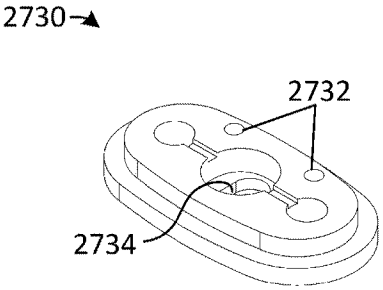
FIG. 27D illustrates an isometric view of the bottom side of a flow director.
Figure 27C:
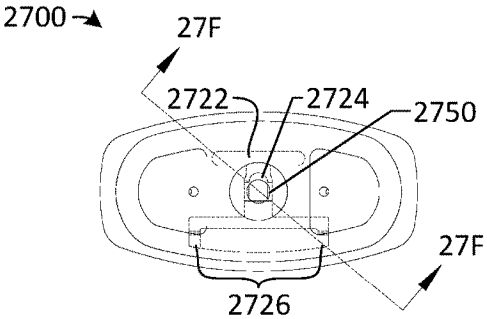
FIG. 27C illustrates a top view of a vaporizer assembly.
Figure 27B:
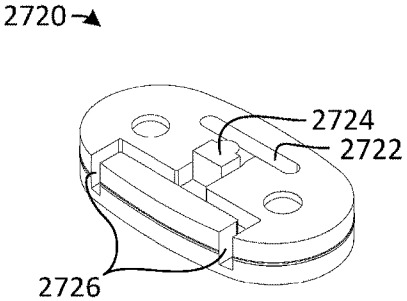
FIG. 27B illustrates an isometric view of the bottom side of an upper seal.
Figure 27G:
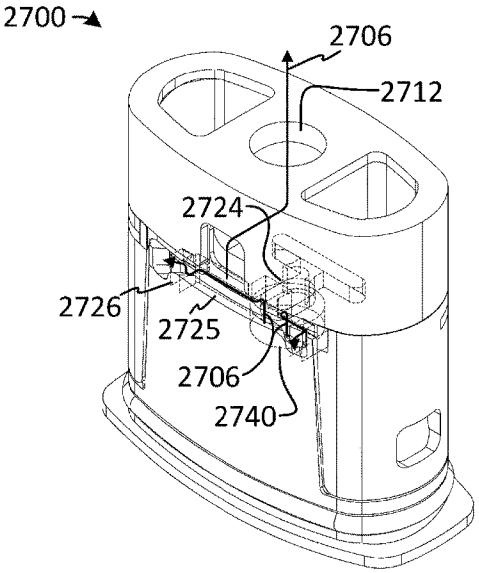
FIG. 27G illustrates an isometric view an outlet flow path.
Figure 27F:
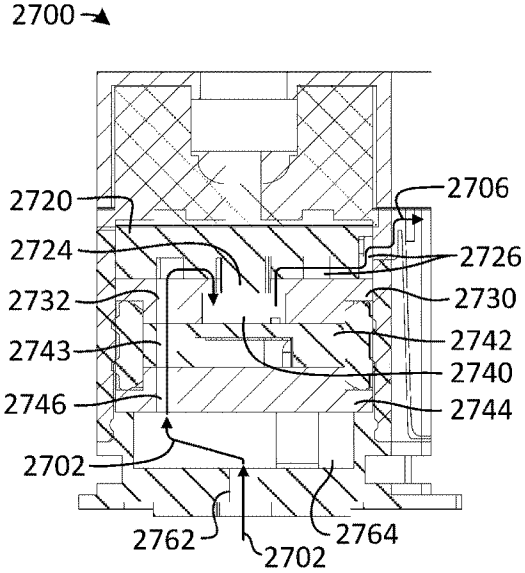
FIG. 27F illustrates a cross section of a vaporizer assembly.
Figure 27E:
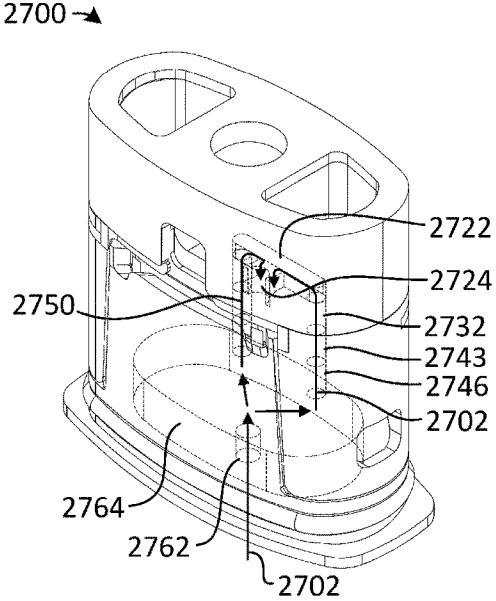
FIG. 27E illustrates an isometric view of an inlet flow path.

FIGS. 27A through 27G present an inlet and outlet flow path for another embodiment of a vaporizer assembly. FIG. 27A provides an exploded view of vaporizer assembly 2700. FIG. 27B is an isometric view of the bottom side of upper seal 2720. FIG. 27C illustrates a top view of vaporizer assembly 2700. FIG. 27D illustrates an isometric view of the bottom side of flow director 2730. FIGS. 27E and 27G are isometric views of an inlet and outlet flow path, respectively. FIG. 27F shows a cross section of vaporizer assembly 2700.

Vaporizer assembly 2700 may comprise upper chassis 2710, upper seal 2720, flow director 2730, upper housing 2742, heater 2750, lower housing 2744, outer seal 2725, and lower chassis 2760. Vaporizer assembly 2700 may, in a general sense, operate in accordance with other vaporizer designs disclosed herein, but may introduce alternative airflow features or methods of operation.

Lower chassis 2760 may include one or more inlets 2762, each comprising a channel of substantially uniform cross section to encourage laminar flow of air 2702 into the device. Inlet 2762 may deliver air 2702 directly into expansion chamber 2764. Expansion chamber 2764 may comprise a relatively large internal volume bounded by the interior of lower chassis 2760 and the bottom surface of lower housing 2744 and may be characterized by a significant increase in flow cross section. This transition may produce a reduction in flow velocity and a shift from laminar to turbulent flow regime. The resulting turbulence may prolong air 2702 residence time, thereby facilitating heat transfer from lower housing 2744 and lower chassis 2760. Surface features such as baffles, ridges, or non-uniform geometries may be optionally integrated to further modulate turbulence intensity or increase surface area for heating.

Lower housing 2744 may include one or more channels 2746 coupled to expansion chamber 2764. These channels 2746 may comprise consistent cross sections to promote laminar flow as air 2702 exits the turbulent expansion chamber 2764. Laminar flow in this region may reduce flow losses and particle deposition along the wall. Upstream, channels 2746 may interface with channels 2743 of upper housing 2742 and subsequently with channels 2732 of flow director 2730, preserving a controlled flow profile through each region. Channels 2732 may ultimately deliver air 2702 to intake channel 2722 within upper seal 2720. Intake channel 2722 may promote low velocity, turbulent flow patterns that may increase in velocity as the flow of air 2702 is supplied to chamber 2740 through diverter 2724.

Diverter 2724 may be configured to mate with aerosol port 2734 of flow director 2730. In this example, diverter 2724 may bifurcate aerosol port 2734 into discrete input and output pathways to chamber 2740. The input side and output side of diverter 2724 may include architecture specific to the input or output function. For example, in an embodiment, the input side of diverter 2724 may comprise a crescent-shaped channel configured to deliver a high velocity flow of air 2702 near the periphery of chamber 2740 to mix with vapor generated in chamber to form aerosol 2706, while the output side may include geometry configured to minimize flow resistance. In some embodiments, diverter 2724 may include geometry configured to produce a vortical, or swirling, flow within chamber 2740 to enhance mixing.

Aerosol 2706 generated within chamber 2740 may exit via outlet 2726, which may couple to aerosol port 2734. Outlet 2726 may initially divide a stream of aerosol 2706 exiting aerosol port 2734 into multiple streams. Downstream, each of these streams may be encouraged to achieve laminar flow before being subjected to multiple impaction surfaces and directional changes designed to induce local turbulence and selectively remove larger or higher-inertia particles from the aerosol 2706 stream.

The divided aerosol 2706 streams may then be directed through aerosol channel 2766. Aerosol channel 2766 may be constructed to recombine streams approaching from opposing directions, resulting in a region of elevated turbulence or shear where recirculating vortices may develop. This region of complex flow may facilitate enhanced re-mixing and promote uniform dispersal of any remaining particles, further conditioning the aerosol phase. Additionally, this region of complex flow may facilitate increased dwell and/or transit time of aerosol 2706 for re-mixing and promote uniform heating and dispersal of any remaining particles, enhancing the formation of smaller more uniform particles present in the aerosol 2706 phase. The combined stream may then be directed toward outlet 2712.

Outlet 2712 may comprise a channel formed within upper chassis 2710, featuring a relatively large cross-sectional area intended to support low-velocity laminar flow of aerosol 2706 prior to user delivery. Outlet 2712 may subject the aerosol 2706 stream to a directional change that may remove residual larger particles (e.g., >5 micron) and enhance mixing uniformity of smaller particles (e.g., <5 micron) before the stream exits the device via outlet 2712.

Because inlet and outlet flow paths may communicate with a vaporization chamber containing a liquid precursor, they may also serve as potential conduits for leakage. Leakage may occur during normal use from device orientation, and/or from environmental conditions such as elevated temperature and/or atmospheric pressure changes such as those that occur with increased elevation. Accordingly, some embodiments may incorporate valves at one or more locations along the flow paths to mitigate undesired leakage of the liquid precursor. These valves may take the form of, for example, flap valves, check valves, duckbill valves, poppet valves, ball-and-spring valves, or membrane-based valves; however, other types of valves may be suitable. The use of valves that are thermally mediated to control the flow of a thermoviscous precursor liquid may be used to control flow such that the flow of the precursor liquid though flow channels only occurs when the channels and liquid precursor within in the channel(s) is heated sufficiently to reduce the viscosity of the precursor liquid sufficiently to permit flow. The particular positioning and selection of such valves may be guided by the intended flow characteristics, device orientation, or liquid properties, and could be varied depending on specific use-case considerations.

Figure 28A:
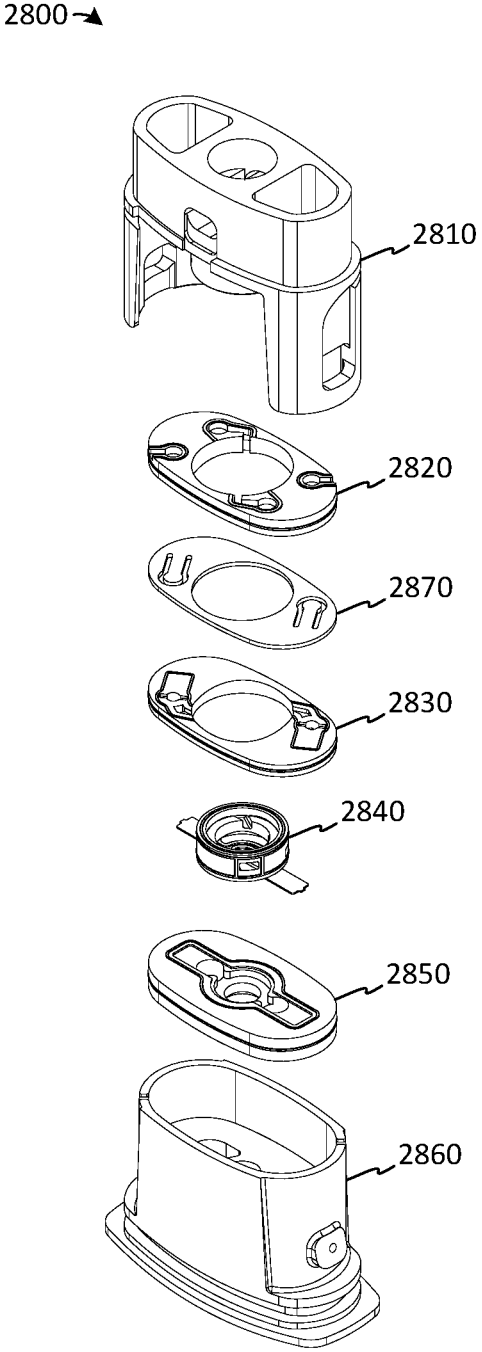
FIG. 28A illustrates an exploded view of a vaporizer assembly.
Figure 28E:
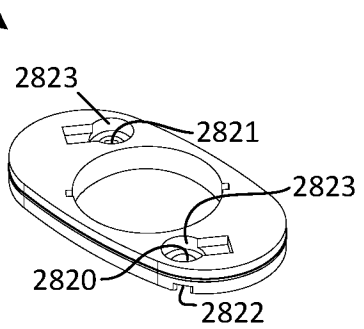
FIG. 28E illustrates an isometric view of a precursor inlet seal.
Figure 28D:
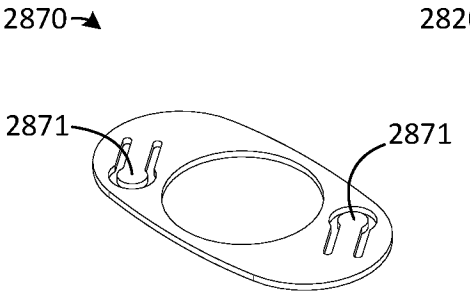
FIG. 28D illustrates an isometric view of a valve assembly.
Figure 28C:
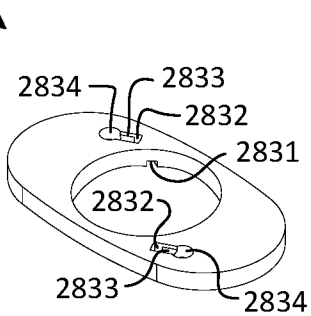
FIG. 28C illustrates an isometric view of the bottom of a mid seal.
Figure 28B:
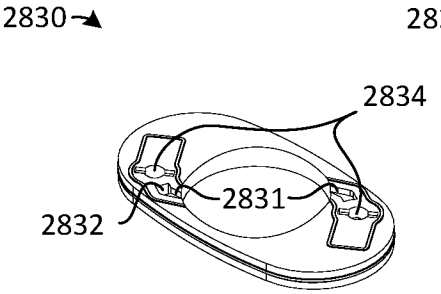
FIG. 28B illustrates an isometric view of the top of a mid seal.
Figure 28H:
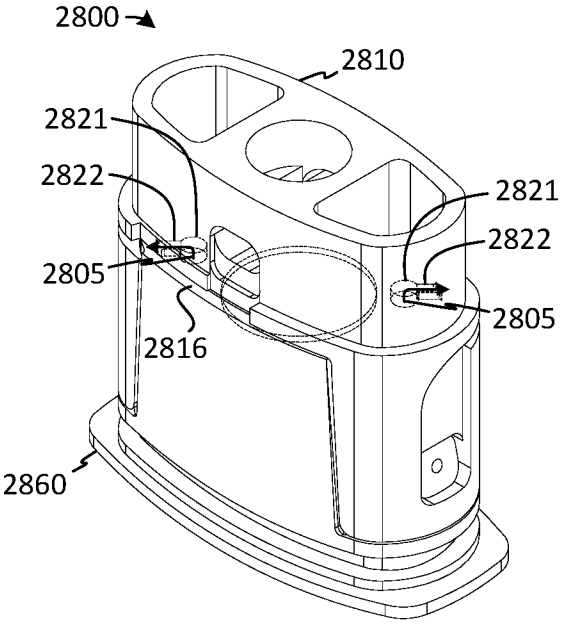
FIG. 28H illustrates a vapor flow path after flap valves.
Figure 28G:
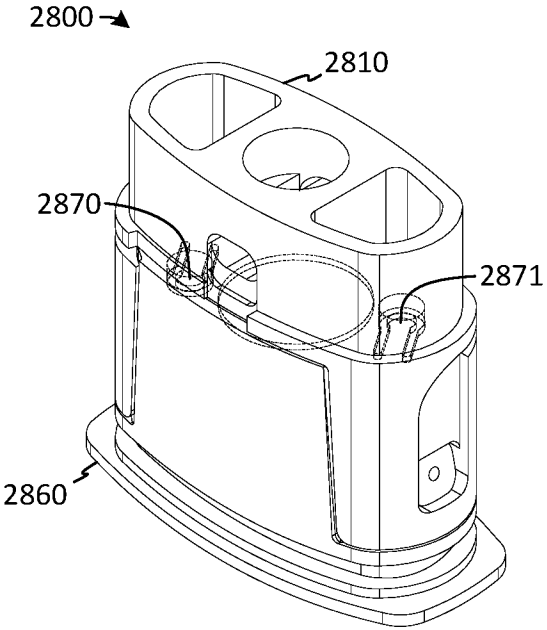
FIG. 28G illustrates flap valves in a vapor flow.
Figure 28F:
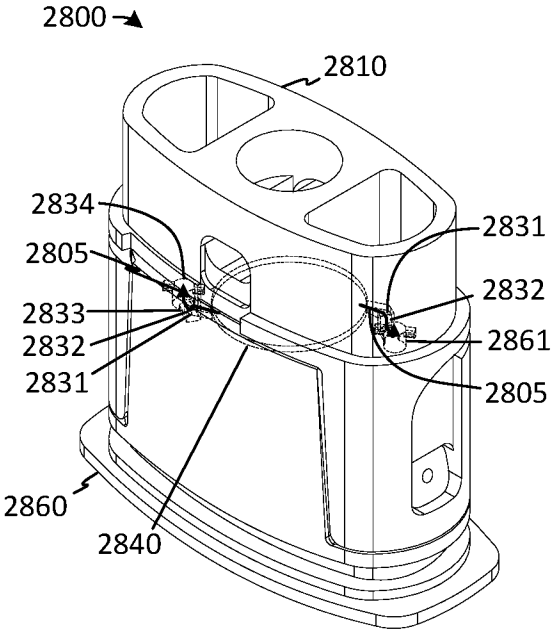
FIG. 28F illustrates a vapor flow path extending from a chamber assembly.

FIGS. 28A through 28H illustrate an outlet flow path including valves for a vaporizer assembly. FIG. 28A provides an exploded view of vaporizer assembly 2800. FIGS. 28B and 28C show top and bottom isometric views of mid seal 2830. FIG. 28D presents an isometric view valve assembly 2870. FIG. 28E depicts an isometric view of precursor inlet seal 2820. FIG. 28F illustrates a vapor flow path extending from chamber assembly 2840, FIG. 28G depicts flap valves 2871 in a vapor flow, and FIG. 28H shows a vapor flow path after flap valves 2871.

Vaporizer assembly 2800 may comprise upper chassis 2810, precursor inlet seal 2820, valve assembly 2870, mid seal 2830, chamber assembly 2840, lower seal 2850, and lower chassis 2860.

Vaporizer assembly 2800 may serve as a further embodiment of vaporizer assembly 2500, generally operating in a similar manner with the notable addition of valve assembly 2870. In this configuration, valve assembly 2870 may be situated between precursor inlet seal 2820 and mid seal 2830, and may occupy a position along the vapor flow path extending from chamber assembly 2840. In certain embodiments, valve assembly 2870 may include one or more flap valves 2871 to inhibit or substantially prevent leakage of a liquid precursor through the vapor pathway, particularly when the device is not in use. When in use, flap valves 2871 may further function as an additional impaction surface to prevent the escapement and/or entrainment of larger particles into the vapor 2805 passing through vapor channels present in precursor inlet seal 2820, and function to return large particles that have impacted the surface of flap valves 2871 and return the larger particles to vapor channels in in mid seal 2830 and subsequently return the particle volume back to precursor liquid chamber assembly 2840. Flap valves 2871 may be configured to open under a certain pressure threshold due to the generation of vapor 2805 in chamber assembly 2840 due to the construction of the flap valves 2871 having a resistance to deflection sufficient to resist opening until sufficient pressure is generated from the production of vapor 2805 to deflect the flap valve 2871. In some embodiments, flap valve 2871 may function as a flutter valve where the valves open and close repeatedly during an activation cycle only when pressure generated from production of vapor 2805 is sufficient to deflect flap valve 2871 and then when the pressure decreases due to the opening of the valve the flap valve 2871 closes until pressure again increases sufficiently to deflect the flap valve 2871. Although flap valves 2871 are described in this example, other valve types may be employed, depending on the desired operational characteristics.

Referring back to FIGS. 25G and 25H, valve assembly 2870 may modify the vapor flow path from chamber assembly 2540 to constriction region 2516. The inlet and outlet flow paths of vaporizer assembly 2800 may be comprised of similar components and operational principles previously described for vaporizer assembly 2500 and as illustrated in FIGS. 25F and 25H.

Valve assembly 2870 may be configured to prevent leakage of a liquid precursor from chamber assembly 2840 through flow paths defined in part by precursor inlet seal 2820 and mid seal 2830, particularly during periods of device inactivity. Flap valves 2871, in some cases constructed from flexible materials such as silicone, may be designed to default to a closed position and may offer a compact profile suitable for integration within constrained spaces. The ability of such valves to provide an effective seal may be influenced by material choice, geometry, and biasing mechanisms.

In this embodiment, precursor inlet seal 2820 and mid seal 2830 may each be adapted from counterparts in vaporizer assembly 2500 (e.g., precursor inlet seal 2520 and mid seal 2530) to accommodate valve assembly 2870. Such adaptations could include the introduction of valve clearances, modified channel geometries, or revised mounting features to ensure compatibility and reliable function of the integrated valve assembly.

With reference to FIG. 28E, precursor inlet seal 2820 may be generally analogous to precursor inlet seal 2520, exhibiting similar top surface geometry and vapor channel orientation (cf. FIG. 25D). Vapor channels 2821 may extend between the top and bottom surfaces of precursor inlet seal 2820, facilitating the passage of vapor streams to vapor channels 2822. In this embodiment, dedicated valve clearances 2823 may be incorporated to allow movement of flap valves 2871 during operation.

Correspondingly, mid seal 2830, as depicted in FIGS. 28B and 28C, may be based on mid seal 2530 but with modifications to the vapor channel arrangement to accommodate valve assembly 2870. In the illustrated configuration, vapor channels 2834 may be isolated from vapor channels 2831 on the top surface, thereby providing a continuous sealing surface against which the flap valves 2871 may close.

During use, vapor 2805 may traverse a series of vapor channels defined by mid seal 2830, progressing from vapor channels 2831 at the top surface through vapor channels 2832, 2833, and finally emerging from vapor channels 2834. Besides accommodating valve assembly 2870, this flow path may incorporate one or more directional changes, serving as a tortuous region to promote selective removal of particles by size and/or mass from the vapor stream before entrainment with carrier air. While this function may be realized in vaporizer assembly 2800, similar conditioning features may be present in vaporizer assembly 2500 employing a mid seal without an intervening valve assembly.

The functional operation of vaporizer assembly 2800 may thus largely parallel that of vaporizer assembly 2500, with the principal distinction being the addition of valve assembly 2870 in the vapor flow path. Lower chassis 2860 and chamber assembly 2840 may correspond to their respective analogues in vaporizer assembly 2500, operating according to similar methods. Air intake, vapor generation, and conditioning of the aerosol stream may proceed as previously described, with the notable difference occurring as vapor 2805 interacts with valve assembly 2870 and passes through the associated sealing and conditioning features.

In operation, air may be drawn through the assembly by application of suction at the outlet, entering via air inlets positioned at the lower chassis and progressing through successive flow conditioning regions. As air exits through lower chassis outlets and transitions into an expansion region, its velocity, temperature, and pressure characteristics may be modulated to promote optimal entrainment conditions, and/or particle size selection conditions, for subsequent interaction with vapor streams.

Vapor generated in chamber assembly 2840 may encounter flap valves 2871 in the closed state, remaining sealed until sufficient vapor pressure or user-applied suction is present to deflect the valve and permit passage. Valve clearances 2823 within precursor inlet seal 2820 may provide necessary free space for valve operation. Upon opening, vapor 2805 continues through aligned vapor channels, ultimately mixing with intake air downstream.

Following entrainment, air and vapor may converge in constriction region 2816, analogous to constriction region 2516, where the velocity differential may promote efficient mixing, thereby forming aerosol 2506. The resultant mixture may then be directed through subsequent expansion and outlet regions, with each segment of the flow path designed to encourage additional particle and/or droplet conditioning, particle selection by size, and/or mass, and ensure suitable aerosol characteristics for aerosol delivery and or aerosol deposition into the deep lung of a user.

Outlet structures, such as outlet 2512, may be tailored to facilitate laminar flow and further particle separation. The outlet cross-section may be uniform or gradually narrowing to enhance aerosol conditioning prior to user inhalation. Larger particles may be removed by gravitational settling or impaction, with the final aerosol composition determined in part by the cumulative operation of tortuous flow geometry, valve assemblies, temperature, and flow conditioning regions throughout the vaporizer assembly.

While vaporizer assembly 2800 provides an example in which flap valves may be efficiently integrated into a vaporizing device, previously described embodiments have primarily contemplated actuation by vapor pressure or suction applied by a user. In alternative configurations, it may be desirable to employ valves capable of being actuated independently of vapor pressure or suction. For instance, certain valve types may be configured to open or close in response to signals from a control system. A control system could initiate valve actuation prior to vapor generation, or alternatively, maintain the valves in a closed state to permit accumulation of vapor within a chamber before selectively opening the valves to allow controlled release. The use of remotely actuated valves, including, but not limited to, solenoid valves, magnetically actuated valves types, shape memory alloy actuators, bi-metallic valve mechanisms, or piezoelectric mechanisms, may offer enhanced flexibility and control over vapor generation and delivery. Such remotely actuated valves may be particularly well-suited for applications where precise timing or user programmability is desired.

Figure 29A:
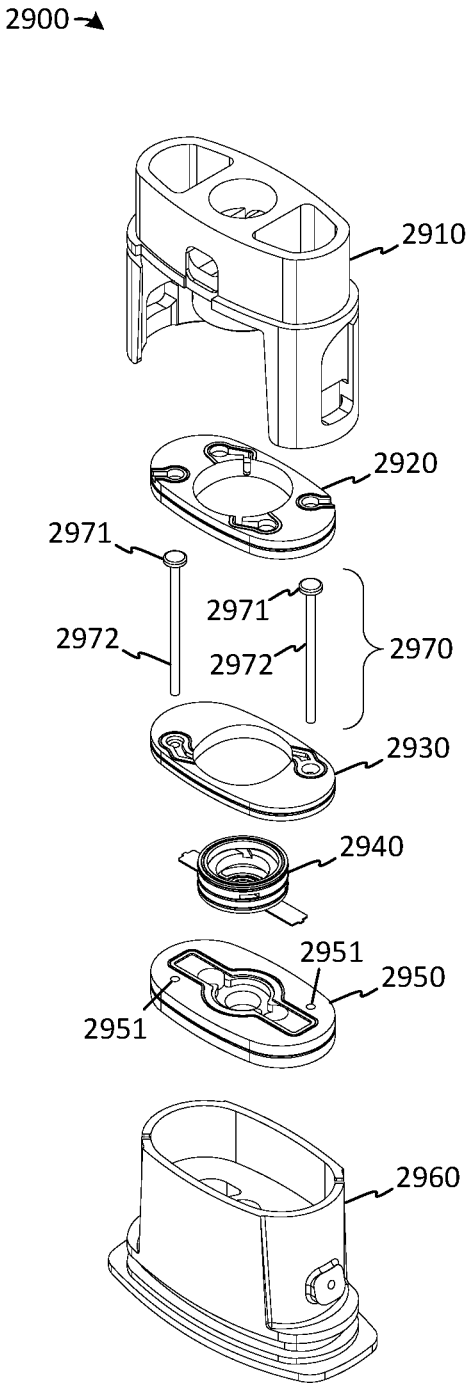
FIG. 29A illustrates an exploded view of a vaporizer assembly.

FIGS. 29A through 29H illustrate an outlet flow path including valves for a vaporizer assembly. FIG. 29A provides an exploded view of vaporizer assembly 2900. FIGS. 29B and 29C show top and bottom isometric views of mid seal 2930. FIGS. 29D and 29E show top and bottom isometric views of precursor inlet seal 2920. FIG. 29F illustrates a vapor flow path extending from chamber 2940, FIG. 29G depicts poppet valve 2970 in a vapor flow, and FIG. 29H shows a vapor flow path after poppet valve 2970. Vaporizer assembly 2900 may comprise upper chassis 2910, precursor inlet seal 2920, poppet valves 2970, mid seal 2930, chamber 2940, lower seal 2950, and lower chassis 2960.

Vaporizer assembly 2900 may represent a further iteration of the vaporizer assemblies previously described, sharing the general flow path architecture outlined for vaporizer assembly 2500 and vaporizer assembly 2800, but introducing remotely actuated valves for select embodiments. While vaporizer assembly 2800 may utilize flap valves actuated by vapor pressure or suction, vaporizer assembly 2900 may instead incorporate poppet valves 2970, which could be actuated by external mechanical or electromechanical means, thereby enabling enhanced control over vapor and liquid flow within the assembly.

Poppet valves 2970 may perform a function analogous to flap valves 2871, specifically in mitigating or preventing leakage of a liquid precursor from chamber 2940 during periods of nonuse. A notable distinction, however, is that poppet valves 2970 may be more easily controlled by external actuation. For example, poppet valves 2970 may include stems 2972 that extend through lower chassis 2960, allowing them to be opened or closed by applying or releasing force to stems 2972. Poppet valves 2970 and/or stems 2972 may be constructed of a thermally conductive material such that the valves, as part of their activation cycle, may be heated. The heating of poppet valves 2970 and/or stems 2972 may serve to help generate vapor 2905 and/or preserve the quality of the vapor 2905 already formed in relation to the vapor 2905 temperature, particle size, particle mass, and other characteristics of the vapor 2905. In certain embodiments, a base unit, such as base unit 802, may house actuation mechanisms, including solenoids, electro-magnets, motors, or other devices configured to operate poppet valves 2970 remotely.

In order to accommodate the form and function of poppet valves 2970, precursor inlet seal 2920, mid seal 2930, and lower seal 2950 may be adapted from analogous seals previously described for vaporizer assembly 2500 and vaporizer assembly 2800. Lower seal 2950, for instance, may incorporate stem seals 2951 configured to provide a close fit around stems 2972 to minimize fluid leakage along these axes. Precursor inlet seal 2920 may include valve clearances 2923 enabling movement of valve heads 2971 within the assembly.

Mid seal 2930 may be manufactured in one or more alternative configurations to support either a relatively direct or a tortuous vapor path. In a first configuration, vapor 2905 may move along a direct channel, similar to that of mid seal 2530, where stem seal 2935 offers a sealing interface for stem 2972. In a second configuration, mid seal 2930 may include tortuous geometry such that vapor 2905 passes through a progression of vapor channels (2931, 2932, 2933, and 2934). In this example, vapor channel 2934 may include an inner diameter larger than stem 2972, permitting vapor 2905 to pass between stem 2972 and the channel sidewall as it advances toward stem seal 2921 of the precursor inlet seal 2920. By altering channel geometry in this manner, mid seal 2930 may contribute to particle conditioning in addition to valve accommodation.

The operation of vaporizer assembly 2900 may parallel the methods discussed for vaporizer assembly 2500 and vaporizer assembly 2800. Air may be drawn into the device through designated inlets, passing through regions designed to condition the stream by temperature, inertial, and turbulent effects. Vapor 2905 may be formed by heating a precursor in chamber 2940, with flow thereafter modulated by the state of poppet valves 2970. Poppet valves 2970 may also be heated to modulate vapor 2905 generated in chamber 2940. Depending on seal and channel configuration, vapor 2905 may encounter a direct valve interface or traverse additional tortuous paths prior to valve engagement.

Poppet valves 2970 may be maintained in a closed state until actuation, preventing advance of vapor 2905 through the flow path. Upon actuation, whether by mechanical depression, electro-magnetic, solenoid actuation, or other means, valve heads 2971 may shift to an open position, permitting vapor flow. Actuation of poppet valves 2970 may occur after initial activation of the device, delayed activation of poppet valves after the activation of the device may serve to facilitate the generation of vapor 2905 in chamber 2940 to reach a desired density and/or pressure of vapor 2905 before being allowed to exit to the vapor channels by the activation of poppet valves 2970. Following passage along vapor channels 2922, vapor 2905 may then be combined with conditioned air in downstream regions. Subsequent flow through expansion and constriction segments of the assembly may further promote aerosolization and selective particle deposition, leading ultimately to delivery of a conditioned aerosol via outlet 2512.

Previously described vaporizer assemblies may generate vapor within a chamber, subsequently mixing the vapor with air introduced from an external source to form an aerosol for delivery to a user. In alternative embodiments, a portion of the air may be introduced directly into the vaporization chamber during vapor generation, enabling in situ mixing with vapor and promoting the formation of aerosol within the chamber itself. Such configurations may incorporate flow directors or similar features configured to induce vortical or rotational flow paths within the chamber. The resulting vortical motion may give rise to centrifugal effects that could serve to disperse a liquid precursor into a thin film or layer, potentially increasing the efficiency of vaporization while also facilitating the selective removal of particles from the aerosol stream based on particle size and/or mass. Notably, a vortical flow within the chamber may be characterized by lower axial velocities near the chamber centerline and higher circumferential velocities near the chamber periphery.

Particles suspended in such a rotational flow may experience mass-dependent separation due to centrifugal forces, with larger or denser particles tending toward the chamber walls and exhibiting increased residence times. Conversely, smaller or lighter particles may preferentially migrate toward the axial core of the flow, where they may become entrained in an aerosol stream exiting the chamber, thereby enhancing aerosol conditioning and delivery characteristics.

Another potential benefit of this design may be the ability to block inlet and outlet flow paths using a single valve. Additionally, as described herein, the introduction of some or all of the intake air into the chamber may serve to put the chamber under a vacuum pressure and thus reduce the vapor pressure of the precursor liquid and therefore reduce the boiling point temperature of the precursor liquid. The reduction in the boiling point temperature of the precursor liquid may serve to increase the efficiency of the production of vapor from the precursor liquid by reducing the amount of thermal energy required to heat the precursor liquid to transition the precursor liquid to a vapor. Reducing the thermal energy required and/or the maximal temperature required to transition the precursor liquid into vapor may also serve to reduce the generation of thermal degradation products that may result from heating the precursor. Furthermore, establishing a vacuum pressure on the chamber during activation may serve to improve vaporizer performance in different environmental conditions such as different elevations such that the vacuum pressure exerted on the chamber serves to normalize the temperature required to mobilize the precursor liquid to a vapor when the vaporizer is operated at different elevations and/or atmospheric pressures. This may improve production of the inhalation aerosol in different elevations above sea level conditions and/or different atmospheric pressures.

Figure 30A:
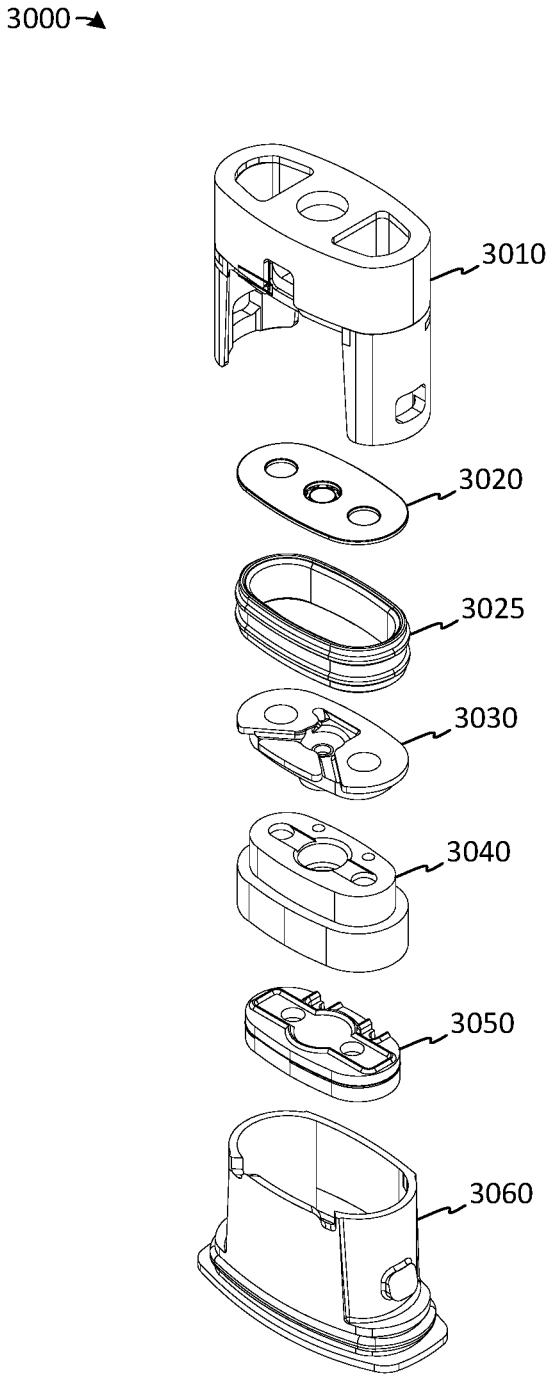
FIG. 30A illustrates an exploded view of a vaporizer assembly.
Figure 30J:
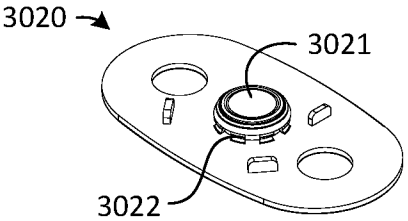
FIG. 30J illustrates an isometric view of the bottom of a vortical flow director.
Figure 30I:
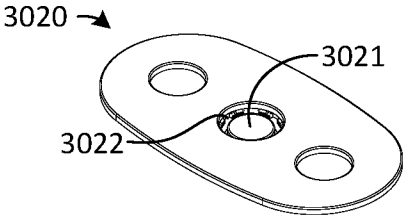
FIG. 30I illustrates an isometric view of the top of a vortical flow director.
Figure 30H:
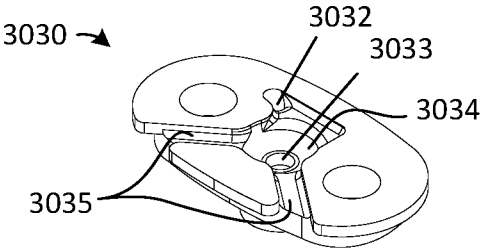
FIG. 30H illustrates an isometric view of the top of a flow director.
Figure 30L:
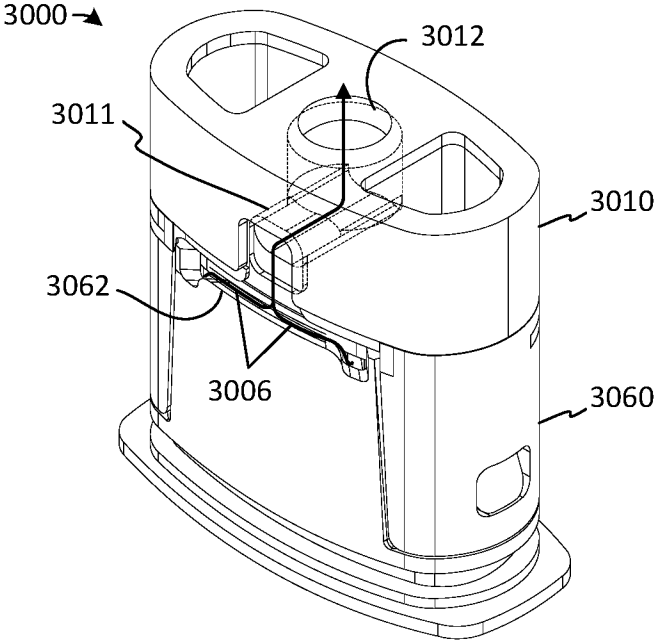
FIG. 30L illustrates an aerosol outlet flow path associated with a vaporizer assembly.
Figure 30K:
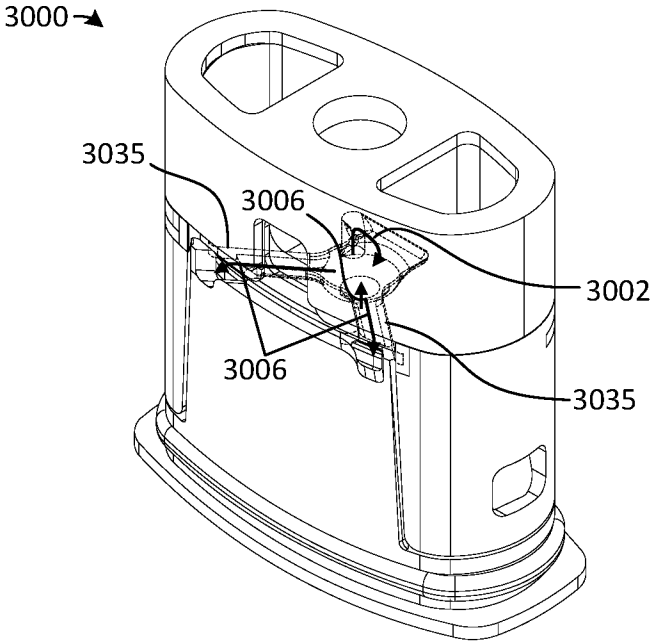
FIG. 30K illustrates an aerosol flow path from a chamber.

FIGS. 30A through 30L illustrate inlet and outlet flow paths including a vortical flow director and a valve for a vaporizer assembly. FIG. 30A provides an exploded view of vaporizer assembly 3000. FIG. 30B shows a cross section of lower chassis 3060. FIG. 30C illustrates a bottom isometric view of lower seal 3050. FIG. 30D illustrates chamber housing 3040. FIGS. 30E and 30H show bottom and top isometric views of flow director 3030. FIG. 30G illustrates an air inlet flow path within vaporizer assembly 3000 and FIG. 30G depicts a vapor flow path extending from chamber 3043. FIGS. 30I and 30J show top and bottom isometric views of vortical flow director 3020. FIG. 30K illustrates an aerosol flow path from chamber 3043. FIG. 30L demonstrates an aerosol outlet flow path associated with vaporizer assembly 3000.

Vaporizer assembly 3000 may comprise upper chassis 3010, vortical flow director 3020, outer seal 3025, flow director 3030, chamber housing 3040, lower seal 3050, and lower chassis 3060. Vaporizer assembly 3000 may generally resemble previously described vaporizers, vaporizing devices, and vaporizer assemblies, though it may exhibit distinctive structural and operational features.

Referring to FIG. 30B, lower chassis 3060 may include intake 3061, which may take the form of a through hole disposed within lower chassis 3060 and configured to direct incoming air 3002 into vaporizer assembly 3000. Intake 3061 may supply air to air channel 3051 formed in lower seal 3050.

FIG. 30C illustrates a bottom surface of lower seal 3050, which may be retained within lower chassis 3060 and configured both to direct incoming air 3002 and to inhibit leakage of a liquid precursor from vaporizer assembly 3000. Lower seal 3050 may include air channel 3051 to receive air 3002 and may further comprise one or more air channels 3052 to supply air 3002 to different regions or components within vaporizer assembly 3000. In the depicted embodiment, air channels 3052 direct air 3002 to lower air channel 3041 and upper air channel 3042 of chamber housing 3040.

As shown in FIG. 30D, chamber housing 3040 may define lower air channel 3041 and upper air channel 3042, which may be configured to facilitate the distribution of air 3002 from a common source to multiple locations within vaporizer assembly 3000. For example, lower air channel 3041 may deliver air 3002 to flow path 3031 of flow director 3030, while upper air channel 3042 may deliver air 3002 to air channel 3032 of flow director 3030.

Turning to FIG. 30E, flow director 3030 may be equipped with flow path 3031, which may include architecture to direct a stream of air 3002 into chamber 3043. Flow path 3031 may be contoured or angled to impart a rotational or vortical motion to air 3002 within chamber 3043, promoting enhanced mixing or dispersion.

The top surface of flow director 3030, as illustrated in FIG. 30H, may include depression 3034 configured to receive plug 3021 of vortical flow director 3020. Vortical flow director 3020 receives intake airflow from air channel 3032 and induces a vortical rotation flow through the helical flow feature of flow director 3022. As depicted in FIG. 30J, the bottom surface of vortical flow director 3020 may incorporate plug 3021, which may be adapted to engage with depression 3034. Vortical flow director 3020 may also be constructed to function as a membrane valve, potentially constructed from a flexible material such as silicone, and configured to permit vertical displacement of plug 3021 in and out of depression 3034. Due to the particular arrangement of the flow paths in this embodiment, where air 3002 may be directed both into chamber 3043 and into depression 3034, and aerosol 3006 generated within chamber 3043 may exit through outlet 3033 to depression 3034 for further mixing, vortical flow director 3020 may be alternatively configured to seal both inlet and outlet flow paths. In an embodiment, vortical flow director 3020 may function as a valve and default to a closed position, opening in response to vapor pressure produced by heating a precursor within chamber 3043, by suction applied by a user, or by a combination of both.

Vortical flow director 3020 may further include flow director 3022 formed on the outer perimeter of plug 3021, which may aid in establishing or maintaining rotational flow in aerosol 3006 as it exits from chamber 3043 at outlet 3033. Air channel 3032 may supply air 3002 from upper air channel 3042 to the interface between vortical flow director 3020 and flow director 3030. The combination of air 3002 and aerosol 3006 may occur within depression 3034, after which the resulting mixture may pass through aerosol channels 3035. Aerosol channels 3035 may be arranged to transfer aerosol 3006 from depression 3034 toward constriction region 3062.

As depicted in FIG. 30K, constriction region 3062 may be formed at the interface of upper chassis 3010 and lower chassis 3060, and, in some embodiments, may be further defined by a housing (not illustrated) similar to reservoir 901. Constriction region 3062 may comprise a channel configured to generate a relatively high-velocity, laminar flow of aerosol 3006. In this embodiment, constriction region 3062 may combine two opposing flows of aerosol 3006, generating turbulence as the combined stream proceeds toward expansion region 3011 and eventually exits through outlet 3012.

The previously described embodiment may have employed a unique flow architecture configured to induce a vortical flow of vapor and air within a chamber to promote enhanced mixing and aerosol conditioning. In addition, such architectures demonstrated how a single valve could be used to block multiple flow paths to mitigate leakage. In further embodiments, a similar chamber design may incorporate a plurality of valves, wherein individual valves selectively block various inlet and outlet flow paths. Moreover, alternatives may feature chamber architectures designed to increase the available surface area for a liquid precursor's exposure to a heated surface, thereby potentially improving vaporization efficiency.

Figure 31A:
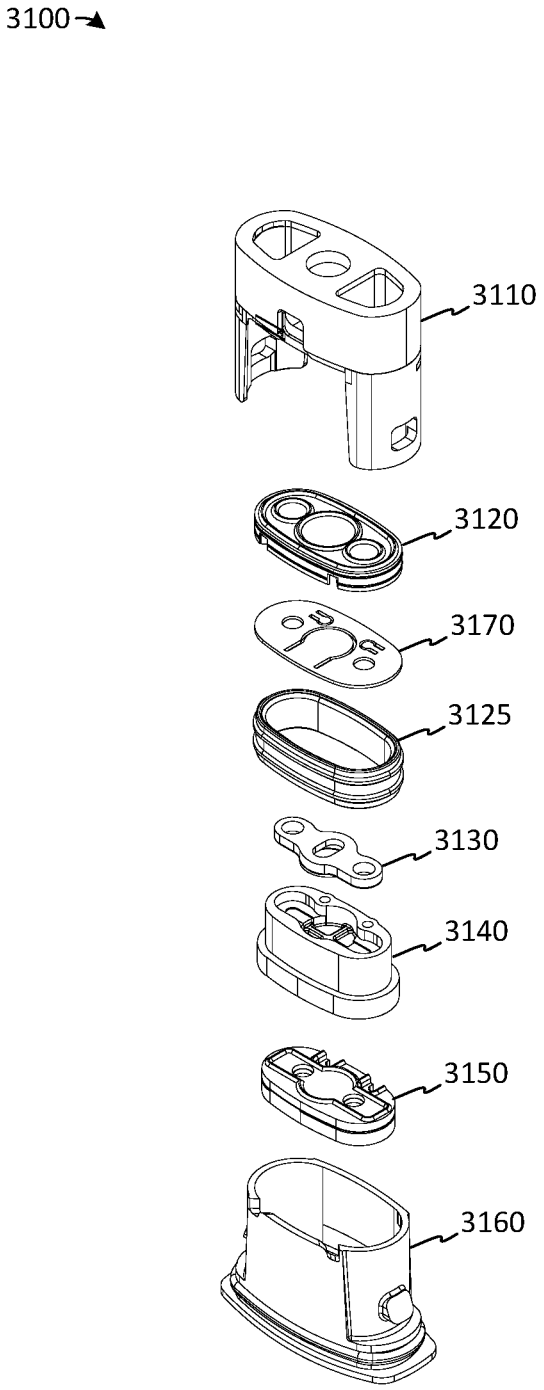
FIG. 31A illustrates an exploded view of a vaporizer assembly.

FIGS. 31A through 31G illustrate inlet and outlet flow paths, as well as associated valves, for a vaporizer assembly. FIG. 31A provides an exploded view of vaporizer assembly 3100. FIG. 31B shows a bottom isometric view of lower seal 3150. FIG. 31C depicts chamber housing 3140. FIG. 31D illustrates an isometric view of valve assembly 3170. FIG. 31E presents a bottom isometric view of flow director 3120. FIG. 31F outlines an air intake flow path, and FIG. 31G depicts the mixing of vapor and air, resulting in aerosol generation and the subsequent exit flow path.

Vaporizer assembly 3100 may comprise upper chassis 3110, flow director 3120, valve assembly 3170, outer seal 3125, chamber flow director 3130, chamber housing 3140, lower seal 3150, and lower chassis 3160. Vaporizer assembly 3100 may generally resemble previously described vaporizer assemblies, while incorporating distinctive structural and operational features.

Lower chassis 3160, which may be similar to lower chassis 2560, may include a cross-sectional profile similar to that shown in FIG. 25B. Lower chassis 3160 may comprise air intake 3161, which may be implemented as a channel positioned within the lower chassis to direct a stream of air into the device. Air intake 3161 may communicate with air channel 3151 formed within lower seal 3150.

As illustrated in FIG. 31B, the bottom surface of lower seal 3150 may be configured to direct incoming air 3102 and inhibit leakage of a liquid precursor from vaporizer assembly 3100. Lower seal 3150 may include air channel 3151 for receiving a stream of air 3102, which may then be distributed to one or more air channels 3152. Air channels 3152 may supply air 3102 to different components, including air channels 3141 and 3142 of chamber housing 3140.

FIG. 31C depicts chamber housing 3140, which may include air channels 3141 and 3142 configured to receive air 3102 from lower portions of the device and direct it to selected locations. In certain embodiments, air channels 3141 and 3142 may supply air 3102 to valve clearances 3121 of flow director 3120, where mixing with vapor 3105 may occur near outlet valve 3172. Intake valves 3171 may be positioned near terminal ends of air channels 3141 to help regulate and prevent leakage.

Valve assembly 3170, illustrated in FIG. 31D, may include one or more intake valves 3171 and at least one outlet valve 3172. Intake valves 3171 could be configured to prevent leakage of liquid precursor from chamber housing 3140 via air channels 3141, and may be actuated by suction or alternative means. Outlet valve 3172 may be configured to actuate in response to vapor pressure, suction, or both. Although flap valves are depicted, other valve types could be substituted to meet particular requirements.

Flow director 3120, as shown in FIG. 31E, may incorporate valve clearances 3121 to accommodate the movement of intake valves 3171. Flow director 3120 may be configured to receive air 3102 from air channels 3141 at valve clearances 3121 and direct it to the mixing region 3122.

Mixing region 3122 may be located proximate to chamber 3143 and may provide space for opening of outlet valve 3172, receive air 3102 via valve clearances 3121, and accept vapor 3105 generated within chamber 3143. Within mixing region 3122, air 3102 and vapor 3105 may combine to generate aerosol 3106 for downstream delivery.

Flow director 3120 may further include aerosol channels 3123 in fluid communication with mixing region 3122, configured to convey aerosol 3106 to constriction region 3162. As indicated in FIG. 31G, constriction region 3162 may be formed at the interface of upper chassis 3110 and lower chassis 3160, and may be further defined by a housing such as reservoir 901 (not shown). Constriction region 3162 may provide a channel for creating a relatively high-velocity, laminar flow of aerosol 3106. In this embodiment, constriction region 3162 may combine two opposing flows of aerosol 3106, thereby generating turbulence as the combined stream advances toward the outlet.

The flow path and operational stages may generally reflect those described for previous embodiments, such as in FIG. 30L, with modifications as noted above.

A variety of valve mechanisms suitable for use in vaporizer devices have been previously described, each providing unique structural or functional benefits. However, these examples are provided for illustrative purposes and are not intended to limit the scope of possible configuration. The following description introduces a further alternative embodiment, illustrating an additional valve system that may be incorporated into a vaporizer device, either independently or in combination with other features disclosed herein.

Figure 32A:
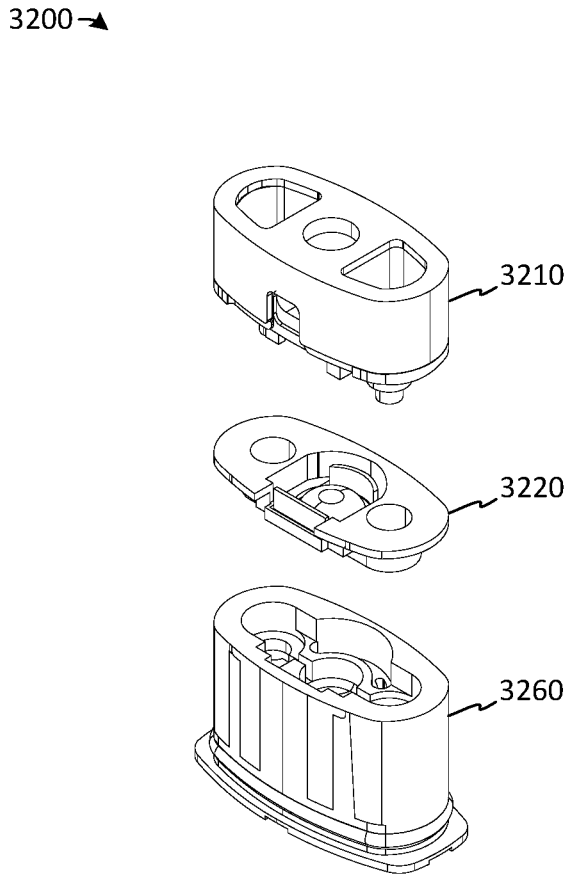
FIG. 32A illustrates an exploded view of a vaporizer assembly.
Figure 32D:
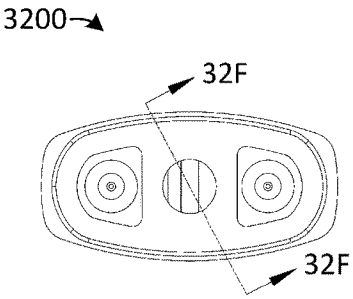
FIG. 32D illustrates a top view of a vaporizer assembly.
Figure 32C:
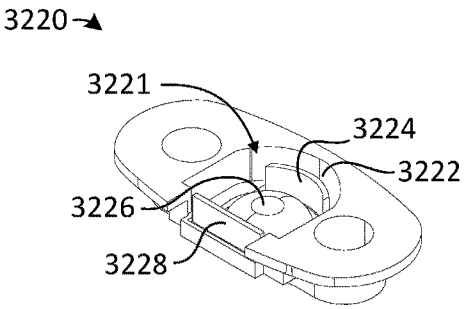
FIG. 32C illustrates an isometric view of a flow director.
Figure 32B:
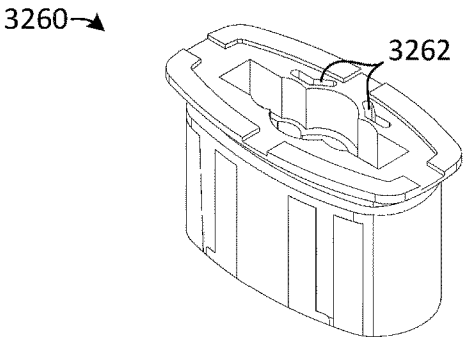
FIG. 32B illustrates an isometric view of the bottom side of a lower chassis.
Figure 32F:
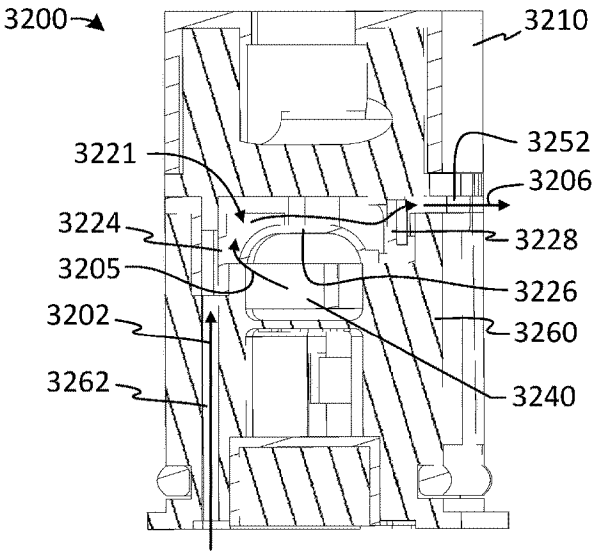
FIG. 32F illustrates a cross section of a vaporizer assembly.
Figure 32E:
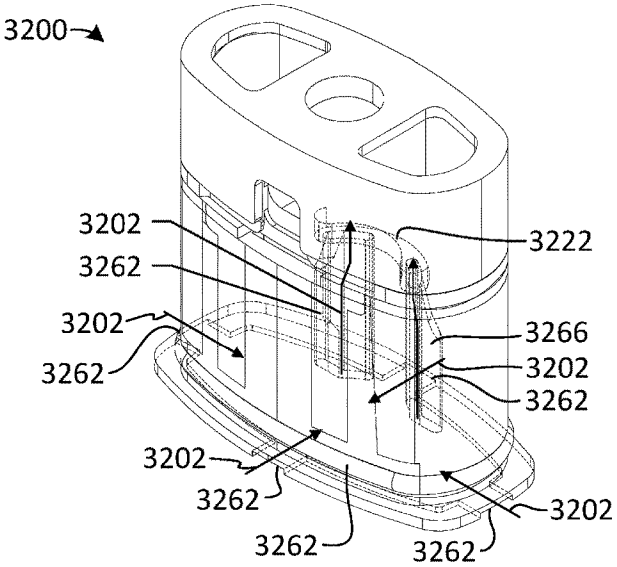
FIG. 32E illustrates an isometric view of a vaporizer assembly.

FIGS. 32A through 32B illustrate various aspects of inlet and outlet flow paths including valves for a vaporizer. FIG. 32A illustrates an exploded view of vaporizer assembly 3200. FIG. 32B presents an isometric view of the bottom side of lower chassis 3260. FIG. 32C is an isometric view of flow director 3220. FIG. 32D provides a top view of vaporizer assembly 3200. FIG. 32E is an isometric illustration of vaporizer assembly 3200. FIG. 32F is a cross section of vaporizer assembly 3200.

Vaporizer assembly 3200 may comprise upper chassis 3210, flow director 3220, and lower chassis 3260. Vaporizer assembly 3200 may generally resemble previously described vaporizer assemblies, while incorporating distinctive structural and operational features.

Lower chassis 3260 may include one or more inlets 3262, each configured to draw air 3202 into lower cavity 3264. Lower cavity 3264 may be a void within lower chassis 3260 where air 3202 streams from the one or more inlets 3262 may combine. Lower cavity 3264 may supply the combined streams to inlet channels 3266. Inlet channels 3262 may initially feature a relatively large cross-sectional area that narrows along the direction of flow. This reduction in cross section may induce an increase in the velocity of air 3202, consistent with the continuity equation. Inlet channels 3262 may be located in proximity to chamber 3240 to allow residual heat from chamber 3240 to heat intake channels 3262 and air 3202 traveling within. Preheating of air 3202 may improve efficiency of vaporization within chamber 3240. Inlet channels 3266 may supply air to intake 3222 of flow director 3220.

Flow director 3220 may include mixing region 3221, intake 3222, intake valve 3224, chamber valve 3226, and outlet valve 3228. Mixing region 3221 may be configured as a cavity in proximity to chamber 3240, wherein air 3202 may be combined with vapor 3205 generated in chamber 3240 to form aerosol 3206. Intake valve 3224, in an embodiment, may comprise a suction-actuated flap valve positioned between intake 3222 and mixing region 3221 and may be responsive to user inhalation. Intake valve 3224 may function to prevent leakage of liquid precursor inlet channels 3266 during periods of nonuse. In alternative embodiments, intake valve 3224 may employ different geometries or actuation mechanisms.

Chamber valve 3226 may comprise a flap-type valve positioned between chamber 3240 and mixing region 3221. Chamber valve 3226 may be configured to seal chamber 3240 to prevent a liquid precursor from leaking when the device is not in use. In an embodiment, chamber valve 3226 may include a dome-shaped geometry that may increase the effective volume of chamber 3240 and provide additional rigidity to the sealing edge of chamber valve 3226. Alternatively, a flat flap valve, analogous to outlet valve 3172, may be employed. Chamber valve 3226 may be actuated by increased pressure within chamber 3240, user-generated suction, or a combination of both. Upon opening, chamber valve 3226 may enable vapor 3205 to be released into mixing region 3221, where it may be mixed with incoming air 3202 to form aerosol 3206.

Outlet valve 3228 may be a flap valve positioned between mixing region 3221 and aerosol channel 3252 and configured to prevent a liquid precursor from leaking through aerosol channel 3252 when the device is not in use. Outlet valve 3228 may be actuated by pressure generated within chamber 3240, user-generated suction, or a combination of both. Upon opening, outlet valve 3228 may allow aerosol 3206 to flow from mixing region 3221 to aerosol channel 3252. Downstream of outlet valve 3228, the flow path may generally resemble that of vaporizer assembly 3100 or other embodiments described herein, although additional conditioning features, such as selective impaction surfaces or further valve elements, could be included as required.

In this embodiment, flow director 3220 may be manufactured from a single piece of non-reactive, compliant material, such as silicone; however, alternative embodiments could separate the various valves into separate parts.

The previously discussed inlet and outlet flow paths have been described in the context of a vaporizer assembly included in a disposable cartridge of a vaporizing device. However, it should be appreciated, that these vaporizer assemblies and associated inlet and outlet flow paths may be assembled into a reusable base unit.

Vaporizing device 3300 may be configured to incorporate any of the previously described vaporizer assembly embodiments, including structures and operational principles analogous to those of vaporizer assembly 2500 and vaporizer assembly 2800. The following description draws on specific features and flow path conditioning processes described for those assemblies, thereby providing a basis for understanding the technical advancements and alternative configurations possible within vaporizing device 3300.

FIGS. 33A through 33D illustrate inlet and outlet flow paths, as well as the associated valves, for vaporizing device 3300. Vaporizing device 3300 may comprise detachable cartridge 3301 for use with base unit 3303. Cartridge 3301 may be configured to store and supply a liquid precursor and may include valves or other means adapted to minimize leakage when cartridge 3301 is detached from base unit 3303. The configuration and operation of these valves may be similar to vaporizer assembly 2800.

Base unit 3303 may comprise vaporizer assembly 3310 and inlets 3361. Inlets 3361 may be an example of any of the previously described inlets (e.g., inlet 150, 250) but may include alternative geometry adapted to this embodiment. In this embodiment, inlets 3361 may be configured to transfer air exterior to base unit 3303 to components comprising vaporizer assembly 3310.

Figure 33A:
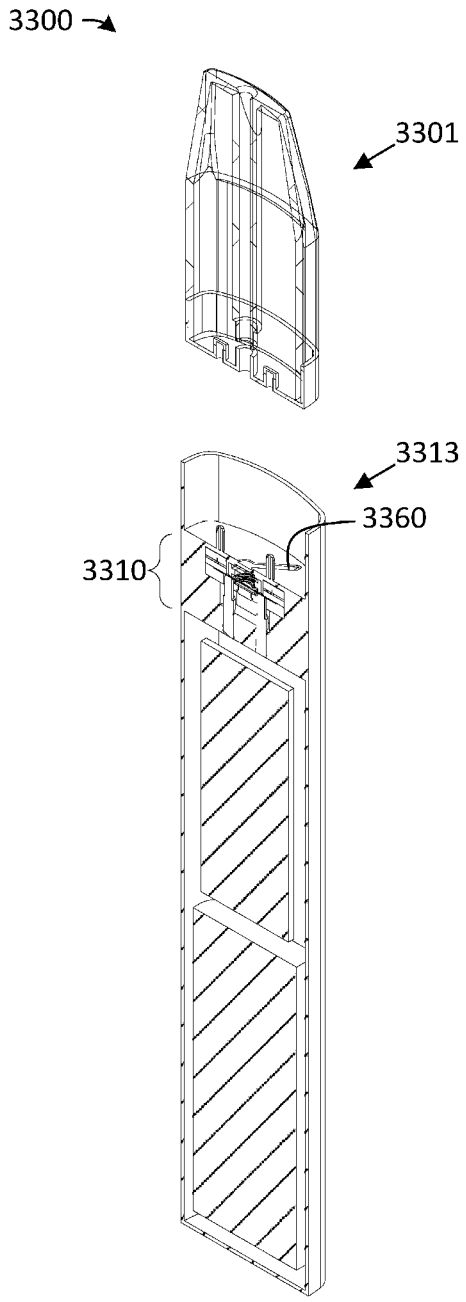
FIG. 33A illustrates a cross section of a vaporizer device.
Figure 33B:
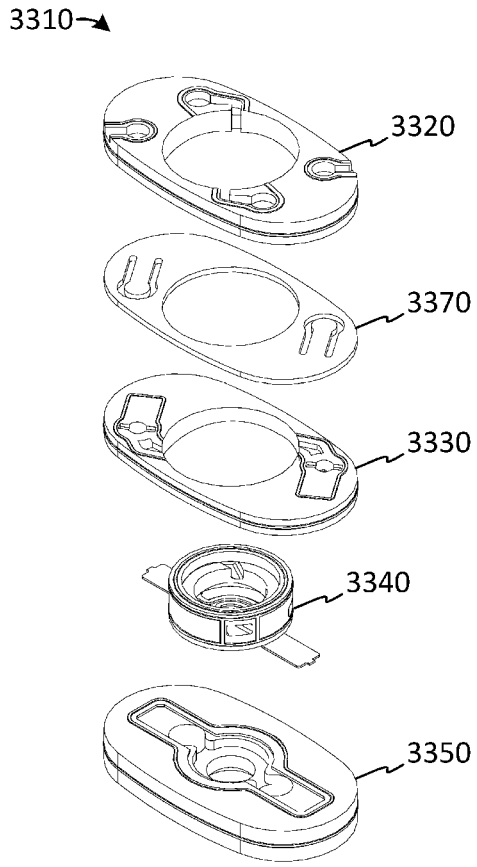
FIG. 33B illustrates an exploded view of a vaporizer assembly.

FIG. 33B illustrates an exploded view of vaporizer assembly 3310. Vaporizer assembly 3310 may be analogous to vaporizer assembly 2500 but adapted for assembly into base unit 3303 rather than a detachable cartridge. It should be clear that any of the previously discussed vaporizers may be adapted for use in either a cartridge or a base unit, such as base unit 3303. Vaporizer assembly 3310 may comprise precursor inlet seal 3320, valve assembly 3370, mid seal 3330, chamber assembly 3340, and lower seal 3350.

A liquid precursor in chamber assembly 3340 may be vaporized via applied heat, producing vapor 3305 and elevating chamber pressure. As illustrated in FIG. 33C, vapor 3305 may flow from chamber assembly 3340 into vapor channels 3331 due to vapor pressure resulting from heating the precursor, suction, or both. Vapor channels 3322, 3331, 3332, 3333, and 3334 may be analogous to previously described outlets and could be configured to include tortuous flow geometry that may promote conditioning of vapor 3305. Tortuous flow geometry may comprise multiple abrupt directional changes, cross-sectional variations, and surface textures within the channels.

Vapor 3305 may be subject to a series of directional changes, which could result in separation of larger particles or droplets from the stream. For example, transitions between vapor channels 3331, 3332, 3333, and 3334 may cause higher-mass constituents to deviate from the primary flow path and deposit onto surfaces, fragment into smaller particles, or condense at phase boundaries. Vapor channel 3334 may extend vertically and have a substantially consistent cross-section that could further act as a laminar flow region where gravitational settling of large particles may occur.

Vapor 3305 may encounter valve 3371 at an end of vapor channel 3334. Valve 3371 may default to a closed position and may be configured to prevent a liquid from leaking from chamber assembly 3340 and to open due to vapor pressure, suction, or both. Valve 3371 may be illustrated as a flap valve in this embodiment but it should be understood that alternative valve designs, such as poppet valve 2970, may be used. Opening of intake valves 3371 may be triggered by user inhalation, vapor pressure, or by electromechanical actuation, according to the selected embodiment.

Figure 33D:
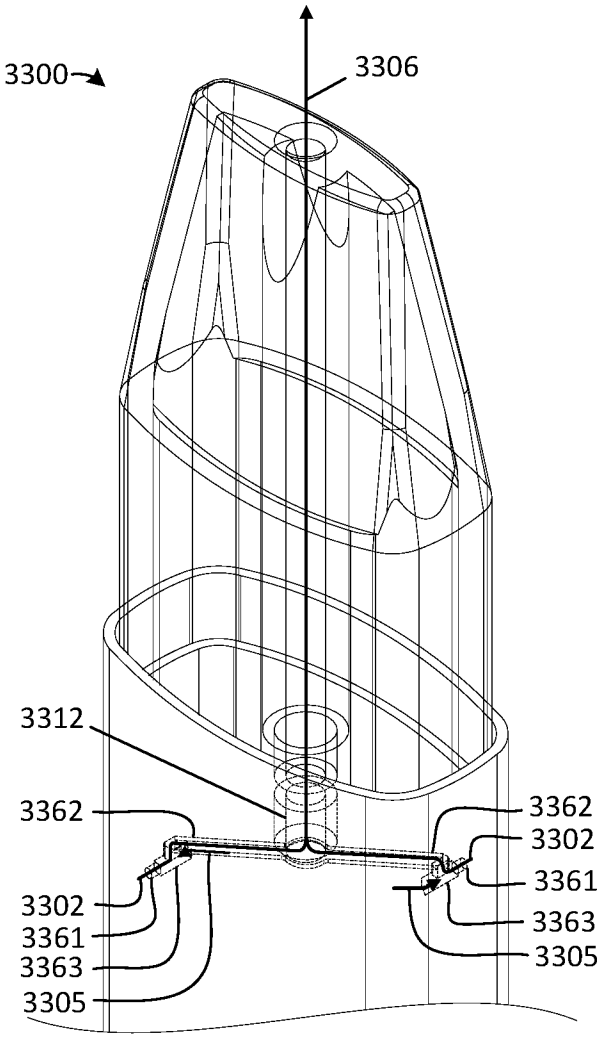
FIG. 33D illustrates an isometric view of an outlet path of a vaporizer device.
Figure 33C:
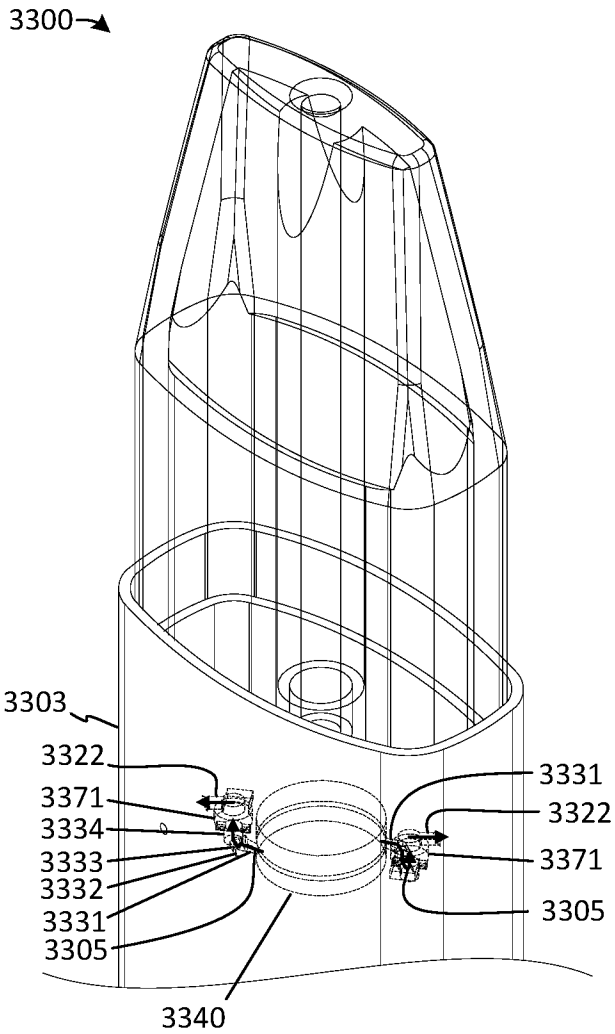
FIG. 33C illustrates an isometric view of an inlet path of a vaporizer device.

FIG. 33D illustrates a flow path following the passage of vapor 3305 through valve 3371. Here, vapor 3305 may encounter air 3302 entering from inlets 3361. Following passage through valve assembly 3370, vapor 3305 may enter mixing region 3363, which may be configured to promote entrainment and dispersion of vapor 3305 with air 3302 to form aerosol 3306, possibly by inducing converging counterflows, swirling vortices, or localized turbulence. Mixing region 3363 may direct a flow of aerosol 3306 to constriction region 3362. Constriction region 3362 may provide a zone of relatively high-velocity, laminar flow that could help maintain uniform aerosol particle suspension and minimize deposition of smaller particles, promoting efficient downstream delivery.

Aerosol 3306 may traverse toward outlet 3312, where the flow regime could transition from laminar to a turbulent, relatively low-velocity environment. This transition may enable additional conditioning, such as further removal of larger particles by coalescence, agglomeration, settling, or impaction on surfaces configured for droplet collection. Outlet 3312 may comprise regions of uniform cross-section or feature gradual tapering, depending on the desired flow characteristics and deposition dynamics.

Vaporizing device 3300 illustrates one possible embodiment of a vaporizing device featuring a base unit and detachable cartridge. Additional embodiments may supplement or replace certain flow path and aerosol conditioning strategies with new functionalities, such as the incorporation of a preheater element for active preconditioning of intake air and the inclusion of additional sensors distributed throughout the device. These enhancements may be directed toward further optimizing vaporization efficiency, facilitate real-time monitoring and control of operational parameters, and improving the user experience.

Figure 34B:
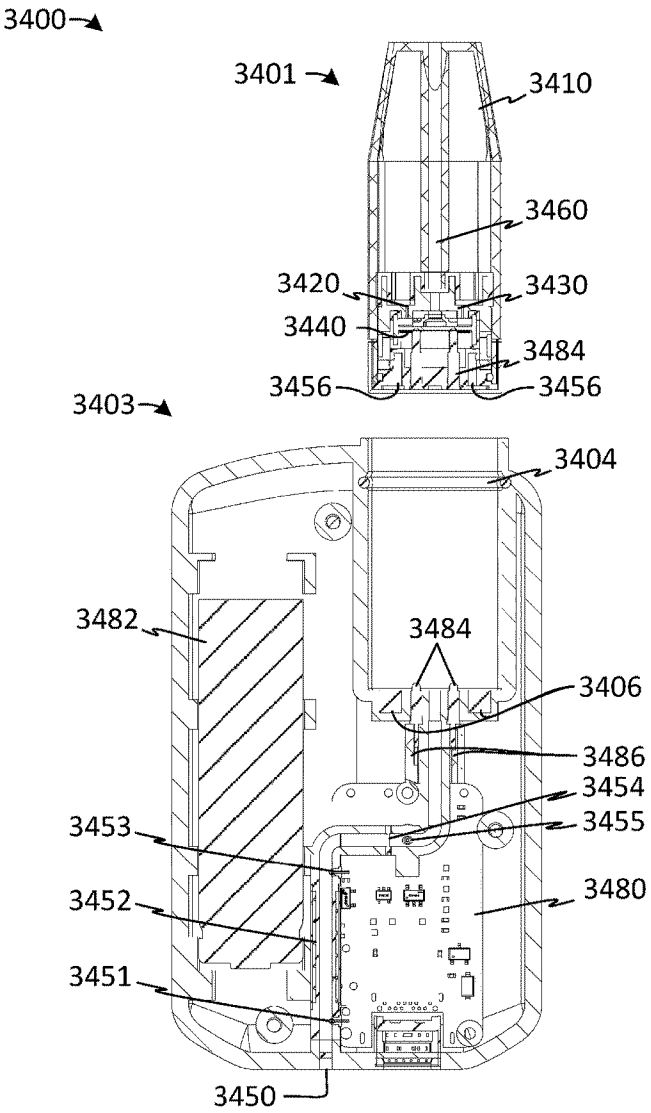
Figure 34A:
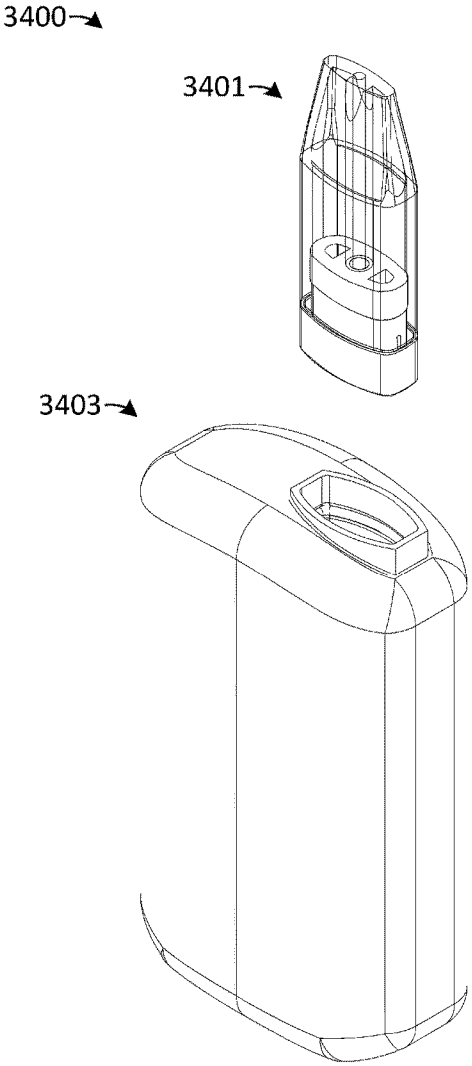

FIGS. 34A and 34B respectively provide an isometric and cross-sectional view of vaporizing device 3400. Vaporizing device 3400 may comprise cartridge 3401 and base unit 3403, wherein cartridge may represent any cartridge embodiment described herein. As illustrated, cartridge 3401 may include reservoir 3410, dispenser 3420, chamber assembly 3430, heater 3440, and cartridge inlet 3456, although, in alternative embodiments, one or more of these components may be integrated within base unit 3403. Similarly, base unit 3403 may exemplify any suitable base unit described herein and, as illustrated, may comprise O-ring 3404, magnets 3406, inlet 3450, sensor 3451, preheater 3452, sensor 3453, flow modifier 3454, sensor 3455, controller 3480, battery 3482, electrical contacts 3484, and heatsinks 3486.

Vaporizing device 3400 may be generally similar to other vaporizer embodiments disclosed herein. Vaporizing device 3400 may include controller 3480 configured to monitor various sensors, such as sensors 3451, 3453, and 3455, and regulate heat delivery to chamber assembly 3430, and battery 3482 to provide electrical power to base unit 3403 and cartridge 3401. Cartridge 3401 may be removably coupled with base unit 3403, and, in some embodiments, may be held in place by one or more magnets 3406. O-ring 3404 may establish a seal between base unit 3403 and cartridge 3401 to inhibit leakage of liquid precursor. Electrical contacts 3484 may deliver power to heater 3440 included in cartridge 3401 and, in certain embodiments, may communicate temperature or other operational data regarding chamber assembly 3430 to controller 3480. Furthermore, electrical contacts 3484 may be thermally coupled to heatsinks 3486, allowing residual thermal energy from cartridge 3401 to be dissipated.

Vaporizing device 3400 may include preheater 3452, configured to heat intake air prior to delivery to chamber assembly 3430. While preheating of intake air has been disclosed in earlier embodiments, typically by harnessing residual heat from the chamber, vaporizing device 3400 may actively heat intake air using preheater 3452. Air may be drawn into base unit 3403 through inlet 3450 when suction is applied by a user. Inlet 3450 may include sensor 3451 and sensor 3453, each configured to monitor physical properties of incoming air. Sensor 3451 and sensor 3453 may comprise thermal sensors for temperature, capacitive or resistive sensors for humidity, piezoelectric sensors for pressure, optical sensors for particulates, ultrasonic sensors for airflow, or other sensors. In the illustrated embodiment, sensor 3451 may be positioned upstream of preheater 3452 and sensor 3453 downstream enabling measurement of air temperature both before and after preheating. This arrangement may provide data to controller 3480, which may adjust power supplied to heater 3440 in real time based on feedback from sensor 3451 and sensor 3453. Preheating incoming air in this manner may enhance vaporization efficiency by reducing thermal losses associated with cold air influx.

Sensor 3455 may be configured to measure physical properties of the preconditioned intake air. Sensor 3455 may comprise one or more electronic sensors, such as those for measuring temperature, flow rate, humidity, pressure, or airflow, as previously outlined. In some embodiments, sensor 3455 may comprise a Micro-Electro-Mechanical Systems (MEMS) microphone, configured to detect changes in pressure. Sensor 3455 may communicate pressure data to controller 3480, enabling activation and regulation of heater 3440 in response to user suction or other variables. Controller 3480 may be configured to continuously monitor sensor 3455 during idle states, so that the application of suction by a user may trigger device activation without the need for pressing a button or performing other manual actions.

Inlet 3450 may include flow modifier 3454, positioned downstream of sensor 3455. Flow modifier 3454 may be configured to condition or stabilize a pressure field experienced by sensor 3455. By introducing controlled perturbations to a generally laminar flow, flow modifier 3454 may create a more uniform and steady pressure region near sensor 3455, thus improving the accuracy and repeatability of sensor measurements. Thereafter, preconditioned air may be directed to cartridge inlet 3456 by inlet 3450, from where it is directed into chamber assembly 3430 for aerosol formation and subsequent delivery to the user via outlet 3460.

The previous embodiment included a disposable cartridge incorporating many of the principal vaporization components, and in some implementations, this may result in a configuration resembling a cartomizer. These types of cartridges are typically discarded after depletion of the precursor contained within their reservoir. In the next embodiment, a greater proportion of functional elements may be relocated from the cartridge to the base unit. Such elements may include heating assemblies, sensors, and fluidic conditioning features. By retaining these elements within the base unit, waste generated upon cartridge depletion may be reduced. Furthermore, this arrangement may promote increased operational repeatability, since the same set of functional elements is used with each replacement cartridge.

Figure 35B:
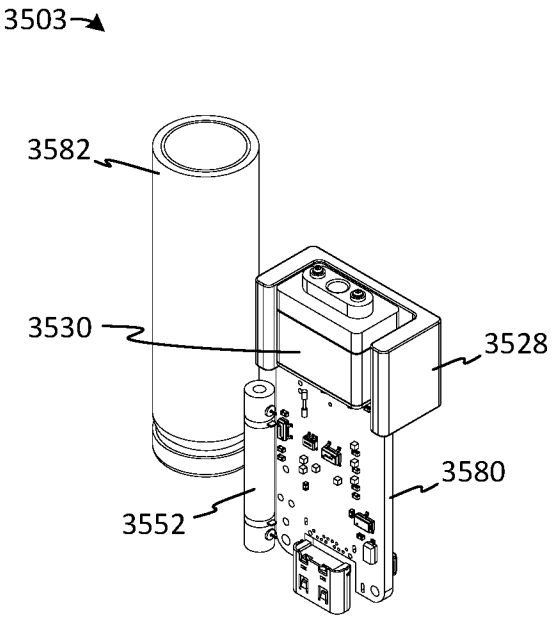
Figure 35A:
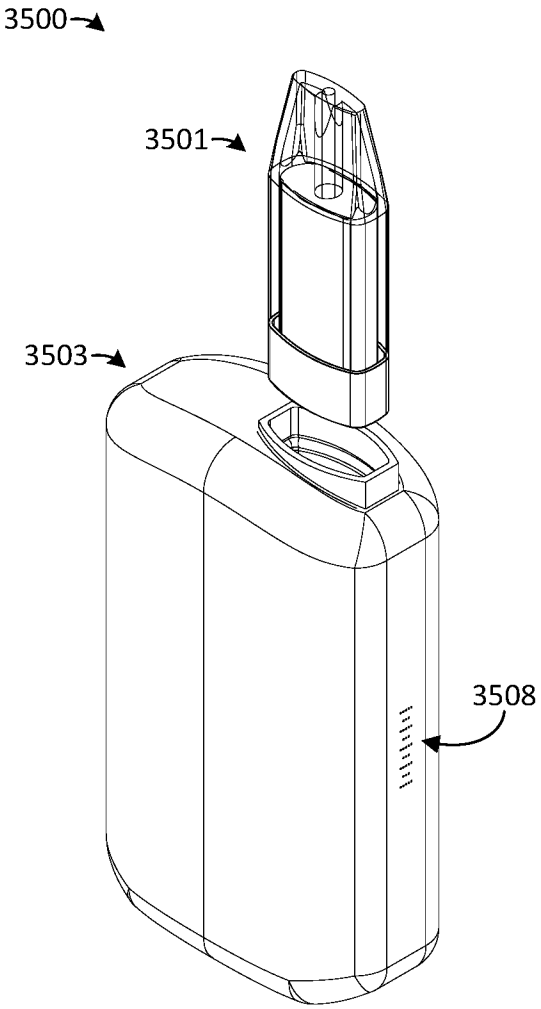
Figure 35D:
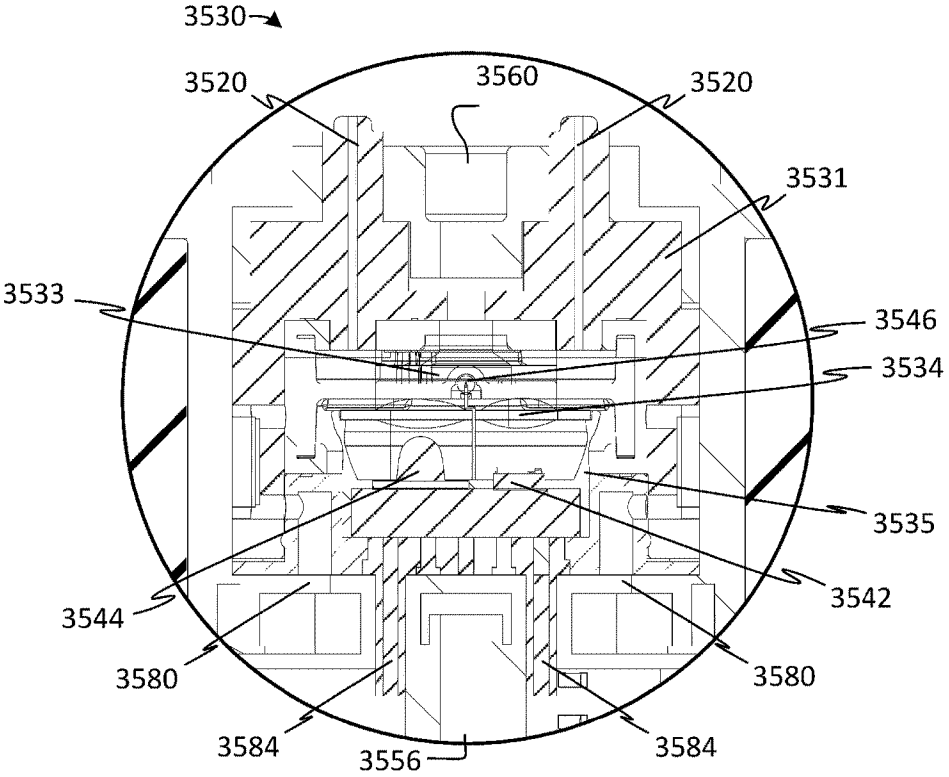
Figure 35C:
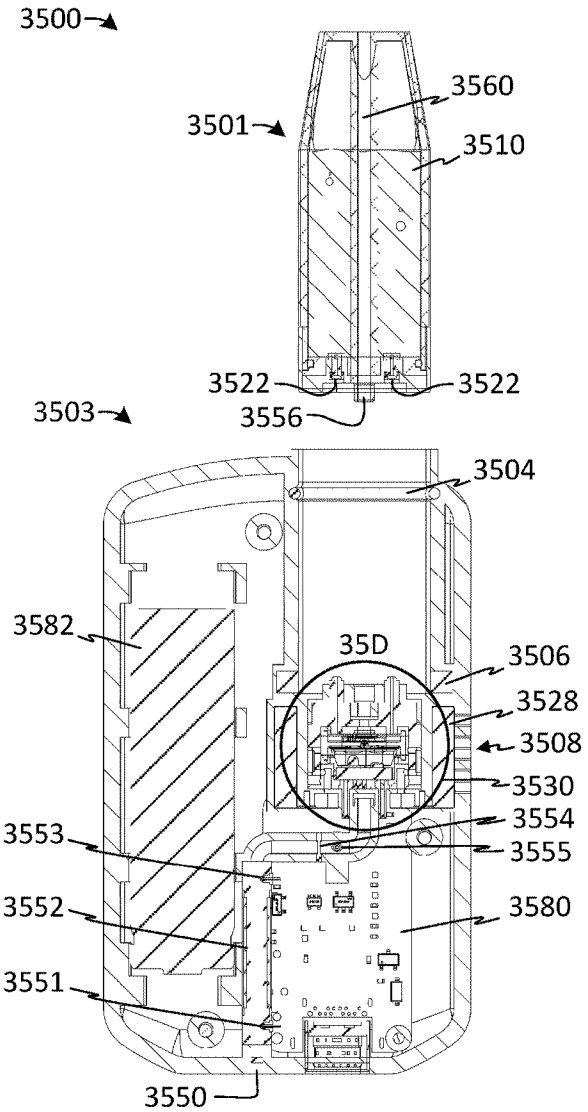

FIG. 35A illustrates an isometric view of vaporizing device 3500. FIG. 35B depicts an isometric view of base unit 3503 with the housing removed. FIG. 35C provides a cross-sectional view of vaporizing device 3500. FIG. 35D presents a detailed view of chamber assembly 3530. Vaporizing device 3500 may adopt a form factor similar to that of vaporizing device 3400, while shifting primary functional components from the cartridge to the base unit. In general, vaporizing device 3500 may include cartridge 3501 and base unit 3503.

Cartridge 3501 may comprise reservoir 3510, valve 3522, cartridge inlet 3556, and outlet 3560. Reservoir 3510 may be configured to contain a precursor composition for delivery to base unit 3503. Valve 3522 may be arranged to prevent unwanted escape of the precursor from reservoir 3510 when cartridge 3501 is detached from base unit 3503. In certain embodiments, valve 3522 may also serve to regulate the flow of precursor from reservoir 3510 to base unit 3503, and may optionally be actuated by controller 3580. Cartridge inlet 3556 may be configured to receive vapor and/or aerosol from base unit 3503, directing it to outlet 3560 for user delivery. In some instances, outlet 3560 may include geometry designed to further condition the vapor or aerosol prior to inhalation.

Base unit 3503 may include O-ring 3504, magnets 3506, vents 3508, absorbent pad 3528, chamber assembly 3530, inlet 3550, sensor 3551, preheater 3552, sensor 3553, flow modifier 3554, sensor 3555, controller 3580, and battery 3582. Many of these components have been described elsewhere herein, and various embodiments may incorporate different combinations to provide a functional vaporizing device.

Vaporizing device 3500 may further include vents 3508 and absorbent pad 3528. These elements may operate in conjunction with O-ring 3504 to limit leakage of liquid precursor when cartridge 3501 is inserted into base unit 3503. O-ring 3504 may provide a liquid-tight seal as well as friction to retain cartridge 3501 within base unit 3503, thereby reducing the potential for leakage to the exterior of the device. However, in some cases, liquid may accumulate in the interstitial space between cartridge 3501 and base unit 3503. Absorbent pad 3528 may be positioned to absorb such liquid, and may be fabricated from chemically compatible, absorbent, and thermally stable wicking materials. Examples of suitable materials include cellulosic fibers, polyolefin nonwovens, polyester (PET) or nylon nonwovens, or open-cell foams. One or more vents 3508 may also be included to promote evaporation of liquid absorbed by pad 3528.

Vaporizing device 3500 may include a chamber or chamber assembly in accordance with those previously disclosed. In this embodiment, chamber assembly 3530 may be constructed and operated similarly to chamber assembly 2300, and may include upper chassis 3531, chamber 3533, lens 3534, reflector 3535, and heater assembly 3540. Upper chassis 3531 may be further configured to include dispenser 3520 for regulating the flow of precursor from reservoir 3510 to chamber 3533.

Heater assembly 3540, in this embodiment, may be substantially similar to heater assembly 2260, though alternative heater types may be employed. Heater assembly 3540 may include UV emitter 3542, IR emitter 3544, sensor 3546, and electrical contacts 3584. Electrical contacts 3584 may facilitate communication with controller 3580, enabling the controller to supply power to heater assembly 3540 and receive temperature or other data from sensor 3546. In some embodiments, electrical contacts 3584 may also be thermally coupled to heatsinks in order to dissipate excess heat generated by heater assembly 3540.

Lens 3534 may, in some cases, may be an example of optical assembly 2268. Lens 3534 may comprise two convex lenses that are configured to direct UV radiation from UV emitter 3542 and IR radiation from IR emitter 3544 toward a common convergence point, thereby facilitating heating of the precursor composition in chamber 3533.

Sensor 3546 may be adapted to measure the temperature of chamber 3533 or the precursor contained within it. Sensor 3546 may comprise one or more electronic temperature-sensing elements, such as a thermocouple, thermistor, resistance temperature detector (RTD), semiconductor temperature sensor, or some other suitable device. In this embodiment, sensor 3546 may be disposed near the convergence point of UV emitter 3542 and IR emitter 3544 within chamber 3533 and may relay temperature data to controller 3580.

Figure 36B:
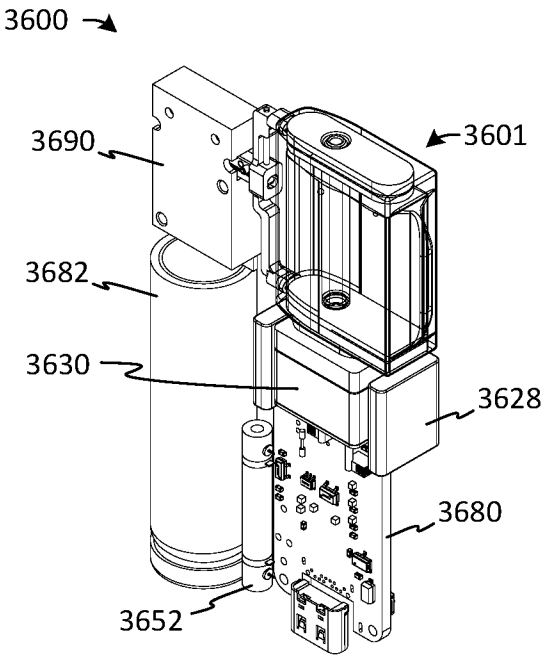
Figure 36A:
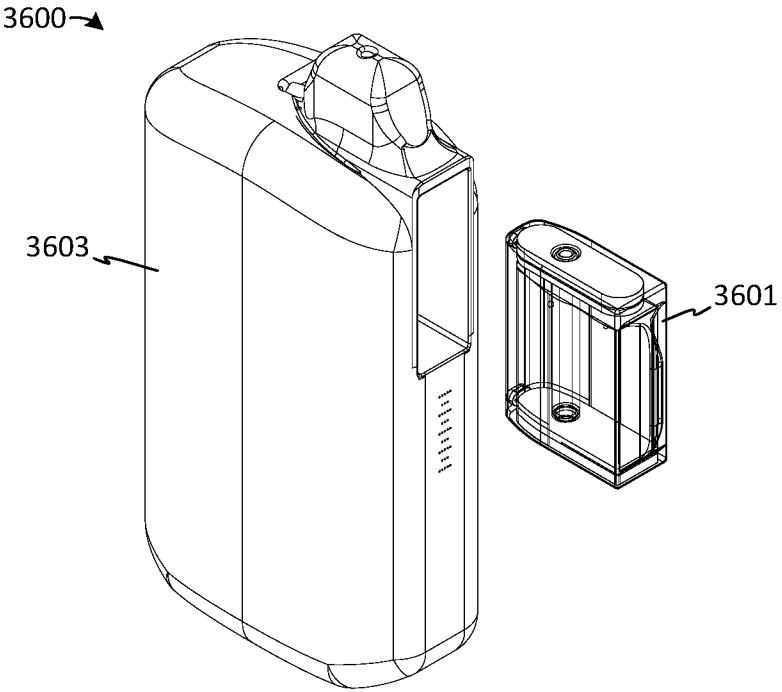

Cartridges incorporating valves to mitigate leakage have been discussed elsewhere herein. Vaporizing device 3600 may provide an example of a cartridge system featuring such valves. FIG. 36A presents an isometric view of vaporizing device 3600, and FIG. 36B illustrates the device with its housing removed. Vaporizing device 3600 may include cartridge 3601 and base unit 3603. Base unit 3603 may include absorbent pad 3628, chamber assembly 3630, preheater 3652, battery 3682, and actuator 3690.

In certain embodiments, cartridge 3601 may be inserted into the side of base unit 3603, in contrast to top-loading configurations described in earlier embodiments. This arrangement may allow cartridge 3601 to include valves positioned at both the top and bottom of the cartridge body, which may be actuated by actuator 3690 housed within base unit 3603. The top valve may be configured to block an outlet, such as outlet 160, thereby inhibiting leakage of liquid from chamber 3630 through the outlet. The bottom valve may be adapted to block precursor from leaking from the reservoir, or may serve to regulate delivery of precursor from cartridge 3601 to chamber 3630. Operation of these valves may be managed by controller 3680. In some embodiments, the valves may be actuated independently to enable greater control over aerosol and liquid handling and device operation.

Actuator 3690 may comprise an electronically controlled device configured to open or close valves within cartridge 3601. In certain embodiments, actuator 3690 may include an electric motor, servo motor, linear actuator, solenoid, or other suitable actuation mechanism. Actuator 3690 may further comprise means for coupling to one or more valves, such as magnets, snap-fit features, hook-and-loop fasteners, or other appropriate mechanical or magnetic mechanisms. In alternative embodiments, actuator 3690 may incorporate position sensors, limit switches, or feedback systems to permit precise valve control.

Figure 37A:
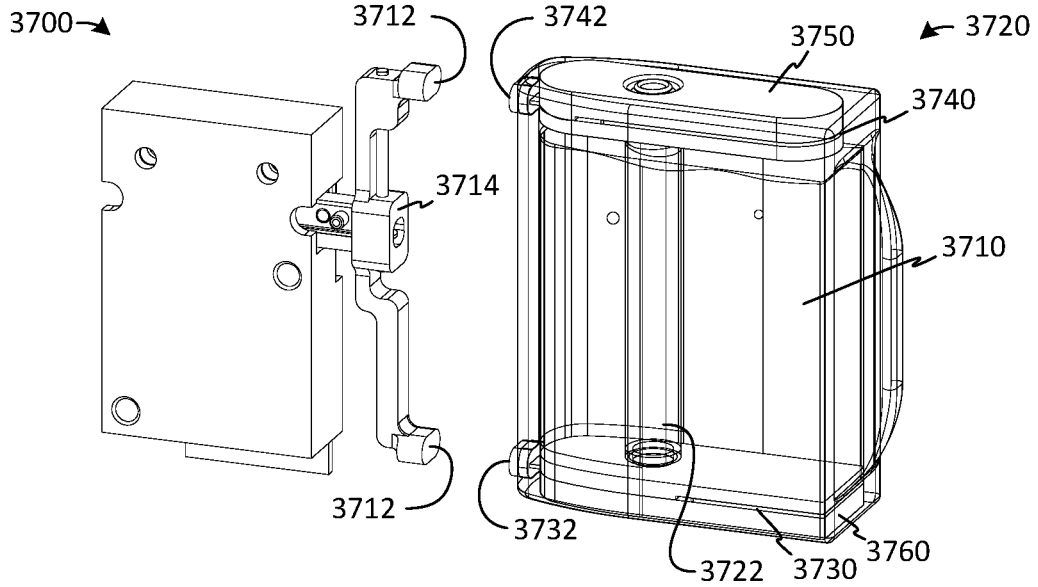
Figure 37B:
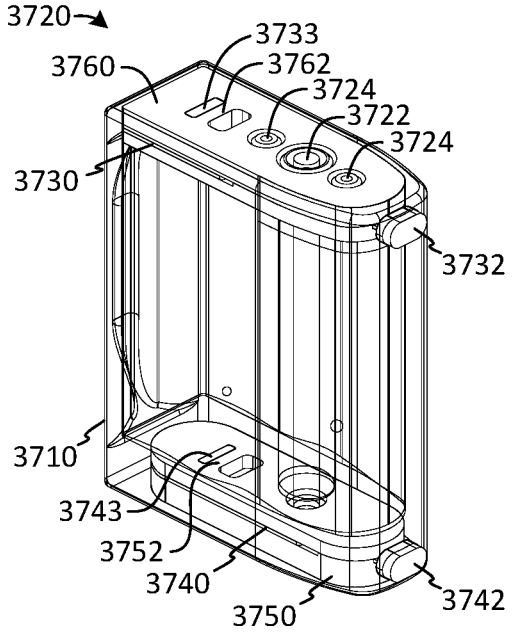
Figure 37C:
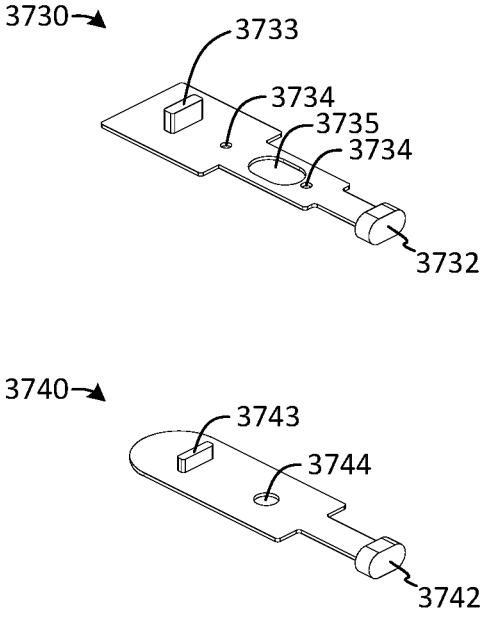

FIG. 37A illustrates actuator 3700 together with cartridge 3720. FIG. 37B presents an isometric view of the underside of cartridge 3720, while FIG. 37C depicts the positions of slide plate 3730 and slide plate 3740 relative to the orientation shown in FIG. 37B. In some embodiments, actuator 3700 may be an example of actuator 3690 and cartridge 3720 may be an example of cartridge 3601.

Cartridge 3720 may be configured to contain a precursor composition and may include one or more valve mechanisms to mitigate precursor leakage. Cartridge 3720 may comprise reservoir 3710, outlet 3722, dispenser 3724, slide plate 3730, contact 3732, slide plate 3740, contact 3742, upper seal 3750, and lower seal 3760. Outlet 3722 may serve a function analogous to outlet 130 and may be in communication with a chamber of a vaporizing device. Liquid precursor often resides in the chamber of vaporizing devices and outlet 3722 may present a potential leakage path. Dispenser 3724 may regulate delivery of a precursor from reservoir 3710 to a vaporizing device and could allow leakage in the absence of an effective flow-blocking element.

To inhibit leakage through outlet 3722, cartridge 3720 may include a valve assembly comprising slide plate 3740 and upper seal 3750. Slide plate 3740 may include contact 3742, lug 3743, and aperture 3744. Upper seal 3750 may include geometry to form compliant spring 3752 configured to engage lug 3743 of slide plate 3740 to maintain slide plate 3740 in a closed position. Compliant spring 3752 may incorporate geometrical features integral to upper seal 3750 permitting localized deformation when a force is applied by lug 3743. Compliant spring 3752 may have a tendency to return to its undeformed shape, thus acting like a spring pulling slide plate 3740 to a closed position. In this embodiment cartridge 3720 is in a default closed position unless inserted into the device (such as vaporizing device 3600) and acted upon by the actuator, such as actuator 3700. Contact 3712 of actuator 3700 may engage contact 3742 on slide plate 3740 in order to move slide plate 3740 between open and closed positions. Slide plate 3740 may further include aperture 3744 configured to align with outlet 3722 when in the open position and to block outlet 3722 when in the closed position. In an embodiment the cartridge 3720 has slide plate 3730 and slide plate 3740 that are in their default state in a closed position, thus sealing the cartridge from the ingress or egress of air or precursor liquid even when the cartridge 3720 is exposed to changing environmental conditions such as increased temperature or decreased atmospheric pressure, the cartridge 3720 also functions to prevent the intentional tampering with the cartridge as may be performed by a user attempting to refill the cartridge 3720, and/or to prevent escape of liquid precursor due to unintentional tampering as may occur if a child was playing with the cartridge 3720.

In a similar manner, cartridge 3720 may include a valve mechanism to inhibit leakage from dispenser 3724 comprising slide plate 3730 and lower seal 3760. This valve mechanism may prevent escape of liquid precursor through dispenser 3724 when cartridge 3720 is detached from a base unit, and may also regulate precursor delivery during normal operation. Slide plate 3730 may include contact 3732, lug 3733, one or more apertures 3734, and clearance slot 3735. Lug 3733 may engage with compliant spring 3762 of lower seal 3760 to retain slide plate 3730 in a closed position. Apertures 3734 may be configured to align with dispensers 3724 when slide plate 3730 is open, while blocking dispenser 3724 when in a closed position. Clearance slot 3735 may provide a passage for outlet 3722 through slide plate 3730, permitting movement of slide plate 3730 between open and closed positions. In certain embodiments, clearance slot 3735 may be omitted if not required by the arrangement of other components.

Actuator 3700 may be configured move arm 3714 to operate valves incorporated within cartridge 3720. In some embodiments, actuator 3700 may comprise a linear actuator, lead screw or ball screw mechanism, a solenoid, a shape memory alloy element, or some other suitable means for moving arm 3714. Alternative embodiments of valve mechanisms may employ other types of actuators. Solenoids or shape memory alloy elements may require a supply of energy to maintain an open or closed position. Actuator 3700 may also include a feedback mechanism, such as an optical scale, hall effect sensor, or limit switches, to communicate the positions of arm 3714 and slide plates 3730 and 3740 to a controller.

Actuator 3700 may include contacts 3712 on arm 3714 that are configured to automatically couple to contacts 3742 and 3732 of cartridge 3720 upon insertion of cartridge 3720 into a base unit, such as base unit 3603. These contacts may utilize magnets, snap-fit mechanisms, hook-and-loop fasteners, or other suitable elements to facilitate coupling and actuation of slide plates 3730 and 3740.

Figure 38:
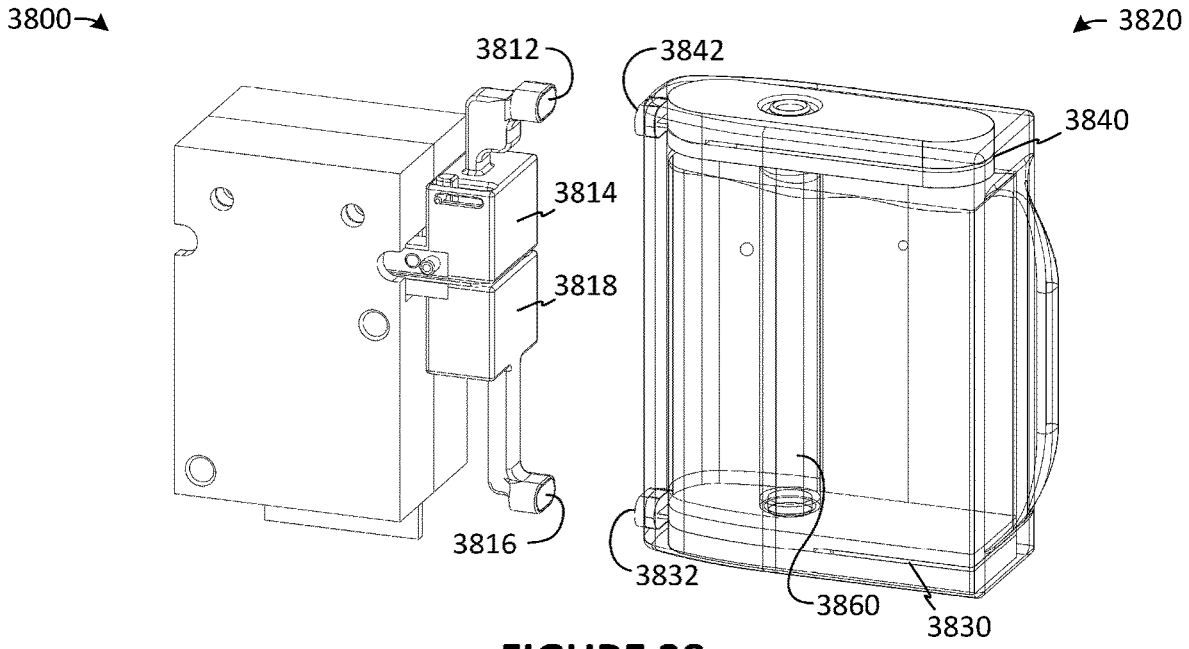

FIG. 38 illustrates actuators with a cartridge. In FIG. 38 actuator 3800 comprising a double actuator arrangement positioned in conjunction with cartridge 3820 is illustrated. In some embodiments, actuator 3800 may be configured as an example of actuator 3700, adapted to independently actuate valves 3830 and 3840. Actuator 3800 may include arm 3814, which may be provided with contact 3812 to engage contact 3842 associated with valve 3840, and arm 3818, which may be provided with contact 3816 to engage contact 3832 associated with valve 3830. Cartridge 3820 may include both valve 3840, with corresponding contact 3842, and valve 3830, with corresponding contact 3832, and outlet 3860. In this embodiment, actuator 3800 may comprise two linear actuators employing one or more rollers that contact and translate arms 3814 and 3818 along a defined path. In alternative embodiments, actuator 3800 may utilize features such as sliding blocks, lead screws, solenoids, electromagnets, or belt-driven mechanisms for linear actuation. Additionally, contacts 3812 and 3816 of actuator 3800 and contacts 3832 and 3842 of cartridge 3820 may comprise magnets, mechanical couplers, or other suitable means for engagement during cartridge insertion.

Arms 3814 and 3818 of actuator 3800 may move independently of one another, facilitating separate control of valves 3830 and 3840. Through independent actuation, a more sophisticated range of device operations may be enabled. For instance, selective closure, and/or selective variable closure of outlet 3860 may allow vapor pressure to accumulate within the chamber, which may be desirable in applications requiring pulsed or metered aerosol delivery. Selective variable closure (for example a partial closing of outlet 3860 to a percentage of the outlet 3860 total available throughput, such a 5% open, 10% open, 15% open, or any such percentage of the outlet 3860 being open between 1-99%) of outlet 3860 can be used to increase or decrease vacuum pressure is the chamber, such as chamber 3630, in order to reduce the vapor pressure exerted on the precursor liquid being heated and to as a result decrease the temperature required to generate a vapor and/or aerosol from the precursor liquid. Alternatively, dispenser valve 3830 may be selectively held open to permit precursor fluid entry into the chamber prior to initial actuation, ensuring that the heater does not activate in the absence of sufficient precursor. Control of arms 3814 and 3818 may be accomplished via independent linear actuators, dual solenoids, micro-motors, shape memory alloys, or other actuation technologies. In certain embodiments, actuation may be governed by a programmable controller, employing algorithms that coordinate valve positions with operational parameters such as temperature, sensed pressure, or inhalation detection. Alternatively, manual switches, user interface elements, or preset mechanical linkages may be used to control valve actuation sequences based on user preference or device configuration. In an embodiment the valve may be positioned in the open position and then closed automatically if environmental conditions such as increased temperature and/or decreased atmospheric pressure are detected as to prevent leakage of precursor from the reservoir due to environmental temperature changes or changes in atmospheric pressure.

In some configurations, automatic activation of the vaporizer may be desirable with no required user input beyond the application of suction. However, when a valve, such as one blocking outlet 160, is in the closed position, user inhalation may not be directly sensed by airflow detection elements situated downstream of the valve. To address this limitation, the device may be equipped with an additional flow path configured specifically for detecting inhalation attempts. This secondary flow path may include a bypass channel containing a pressure sensor, a flow sensor, or a microphone capable of detecting minute pressure differentials or acoustic signatures associated with suction. In an alternative embodiment, detection may occur via sensors integrated upstream of the primary outlet valve, relying on measurements such as diaphragm deflection, humidity changes, or even thermal flow sensing to identify inhalation events. In some cases, both electrical and mechanical detection modalities may be combined. Selection among these approaches may depend on device architecture, intended use-case, and power consumption requirements.

FIG. 39 illustrates a cross-sectional view of vaporizing device 3900. Vaporizing device 3900 may include flow path 3910, port 3912, cartridge 3920, lower valve 3930, upper valve 3940, inlet 3950, sensor 3955, outlet 3960, chamber assembly 3970, and controller 3980. Vaporizing device 3900 may serve as an example of other vaporizing devices disclosed herein, and may incorporate similar or alternative configurations as appropriate for the intended use.

Cartridge 3920 may comprise lower valve 3930, which may be configured to regulate the flow of precursor material from cartridge 3920 to chamber assembly 3970, and upper valve 3940, which may be configured to regulate the flow of vapor and/or aerosol through outlet 3960. As depicted in FIG. 39, when upper valve 3940 is open, suction 3906 may pass through outlet 3960, bypassing chamber assembly 3970, and through inlet 3950, thereby exerting a signal to sensor 3955.

Sensor 3955 may be positioned within inlet 3950 and may be configured to monitor intake pressure or another property of the intake air, providing data to controller 3980. In certain embodiments, sensor 3955 may comprise a MEMS microphone or other pressure-sensitive element adapted to measure intake air pressure changes. In certain embodiments sensor 3955 is part of a flow detection system in which flow rate is measured, in such an embodiment the pressure is calculated based on the measured flow through the system. Several methods may be used by the programming in the controller 3980 for the mathematical determination of the pressure by using the measured flow rate through inlet 3950, including but not limited to, the Darcy-Weisbach equation for turbulent flow, or the Hagen-Poiseuille equation for laminar flow, as these account for fluid properties, pipe geometry, and velocity, Bernoulli's equation can also be used, especially when comparing the pressure between two points, and can be combined with the continuity equation to solve for unknown pressures and velocities. In addition, machine learning/training methods may be used to correlate measured inputs to flow rate and/or pressure. Detection of a pressure change exceeding a predefined magnitude may indicate to controller 3980 that suction has been applied at outlet 3960, upon which controller 3980 may activate a heater contained within chamber assembly 3970. In some embodiments, controller 3980 may further modulate power delivered to the heater in response to real-time pressure signals from sensor 3955. In particular, the controller may select from a plurality of predefined heating profiles corresponding to specific pressure change patterns, allowing for customized or adaptive operation.

When upper valve 3940 is closed, it may block suction 3906 from reaching sensor 3955 if an auxiliary flow path, such as flow path 3910, were not present. In such cases, controller 3980 may not detect suction at outlet 3960 and might require user intervention, such as manual switch activation, or another means to initiate device operation. Vaporizing device 3900 may therefore include flow path 3910, which may be configured to bypass upper valve 3940 and direct a portion of suction 3906 through port 3912 to a region upstream of sensor 3955 located within or adjacent to inlet 3950. This arrangement may enable vaporizing device 3900 to be automatically activated upon detection of suction 3906, even when upper valve 3940 is closed. Additionally, this arrangement may provide the controller 3980 with greater flexibility in managing vapor or aerosol generation cycles. For example, controller 3980 may be programmed to maintain upper valve 3940 in a closed state for a specified portion of the cycle, thereby controlling the timing, concentration, or delivery characteristics of released vapor or aerosol. In an embodiment flow path 3910 is closed by the opening of upper valve 3940, and conversely flow path 3910 is opened by the closing of upper valve 3940.

Means and methods of vapor and/or aerosol generation have been disclosed herein. Some methods may be open-ended, while others incorporate some degree of feedback.

Different precursor compositions may require different inputs to generate an optimum vapor and/or aerosol output. For example, precursors containing nicotine may require a different set of inputs than precursors containing cannabis compounds. Some vaporizing devices may incorporate spectroscopy, spectrophotometry, interferometry, and/or refractive index measurement to analyze a precursor composition prior to vaporization.

FIG. 40A presents a cross-sectional view of vaporizing device 4000, while FIG. 40B provides an isometric view of vaporizing device 4000 with its housing removed. Vaporizing device 4000 may include cartridge 4001, base unit 4003, chamber 4030, heater 4040, inlet 4050, controller 4080, battery 4082, battery 4083, and spectrometer 4090. Various embodiments of cartridge 4001, base unit 4003, chamber 4030, heater 4040, inlet 4050, controller 4080, battery 4082, and battery 4083 have been described elsewhere herein, and interchangeable or alternative configurations of these components may be employed, depending on device requirements or desired performance characteristics.

Spectrometer 4090 may be configured to broadly measure electromagnetic radiation, including but not limited to infrared (IR) and ultraviolet (UV) wavelengths, associated with a precursor composition housed in chamber 4030. In certain embodiments, spectrometer 4090 may utilize an IR spectrometer capable of multi-wavelength measurement for comprehensive spectral analysis. Suitable spectrometer configurations may include compact or miniaturized interferometers, such as fiber-optic Michelson interferometers, miniature lamellar grating interferometers, Fizeau, or white-light interferometers, which function analogously to prisms or gratings in order to separate and resolve IR or other radiation into constituent wavelengths. Such miniaturized spectrometers may be fabricated using silicon fabrication techniques to increase portability and facilitate integration into device housing. By analyzing the resultant spectra, spectrometer 4090 may determine absorbance, transmittance, or emission characteristics of the precursor composition and communicate relevant data to controller 4080. In some embodiments, controller 4080 may regulate the energy output, spectral characteristics, or timing of heater 4040 in response to spectroscopic data received from spectrometer 4090, thereby improving operational efficiency or vapor quality.

Spectrometer 4090 may also support identification or qualification of precursor compositions by comparing measured spectral data to reference profiles stored within controller 4080 or in an external database. In some instances, detailed precursor characterization may be performed in laboratory settings utilizing alternative modalities, such as Fourier-transform infrared (FTIR), attenuated total reflectance FTIR (ATR-FTIR), Dispersive IR (DIR), Raman Spectroscopy, Near-Infrared (NIR) spectroscopy, Diffuse Reflectance Infrared Fourier Transform Spectroscopy (DRIFTS), PiF-IR, or laser spectrometers, with the compiled spectral profiles later referenced by controller 4080 in device operation. Spectrometer 4090, in conjunction with controller 4080, may acquire and analyze the spectral data of the precursor, enabling heater 4040 to be controlled according to a matching predefined profile. In some cases, vaporizing device 4000 may be configured to disable heater 4040 if an unrecognized or incompatible precursor composition is detected. Alternatively, the device may continue to operate heater 4040 by dynamically adjusting output parameters based on real-time data acquired by spectrometer 4090, even without the use of stored profiles.

FIG. 41A illustrates an exploded view of spectrometer 4100, and FIG. 41B illustrates an exploded view of sample chamber 4120. Spectrometer 4100 may comprise detector 4110, sample chamber 4120, emitter 4140, and battery 4183. Vaporization chamber 4130 may correspond to examples provided elsewhere herein, and may, in some embodiments, be configured to supply a portion of precursor composition to sample chamber 4120 for spectral analysis prior to vaporization.

Detector 4110, as included within spectrometer 4100, may be configured to analyze the intensity of electromagnetic radiation, including UV and/or IR wavelengths, either transmitted through or reflected from a precursor sample. Detector 4110 may provide processed or raw signal data to a controller for spectral analysis. In certain embodiments, detector 4110 may include one or more photodiodes, photodiode arrays, InGaAs detectors, CCD or CMOS sensors, or similar photon detection devices capable of resolving particular spectral ranges of interest.

Sample chamber 4120 may be configured to contain a precursor sample for analysis by spectrometer 4100. Sample chamber 4120 may comprise upper retaining plate 4122, upper window 4124, sample cell body 4150, lower optical elements 4126, and lower retaining plate 4128. Sample cell body 4150 may include port 4152, channel 4154, and one or more apertures 4156. In some embodiments, sample chamber 4120 may be configured to continuously monitor the flow of the precursor liquid as it moves from a reservoir to a vaporization chamber. In some embodiments, sample chamber 4120 may be configured to to be heated to facilitate the flow of a thermoviscous precursor liquid. In some embodiments, sample chamber 4120 may be configured to to be heated to control the flow rate of a thermoviscous precursor liquid through the sample cell. Alternatively, sample chamber 4120 may be designed for batch sampling, in which a static portion of precursor is retained for analysis. Selective heating of sample chamber 4120 may be used for batch sampling, in which a static portion of a thermoviscous precursor is retained for analysis, and then selectively heated to be mobilized from the sampling chamber. In some embodiments the sample chamber may be incorporated into the cartridge, such as the cartridge 4001 or any of the cartridges described herein. In some embodiments the sample chamber may be incorporated into the reservoir, such as the reservoir 3710 or any of the reservoirs described herein.

Upper retaining plate 4122 may function as a mechanical clamp that applies pressure to seal upper window 4124 against sample cell body 4150. Upper retaining plate 4122 may be joined to lower retaining plate 4128 using screws, bolts, or other fastening means. In certain embodiments, upper retaining plate 4122 may be provided with slits or apertures to attenuate the intensity of transmitted radiation and/or light, and may include features for alignment or mating with detector 4110.

Upper window 4124 may be a transparent plate configured to permit transmission of at least UV and IR light. Upper window 4124 may mate with sample cell body 4150 to form a seal on the upper surface, thereby containing precursor liquid while providing a clear optical path for incident light and/or transmitted radiation.

Sample cell body 4150 may be designed to receive and direct a flow 4158 of precursor fluid, defining a pathway over one or more apertures 4156 for analysis. Port 4152 may be positioned to couple with vaporization chamber 4130, thus enabling reception and return of a precursor sample from a dispenser or similar element. Channel 4154 may receive flow 4158 of precursor, direct it over apertures 4156, and permit return flow via port 4152.

Sample cell body 4150 may be configured to receive and direct a flow 4158 of a precursor fluid and define a flow path of the fluid over one or more apertures 4156 for analysis. Sample cell body 4150 may include port 4152 configured to couple to vaporization chamber 4130 to receive and return a flow 4158 of a precursor from a dispenser or some other element included in vaporization chamber 4130. Port 4152 may be in fluidic communication with channel 4154. Channel 4154 may be configured to receive flow 4158 of precursor, direct flow 4158 over apertures 4156, and return flow to vaporization chamber 4130 via port 4152. Sample cell body 4150 may be manufactured from materials that are preferably non-reactive with precursor compositions and chemically inert. Sample cell body 4150 may be fabricated from materials substantially non-reactive with the precursor composition, such as stainless steel, glass, ceramics, or other chemically inert substances.

Sample cell body 4150 may be configured to mate with upper window 4124 and lower optical elements 4126. Upper retaining plate 4122 and lower retaining plate 4128 may operate as clamps, securing upper window 4124, sample cell body 4150, and lower optical elements 4126 together in a liquid-tight assembly.

Lower optical elements 4126 may comprise one or more transparent plates allowing transmission of UV and/or IR radiation, and may mate with sample cell body 4150 to form a seal on its lower surface. In some embodiments, lower optical elements 4126 may be provided as disc-shaped optical elements. Lower optical elements 4126 may serve as simple windows, lenses to focus or collimate incident light, or as diffraction gratings or filters for spectral dispersion or wavelength selection.

Lower retaining plate 4128 may serve as a mechanical clamp, applying pressure to lower optical elements 4126 to seal them against the sample cell body 4150. Lower retaining plate 4128 may be connected to upper retaining plate 4122 by screws, bolts, or other suitable fastening techniques. In some embodiments, lower retaining plate 4128 may be provided with features configured to align with or secure emitter 4140.

Emitter 4140 may be configured to generate electromagnetic radiation in a selected wavelength range appropriate for probing the precursor sample. Emitter 4140 may direct light and/or electromagnetic radiation through the sample contained within sample chamber 4120, facilitating detection by detector 4110. In some cases, emitter 4140 may produce radiation in the UV, IR, or additional wavelength regions, depending on the spectral characteristics required for analysis.

Battery 4183 may be configured to supply power to spectrometer 4100. As illustrated in FIG. 41A, battery 4183 may be positioned adjacent to or surrounded by a heatsink structure configured to dissipate thermal energy generated by emitter 4140 or other electrical components. In certain embodiments, battery 4183 may be supplemented or recharged by an auxiliary battery, such as battery 4082, to extend operational duration or provide redundancy.

FIG. 42 is a block diagram illustrating a vaporizer. In FIG. 42, vaporizer 4200 comprises reservoir 4210, vaporizing chamber 4230, chamber heater 4240, air intake 4250, intake airpath 4251, output 4260, and controller 4280. Heater 4240 includes temperature sense 4241. Intake airpath 4251 includes temperature sense 4281, flow disrupter 4285, and airflow sense 4286. Intake airpath 4251 optionally includes temperature sense 4282 and intake air heater 4284. Temperature sense 4281, temperature sense 4282 (if present), heater 4284 (if present) and airflow sense 4286 are operatively coupled with controller 4280. Controller 4280 is operatively coupled with heater 4240 and temperature sense 4241. Controller 4280 is operatively coupled with heater 4240 to control the heating of chamber 4230 to vaporize substances drawn from reservoir 4210.

During operation, air is induced by a user to flow into intake 4250, through intake airpath 4251, through chamber 4230, and output 4260 (e.g., a mouthpiece). Also during operation, the air flowing along intake airpath 4251 flows over flow disrupter 4285 that induces vortex shedding. The vortices shed by flow disrupter 4285 induce pressure and/or acoustic fluctuations during inhalation. In other words, flow disrupter 4285 may convert a substantially laminar inflow into a time-varying vortical pattern as the intake airflow passes the flow disrupter 4285.

Flow disrupter 4285 may be, for example, a wire spanning the intake airpath, a cylinder, rib, vane, tab, perforated plate, lattice, airfoil-like forms, bluff posts, integral fins, and/or other structures configured to promote vortex shedding or controlled turbulence. The geometry, placement, and surface finish may be selected, for example, to obtain a desired amplitude and frequency range for resulting fluctuations.

Airflow sensor 4286 picks up the pressure variations caused by these vortices. Airflow sensor 4286 may be or comprise a transducer (e.g., microphone, MEMS microphone, and/or pressure sensor). In an embodiment, airflow sensor 4286 may be in communication with these variations via a transducer port and thus may not be placed directly in the intake airflow. In another embodiment, airflow sensor 4286 may be placed directly in the intake airflow. Airflow sensor 4286 or the transducer port (if any) may be placed downstream of flow disrupter 4285 to observe the shedding field with a strong signal-to-noise ratio. Thus, when a user inhales, airflow sensor 4286 provides a signal to controller 4280 containing time-varying features (e.g., pulses or spectral peaks) indicative of the instantaneous flow rate. In an embodiment, controller 4280 may derive a flow rate value using time-domain pulse detection and/or frequency-domain analysis (e.g., FFT). Based on this flow rate value, controller 4280 may modulate heater 4240 power (e.g., using PWM). Based on this flow rate control 4280 may calculate real time pressure values using methods previously described herein.

In an embodiment, for time-domain pulse detection, the output of airflow sensor 4286 may be AC coupled to the input of a comparator. The output of this comparator may produce a digital pulse train that is analyzed by controller 4280 to determine the flow rate value.

For frequency-domain analysis, the output of airflow sensor 4286 may be coupled to an analog-to-digital converter which provides a time-series of digital values to controller 4280. This time-series of digital values may be analyzed by controller 4280 to determine the flow rate value. Controller 4280 may use spectral analysis to determine the flow rate value. Thus controller 4280 may compute an FFT, Goertzel, filter-bank energies, or wavelet coefficients. A passband (e.g., around ~1-5 kHz for certain flow disrupter 4285 geometries) may be used, although other bands can be selected by design.

Controller 4280 may construct a flow rate value as a monotonic function of one or more features: pulse count per window, dominant frequency, or band-limited spectral energy. A calibration mapping may be generated from known flows and stored in a non-volatile memory as a table or parametric equation. A calibration mapping of pressure values as they correlate to flow rates may be generated from known flows and stored in a non-volatile memory as a table or parametric equation. Controller 4280 may estimate the flow rate value from the time- or frequency-domain metrics to a flow-correlated value—optionally using a calibration look-up table (LUT) derived from empirical data (e.g., syringe-pump flows, flow bench, or user testing). Controller 4280 may estimate the pressure based on the flow rate value from the time- or frequency-domain metrics to a flow-correlated value—optionally using a calibration look-up table (LUT) derived from empirical data (e.g., syringe-pump flows, flow bench, or user testing). In some embodiments, regression models, adaptive filters, or machine learning (e.g., trained on spectrogram images or raw sequences) may be employed to produce the flow-correlated value. In some embodiments, regression models, adaptive filters, or machine learning (e.g., trained on spectrogram images or raw sequences) may be employed to produce pressure value correlated to the flow-correlated value. The results may include high-resolution, real-time flow sensing enabling inhalation topography capture. The results may include high-resolution, real-time pressure data based on the flow sensing enabling inhalation topography capture.

In an embodiment, temperature sensor 4281 measures incoming air, intake-air heater 4284 raises air temperature, and a temperature sensor 4282 confirms post-heat temperature. Controller 4280 may drive heater 4284 such that intake-air temperature is normalized toward a target range regardless of ambient air temperature. Airflow sensor 4286 (or port) may be upstream of the heater 4284 so flow sensing precedes heating. Spacing between airflow sensor 4286 and intake heater 4284 may be chosen such that the thermal rise coincides with airflow arrival at the chamber, considering transit time under typical puff rates. Downstream passage sections of intake airpath 4251 can be tortuous or coiled to increase residence time for heat transfer. Optionally, a relative humidity sensor upstream of the intake heater and coupled with controller 4280 may allow humidity-aware control.

Thus, in this embodiment, a temperature sensor 4281, heater 4284, and temperature sensor 4282 may implement a feedback loop that regulates intake air to a setpoint (e.g., 35-80 °C in some embodiments; other ranges may be used). Controller 4280 may apply proportional-integral-derivative controller, proportional-integral, bang-bang, model-predictive, feed-forward, or hybrid control. In some embodiments, the elements in intake airpath 4251 (not shown in FIG. 42) may cool or dehumidify intake air using different conditioning elements, e.g., thermoelectric devices or desiccants.

Heater 4240, under the control of controller 4280, heats chamber 4230 to vaporize substance received into chamber 4230 from reservoir 4210. In an embodiment (e.g., etched metallic heaters, photochemically etched foil, thick-film, ceramic, PTC, or wire-wound), heater 4240 resistance varies with temperature. Controller 4280 may incorporate a precision voltage reference and current sensing (e.g., shunt or Hall) to determine voltage, current, and hence resistance of heater 4240 within PWM cycles, while compensating for battery voltage sag. Controller 4280 may compute heater temperature from resistance using known characteristics (e.g., temperature vs. resistance, empirically derived curve, etc.). Controller 4280 may compensate for battery variation by measuring battery voltage, internal resistance, and temperature, and may normalize power to heater 4240 to maintain consistent wattage.

In some embodiments the controller 4280 may periodically sample the current, battery voltage, etc. when the PWM is in a low-impedance phase (switch on time) or may synchronously sample with respect to the PWM pulses to improve accuracy. A closed control loop implemented by controller 4280 may use flow rate, intake-air temperature(s), and heater temperature to pulse-width modulate power applied to heater 4240. In an embodiment, controller 4280 may preemptively adjust power based on a predicted inhalation profile derived from early signal portions, and detect puff end to cease heating. In an embodiment, controller 4280 may preemptively adjust power based on a predicted inhalation profile derived from early signal portions, and predict puff end to cease heating prior to actual end of puff.

Mappings from flow rate value to target heater 4240 power by controller 4280 may be linear, piecewise, nonlinear, or table-driven. Controller 4280 may incorporate temperature compensation, altitude, or ambient pressure compensation, and fluid properties. In an embodiment, to reduce latency at puff onset, controller 4280 may maintain a ready temperature in chamber 4230 that is below aerosolization onset when the device is idle. The ready temperature may be a programmable offset above ambient, may increase after recent use, or may be disabled during transport. Coordination with intake-air conditioning improves first-puff consistency.

In some embodiments, controller 4280 may generate an inhalation signature from the time-varying airflow signals. A signature may be compared with a stored template to operate an enable gate, thereby applying power to heater 4240. The signature may comprise temporal, spectral, and/or statistical features. The controller 4280 may update templates over time or maintain multiple profiles (e.g., for parental controls, access control, or personalization). Other gating criteria may be used (e.g., PIN, proximity, or multi-factor combinations).

As discussed herein, in an embodiment, airflow sensor 4286 may be placed directly in the intake airflow. Airflow sensor 4286 or the transducer port (if any) may be placed downstream of flow disrupter 4285 to observe the shedding field with a strong signal-to-noise ratio. Thus, when a user inhales, airflow sensor 4286 provides a signal to controller 4280 containing time-varying features (e.g., pulses or spectral peaks) indicative of the instantaneous flow rate.

In an embodiment, the von Karman vortex street and Strouhal instability may be used to estimate the flow rate through the constricted passage of intake airpath 4251. For example, air may be sucked a constricted passageway portion of intake airpath 4251 having a diameter of $D_0$. This portion includes a sensitive microphone (e.g., airflow sensor 4286). Air is drawn at a flow rate of Q. This is typically, for example, roughly 55 ml in 3 seconds, thus $Q \approx 18$ ml/s$\approx 18\times 10^{-6}$ $m^3/s$. The average air speed may be found by, for example, solving Q=UA for U. Thus, in the example: $U \approx 10.3$ m/s. If the passageway has a cross-sectional area A of roughly 1.75 square millimeters ($mm^2$), thus: $A=1.75\times 10^{-6}$ $m^2$. Assuming a circular cross section implies $D_0 \approx 1.5$ mm.

In an embodiment, a wire/column of diameter Dw is mounted orthogonal to the flow direction in portion of intake airpath 4251 just upstream of the microphone/airflow sensor 4286 to act as flow disrupter 4285. In various embodiments, the wire/column flow disrupter 4285 may be oriented horizontally or vertically. Airflow past the wire/column flow disrupter 4285 causes vortex shedding at frequency f. These vortices impact microphone based airflow sensor 4286 and may be detected as audible noise. The FFT of the audio signal may be computed, and from the peak in the spectrum, the shedding frequency f may be determined. From the foregoing, the Reynolds number for the flow may be calculated from:

$$Re = \frac{UD_0}{v}$$

where v is the kinematic viscosity of air. Using a $v=1.5\times10^{-5}$ $m^2/s$ yields: Re≈1020. A Strouhal number St which may be used to estimate the vortex-shedding frequency, f. For flow around a wire:

$$St = \frac{fD_w}{U}$$

The Strouhal number has a stable value of roughly 0.2 for a range of flows encompassing the estimated Reynolds number of 1020. This yields:

$$f \approx 0.2UD_w \approx \frac{2}{D_w}$$

From the foregoing, it should be understood that at the typical inhalation rate, the frequency generated by the vortices and thus picked up by microphone based airflow sensor 4286 are determined by the wire diameter, $D_w$. For example, at a typical airflow rate (e.g., Q≈18 ml/s≈$18\times10^{-6}$ $m^3/s$), to generate an f=5 kHz, $D_w$=400 μm; f=10 kHz, $D_w$=200 μm; and f=20 kHz, $D_w$=100 μm. Variance in the shedding frequency f from the selected 'typical' frequency indicate (e.g., to controller 4280) variances in the inhalation flow rate that may be used to determine a 'measured' inhalation flow rate.

FIG. 43 is a block diagram illustrating a vaporizing chamber heater control system. In FIG. 43, control system 4300 comprises chamber heater 4340, current sense 4342, battery 4343, controlled switching 4345, controller 4380, temperature sense 4381, optional temperature sense 4382, voltage reference 4383, and airflow sense 4386. Current sense 4342, battery 4343, temperature sense 4381, optional temperature sense 4382, voltage reference 4383, and airflow sense 4386 are all operatively coupled with controller 4380. Current sense 4342, battery 4343, temperature sense 4381, optional temperature sense 4382, voltage reference 4383, and airflow sense 4386 are all operatively coupled to controller 4380 to provide input parameters to controller 4380 to form one or more closed loop control systems. Controller 4380 operates controlled switching 4345 to cause current to flow through heater 4340. In an embodiment, based on one or more parameters received from one or more of current sense 4342, battery 4343, temperature sense 4381, optional temperature sense 4382, voltage reference 4383, and airflow sense 4386, controller 4380 modulates (e.g., PWM, PFM, etc.) the current flowing through heater 4340 by controlling switching 4345 (e.g., a field-effect transistor) to selectively close (thereby conducting current from battery 4343 though current sense 4342 and heater 4340) and open (thereby interrupting/preventing current from flowing though heater 4340).

Airflow sensor 4386 is configured to respond to pressure variations caused by non-laminar airflow. Airflow sensor 4386 may be or comprise a transducer (e.g., microphone, MEMS microphone or pressure sensor). In an embodiment, airflow sensor 4386 may be in communication with these variations via a transducer port and thus may not be placed directly in the non-laminar airflow. In another embodiment, airflow sensor 4386 may be placed directly in the non-laminar airflow. Thus, when a user of the vaporizer being controlled by system 4300 inhales, airflow sensor 4386 provides a signal to controller 4380 containing time-varying features (e.g., pulses or spectral peaks) indicative of the instantaneous flow rate. In an embodiment, controller 4380 may derive a flow rate value using time-domain pulse detection and/or frequency-domain analysis (e.g., FFT). Based on this flow rate value, controller 4380 may modulate switching 4345 (and thus the power output by heater 4340) power based on the flow rate value.

In an embodiment, for time-domain pulse detection, the output of airflow sensor 4386 may be AC coupled to the input of a comparator. The output of this comparator may produce a digital pulse train that is analyzed by controller 4380 to determine the flow rate value.

For frequency-domain analysis, the output of airflow sensor 4386 may be coupled to an analog-to-digital converter (e.g., which is part of controller 4380) to generate a time-series of digital values for use by controller 4380. This time-series of digital values may be analyzed by controller 4380 to determine the flow rate value. Controller 4380 may use spectral analysis to determine the flow rate value. Thus, controller 4380 may compute an FFT, Goertzel, filter-bank energies, and/or wavelet coefficients. A passband may be used, and/or selected by design.

Controller 4380 may construct a flow rate value as a monotonic function of one or more features: pulse count per window, dominant frequency, or band-limited spectral energy. A calibration mapping may be generated from known flows and stored in a non-volatile memory as a table or parametric equation. Controller 4380 may estimate the flow rate value from the time- or frequency-domain metrics to a flow-correlated value. Optionally using a calibration look-up table (LUT) derived from empirical data (e.g., syringe-pump flows, flow bench, or user testing). In some embodiments, regression models, adaptive filters, or machine learning (e.g., trained on spectrogram images or raw sequences) may be employed to produce the flow-correlated value. The results may include high-resolution, real-time flow sensing enabling inhalation topography capture. Capture of inhalation topography may be utilized by a machine learning program to optimize activation cycles based on cumulative inhalation topography data such that the device may develop and refine activation cycles optimized for specific inhalation topographies. Activation cycle optimization based on captured inhalation topography may be further optimized by real-time control based on predictive assessment by the machine learning program such that inhalation topography may be evaluated real time at high frequency, for example several thousand times per second, and adjustments made to the activation cycle based on real time assessment of the inhalation, including but not limited to predictive adjustments based on captured inhalation topography data.

In an embodiment, temperature sensor 4381 measures incoming air temperature. In some embodiments, sensor 4382 confirms post-heat temperature. Controller 4380 may drive a heater such that intake-air temperature is normalized toward a target range regardless of ambient air temperature. Airflow sensor 4386 (or port) may be upstream of the heater 2584 so flow sensing precedes heating. In some embodiments, a relative humidity sensor (not shown in FIG. 43) coupled with controller 4380 may allow humidity-aware control. Heating of incoming air may be optimized by machine learning where other activation data points such as inhalation duration, inhalation volume, inhalation frequency, and other inhalation topography metrics such as those captured during an inhalation cycle may be used to evaluate the overall quality of the activation cycle, these metrics, and other metrics gathered by the sensors and controller may be assimilated by a machine learning program to develop optimized intake airflow preheating parameters, such parameters may be adjusted in real time and/or on a predictive basis by the controller.

Switching 4345, under the control of controller 4380, causes heater 4340 to vaporize substance received into a chamber from a reservoir. In an embodiment (e.g., etched metallic heaters, photochemically etched foil, thick-film, ceramic, PTC, or wire-wound), the resistance of heater 4340 varies with temperature. Controller 4380 receives parameters from a precision voltage reference 4383 and current sensing 4342 (e.g., shunt or Hall) to determine voltage, current, and hence resistance of heater 4340 within PWM cycles, while compensating for battery voltage sag (e.g., by comparing voltage reference 4383 to the voltage of battery 4343). Controller 4380 may compute heater temperature from resistance using known characteristics (e.g., temperature vs. resistance, empirically derived curve or curves, etc.). Controller 4380 may compensate for battery variation by measuring (or comparing) battery voltage, internal resistance, and temperature, and may normalize power to heater 4340 to maintain consistent wattage.

In some embodiments controller 4380 may periodically sample the current, battery voltage, etc. when the switching 4345 is closed (i.e., "on") and may sample synchronously with PWM pulses to improve accuracy. A closed control loop implemented by controller 4380 may use flow rate, intake-air temperature(s), and heater temperature to pulse-width modulate power switching 4345 and thus modulate the power generated by heater 4340. In an embodiment, controller 4380 may preemptively adjust power based on a predicted inhalation profile derived from early signal portions, and detect puff end to cease heating.

Mappings from flow rate value to target heater 4340 power by controller 4380 may be linear, piecewise, nonlinear, or table-driven. Controller 4380 may incorporate temperature compensation, altitude, or ambient pressure compensation, and fluid properties. In an embodiment, to reduce latency at puff onset, controller 4380 may maintain a ready temperature in a vaporizing chamber that is below aerosolization onset when the device is idle. The ready temperature may be a programmable offset above ambient, may increase after recent use, or may be disabled during transport. Coordination with intake-air conditioning improves first-puff consistency. Machine learning may be utilized to determine when the ready temperature should be utilized, such that a predictive control of the ready temperature is effected by assimilation and analysis of prior use data by the individual user or in aggregate.

In some embodiments, controller 4380 may generate an inhalation signature from the time-varying airflow signals. A signature may be compared with a stored template to operate an enable gate, thereby applying power to heater 4340. The signature may comprise temporal, spectral, and/or statistical features. The controller 4380 may update templates over time or maintain multiple profiles (e.g., for parental controls, access control, or personalization). Other gating criteria may be used (e.g., PIN, proximity, or multi-factor combinations).

FIG. 44 illustrates example airflow versus time measurements for three successive puffs. In FIG. 44, example airflow measurement/profiles vs. time a sketched 4401 for three successive puffs are illustrated. The profiles of the puffs illustrated in FIG. 44 are a small 4402, medium 4403, and large 4404 puffs.

FIG. 45 illustrates example airflow and heater control system output vs time measurements. In FIG. 45, the airflow 4501 and heater output 4502 (e.g., PWM percentage as controlled by controller 4380) are illustrated on the same time scale. Before the puff begins, the user activates the device and the devices begins to preheat 4503 (e.g., at 25% PWM "on"). At 4504, the user begins the puff. During the increasing flow of the puff during 4505, the device increases the heat production to track the airflow. At 4506, the device (e.g., controller 4380) detects that a full inhale type puff is occurring. At 4507, the device applies full heat (e.g., 100% PWM "on"). During 4509, a steady drag inhale is occurring. During 4509, the airflow is decreasing as the puff starts to end. During 4510, the device decreases the heating to track the decreasing airflow.

FIG. 46 illustrates another example airflow and heater control system output vs time measurements. In FIG. 46, the airflow 4601 and heater output 4602 (e.g., PWM percentage as controlled by controller 4380) are illustrated on the same time scale. Before the puff begins, the user activates the device and the devices begins to preheat 4603 (e.g., at 30% PWM "on"). During a preheat phase, between the user activating the device and beginning to inhale, the device holds the heat output steady during 4604. At 4605, the user begins the puff. During the increasing flow of the puff during 4606, the device increases the heat production to track the airflow. At 4607, the device (e.g., controller 4380) detects that a full inhale type puff is occurring. At 4608, the device applies full heat (e.g., 100% PWM "on"). At 4609, peak inhale airflow occurs and the airflow begins to decrease. During 4610, the airflow is decreasing as the puff starts to end. During 4611, the device decreases the heating to track the decreasing airflow. At 4612, the puff ends. At 4613, the heating is halted (e.g., 0% PWM "on"). After the puff ends, the user may release the button (i.e., e.g., the heating may end based on the puff/airflow, not the button).

In various embodiments, a vapor delivery device comprises: a housing defining an airflow path between an intake and an outlet; a heater thermally coupled to an aerosolization chamber and electrically driven by a power stage; at least one transducer positioned to generate a transducer signal indicative of airflow through the airflow path; at least one temperature sensor positioned to generate a temperature signal indicative of a temperature associated with the device; and a controller operatively coupled to the power stage, the transducer, and the at least one temperature sensor, the controller configured to: (i) determine a flow parameter as a function of the transducer signal; and (ii) command a power delivery profile to the heater based at least on the flow parameter and the temperature signal such that heater power is increased with increasing airflow and decreased with decreasing airflow, wherein the heater is isolated from direct contact with liquid in the aerosolization chamber and from the airflow path.

The transducer may be or comprise at least one of: a MEMS microphone, an absolute pressure sensor, a differential pressure sensor, or a thermal anemometer. In embodiments using a thermal anemometer, the transducer comprises a heated element driven with a constant-current or constant-temperature circuit and the controller derives a flow parameter from variations in element resistance or bridge output versus airflow. The controller may determine the flow parameter using a time-domain pulse count obtained from the transducer signal during a sampling window. The controller may determine the flow parameter using a frequency-domain spectral-energy metric computed from an analog-to-digital converted transducer signal. A flow disrupter (or flow-disturbing) body may be disposed in the airflow path and configured to induce periodic pressure fluctuations in response to airflow. The flow disrupter body may be or comprise at least one of: a wire, rod, rib, vane, tab, bluff body, perforated plate, or lattice. The at least one temperature sensor may comprise a first temperature sensor positioned upstream of an airpath heater and a second temperature sensor positioned downstream of the airpath heater. The controller may maintain a mapping between the flow parameter and a target power value that is monotonically increasing over a defined operating range. The heater may be physically isolated from the airflow path and liquids by an isolation barrier (e.g., glass) and its temperature is inferred from electrical resistance measured during operation. The controller may compensate for battery voltage sag using a precision voltage reference and current-sense feedback. The controller may implement pulse-width modulation at frequencies between about 100 Hz and about 200 kHz.

In various embodiments, a vaporizing device comprises: a conduit forming a portion of an airflow path; a flow disrupter body disposed in the conduit and configured, during inhalation, to generate periodic pressure fluctuations in the airflow path; an acoustic or pressure transducer fluidically coupled to the conduit and configured to output a transducer signal in response to the periodic pressure fluctuations; a heater arranged to vaporize a fluid; and a controller configured to: (i) compute a flow parameter using one of: (A) counting pulses derived from the transducer signal during a sampling window, and/or (B) deriving spectral energy within a passband of the transducer signal; and (ii) modulate electrical power to the heater according to a mapping between the flow parameter and a target power value.

The flow disrupter body may comprise a cylindrical element having a diameter selected to yield a vortex-shedding frequency within a target passband for a design airflow range. The transducer signal may be AC-coupled to an amplifier and/or a comparator that produces a pulse train whose pulse count is within a sampling window and correlates with airflow. The controller may compute the spectral-energy over a passband centered between about 1 kHz and about 5 kHz. The controller may use a calibration lookup table generated from empirical flow data obtained using, for example, a syringe pump or flow bench. The conduit may have a cross-section (e.g., substantially circular) and a length selected to promote laminar flow upstream of the flow disrupter body. The controller may apply hysteresis and/or outlier rejection to the transducer signal prior to flow parameter estimation.

In various embodiments, a vapor generator comprises: an intake, an outlet, and an airflow path extending therebetween; a first temperature sensor disposed upstream in the airflow path; an airpath heater disposed downstream of the first temperature sensor and configured to heat intake air flowing along the airflow path; a second temperature sensor disposed downstream of the airpath heater; an aerosolization heater isolated from the airflow path; and a controller configured to drive the airpath heater to maintain an intake-air temperature setpoint based on feedback from the first and second temperature sensors, and further configured to independently drive the aerosolization heater according to a power profile responsive to airflow during inhalation.

The airpath heater may comprise a resistive element selected from a foil heater, thick-film heater, wire-wound heater, and/or positive temperature coefficient heater. The vapor generator may further comprise a humidity sensor coupled to the controller, the controller being configured to adjust the intake-air setpoint based at least in part on ambient humidity. The controller may implement a closed-loop control algorithm selected from proportional-integral-derivative control, model-predictive control, or a hybrid feed-forward/feedback scheme. The airpath heater may be positioned downstream of an airflow sensor and upstream of the second temperature sensor.

In various embodiments, a method of operating a vapor delivery device, comprises: receiving a transducer signal indicative of airflow through an airflow path of the device; determining a flow parameter from the transducer signal by (i) counting pulses in a time window and/or (ii) computing spectral energy within a frequency band; sensing at least one temperature associated with the device; determining a heater power command as a function of the flow parameter and the at least one temperature; and driving a heater with a pulse-width-modulated signal according to the heater power command while the heater remains isolated from direct contact with liquid and the airflow path.

Determining the flow parameter may include counting pulses exceeding a comparator threshold during a sampling window between about 10 ms and about 200 ms. Determining the flow parameter may include computing spectral energy in a predefined passband and normalizing the energy to a reference level. The method may include filtering the transducer signal using at least one of: a low-pass filter, a band-pass filter, a notch filter, and a moving average. The method may include detecting an end-of-inhalation condition based on a decrease in the flow parameter below a threshold for a minimum dwell time. The method may include adjusting the power profile using a temperature that is inferred from the resistance of the heater obtained from voltage and current measurements.

In various embodiments, one or more non-transitory computer-readable media are storing instructions which, when executed by one or more processors of an vapor delivery device, cause the device to: acquire a transducer signal indicative of airflow in an airflow path; compute a flow parameter by (i) counting pulses derived from the transducer signal and/or (ii) calculating a spectral-energy metric within a defined passband; acquire at least one temperature signal; compute a target power value for an aerosolization heater as a function of the flow parameter and the at least one temperature signal; and generate a pulse-width-modulated drive signal to deliver power to the aerosolization heater according to the target power value.

The instructions may cause the device to select between the time-domain pulse-count method and the frequency-domain spectral-energy method based on a quality metric. The computer-readable media may include a calibration table generated from empirical airflow measurements and stored in non-volatile memory. The instructions may cause the device to compensate for battery voltage variation by normalizing heater power delivery to maintain a target wattage. The instructions may cause the device to maintain a low-power standby state in which the heater is periodically sampled and/or pre-warmed below an aerosolization threshold.

In various embodiments, a flow-sensing assembly comprises: a conduit defining an airflow passage; a flow disrupter body positioned within the airflow passage and configured to produce periodic pressure fluctuations when airflow is present; a transducer having a fluidic or acoustic coupling to the airflow passage and configured to output a transducer signal responsive to the periodic pressure fluctuations; and processing circuitry configured to output a flow-correlated value based on the transducer signal by counting pulses and/or evaluating spectral energy.

The flow disrupter body may be or comprise a removable insert configured to be exchanged to alter a frequency response of the assembly. The conduit may be or comprise an injection-molded polymer or a metal tube and the transducer is coupled to the airflow passage via a micro-machined aperture. The processing circuitry may produce both a pulse-count value and a spectral-energy value and output a flow-correlated value based thereon. The assembly may comprise a gasket or seal configured to acoustically isolate the transducer from external ambient noise.

In various embodiments, a device comprises: an airflow path; a transducer configured to output a time-varying signal during an inhalation event; a heater configured to vaporize a fluid; and a controller configured to: (i) generate an inhalation signature from the time-varying signal; (ii) compare the inhalation signature to a stored template; and (iii) enable power delivery to the heater only upon the comparison satisfying a similarity criterion.

The inhalation signature may be or comprise at least one of: a temporal profile of the flow parameter, a spectral-energy distribution, or a statistical feature vector. The similarity criterion may be satisfied when a distance metric between the inhalation signature and the stored template is less than a threshold. The controller may update the stored template over time using incremental averaging or weighted adaptation. The controller may additionally require, for power delivery to the heater, a secondary factor. The secondary factor may be or comprise one or more of: a user input, a proximity condition, and a minimum battery level.

In various embodiments, an vapor delivery device comprises: a heater isolated from an airflow path and a liquid supply; a power stage configured to deliver electrical energy to the heater; measurement circuitry configured to measure voltage across the heater and current through the heater with respect to a precision voltage reference and to determine an electrical resistance of the heater during operation; and a controller configured to infer a heater temperature from the electrical resistance and to regulate the power stage based on the inferred heater temperature and a flow parameter indicative of airflow through the device.

The current may be measured using a shunt resistor. The voltage may be measured relative to the precision voltage reference. The controller may compute the heater resistance using Ohm's law. The current may be measured using a Hall-effect sensor that outputs a signal indicative of current (e.g., without a series shunt resistor). The voltage and/or current measurements may be synchronized to a designated phase of a pulse-width-modulated drive cycle to reduce measurement error. The controller may map the inferred heater temperature to a temperature-dependent power limit and reduce heater power upon exceeding the limit.

In various embodiments, a vaporization system comprises: a pod comprising a fluid reservoir and an aerosolization chamber; a power module releasably couplable to the pod and comprising: the flow passage with a flow-disrupting body and a transducer, an intake-air heater with dual temperature sensors, and a controller configured to modulate power delivered to a heater of the pod as a function of a flow rate value and conditioned-air temperature. The pod may function substantially as a fluid reservoir, with a portion of the air path located in the power module. The pod and power module may mate via a quick-connect (e.g., comprising magnetics). The power module may house the controller, sensors, and signal-conditioning electronics. Pods with different fluids may be usable with a common power module. The power module may be compatible with etched-foil heaters and bulb heaters. Insertion of a pod may trigger self-diagnostics of the sensing and heating subsystems. The flow-disrupting body may be integral with a housing of the power module. The system may comprise pod identification storage usable by the controller.

A vaporization device comprising: a bulb heater defining at least part of a vaporization chamber; and a separate temperature sensor disposed to sense temperature of the bulb heater or chamber, the device further comprising a controller configured to modulate heater power based on the sensed temperature and a flow rate value derived from a flow-sensing transducer. The separate temperature sensor may be a glass-bead thermistor. The bulb heater may comprise glass. The device may comprise a mounting that thermally couples the sensor to the bulb. The device may operate in a closed control loop using a separate temperature sensor.

FIG. 47 is a block diagram illustrating an optical analysis subsystem. In FIG. 47, optical analysis subsystem 4700 comprises light emitters 4761, sampling cell 4711, spectrum sensor 4762, and controller 4780. In an embodiment, light emitters 4761 illuminate sampling cell 4711 which contains precursor to be analyzed before being vaporized by a personal vaporizer as described herein. The light from light emitters 4761 passes through the precursor being analyzed and, after various wavelengths are absorbed and/or amplified by the substance/liquid/precursor, is received by spectrum sensor 4762 (e.g., spectrometer, interferometer). The output of spectrum sensor 4762 is provided to controller 4780 (e.g., controller 4280, controller 4380, etc.).

In an embodiment, controller 4780 may use spectra from spectrum sensor 4762 to classify the precursor by brand, formulation, SKU family, concentration, or flavor. In an embodiment, controller 4780 may further verify pod legitimacy and detect degradation (e.g., oxidation, hydrolysis, and/or volatilization loss) by comparing the measured spectral features to stored templates and thresholds. The analysis may be performed when a pod is inserted, periodically during use, and/or upon a user-triggered diagnostic event. In some embodiments, a portion of the precursor is routed through a bypass sampling cell and returned to the reservoir or chamber; in others, the pod integrates the sampling window such that sampling can occur without additional routing.

The optical subsystem 4700 may operate across one or more spectral bands (e.g., visible, near-infrared, mid-infrared, UV, and/or white light), and may employ interferometric techniques to obtain high signal-to-noise spectra within compact packaging. Controller 4780 may store spectra, classification results, and quality metrics in non-volatile memory, and may adjust control parameters accordingly as discussed below.

In an embodiment, the precursor formulation includes at least one inert marker compound chosen to provide a strong, unique spectral signature detectable by the on-board optical subsystem 4700. The marker can improve classification accuracy, enable counterfeit detection, and facilitate verification that an approved formulation is present. In addition, the controller 4780 may utilize detected marker intensity to estimate fluid aging or dilution and to adjust power delivery, valve positions, or intake-air setpoints. The selection of such marker compounds may support separate protection of formulation compositions independent of the device embodiments. In some embodiments the inert marker or markers may be a component of the precursor that is part of a specific formulation intended to improve and/or convey attributes to the formed vapor that are desirable such as improved vapor density, and/or improved vapor flavor, and/or improved particle size formation.

Controller 4780 may adapt power delivery, preheat level, intake-air conditioning, and valve actuation as a function of the identified precursor type (e.g., nicotine strength, flavor family, cannabinoid profile). In an example, activation-cycle data (e.g., puff duration, inter-puff interval, and airflow dynamics) are collected per SKU and used to update a mapping between airflow-derived flow parameters and target heater power. The mapping may be implemented as tables, parametric equations, or machine-learning models trained on historical usage. The resulting configured/programmed controller 4700 can, for example, increase heater responsiveness for short, high-intensity puffs typical of one SKU while favoring temperature stability for longer, lower-flow puffs typical of another.

In some embodiments the architecture described herein as it relates to the construction of a sampling cell located between an emitter or emitters and a sensor and/or detector or sensors and/or detectors may be configured to analyze the refractive index of the precursor liquid. In such an embodiment the emitter may be a light source, which may be a coherent or non-coherent light source, and the sample cell may be constructed to function as a prism, and the sensor and/or detector may function to measure the angle of light refraction. The angle of light refraction is may be used to determine the precursor sample refractive index.

Several methods of determination of the refractive index of the precursor liquid sample may be utilized, including but not limited to, the use of simple internal architecture constructed with and/or in proximity to the sample cell, such as fixed pins or similar structure, and to then to use Snell's law to calculate the index of refraction from angle measurements of the light passing through the precursor liquid sample and then interacting with the fixed pins or similar structure. Additionally, a prism may be used. Using refractometers like Pulfrich refractometers can be utilized to measure the deviation of the emitted light beam as it passes through the sample cell that functions as a prism containing the precursor liquid sample. Alternatively, interferometry and the Brewster angle method may be used. Another common method that can be utilized is the critical angle method, such as is used in process refractometers, which measures the angle at which total internal reflection occurs. Another method is to utilize an interferometer, this technique uses the interference of light waves to measure small changes in the refractive index with high precision. Types of interferometers available in compact form factors that may be used include, but are not limited to, miniature versions of common interferometer types.

Examples of miniature versions of common interferometer types include, but are not limited to, the miniature Michelson interferometer which can be built on integrated platforms like low-temperature co-fired ceramics (LTCC) and designed without moving parts, as well as fiber Mach-Zehnder Interferometer (MZI) which uses optical fiber to split and recombine beams (which is often used for sensing applications). Also, the miniature Fabry-Pérot interferometer (FPI) may be used. This type is often integrated into small devices like optical microcavities and distributed Bragg reflectors.

In an embodiment, using an FPI part of the sensor and/detector array may include a Bragg reflector, or distributed Bragg reflector (DBR). This may include an optical mirror made of alternating layers of two different materials with different refractive indices. Each layer is a quarter-wavelength thick, and their precise arrangement causes reflections from each interface to interfere constructively, leading to strong reflection of light within a specific wavelength range. Another type of interferometer that may be utilized is the fiber Sagnac interferometer, which is a miniature configuration using optical fiber to create a compact setup where a beam of light is split into two paths by a beamsplitter. These two beams travel in opposite directions around a closed loop—typically a fiber optic coil or a ring interferometer (e.g., a micro ring-assisted Mach-Zehnder interferometer which uses a micro ring for enhanced performance), or a miniature Fabry-Perot interferometer. Other compact interferometers, such as miniature versions of a Fizeau and Twyman-Green interferometer, may be utilized as part of the sensor and/or detector array. Other specialized miniature designs of interferometers include the miniature lamellar grating interferometer which is designed on silicon technology that divides the incident wavefront into multiple parts for real-time spectroscopy. Additionally compact versions of white light interferometers may be used for precise measurements over short distances such as the sample cell architecture described herein. A laser diode interferometer which includes homodyne and heterodyne types that use laser diodes, and can be integrated into fiber optic configurations. Furthermore, the Brewster's Angle method may be utilized which relies on the angle at which light becomes perfectly polarized upon reflection from the liquid's surface.

Other methods that may be used include the acousto-optic method which uses the interaction of light and sound to measure the refractive index. In such an embodiment, the emitter array includes an acoustic component (such as a speaker) and the sensor and/or detector array includes an acoustic sensor (such as a microphone). Another method utilizes spectroscopic ellipsometry, where this method measures how the polarization of light changes upon reflection from a sample to determine its refractive index. In an embodiment, an inline refractometer, (also referred to as a process refractometer) may be used to determine the refractive index of the precursor liquid for continuous, real-time monitoring of liquid streams.

The specific precursor liquid formulations vary in the active component such as nicotine, or cannabinoids, or nicotine and cannabinoids, as well as having different concentrations of active components. Furthermore, the presence of additional constituents in some precursor liquid formulations such as propylene glycol (PG), vegetable glycerol (VG), acid, volatile compounds such as terpenes (monoterpenes, diterpenes, triterpenes, and/or terpenic acid or acids), water, and other compounds described herein will result in a unique refractive index for specific precursor liquid formulations.

In an embodiment, the precursor formulation has a unique detectable refractive index detectable by the on-board optical subsystem 4700. The unique refractive index can serve as a unique identifier to the specific precursor liquid formulation. The refractive index identifier may improve classification accuracy, enable counterfeit detection, and facilitate verification that an approved precursor formulation is present. In addition, controller 4780 may utilize detected refractive index values to estimate fluid aging or dilution to adjust power delivery, valve positions, or intake-air setpoints. The adjustment of power delivery, valve positions, or intake-air setpoints may be specific to optimize the activation of the vaporization device (such as any of the vaporization devices described herein) for a specific formulation, such that, for example, the activation cycle is optimized for a specific formulation as identified by the unique refractive index identifier. The refractive index identifier can support separate protection of formulation compositions independent of the device embodiments.

Methods of evaluating and/or analyzing the precursor liquid such as the use of Infra Red (IR) spectroscopy, and ultraviolet (UV) spectroscopy and the combination of IR and UV spectroscopy have been described herein. Additionally, an alternative method using the optical subsystem as a refractometer for the measurement of the refractive index of the precursor liquid has also been described herein. Another method involves constructing the optical sub-system 4700 to function as a spectrophotometer for the analysis and evaluation of the precursor liquid.

A spectrophotometer can operate over a wide spectrum of visible and non-visable light. For this method of evaluating the precursor sample the construction of the spectrophotometer may utilize a visible light source (referred to as visible spectroscopy and sometimes also referred to as white light spectroscopy—although white light spectroscopy may also include IR and UV spectrums). Visible spectroscopy is a technique that uses light in the visible range of the electromagnetic spectrum to analyze the precursor liquid by measuring the amount of light it absorbs, transmits, and/or reflects. This method can be used to identify unique characteristic of precursor liquid formulations, as each substance in the precursor formulation mixture and/or solution absorbs and transmits visible light in a unique way, thereby creating a distinct spectrum. It should be understood that it is contemplated that IR, UV and visible light spectroscopy, spectrophotometry, and refractometry can be used individually or in combination with one another, and the optical system(s) described herein may be configured to perform IR, UV and visible light spectroscopy, spectrophotometry, and refractometry or a combination thereof.

A single beam or a double beam construction may be utilized. A single beam spectrophotometer comprises of a visible light source that serves as the emitter, may have a monochromator in order to select a specific wavelength, a sample cell where the liquid precursor is present, and a detector and/or sensor to measure light intensity that passes through the sample cell. For a double-beam construction, a beam splitter is also included to direct light through both the sample and a reference beam. Dividing the light beam so it can travel through both the sample and a reference cell simultaneously or in rapid succession. This may allow for a more stable comparison.

Light sources that may be utilized to provide a beam of light include a tungsten lamp for visible light, or an LED or plurality of LEDs may be utilized. A monochromator may isolate a single, specific wavelength of light from the source. It typically contains a prism and/or diffraction grating to separate the light and a slit to control the bandpass. The emitted visible light then passes through the precursor sample chamber. The light that passes through the precursor liquid sample in the sample cell is then measured by the detector and/or sensor. The detector and/or sensor measures the intensity of light that passes through the precursor liquid sample. The detector and/or sensor converts the light energy into an electrical signal, with the signal being output often as a numerical value for absorbance or transmittance, and or generates a spectrum.

In an embodiment, the precursor formulation has a unique detectable absorbance and/or transmittance of visible light detectable by the on-board optical subsystem 4700 functioning as a spectrophotometer. The unique absorbance and/or transmittance can serve as a unique identifier to the specific precursor liquid formulation. The absorbance and/or transmittance identifier can improve classification accuracy, enable counterfeit detection, and facilitate verification that an approved precursor formulation is present. In addition, the controller 4780 may utilize detected absorbance and/or transmittance values to estimate fluid aging or dilution and to adjust power delivery, valve positions, or intake-air setpoints. The adjustment of power delivery, valve positions, or intake-air setpoints may be specific to optimize the activation of the vaporization device, such as any of the vaporization devices described herein, for a specific formulation, such that, for example, the activation cycle is optimized for a specific formulation as identified by the unique absorbance and/or transmittance identifier. The absorbance and/or transmittance identifier can support separate protection of formulation compositions independent of the device embodiments.

FIG. 48 is a block diagram illustrating a dual-cell optical analysis subsystem. In FIG. 48, optical analysis subsystem 4800 comprises light emitters 4861, precursor sampling cell 4811, vapor sampling cell 4812, precursor spectrum sensor 4862, vapor spectrum sensor 4863, and controller 4880. In an embodiment, light emitters 4861 illuminate precursor sampling cell 4811 which contains precursor to be analyzed before being vaporized by a personal vaporizer as described herein. Light emitters 4861 also illuminate vapor sampling cell 4812 which contains vaporized precursor to be analyzed after being vaporized as described herein. The light from light emitters 4861 passes through the precursor being analyzed and, after various wavelengths are absorbed and/or amplified by the substance/liquid/precursor, is received by spectrum sensor 4862 (e.g., spectrometer, interferometer). The light from light emitters 4861 passes through the vaporized precursor being analyzed and, after various wavelengths are absorbed and/or amplified by the vaporized precursor, is received by spectrum sensor 4863 (e.g., spectrometer, interferometer). The output of spectrum sensor 4862 is provided to controller 4880 (e.g., controller 4280, controller 4380, etc.). The output of spectrum sensor 4863 is provided to controller 4880 (e.g., controller 4280, controller 4380, etc.).

In an embodiment used with cannabinoid-containing fluids, controller 4880 may biases thermal conditions to promote interconversion of certain constituents over time (e.g., converting a portion and/or all, and or substantially all of Δ9-THC toward CBN). Controller 4880 may implement time-varying target temperatures, dwell profiles, or post-puff soak periods to modulate interconversion. The dual-cell optical analysis arrangement of analysis system 4800 may be used to monitor conversion. For example, precursor sampling cell 4811 and precursor spectrum sensor 4862 may provide analysis data/information about the pre-heating precursor, whereas vapor sampling cell 4812 and vapor spectrum sensor 4863 may provide analysis data/information about the post-heating (i.e., at least partially vaporized) precursor. Differences in spectral features between the cells may indicate conversion extent, enabling closed-loop adjustment of heater commands and, optionally, airflow or liquid metering to achieve a target conversion rate.

In some embodiments, a device described herein may execute a diurnal schedule in which morning usage favors a first profile (e.g., lower conversion) and evening usage progressively increases conversion to shift perceived effects, with the schedule refined over time. To enable time-aware control (e.g., diurnal interconversion schedules) and to support analytics (e.g., correlation of activation cycles to time-of-day), a device described herein may include an RTC coupled to the controller. The RTC may be maintained by a dedicated backup power source (e.g., a button cell or super-capacitor) such that correct time persists across primary-battery depletion. A controller may timestamp sensed data (e.g., airflow signals, temperature, valve states) and store records in non-volatile memory for on-device learning or later diagnostics. A machine learning program may utilize the activation data metrics as they correlate to time of day usage and generate predictive activation cycles to optimize time of day activation device performance. Machine learning may be used to estimate and predict desired pharmacokinetic delivery of precursors based on usage and optimize activation cycles to achieve predicted pharmacokinetic targets for precursor mass transfer to an inhalation aerosol and/or vapor. Pharmacokinetic data of the precursor constituents and characteristic of conversion to an inhalation aerosol and/or vapor may be utilized for predictive activation, either passively (e.g. the device is in a ready state at a predicted time), or actively (e.g. notifying the user with via a notification to a device such as a cell phone, tablet or smart watch or other type of wearable, haptic feedback such a vibration of the device, visual indicator such as a LED light signal, and/or auditory cue from the device).

Multiple autonomous time-setting embodiments are contemplated to avoid reliance on external apps: (i) GNSS/GPS time acquisition; (ii) reception of terrestrial time signals (e.g., multi-frequency time beacons); (iii) passive timezone inference from sunrise/sunset periodicity using an on-board photodetector and a date-tracking RTC; and/or (iv) time-setting via an accessory such as a charger or a dedicated cartridge. Satellite-beacon or broadcast-time reception may provide coarse time without establishing a data connection. Photodetector-based inference may operate over several day-night cycles to estimate local offset and daylight-saving transitions. The controller may select among these methods based on availability, power budget, or user privacy settings. Machine learning may utilize time of day activation cycles and associated measurable metrics and data points to develop predictive time based activation cycles to optimize device activation and performance throughout the day, such that activation cycles are modulated and improved based on the individual's use of the device throughout the day, and/or on different days of the week, and/or aggregate usage data is analyzed and assimilated in order to optimize specific time of day, and/or time and day of week activation parameters.

As described for airflow sensing, a controller may generate an inhalation signature from transducer signals (e.g., temporal and spectral features). Power delivery can be enabled only when a similarity metric between a current inhalation signature and a stored authorized template meets a criterion. The controller may maintain multiple authorized templates (e.g., primary user and a secondary) and may employ thresholds, hysteresis, and liveness checks (e.g., consistency over a minimum duration) to reduce false activations. Enrollment may occur implicitly during initial usage or via a designated training routine. Users may develop a unique activation trigger based on flow sensing through the device to unlock or otherwise activate the device, such as, for example, three short puffs to turn the device on, and two short puffs to deactivate the device. These are just examples and many types of puff or inhalation based signals may be contemplated. The device may use a machine learning program to analyze and record the user's desired activation trigger, and may have the user repeat the activation trigger several times in order to learn the unique profile. Such unique activation triggers may be utilized to prevent unwanted or unauthorized use of the device by anyone other than the user, essentially functioning as a type of biometric security system for the device.

In some embodiments described herein, intake-air restriction and/or liquid feed to the aerosolization chamber are modulated by actuators under controller command. Examples include: (i) micro linear actuators translating shutters or slides; (ii) miniature servos driving valves; and (iii) electromagnetic actuators coupled with Hall-effect sensors for position feedback. As a passive alternative, a diaphragm-driven needle valve may use user-generated vacuum to displace a needle, thereby metering liquid flow without electrical drive. The device may employ one or more of these mechanisms, with actuator selection based on response time, power consumption, and manufacturability. Valve position may be scheduled in coordination with heater power and intake-air temperature to achieve consistent aerosol output across puff profiles.

In some embodiments, learning models may execute on the embedded controller to avoid external connectivity. Feature statistics, calibration tables, and schedules can be stored locally, with optional export via a service interface for diagnostics. In some embodiments, learning operates in a privacy-preserving mode in which only anonymized metrics (e.g., histogram bins or quantized templates) are retained.

It may be desirable in some embodiments to formulate a precursor liquid to be resistant to the formation of undesirable and/or unwanted thermal degradation byproducts when heated to form an aerosol and/or vapor. In some embodiments the precursor liquid is formulated such that the boiling point temperature of the precursor liquid formulation is lowered from the temperature in which thermal degradation of the components of the precursor may occur. Formulating the precursor with specific components to reduce the temperature in which the precursor liquid undergoes a phase change from a liquid to a vapor can be used as a method for the reduction of undesirable thermal degradation products that may occur from the heating of components in the precursor liquid formulation. In other words, for example, the greater the difference in the temperature required to phase change the precursor liquid to a vapor and the temperature(s) in which thermal degradation of the precursor liquid component occurs, the greater the reduction in the presence of thermal degradation byproducts present in the aerosol and/or vapor.

In some embodiments, vaporization devices such as those described herein utilize a vacuum pressure during activation to reduce the boiling point of the precursor by reducing the vapor pressure that the precursor liquid is subjected to when heated. This method may be combined, in some embodiments, with a precursor liquid or liquid formulated to have an intrinsically lower boiling point that when heated under reduced pressure result in a larger difference in the temperature at which a phase change from a liquid to a vapor and/or aerosol occurs and the temperature at which thermal degradation of the liquid and/or a component and/or components of the precursor liquid may undergo thermal degradation. In some embodiments, a precursor formulation specifically formulated to have a lower boiling point is used in a vaporization device (such as those described herein) in which a vacuum pressure is exerted on the precursor liquid during heating in order to reduce or ameliorate the formation of thermal degradation byproducts during activation of the vaporization device. In some embodiments, the precursor liquid formulation or precursor liquid formulations is a combination of volatile and non-volatile constituents where the ratio of the volatile and non-volatile constituents are mixed to effect a reduction in the boiling point of the precursor.

Precursor liquid(s) containing nicotine and/or nicotine salts as a component of the formulation are often composed primarily of non-volatile liquids such as propylene glycol (PG) and/or glycerol, a vegetable derived glycerol (VG), and/or a mixture of PG and VG and as has been described herein. Precursor liquid(s) that contain one or more cannabinoids as a component of the formulation may also contain PG, VG, and/or a mixture of PG and VG. Heating of PG and VG to temperatures near their standard atmospheric pressure boiling point can result in the formation of undesirable byproducts as a result of the thermal degradation of the precursor liquid. For example, PG begins to degrade into formaldehyde at temperatures as low as 133 °C (271 °F) in the presence of oxygen, with significant degradation occurring between 133 °C and 175 °C (271 °F to 347 °F). The boiling point of pure propylene glycol is approximately 187 °C to 188 °C (369 °F to 370 °F) at standard atmospheric pressure. The process of PG degradation to formaldehyde is significantly accelerated by higher temperatures and the presence of oxygen. This is a key factor in e-cigarette vapor degradation. The boiling point of VG is 290 °C (554 °F). VG begins to degrade into acrolein slightly below its boiling point (at around 280 °C). The reaction is slow without a catalyst and is more efficient at higher temperatures (often around 300-320 °C), especially in gas-phase reactions.

In precursor liquids that are composed entirely of and/or include cannabinoids as a constituent of the precursor liquid it is also desirable to reduce, and/or mitigate, and/or ameliorate the formation of thermal degradation byproducts. As cannabinoids have high boiling points and are typically considered non-volatile, it is possible to have the formation of undesirable thermal degradation byproducts when heating the cannabinoids to form a vapor and/or aerosol. Cannabinoids begin to degrade at temperatures above 110 °F (43 °C), but the process accelerates significantly above 320 °F (160 °C) and becomes very rapid above 392 °F (200 °C). The thermal degradation of cannabinoids produces various byproducts including isoprene, 2-methyl-2-butene, 3-methylcrotonaldehyde, and 3-methyl-1-butene from THC. Depending on the heating conditions, other compounds like psychoactive Δ8 and Δ9 THC isomers, cannabichromene (CBC), and hexahydropyran-4-yl 1-pentylcarboxylate (CBDQ) can also form.

The formation of thermal degradation byproducts from the precursor formulation can be reduced, and/or mitigated, and/or ameliorated by the reduction of the boiling point of the precursor liquid. As the boiling point is a physical property determined primarily by the strength of intermolecular forces such as London dispersion forces, dipole-dipole forces, hydrogen bonding, ion-dipole and ion-induced dipole forces. One method to reduce the boiling point is to lower the vapor pressure by the application of a vacuum (i.e., below atmospheric and or ambient) pressure to the precursor when heated, as is described herein. Another method that can be used in conjunction with an applied vacuum pressure, or in the absence of an applied vacuum pressure, is to add a volatile molecule, compound, and/or compounds to the precursor liquid formulation or precursor liquid formations. In some embodiments, the addition of a volatile molecule, compound, compounds, volatile component, and/or volatile components changes the overall vapor pressure of the precursor liquid mixture, altering the boiling point.

This method and process for the reduction, mitigation, and/or amelioration of the production of thermal degradation byproducts and/or decomposition of the precursor liquid is achieved by way of thermal degradation (or decomposition) being a chemical process involving the breaking of intramolecular bonds (forces within molecules). This breaking of intramolecular bonds requires a specific amount of energy to break those chemical bonds. This breaking generally occurs at a characteristic temperature range for a given substance regardless of the boiling point of the mixture it is in. Thus the boiling point of the precursor liquid may be reduced to lower temperatures that are not sufficient to generate the specific amount of energy required to break the intramolecular bonds of the precursor liquid, and is also therefore insufficient to cause the formation of thermal degradation byproducts and/or thermal decomposition byproducts.

In some embodiments, the vaporization device and/or vaporization devices (such as those described herein) are constructed and/or controlled to heat the precursor liquid and/or precursor liquids to a temperature sufficient to phase change and/or mobilize the precursor liquid from a liquid phase state into an aerosol and/or vapor phase. In order to facilitate the ideal and/or optimized heating of the precursor liquid and/or liquids the precursor liquid formulation and/or formulations can be empirically and/or theoretically analyzed to determine the specific boiling point of the precursor liquid formulation and/or formulations such that the construction and/or control of the vaporization devices heating cycle is designed to apply sufficient thermal energy to heat the precursor liquid and/or precursor liquids such that the generation of a vapor and/or aerosol occurs, but less energy than would be required to cause the thermal degradation and/or thermal decomposition of the precursor liquid. One method for the determination of the boiling point of the precursor liquid formulation and/or formulations is to experimentally determine the boiling point of the precursor liquids. This determination can be achieved, for example, by an experimental set-up using a simple boiling point apparatus like a Thiele tube. Another method is to calculate the theoretical boiling point elevation using the colligative property equation, which states that the change in boiling point ($\Delta T_b$) is proportional to the molality (m) of the non-volatile solute ($\Delta T_b = K_b \cdot m \cdot i$) where (i) is the van't Hoff factor and the solvent's ebullioscopic constant is ($K_b$).

In some embodiments, the precursor liquid is formed from non-volatile components such as PG, VG, or a mixture of PG and VG, and also comprises nicotine and/or a nicotine salt, water, an acid (such as citric acid—although other acids or mixtures of acids may be used including, but not limited to, lactic acid, benzoic acid, levulinic acid, salicylic acid, malic acid, and tartaric acid, and/or mixtures of such acids), and a volatile molecule, component, and/or components that are included to reduce the precursor liquid's boiling point. In some embodiments, the precursor liquid is formed from non-volatile components such as PG, VG, or a mixture of PG and VG, comprising nicotine, water, and a terpenoid and/or terpenoids (also called isoprenoids), where the terpenoid and/or terpenoids function to protonate the nicotine (thereby forming a nicotine salt), and also function as a volatile component and/or components that reduce the precursor liquid's boiling point.

In some embodiments, the precursor liquid is formed from non-volatile components such as PG, VG, or a mixture of PG and VG, a cannabinoid or cannabinoids, and a volatile component or components are included to reduce the precursor liquid's boiling point. In some embodiments, the precursor contains a cannabinoid or cannabinoids, and a volatile component or components that are naturally occurring and/or are included to reduce the precursor liquid's boiling point. In some embodiments, the precursor contains a cannabinoid or cannabinoids, and a volatile component or components that are bound to the cannabinoid forming cannabinoid acids (such as tetrahydrocannabinolic acid—THCA—and/or cannabidiolic acid—CBDA) These cannabinoid acids are formed by the joining of a phenol group on the cannabinoid with a volatile compound, such as, for example, a terpene precursor. In some embodiments, the precursor comprises a cannabinoid or cannabinoids, and a volatile component or components that are bound to the cannabinoid forming cannabinoid acids (such as THCA and/or CBDA), in order to render the precursor psychoactively inactive until undergoing decarboxylation of the cannabinoid acid during heating as part of the activation cycle of the vaporization device (such as those described herein) to form the aerosol and/or vapor. In some embodiments, the precursor liquid comprises a cannabinoid or cannabinoids and a volatile compound such as a terpene and/or terpenes that is included to impart an enhanced physiological effect in conjunction with the cannabinoid or cannabinoids (sometimes referred to as an "enterouge effect") where the non-volatile and volatile compounds work together synergistically to enhance the overall effects and benefits of the individual components producing a physiological effect that is enhanced when compared to the physiological effects of the non-volatile and volatile compounds in isolation.

In some embodiments of the precursor liquid, a cannabinoid acid or cannabinoid acids are combined with nicotine to form a nicotine salt, where the cannabinoid acid donates a hydrogen ion (proton) to the nitrogen group on the freebase nicotine molecule thereby creating a positively charged nicotinium ion which then forms an ionic bond with the deprotonated cannabinoid acid molecule (e.g., a carboxylate ion). This results in a salt, such as nicotine cannabidiolate and/or similar compounds.

In some embodiments, the use of a volatile molecule, molecules, compound, and/or mixture of volatile compounds included in the precursor formulation may also function to convey organoleptic attributes (such as flavor or flavors) to the aerosol and/or vapor formed from the precursor. In some embodiments, the use of a volatile molecule, molecules, compound, and/or mixture of volatile compounds included in the precursor formulation may also function to convey sensory attributes such as tracheal stimulation (sometimes referred to as "throat hit") upon inhalation of the formed aerosol and/or vapor formed from the precursor. In some embodiments, the use of volatile molecule, molecules, compound, and/or mixture of volatile compounds included in the precursor formulation may also function to convey other physiological responses and/or effects associated with the inhalation of the volatile molecule, molecules, compound, and/or mixture of volatile compounds, including but not limited to, stimulation, wakefulness, sensation of increased focus, reduction in perceived anxiety, increased or improved relaxation, anti-inflammatory effects, appetite stimulation, appetite suppression, analgesic effect (pain relief), sleep induction, improved sleep duration and/or improved sleep quality that may occur as a result of inhalation of the aerosol and/or vapor formed from the precursor including the volatile molecule, molecules, compound, and/or mixture of volatile compounds. Some volatile molecule, molecules, compound, and/or mixture of volatile compounds may convey additional physiological benefits including but not limited to anti-despressant effects, anti-oncogenic and/or anti-tumorogenic effects, bronchodilation, anti-mucogenic effects, neuroprotective effects, and muscle relaxation.

In the formulation of precursor liquids that contain nicotine, cannabinoids, or nicotine in combination with cannabinoids the volatile molecule, molecules, compound, and/or mixture of volatile compounds that may be utilized to reduce the boiling point of the precursor liquid include, but are not limited to, mono-terpenes such as α-Pinene (alpha-Pinene CAS 80-56-8), β-Pinene (beta-Pinene, CAS 127-91-3), Δ3-Carene (β-carene, Delta-3-Carene, CAS 13466-78-9), Δ2-Carene (Delta-2-Carene CAS, 5146-62-10, myrcene (β-Myrcene, CAS 123-35-3), limonene (d-limonene, CAS 5989-27-5), p-Cymene (para-Cymene, CAS 99-87-6), γ-Terpinene (gamma-Terpinene, CAS 99-85-4), α-Terpinene (alpha-Terpinene CAS 99-86-5), terpinolene (CAS 586-62-9), ocimene isomers, including but not limited to, α-Ocimene, β-Ocimene, and trans-β-Ocimene (CAS (α) 58542-37-1, (β) 13877-91-3), sabinene (CAS 3387-41-5), camphene (CAS 79-92-5), thujene isomers, including but not limited to, α-Thujene (CAS 28644-6-2), phellandrene isomers, including, but not limited to, α-Phellandrene, and β-Phellandrene (CAS (α)4096-78-2, (β)555-10-2), terpinene, including, but not limited to, various terpinene isomers (CAS varies) such as α-Terpinolene variants listed above (terpinolene), 1,8-Cineole (eucalyptol also called 1,8-Cineole, CAS 470-82-6), and p-Mentha-1(7),8-diene (also called p-menthadienes, CAS 18320-49-3). It should be understood that the aforementioned molecules and/or compounds may be used individually or in combination.

In the formulation of precursor liquids that contain nicotine, cannabinoids, or nicotine in combination with cannabinoids, the volatile compounds that may be utilized to reduce the boiling point of the precursor liquid and/or may also serve to function as an acid include, but are not limited to, terpenoids and/or monoterpenoids (oxygenated monoterpenes, with the general chemical formula of $C_{10}H_{16}O$) such as linalool and other isoprene derivatives (CAS 78-70-6), α-Terpineol (also called Alpha-Terpineol, CAS 98-55-5), terpinen-4-ol (4-Terpineol, CAS 562-74-3), borneol (including endo-/exo-variants), CAS 1817-75-2), isoborneol (CAS 125-12-2), bornyl acetate (CAS 124-47-0), linalyl acetate (CAS 115-95-7), 1,8-Cineole (listed previously but is a also a monoterpenoid/ether), endo-fenchol (also called fenchol, CAS 499-20-1), exo-fenchol (CAS varies), nerol (also called geraniol—a monoterpenoid alcohol, CAS 106-24-1), citronellol, (CAS 106-22-9), pinocarvone (including pinocarvone derivatives, CAS 1831-14-1), terpinen-4-ol and related oxides, including those listed above, p-Cymen-8-ol (also called p-Cymenol—CAS varies), α-Terpinene oxide, and other monoterpene oxides. It should be understood that the aforementioned molecules and/or compounds may be used individually or in combination.

In the formulation of precursor liquids that contain nicotine, cannabinoids, or nicotine in combination with cannabinoids, the volatile compounds that may be utilized to reduce the boiling point of the precursor liquid may also serve to function as an acid include, but are not limited to, sesquiterpenes with the general chemical formula of $C_{15}H_{24}$ or a simple derivative of such a compound, such as β-Caryophyllene (also called beta-Caryophyllene) and the isomer cis-β-Caryophyllene (CAS 87-44-5), α-Humulene (also called α-Caryophyllene and also called Alpha-Humulene—CAS 6753-98-6, β-Pinene (listed above as a monoterpene), α-Bulnesene (also called Alpha-Bulnesene), α-Bisabolene, β-Bisabolene, trans-α-Bisabolene, and bisabolene isomer mixtures, γ-Elemene (including β/γ elemene, CAS 68381-

10-6), germacrene B (CAS 481-84-1), valencene (CAS 4630-7-3), α-Guaiene, β-Guaiene, Trans-β-guaiene and guaiene isomer mixtures, selinane isomers including selina-3,7(11)-diene, selina-4(15), 7(11)-diene, γ-selinene, α-selinene, β-selinene, δ-selinene) and selina-3,7(11)-diene, γ-Cadinene and α-Cadinene, germacrene D (CAS 25277-45-0), β-Elemene (also called Beta-Elemene, CAS 51452-72-3), β-Longipinene, β-Himachalene, muurolene isomers, and aromadendrene. It should be understood that the aforementioned molecules and/or compounds may be used individually or in combination.

In the formulation of precursor liquids that contain nicotine, cannabinoids, or nicotine in combination with cannabinoids, the volatile compounds that may be utilized to reduce the boiling point of the precursor liquid and/or may also serve to function as an acid include, but are not limited to, sesquiterpenoids (oxygenated sesquiterpenes with the general chemical formula of $C_{15}H_{24}O$) such as caryophyllene oxide (CAS 1139-30-6), guaiol (CAS 489-86-1), 10-epi-γ-Eudesmol (also called 10-epi-gamma-Eudesmol), γ-Eudesmol (also called gamma-Eudesmol), α-Eudesmol (also called alpha-Eudesmol), β-Eudesmol (also called beta-Eudesmol), bulnesol, α-Bisabolol (also called Alpha-Bisabolol, CAS 23089-26-1), Epi-α-bisabolol and other bisabolol isomers, humulene epoxide I & II, nerolidol including the isomers trans-nerolidol, and cis-nerolidol (CAS 7212-44-4), selinols and selina alcohols (e.g., selin-6-en-4α-ol), caryophylla-4(12),8(13)-dien-5-β-ol and related oxygenates, and eudesmol and eudesmol isomers. It should be understood that the aforementioned molecules and/or compounds may be used individually or in combination.

In the formulation of precursor liquids that contain nicotine, cannabinoids, or nicotine in combination with cannabinoids, the volatile compounds that may be utilized to reduce the boiling point of the precursor liquid include, but are not limited to, diterpenes (a group of terpenes generally categorized as unsaturated molecules with the formula $C_{20}H_{32}$) such as phytol (also called a diterpenoid alcohol, CAS 150-86-7), m-Camphorene and p-Camphorene (also called diterpene hydrocarbons), and other diterpene-related cannabinoids derived biosynthetically from geranyl diphosphate and olivetolic acid. It should be understood that the aforementioned molecules and/or compounds may be used individually or in combination.

In the formulation of precursor liquids that contain nicotine, cannabinoids, or nicotine in combination with cannabinoids the volatile compounds that may be utilized to reduce the boiling point of the precursor liquid and/or function as an acid include, but are not limited to diterpenic acids, such as abietic acid, acanthoic acid, agathic acid, callitrisic acid, carnosic acid, cativic acid, cleroda-7,13E-dien-15-oic acid, communic acid (and cis-communic acid, myrceocommunic acid, etc.), copalic acid, dehydroabietic acid, dihydroagathic acid (also called pinifolic acid), ent-polialtic acid, eperuic acid, hardwickiic acid, imbricataloic acid, isopimaric acid, kaurenoic acid, kolavenic acid, lambertianic acid, levopimaric acid, neoabietic acid, palustric acid, pimaric acid, pisiferic acid, sandaracopimaric acid, and thunbergol (a macrocyclic diterpenoid, not technically an acid, included here as it is often classified as a diterpinoid). It should be understood that the aforementioned molecules and/or compounds may be used individually or in combination.

In the formulation of precursor liquids that contain nicotine, cannabinoids, or nicotine in combination with cannabinoids, the volatile compounds that may be utilized to reduce the boiling point of the precursor liquid and/or may also serve to function as an acid, include, but are not limited to, triterpenes (a group of terpenes generally categorized as unsaturated molecules with the formula $C_{30}H_{48}$) and triterpenoids such as squalene (CAS 111-2-4), friedelin (CAS 563-92-2), sitostanol and sitosterol derivatives (CAS 11066-25-2). It should be understood that the aforementioned molecules and/or compounds may be used individually or in combination.

In the formulation of precursor liquids that contain nicotine, cannabinoids, or nicotine in combination with cannabinoids, the volatile compounds that may be utilized to reduce the boiling point of the precursor liquid and/or may also serve to function as an acid include, but are not limited to minor volatiles such as aromatics, esters, alcohols, aldehydes and others compounds such as 1,3-Diethylbenzene (CAS 591-50-0), aromatic volatiles such as p-Xylene (CAS 106-42-3) and o-Xylene (CAS 95-47-6), aromatic volatiles such as ethylbenzene (CAS 100-41-4) and methyl anthranilate, aromatic compounds such as ethyl maltol and the maltol precursor, aldehydes such as heptanal and nonanal, and esters such as hexyl butyrate, hexyl butanoate, and hexyl hexanoate. Additionally terpene oxides and hydrated terpenes such as pinene hydrates, pinocarveol, and trans-pinocarveol. It should be understood that the aforementioned molecules and/or compounds may be used individually or in combination.

In some embodiments, the formulation of precursor liquids and/or precursor compounds that contain cannabinoids, the volatile molecule and/or molecules and/or compounds that may be utilized to reduce the boiling point of the precursor liquid and/or precursor compound that the volatile molecule, molecules, compound, and/or compounds may include terpenes, terpenoids, diterpenes, diterpenoids, polyterpenes, polyterpenoids, aromatics, esters, alcohols, aldehydes and other compounds described herein, or a mixture of these that are found naturally in cannabis and/or derived directly from cannabis. It should be understood that the aforementioned molecules and/or compounds may be used individually or in combination.

In some embodiments the formulation of precursor liquids and/or precursor compounds that contain cannabinoids, the volatile molecule, molecules, compound, and/or compounds that are utilized to reduce the boiling point of the precursor liquid, may include terpenes, terpenoids, diterpenes, diterpenoids, polyterpenes, polyterpenoids, aromatics, esters, alcohols, aldehydes and others, molecules and/or compounds or a mixture of these volatile molecules and/or compounds where the ratios of the molecules and/or compounds, identity of the molecules and/or compounds, is formulated to be substantially identical to the identity and ratios of the volatile molecules and/or compounds found and/or identified and/or analyzed directly in a cannabis cultivar. In an embodiment, the formulation may be formulated to be substantially identical to a specific cannabis cultivar in relation to the percentages and ratios of cannabinoids and volatile molecules and/or compounds such as those described herein. In an embodiment the formulation may be formulated to be substantially identical to a specific cannabis cultivar in relation to the percentages and ratios of cannabinoids and volatile molecules and/or compounds such as those described herein where the cannabis cultivar is analyzed analytically to quantitate the specific type and ratio of cannabinoids and the identities and ratios of volatile molecules and/or compounds such as those described herein, and the result of the analysis provide the identities and ratios of the cannabinoids and the volatile components, including flavonoids, that are used in the formulation of the precursor liquid and/or precursor compound such that the precursor liquid and/or precursor compound is substantially identical, in compound composition and ratios of molecules and/or compounds, to the cannabis cultivar that has been analyzed. In some embodiments, where the precursor formulation is based on the analysis of a specific cannabis cultivar, one or more cannabinoids and/or one or more volatile molecules and/or compounds may be omitted from the formulation.

In some embodiments, the precursor liquids that contain nicotine and the volatile components of the precursor liquid may be selected to replicate the aromatic and/or flavor attributes of tobacco and to formulate the precursor liquid with variety of terpenes that are naturally present in tobacco that contribute to the aroma and/or flavor profile of tobacco. These include but are not limited to, myrcene, limonene, linalool, pinene, caryophyllene, humulene, geraniol, eucalyptol, ocimene, borneol, terpinene, valencene, bisabolol, camphene, nerolidol, and terpineol.

In some embodiments, the precursor liquids that contain nicotine include non-volatile components of the precursor liquid that may be included to replicate the functional, and/or aromatic and/or flavor attributes of tobacco, and to formulate the precursor liquid with variety of flavinoids that are naturally present in tobacco that contribute to the aroma and/or flavor profile of tobacco. These include, but are not limited to, rutin, quercetin, and apigenin, kaempferol-3-rutinoside, scopolin, esculetin, nictoflorin, and various methyl and glycoside derivatives of flavones and flavonols. These molecules and/or compounds may be synthesized and/or extracted from parts of the tobacco plant, such as the leaves, stamens, corolla, and calyxes, and can be used in precursor liquid formulations to replicate the quality, aroma, and flavor of tobacco generally, or specifically to replicate the quality, aroma, and flavor of individual tobacco cultivars or blends of tobacco cultivars such as those used in common tobacco products such as cigarettes. In some embodiments of precursor formulations, the flavonoids may also be selected, and their ratio in the precursor formulation adjusted based on desirable physiological effects.

In some embodiments, the precursor liquids that contain nicotine and the volatile components of the precursor liquid may be selected to replicate the aromatic and/or flavor attributes of tobacco and the specific concentration of these compounds can be varied depending on the tobacco variety, aging process, and growing conditions that the precursor liquid is formulated to replicate. In some embodiments the precursor liquids that contain nicotine and the volatile components of the precursor liquid may be selected to replicate the aromatic and/or flavor attributes of tobacco and the direct analysis of a tobacco cultivar to determine the specific identity ratios of volatile aromatic compounds may be used to determine the ratio and identity of the of the volatile aromatic compounds in the precursor formulation. In an embodiment, the formulation may be formulated to be substantially identical to a specific tobacco cultivar in relation to the percentages and ratios of flavonoids and volatile compounds (such as those described herein) where the tobacco cultivar is analyzed analytically to quantitate the specific type and ratio of flavonoids and the identities and ratios of volatile compounds (such as those described herein) where the result of the analysis provides the identities and ratios of the flavonoids and the volatile components (including terpenes and/or terpenoids) that are used in the formulation of the precursor liquid and/or precursor compound such that the precursor liquid and/or precursor compound is substantially identical in compound composition and ratios of compounds to the tobacco cultivar that has been analyzed. In some embodiments, where the precursor formulation is based on the analysis of a specific tobacco cultivar, one or more flavonoids and/or one or more volatile compounds may be omitted from the formulation.

In some embodiments, the precursor liquids that contain nicotine, cannabinoids, or nicotine in combination with cannabinoids, the volatile molecule, molecules, compound, and/or compounds may be utilized to reduce the boiling point of the precursor liquid may also serve to function as an acid, serve to convey a flavor, and/or serve to convey an aromatic profile of the precursor liquid when converted to an aerosol and/or vapor. In some embodiments, the precursor liquids that contain nicotine, cannabinoids, or nicotine in combination with cannabinoids, the volatile molecule, molecules, compound, and/or compounds may be utilized to impart a physiological effect and/or perceived and/or measurable physiological benefit, and/or a perceived and/or measurable psychological effect and/or benefit resultant of the constituents of the precursor liquid when converted to an aerosol and/or vapor and inhaled. For example, some of the volatile molecules and/or compounds that may be used to impart a physiological and/or psychological effect include, but are not limited to: myrcene for its sedative and muscle-relaxant effects, and anti-inflammatory and pain-relieving (analgesic) properties; limonene for mood-enhancing and stress-relieving properties such as imparting psychologically uplifting effects that can also be described as anti-anxiety and anti-depressive, as well as anti-inflammatory and anti-oxidant effects; pinene (alpha and beta) for promotion of alertness and memory retention and also acts as a bronchodilator (opens airways) and has anti-inflammatory properties; linalool for its calming and anti-anxiety effects, making it a potential sleep aid, and also exhibits pain-relieving and anti-inflammatory properties; caryophyllene (beta-caryophyllene) for anti-inflammatory and pain-relieving effects; humulene for anti-inflammatory properties and can function as an appetite suppressant; terpinolene for uplifting and energizing effects at low concentrations to mildly sedative at higher concentrations, and antioxidant properties. It should be understood that the aforementioned molecules and/or compounds may be used individually or in combination.

In some embodiments, the precursor includes volatile compounds selected specifically to impart a targeted physiological effect, for example the inclusion into the precursor liquid of β-caryophyllene, myrcene, α-pinene (sometimes simply called pinene), limonen, humulene, linalool, bisabolol, eucalyptol, borneol, geraniol, and nerolidol in order to optimize the anti-inflammatory effects of the precursor liquid, where such a precursor liquid formulation may include a mixture all of the aforementioned volatile compounds or a mixture of some of the aforementioned volatile compounds. Embodiments of the precursor liquid include volatile compounds selected specifically to impart a targeted physiological effect, such as can be described as anti-anxiety and/or stress relieving, including targeted receptor binding and/or receptor interaction of one or more of the volatile compounds by inclusion into the precursor liquid formulation, including but not limited to, linalool which interacts with the brain's GABA receptors to promote relaxation and calm the nervous system, myrcene, β-caryophyllene which binds directly to CB2 receptors, limonene, and α-pinene. It should be understood that these examples are intended to illustrate only some of the possible formulations, and that other formulations can be composed based on the compounds and combination of compounds described herein.

In some embodiments, the precursor liquids that contain nicotine, cannabinoids, or nicotine in combination with cannabinoids, the volatile compound or compounds may be utilized to reduce the boiling point of the precursor liquid and/or may also serve to function to impart neuroprotective benefits, where these neuroprotective effects are achieved through various mechanisms, including fighting oxidative stress, reducing inflammation, and inhibiting the clumping of proteins associated with neurodegenerative diseases. Volatile compounds that may be used in such a formulation include, but are not limited to: α-Pinene and β-Pinene, which protects against neurotoxicity from amyloid-beta proteins by inhibiting their aggregation; β-Caryophyllene that affects neuroprotective activity by acting as an antioxidant and anti-inflammatory properties; α-Bisabolol which protects against amyloid-beta toxicity and oxidative stress; limonene which has antioxidant and anti-inflammatory effects; 1,8-Cineole which protects against oxidative stress-induced cell death by scavenging reactive oxygen species (ROS) and inducing antioxidant enzymes; terpineol that inhibits inflammation by reducing the production of inflammatory cytokines like TNFα and IL-6; eugenol which has antioxidant properties and inhibits enzymes related to cognitive decline; and carvacrol that has antioxidant activity and is neuroprotective due to its anti-inflammatory and antioxidant properties. It should be understood that these examples are intended to illustrate only some of the possible formulations, and that other formulations can be composed based on the compounds and combination of compounds described herein.

In some embodiments, the precursor liquids that contain cannabinoids include non-volatile components of the precursor liquid that may be selected to replicate the aromatic and/or flavor attributes of tobacco and to formulate the precursor liquid with variety of flavinoids that are naturally present in tobacco that contribute to the aroma and flavor profile of cannabis. These include but are not limited to, compounds called cannaflavins (A, B, and C), quercetin, kaempferol, apigenin, and luteolin. These molecules and/or compounds may be synthesized or extracted from parts of the cannabis plant, and can be used in precursor liquid formulations to replicate the quality, aroma, and flavor of cannabis generally, or specifically to replicate the quality, aroma, and flavor of individual cannabis cultivars or blends of cannabis cultivars. In some embodiments of precursor formulations the flavonoids may also be selected based on desirable physiological effects such as antioxidant, anti-inflammatory, and other potential therapeutic properties.

It should be understood that in the formulation of precursor liquids that contain nicotine, cannabinoids, or nicotine in combination with cannabinoids may be formulated with volatile and non-violatile compounds, where the volatile compounds may include but are not limited to: terpenes, terpenoids, volatile sulfur compounds (VSCs) and various non-terpenoid compounds that may include, but are not limited to: esters, aldehydes, ketones. The non-volatile compounds may include, but not limited to: flavonoids, acids such as cannabinoid acids such as THCA and CBDA, other acids such as benzoic acid, levulinic acid, citric acid, malic acid, and tartaric acid, propylene glycol, vegetable glycerol, and water described herein. It should be understood that these molecules and/or compounds may be formulated and/or combined in various ways in order to formulate a precursor liquid and or precursor compound with the desired physical properties and the desired organoleptic profile, and desired physiological and/or psychological effect.

It may be desirable to use volatile molecules and/or compounds such as those described herein to facilitate the ease and/or speed of the filling of cartridges and/or reservoirs (such as any of those described herein) in order to reduce the viscosity of a precursor liquid and/or precursor compound to increase the flowability of the precursor liquid and/or precursor compound. The use of a volatile molecule and/or volatile compound that is already present as part of the formulation may be added to the precursor liquid formulation in an amount in excess of the target amount present in the formulation in order to decrease the viscosity and increase the flowability of the precursor liquid and/or precursor compound to facilitate the filling of a reservoir or cartridge, where then the excess volatile molecule and/or compound, after the reservoir or cartridge has been filled, may be allowed to volatilize and/or off gas into the air until the desired concentration of the volatile molecule and/or compound is reached in the reservoir or cartridge. Such a method may use a closed environment for the filling process such that the volatile molecule and/or compound that has been volatilized and/or off gassed into the closed environment may be captured and reused in subsequent formulations. This method and process may increase the flowability of a precursor liquid and/or precursor compound without the need to add additional constituents to the precursor formulation that are not already present within the intended formulation. This method and process also helps to make the precursor liquid or precursor compound, which may be thermoviscous, flowable without the addition of heat, thereby facilitating the filling of reservoir or cartridges at ambient or sub-ambient temperatures which may serve to reduce potential thermal or oxidative degradation of the precursor liquid and/or precursor compound that may otherwise occur if the precursor liquid or precursor compound had to be heated directly or indirectly during the reservoir or cartridge filling process.

Where the vaporizing device, and/or vaporizer, and/or vaporizer assembly (such as vaporizing device 100, 200, 300, 400, 500, 600, 700, 800, 1100, 1600, 3300, 3400, 3500, 3600, 3900, 4000, 4200, 4300, 4700, 4800, and/or any other vaporizing device described herein), and/or vaporizer (such as vaporizer 902, 1000 and any other vaporizer described herein) or vaporizer assembly (such as vaporizer assembly 2400, 2500, 2600, 2700, 2800, 2900, 3000, 3100, 3200, 3310 and/or any other vaporizer assembly described herein) works in conjunction with the controller (such as controller 480, 580, 780, 880, 3480, 3580, 3680, 3980, 4080, 4280, 4380, 4780, 4880 and/or any other controller and/or control assembly and/or control system described herein) the controller may include a screen and/or digital display, or a plurality of screens and/or displays. The screen and/or display may be located on an area of the control such that the information displayed on the screen is viewable by the user. The screen and or display may be configured to be a touch-sensitive screen and/or display. Types of screen technology and/or screen types and/or digital display types may include but is not limited to; LCD (Liquid Crystal Display) which uses liquid crystals to block or pass light from a backlight (often LED). Types of LCD that may be used include Twisted Nematic (TN), In-Plane Switching (IPS), and/or Vertical Alignment (VA). LED (Light-Emitting Diode) screen or display, including OLED (Organic Light-Emitting Diode), QLED (Quantum Dot LED), MicroLED which is similar to OLED (self-emissive) but uses inorganic LEDs. Mini-LED which uses thousands of tiny LEDs for backlighting LCDs, creating better local dimming and contrast than standard LED-backlit LCDs. AMOLED/Super AMOLED which are advanced OLEDs with faster response times and better touch sensitivity. QD-OLED which combines Quantum Dot (QD) technology with OLED for superior color and brightness. Non LED technology such as E-Paper and/or E-Ink reflective displays that mimic ink on paper, and have extremely low power may also be used. And transparent digital display and/or screen technologies may also be utilized. Selection of the type of screen and/or display technology may dependent on the need for touch capability and/or touch sensitivity, power consumption, size of screen or display, number of screens and/or displays, requirements for screen and/or display performance in relation to color, brightness, contrast, power consumption, integration into the controller, and cost may be used to determine the type of screen and/or display. The screen and/or digital display may be used in conjunction with LEDs individually or in plurality for the purpose of communicating and/or indicating information to the user.

In some embodiments a single screen and/or digital display is located on the controller (such as controller 480, 580, 780, 880, 3480, 3580, 3680, 3980, 4080, 4280, 4380, 4780, 4880 and/or any other controller and/or control assembly and/or control system described herein) and is used to display information to the user, such information may include, but is not limited to: battery or batteries charge level, battery or batteries charge status, battery or batteries charging indicator, battery or batteries fully charged indicator, battery or batteries health status, vaporizing device (such as vaporizing device 100, 200, 300, 400, 500, 600, 700, 800, 1100, 1600, 3300, 3400, 3500, 3600, 3900, 4000, 4200, 4300, 4700, 4800, and/or any other vaporizing device described herein), and/or vaporizer (such as vaporizer 902, 1000 and any other vaporizer described herein) or vaporizer assembly (such as vaporizer assembly 2400, 2500, 2600, 2700, 2800, 2900, 3000, 3100, 3200, 3310 and any other vaporizer assembly described herein) mode and/or state (e.g., being in an "Off" mode, "On" mode, "Standby" mode, "Ready" state, "Not Ready" state) and/or other indications that may relate to the indication of the mode and/or state of the vaporizing device. Information may be displayed on the screen and/or digital display that includes information about the precursor liquid, precursor compound, and/or precursor cartridge. Information displayed and/or indicated may include, but is not limited to, for example: the type of precursor liquid and/or formulation; details regarding the precursor formulation and/or compound such as, for example, flavor, strength, brand, ingredients, expiration date; installation date (for example the insertion date and/or installation date of the cartridge into the vaporizing device), number of inhalations and/or activation cycles remaining; number of inhalations and/or activation cycles taken (for example number of inhalations taken of a specific cartridge and/or reservoir and/or number of total inhalations and/or activation cycles taken over the life of the vaporizer device); information about the consumption of the precursor liquid and/or precursor compound such as, for example, milliliters/volume of precursor liquid consumed, which may be displayed on a volume per inhalation basis, and/or a total volume basis; information on the amount of active component or components (e.g., nicotine, cannabinoid, cannabinoids, pharmaceutical agent, and/or drug) that has been consumed (e.g., displayed in milligrams) which may be displayed, for example, on a mass per inhalation basis, and/or a total mass basis. Displayed information may also include the volume and/or mass of a precursor liquid and/or precursor compound that remains in a reservoir or cartridge, and/or the mass and/or volume of precursor liquid and/or compound that remains in a reservoir or cartridge. Displayed information may also include information about the status of a reservoir or cartridge including, but not limited to: the need to replace a reservoir and or cartridge that has been consumed; is expired; is not genuine; has been tampered with; and/or is malfunctioning.

In some embodiments, the digital display and/or screen may display instructions for the use of the vaporizer device. This may include general operation, insertion and removal of a reservoir or cartridge, the filling of a reservoir or cartridge, the charging of the vaporizer device, the cleaning and/or maintenance of the device, the proper storage of the device, instructions on adjusting the settings of the device such as adjusting different operating modes, turning the device on or off, locking and unlocking the device (which may, for example, include the use of a PIN code), password, or biometric signature, setting the vaporizer device into a sleep or standby mode, setting the vaporizer device into a travel mode, setting the device into an "airplane" mode to disable bluetooth and/or wifi and/or RFID, and/or GPS functions.

In some embodiments, the digital display and/or screen may display software status including software updating, software update status, software version, error messages, instructions and/or steps and/or procedures to rectify error messages, error messages that may include an error code, notification and/or messages that may be internally generated from the vaporizer device or externally generated from a device, server, computer, software program that may be either originated from the vaporizer device manufacturer, third party, or the user including notifications and/or messages originating from a an external device, such as a smart phone, tablet computer, computer, and/or wearable digital device. The screen and/or digital display may include a camera or cameras as part of the construction or coupled to a separate camera or cameras by the controller for the purpose of visual identification methods such as facial recognition for example which may be used as a biometric signature for unlocking the device or otherwise activating the device. The camera or cameras may function as a sensor, or in conjunction with other sensors, including but not limited to visible light sensors, motion sensors, proximity sensors, thermal sensors, RADAR, LIDAR, or other sensor types.

In some embodiments, the digital display and/or screen may display information that is combined with other modalities, for example auditory signals and/or haptic feedback, that may be used individually or in combination with the display to alert the user of the delivery of a metered dose, or partial delivery of a metered dose (if, for example, the activation cycle was prematurely ended). Such visual and/or auditory and/or haptic feedback (whether direct or indirect) may include: notifications that serve as a reminder and/or notification that a scheduled dose should be taken; a reminder and/or notification that a scheduled dose was missed; a reminder and/or notification that an additional dose (which may be a partial dose) needs to be taken (e.g., when a previous activation cycle did not effectively deliver the intended dose—as may be the case if the previous activation cycle was ended prematurely). In such an embodiment, the vaporizer device may use visual signals, auditory signals, and/or haptic signals to provide instruction and feedback to instruct and/or guide and/or ensure that the intended activation cycle and inhalation cycle has been undertaken, and the intended metered dose has been delivered to the user. In some embodiments, the dose is not a metered dose and for example may be a desired dose selected or indicated by the user. Or the dose may be a dose that is determined to be desirable over a dosage range.

In some embodiments, the digital display and/or screen may display information that is combined with other modalities, for example LED indicators, and/or auditory signals, and/or haptic feedback, that may be used individually or in combination with the digital display and/or screen in combination with a machine learning model for purposes including, but not limited to: learning and/or mapping the user inhalation topography; measuring and quantitating the users unique inhalation topography; establishing and/or validating the user inhalation topography (which may function as a unique biometric signature). The vaporization device digital display and/or screen in combination with a machine learning model may be used for the measurement, display, recording and/or storage of qualitative and quantitative metrics as experienced by the user when operating the device. For example, the user may provide inputs automatically including but not limited to: inputs related to the activation of the vaporizing device such as activation cycle duration, activation cycle flow rate, activation cycle flow velocity, volume of precursor liquid and/or precursor compound consumed per cycle and/or in aggregate, volume of aerosol and/or vapor generated per cycle and/or in aggregate, frequency of activation cycles, time of day of activation cycle occurrence, vaporizer device settings used in an activation cycle, adjustments to setting or vaporizing device configuration including time data related to such adjustments. The user may also provide information and/or input data to the machine learning model that may not be generated automatically where the digital display and/or screen may be used with other methods such as LED indicators, auditory signals such as sounds or verbal messages, and/or haptic signals to gather data from the user. This data may include, but is not limited to: the users perceived satisfaction and/or experience when operating the device; the users experience, enjoyment and/or satisfaction with the settings of the vaporizing device; activation cycle performance; the users experience, enjoyment and/or satisfaction with organoleptic attributes of the inhaled aerosol and/or vapor; the users perceived efficacy of the inhaled aerosol and/or vapor; the users desired usage case such as desired outcomes from the use of the device (which may include, for example, the users feedback on the performance of the vaporizer device to meet the desired outcomes of the user). User inputs may be entered on the digital display and/or touch screen by utilizing touchscreen functions of the digital display and/or screen, and/or by using separate buttons and/or switches and/or dials where the input is displayed on the digital display or screen, and/or by verbally communication with the vaporizer device. The user's verbal communications may be captured by a microphone and/or an acoustic sensor and the digital display and/or screen may display and/or acknowledge the verbal communication. Such communication may result from a query and/or question that could be an auditory signal such as verbal communication originating from the vaporizing device and/or visually displayed on the digital display and/or screen. In some embodiments, the machine learning model works in conjunction with the screen and/or digital display to communicate with the user for the purpose of gathering user inputs and/or data for the purpose optimizing the device performance for the needs of an individual user.

In some embodiments the vaporizing device (such as vaporizing device 100, 200, 300, 400, 500, 600, 700, 800, 1100, 1600, 3300, 3400, 3500, 3600, 3900, 4000, 4200, 4300, 4700, 4800 and/or any other vaporizing device described herein), and/or vaporizer (such as vaporizer 902, 1000 and any other vaporizer described herein) or vaporizer assembly (such as vaporizer assembly 2400, 2500, 2600, 2700, 2800, 2900, 3000, 3100, 3200, 3310 and any other vaporizer assembly described herein) individually or in combination is configured to function as a metered dose inhaler. Where the vaporizing device, and/or vaporizer, and/or vaporizer assembly works in conjunction with the controller (such as controller 480, 580, 780, 880, 3480, 3580, 3680, 3980, 4080, 4280, 4380, 4780, 4880 and any other controller and/or control assembly and/or control system described herein) to be activated in such a way that an activation cycle functions to deliver a metered dose of the aerosol and/or vapor generated from the precursor to the user. In an embodiment, the flow sensing assembly, such as any of the flow sensing assemblies and/or flow detection assemblies or flow detection systems and/or flow measuring assemblies or systems described herein detects the flow rate of the airflow through the system which corresponds to the flow rate of a formed aerosol and/or vapor out of the system and to the user. The detected and/or sensed and/or measured and/or calculated flow rate is communicated to the controller and/or control system, such as any of the controllers and/or control systems described herein, and the flow rate is used in conjunction with the activation cycle power delivery to meter and/or otherwise control the amount of aerosol and/or vapor that is generated over an activation cycle by modulating the power output to the heater and/or emitter and/or the time duration of the activation.

The measurement of the flow rate combined with the modulated power output to the heater and/or emitter and/or the control of the time duration of the activation cycle is used to deliver a metered dose of formed aerosol and/or vapor to the user. Such a metered dose can thus be effectively delivered even when the flow rate through the system is variable, as the power delivery to the heater and/or emitter and the time duration of activation can be variably adjusted based on the real-time flow rate to insure the desired and/or intended dosage of formed aerosol and/or vapor has been generated during the activation cycle. In such an embodiment, the device may provide direct feedback to the user such as a sound and/or noise (e.g., a beep or tone), a visual indicator (e.g., a light, and/or indication on a screen display), and/or a haptic signal. Such indicators may be used individually or in a combination of indicators to alert the user of the delivery of a metered dose or partial delivery of a metered dose (for example, if the activation cycle was prematurely ended). In such an embodiment, the device may provide indirect (e.g. to a device other than the vaporizer device) feedback to the user such as a sound that may include an audible message and/or noise (e.g., beep or tone), a visual indicator (e.g., a light, and/or indication that may include a written and or audible message on a screen display), and/or a haptic signal, to a smart device (e.g., a cellular phone, tablet computer, computer, or wearable digital device such as a smart watch or smart glasses). Feedback modalities may be used individually or in combination to alert the user of the delivery of a metered dose, or partial delivery of a metered dose (if, for example, the activation cycle was prematurely ended). Such feedback, whether direct or indirect, may include notifications that serve as a reminder and/or notification that a scheduled dose should be taken, a reminder and/or notification that a scheduled dose was missed, and/or a reminder and/or notification that an additional dose (which may be a partial dose), needs to be taken. If the previous activation cycle did not effectively deliver the intended dose (as may be the case if the previous activation cycle was ended prematurely), a reminder and/or notification that an additional dose (which also may be a partial dose), needs to be taken may be communicated.

In some embodiments, the device may provide notifications that originate from an external device, such as a smart phone, tablet computer, computer, and/or wearable digital device. Such reminders may be preset reminders based on a desired dosing schedule and/or reminders based on physiological parameters that may be measured by a digital device (e.g., a wearable digital device) that measures and/or monitors and/or records physiological metrics including, but not limited to: heart rate, breathing rate, oxygen saturation, sleep status, sleep duration, and/or sleep quality. Indication signals may be used to signal to the user that an inhalation cycle should begin. Another indication signal may indicate when the inhalation cycle should end. In some embodiments, the device may internally end the activation cycle (e.g., end generation of the vapor and/or aerosol) prior to the notification to the user that the user's inhalation should end. This may be in order to ensure that the metered dose of aerosol and/or vapor is fully inhaled before the user is signaled or otherwise notified to cease inhaling. It should be understood that the methods described, including the methods for communicating information to the user are intended to serve as examples and other methods and means of communication may be used and may be used in combination or sequence with the methods and/or processes described herein.

In some embodiments, the vaporizing device (e.g., any of the vaporization devices, vaporizers, and/or vaporizer assemblies described herein) having a controller, control assembly and/or control system described herein is calibrated such that the flow rate through the system correlates to an amount of generated aerosol and/vapor generated. Calibration methods that may be used include but are not limited to: total particulate matter testing, impaction testing, laser diffraction testing, pharmacokinetic testing, various types of "puff" testing used for quantifying e-cigarettes, and other testing methods. This testing may include, for example, testing methods that activate the vaporization device to form an aerosol and/or vapor using a pump and/or other method of generating a flow through the vaporization device and capturing the aerosol and/or vapor in a matrix, such as a cambridge pad, for further analysis. This testing may also include, for example, inhalation and/or "puff" topography analysis of how a person or persons uses the device (e.g., inhalation/puff duration, inhalation/puff volume, flow rate, and number of inhalations/puffs).

Several methods may be used for inhalation and/or "puff" topography analysis including, but not limited to, specialized electronic devices that can be attached to the vaporizing device (or vaporizers, and/or vaporizer assemblies) to measure and record inhalation/puffing behavior. Video analysis can be utilized to analyze video recordings of users inhaling from vaporizing devices (or vaporizers, and/or vaporizer assemblies) to measure inhalations/puff durations and other characteristics. Another method is particle size distribution analysis to determine the range and concentration of particles in the aerosol using methods and/or techniques such as optical transmission and laser scattering which can be used to analyze the size of aerosol particles. Mobility analysis may include electrical mobility and scanning mobility analyzers to measure particle size in real-time. It should be understood that the methods described herein for the calibration of the vaporizing devices (or vaporizers, and/or vaporizer assemblies) and/or analysis of the aerosol are intended to serve as examples of methods, processes, and/or techniques that may be used and that these methods, processes, and/or techniques may be used in combination, including in sequence, and that other methods and processes may be utilized.

Methods and processes for generating quantitative data for the purpose of calibrating and/or optimizing the vaporizer device (or vaporizers, and/or vaporizer assemblies) include but are not limited to using cascade impactors to collect and size particles based on their aerodynamic properties. Methods for the evaluation of the chemical composition of the aerosol and/or vapor including the types and amounts of chemicals present in the vapor (e.g., nicotine and other constituents) may include aerosol collection systems that are used to collect and condense the aerosol and/or vapor and then creating a liquid sample for chemical analysis, where the collected samples are then analyzed using various techniques (such as the techniques described herein) to determine their chemical makeup. In vivo measurements may also be used where biomarkers (e.g., plasma nicotine and/or plasma cotinine concentrations) can be measured in users over time.

Vaporizing devices (or vaporizers, and/or vaporizer assemblies) usage frequency can also be measured by evaluating how often and how much the vaporizing devices (or vaporizers, and/or vaporizer assemblies) is used and may be measured using methods including, but not limited to: embedded inhalation/puff counters where the vaporizing devices (or vaporizers, and/or vaporizer assemblies) has a built-in counter that automatically record the number of inhalations/puffs taken as well as additional data (e.g., inhalations/puff duration, inhalations/puff frequency, duration of time between inhalations/puffs, and/or other related metrics). Self-reporting may be utilized where users can be asked to log their usage in a diary and/or answer questions about how many times they use the device per day. Cartridge/precursor liquid consumption can be analyzed where an amount of precursor liquid and/or precursor compound used per day (e.g., number of cartridges, milliliters/volume of precursor liquid and/or precursor compound) can also be used as a measure. It should be understood that the methods described herein for the analysis of the aerosol and/or vapor and calibration of the vaporizing devices (or vaporizers, and/or vaporizer assemblies) are intended to serve as examples of methods, processes, and/or techniques that may be used and that these methods, processes, and/or techniques may be used in combination including in sequence and that other methods and processes may be utilized.

The various sensors on the vaporizer device (or vaporizers, and/or vaporizer assemblies) and/or controller (such as any of the controllers, control systems, control assemblies, and/or control systems described herein) that have been described herein may be utilized to gather and measure data such as environmental data, flow rate data, flow volume data, user inhalation/puff topography data, time of activation that may include day of week, month of year, geographical data, number of inhalations/puffs taken, inhalations/puff duration, inhalations/puff frequency, duration of time between inhalations/puffs, and data related to the formulation of the precursor being used. The vaporizing devices (or vaporizers, and/or vaporizer assemblies) may also be configured to accept, assimilate, and aggregate user input data directly to the device or indirectly through an external device, such as a smart phone, tablet computer, computer, and/or wearable digital device. It should be understood that the methods described herein for the analysis of the aerosol and/or vapor and calibration of the vaporizing devices (or vaporizers, and/or vaporizer assemblies) are intended to serve as examples of methods, processes, and/or techniques that may be used and that these methods, processes, and/or techniques may be used in combination, including in sequence, and that other methods and processes may be utilized.

Calibration methods may also include analytical testing and/or analysis including but not limited to: measuring of the mass of the aerosol and/or vapor; analysis of the components of the aerosol/and or vapor using various techniques, such as chromatography methods like gas chromatography (GC) and liquid chromatography (LC) coupled with detectors such as mass spectrometry (MS). Other methods include, but are not limited to: high-resolution, accurate-mass MS, spectroscopic techniques like NMR, and elemental analysis methods like ICP-MS for analyzing metals. Specific methods like thermal desorption (TD) can be paired with GC-MS for analyzing volatile and semi-volatile compounds. GC-FID uses a Flame Ionization Detector (FID) for analyzing major components like propylene glycol and glycerol. LC-MS/MS may be used for detecting and quantifying specific compounds (for example nitrosamines). High-performance liquid chromatography (HPLC) may be used in combination and/or sequentially with various detectors like diode-array detection (DAD) or mass spectrometry. Nuclear Magnetic Resonance (NMR) spectroscopy may be used to identify and quantify a range of constituents, including nicotine and flavor compounds. Inductively Coupled Plasma Mass Spectrometry (ICP-MS) may be specifically used to analyze the presence and concentration of heavy metals in the vapor. Thermal Desorption (TD) may be coupled with GC-MS and used to analyze volatile and semi-volatile organic compounds (VOCs and SVOCs) by first trapping them, and then desorbing them for analysis. It should be understood that the methods described herein for the analysis of the aerosol and/or vapor and calibration of the vaporizing devices (or vaporizers, and/or vaporizer assemblies) are intended to serve as examples of methods, processes, and/or techniques that may be used and that these methods, processes, and/or techniques may be used in combination, including in sequence, and that other methods and processes may be utilized.

In an embodiment, the vaporizer device (such as any of the vaporizer devices, vaporizers, or vaporizers assemblies described herein) and/or the controller (such as any of the controllers, control systems, control assemblies, and/or control systems described herein) may be calibrated using methods described herein such that the formed aerosol and/or vapor generated under an activation cycle can be delivered to the user in a metered dose. In an embodiment, the vaporizer device (such as any of the vaporizer devices, vaporizers, or vaporizers assemblies described herein) and/or the controller (such as any of the controllers, control systems, control assemblies, and/or control systems described herein) may be calibrated using methods described herein such that the formed aerosol and/or vapor generated under an activation cycle can be delivered to the user in a metered dose when the flow rate through the device is unique to the inhalation and/or puff topography of a specific user. In an embodiment, the vaporizer device (such as any of the vaporizer devices, vaporizers, or vaporizers assemblies described herein) and/or the controller (such as any of the controllers, control systems, control assemblies, and/or control systems described herein) may be calibrated using methods described herein such that the formed aerosol and/or vapor generated under an activation cycle can be delivered to the user in a metered dose when the flow rate through the device is unique to the inhalation and/or puff topography of a specific user and where the activation cycle is terminated when the metered dose is reached. In an embodiment the vaporizer device (such as any of the vaporizer devices, vaporizers, or vaporizers assemblies described herein) and/or the controller (such as any of the controllers, control systems, control assemblies, and/or control systems described herein) may be calibrated using methods described herein such that the formed aerosol and/or vapor generated under an activation cycle can be delivered to the user in a metered dose, where one or more activation cycles may deliver the intended dosage (e.g., a single inhalation may deliver a metered dose during a single activation cycle, and/or more than one activation cycles and associated inhalations and/or puffs may be required to deliver the metered dose). It should be understood that the description of embodiments delivering a metered dose of aerosol and/or vapor are examples and may be combined with other examples and/or embodiments described herein. It should be understood that the metered dose of an aerosol and or/vapor may be determined by the dose of active molecules and/or compounds present in the metered dose of aerosol and/or vapor, where the active molecules and/or compounds present in the aerosol and/or vapor may be for example nicotine and/or a nicotine salt, and/or a cannabinoid or cannabinoids, and/or terpenes and/or terpene derivatives.

In an embodiment, the vaporizer device (such as any of the vaporizer devices, vaporizers, or vaporizers assemblies described herein) and/or the controller (such as any of the controllers, control systems, control assemblies, and/or control systems described herein) may be calibrated using methods described herein such that the formed aerosol and/or vapor generated under an activation cycle can be delivered to the user in a metered dose and the device is in a ready state and may be activated when a metered dose is due to be administered to the user. Conversely the device may be rendered inactive during periods of time when no metered dose should be administered. For example, when a metered dose may be indicated to be administered twice a day, in the morning and in the evening, the device may be in a ready state in the morning and once the dose is delivered the device is rendered inactive until the evening. In the evening, the device may be once again placed in a ready state and be ready to be activated to administer the evening dose. Once the evening dose is administered, the device is again placed in an inactive state and cannot be activated until the next dose is due for administration (in this example, the following morning). It should be understood that in such an embodiment there may be an indicated dosage schedule ranging from one per day to a plurality of times per day. It should also be understood that the description of embodiments delivering a metered dose of aerosol and/or vapor are examples and may be combined with other examples and/or embodiments described herein. It should be understood that the metered dose of an aerosol and or/vapor may be determined by the dose of active molecules and/or compounds present in the metered dose of aerosol and/or vapor, where the active molecules and/or compounds present in the aerosol and/or vapor may be for example nicotine and/or a nicotine salt, and/or a cannabinoid or cannabinoids, and/or terpenes and/or terpene derivatives.

In an embodiment, the vaporizer device (such as any of the vaporizer devices, vaporizers, or vaporizers assemblies described herein) and/or the controller (such as any of the controllers, control systems, control assemblies, and/or control systems described herein) may be calibrated using methods described herein such that the formed aerosol and/or vapor generated under an activation cycle can be delivered to the user in a metered dose when the flow rate through the device reaches a predetermined flow rate. For example, the aerosol and/or vapor generation may not be initiated until a predetermined flow rate is reached and remains active and generating aerosol and/or vapor until the metered dose is reached as long as a sufficient flow rate through the device is being detected. If sufficient flow is not detected, then the activation cycle is ceased, and the activation cycle will only resume under the conditions of sufficient flow. In such an embodiment, the flow rate through the device may be determined to be sufficient for activation of the cycle to generate an aerosol and/or vapor if the flow rate is sufficient to deliver the aerosol and/or vapor to the deep lung. In another embodiment, the flow rate may be determined to be sufficient to initiate the activation cycle for the purpose of generating the metered dose of an aerosol and/or vapor if the flow rate is sufficient to deliver the aerosol and/or vapor to the upper airway (e.g., the oral cavity, oropharyngeal cavity, trachea, bronchus etc.). It should be understood that the description of embodiments delivering a metered dose of aerosol and/or vapor are examples and may be combined with other examples and/or embodiments described herein.

In an embodiment, the vaporizer device (such as any of the vaporizer devices, vaporizers, or vaporizers assemblies described herein) and/or the controller (such as any of the controllers, control systems, control assemblies, and/or control systems described herein) may be calibrated using methods described herein such that the formed aerosol and/or vapor generated under an activation cycle can be delivered to the user in a metered dose when the flow rate through the device is used in combination with the correlated calibrated activation cycle and/or cycles. It should be understood that the description of embodiments delivering a metered dose of aerosol and/or vapor are examples and may be combined with other examples and/or embodiments described herein. It should be understood that the metered dose of an aerosol and or/vapor may be determined by the dose of active molecules and/or compounds present in the metered dose of aerosol and/or vapor, where the active molecules and/or compounds present in the aerosol and/or vapor may be for example nicotine and/or a nicotine salt, and/or a cannabinoid or cannabinoids, and/or terpenes and/or terpene derivatives.

In an embodiment, the vaporizer device (such as any of the vaporizer devices, vaporizers, or vaporizers assemblies described herein) and/or the controller (such as any of the controllers, control systems, control assemblies, and/or control systems described herein) may be calibrated using methods described herein such that the formed aerosol and/or vapor generated under an activation cycle can be delivered to the user in a metered dose when the flow rate through the device is constant or variable (i.e., regardless of whether the flow rate is constant or variable) and the calibrated controller can determine the amount of the dose delivered in real time. In an embodiment, the vaporizer device (such as any of the vaporizer devices, vaporizers, or vaporizers assemblies described herein) and/or the controller (such as any of the controllers, control systems, control assemblies, and/or control systems described herein) may be calibrated using methods described herein such that the formed aerosol and/or vapor generated under an activation cycle can be delivered to the user in a metered dose using the data generated at a frequency of several hundred times per second from the flow rate and the activation of the heater and/or emitter to determine the amount of aerosol and/or vapor being generated and delivered to the user. In an embodiment, the vaporizer device (such as any of the vaporizer devices, vaporizers, or vaporizers assemblies described herein) and/or the controller (such as any of the controllers, control systems, control assemblies, and/or control systems described herein) may be calibrated using methods described herein such that the formed aerosol and/or vapor generated under an activation cycle can be delivered to the user in a metered dose using the data generated at a frequency of several thousand times per second from the flow rate and the activation of the heater and/or emitter to determine the amount of aerosol and/or vapor being generated and delivered to the user. In an embodiment, the vaporizer device (such as any of the vaporizer devices, vaporizers, or vaporizers assemblies described herein) and/or the controller (such as any of the controllers, control systems, control assemblies, and/or control systems described herein) may be calibrated using methods described herein such that the formed aerosol and/or vapor generated under an activation cycle can be delivered to the user in a metered dose using the data generated at a frequency of equal to or greater than ten thousand times per second from the flow rate and the activation of the heater and/or emitter to determine the amount of aerosol and/or vapor being generated and delivered to the user. It should be understood that the description of embodiments delivering a metered dose of aerosol and/or vapor are examples and may be combined with other examples and/or embodiments described herein. It should be understood that the metered dose of an aerosol and or/vapor may be determined by the dose of active molecules and/or compounds present in the metered dose of aerosol and/or vapor, where the active molecules and/or compounds present in the aerosol and/or vapor may be for example nicotine and/or a nicotine salt, and/or a cannabinoid or cannabinoids, and/or terpenes and/or terpene derivatives.

In some embodiments, data relating to and generated from an activation cycle, including but not limited to high frequency sampling of flow data, environmental data, duration of activation data, power delivery data, time of day, day of week, number of activation cycles, inter-activation cycle duration, formulation data, user specific inhalation topography data, aggregate inhalation topography data, biometric data, and external data such as inputs from a user may be utilized by a machine learning model in combination with a controller (such as any of the controllers, control systems, control assemblies, and/or control systems described herein) to optimize the activation cycle on a real time or ongoing basis. Machine learning model based optimization for the activation of the vaporizer device (such as any of the vaporizer devices, vaporizers, or vaporizers assemblies described herein) may be used to increase quantitative metrics including, but not limited to, the accuracy of the metered dose, the effectiveness of the metered dose reaching the intended target tissue (such as the deep lung), predictive activation power delivery configuration based on inhalation topography for improved activation cycle efficiency, and qualitative metrics such as ease of use of the vaporizer device, and perceived efficacy of the inhalation by the user. It should be understood that the description is intended as an example and additional types and sources of data, and additional methods and processes such as those described herein may be utilized.

In an embodiment, the vaporizer device (such as any of the vaporizer devices, vaporizers, or vaporizers assemblies described herein) and/or the controller (such as any of the controllers, control systems, control assemblies, and/or control systems described herein) may be calibrated using methods described herein such that the formed aerosol and/or vapor generated under an activation cycle can be delivered to the user in a metered dose using the data generated from the flow rate and the activation of the heater and/or emitter to determine the amount of aerosol and/or vapor being generated and delivered to the user at a frequency determined to be sufficient to achieve a sufficient metered dose to the user, where the metered dose may be determined to be sufficient over a range of acceptable values. For example, the metered dose may be 200 mg and be determined to be sufficient if the dose delivered is within a range of 180-220 mg (e.g. +/1 10% of the intended dosage). It should be understood that the description of embodiments delivering a metered dose of aerosol and/or vapor are examples and may be combined with other examples and/or embodiments described herein. It should be understood that the metered dose of an aerosol and or/vapor may be determined by the dose of active molecules and/or compounds present in the metered dose of aerosol and/or vapor, where the active molecules and/or compounds present in the aerosol and/or vapor may be a prescription or over the count drug and/or pharmaceutical agent and/or compound.

In an embodiment, the vaporizer device (such as any of the vaporizer devices, vaporizers, or vaporizers assemblies described herein) and/or the controller (such as any of the controllers, control systems, control assemblies, and/or control systems described herein) may be calibrated using methods described herein such that the formed aerosol and/or vapor generated under an activation cycle can be delivered to the user in a metered dose using the data generated from the flow rate and the activation of the heater and/or emitter to determine the amount of aerosol and/or vapor being generated and delivered to the user where the metered dose has been prescribed by a healthcare provider and the active component in the aerosol and/or vapor is a pharmaceutical compound and/or drug having a target tissue for delivery of the active component in the human airway. In an embodiment, the vaporizer device (such as any of the vaporizer devices, vaporizers, or vaporizers assemblies described herein) and/or the controller (such as any of the controllers, control systems, control assemblies, and/or control systems described herein) may be calibrated using methods described herein such that the formed aerosol and/or vapor generated under an activation cycle can be delivered to the user in a metered dose using the data generated from the flow rate and the activation of the heater and/or emitter to determine the amount of aerosol and/or vapor being generated and delivered to the user where the metered dose has be prescribed by a healthcare provider and the active component in the aerosol and/or vapor is a pharmaceutical compound and/or drug having a target tissue for delivery of the active component or components in the human airway (e.g., inhaled prescription drugs that are primarily used to treat respiratory conditions including but not limited to asthma and Chronic Obstructive Pulmonary Disease (COPD)), where the inhaled prescription drugs work by delivering medication directly to the lungs (thereby, for example, reducing systemic side effects and improving symptom control).

The inhaled prescription drugs that may be delivered by the vaporizer device (such as any of the vaporizer devices, vaporizers, or vaporizers assemblies described herein) may fall into several main categories, including, but not limited to, for example bronchodilators, which are drugs that function to relax the muscles around the airways in order to open (also called bronchodilation) the bronchial tubes and make breathing easier. Example bronchodilating drugs include, but are not limited to: short-acting beta2-agonists (SABAs) which have a rapid onset of action and are often used to provide acute relief from sudden onset symptoms; albuterol (e.g., brand names include Ventolin, ProAir, etc.) which are long-acting beta2-agonists (LABAs) and used to provide long-lasting airway relaxation; salmeterol (one of the active components of the brand name prescription drug Advair); formoterol; and arformoterol. Another category of inhaled prescription drugs are, for example, anticholinergics (muscarinic antagonists) which also function primarily as bronchodilators. Examples of anticholinergics include, but are not limited to: ipratropium bromide (example brand name Atrovent), tiotropium bromide (example brand name Spiriva), aclidinium, and umeclidinium bromide. Another example category of inhaled prescription drugs are corticosteroids, which function to reduce inflammation in the inner lining of the airway (for example, to help to prevent asthma attacks and improve lung function). They are typically for maintenance treatment and include, but are not limited to: budesonide (example brand names include Pulmicort Respules, and Pulmicort Flexhaler), fluticasone (example brand names include Flovent, and Arnuity Ellipta), beclomethasone (example brand name Qvar RediHaler), mometasone (example brand names include Asmanex Twisthaler, and Asmanex HFA), and ciclesonide (example brand name Alvesco).

Inhaled prescription drugs may also be utilized in combination and multiple inhaled formulations that combine a corticosteroid and a bronchodilator. Examples of such combined formulations include, but are not limited to: fluticasone/salmeterol (example brand name Advair), budesonide/formoterol (example brand name Symbicort), and fluticasone furoate/vilanterol (example brand name Breo Ellipta). Other inhaled drugs and/or pharmaceutical agents include, but are not limited to: antibiotics inhaled for specific lung infections and/or chronic diseases and/or conditions (e.g., cystic fibrosis) such as inhaled solutions of tobramycin, aztreonam, and colistin. Some inhaled agents may not be classified directly as a pharmaceutical but may be inhaled for therapeutic benefit. These include, but are not limited to hypertonic saline which is inhaled to help break up mucus. There are also pharmaceutical agents and/or drugs that may be inhaled for analgesia and the purpose of treating acute or chronic pain. Examples include, but are not limited to: fentanyl which is a strong opioid used for pain management, methoxyflurane (Penthrox) which is a prescription volatile anesthetic used for acute trauma pain (for example bone fractures), morphine which can be inhaled to treat dyspnea (shortness of breath—which often accompanies pain in chronic lung diseases), and indomethacin which is an inhaled non-steroidal anti-inflammatory drug (NSAID) used for reducing sputum and potentially easing breathlessness in chronic lung conditions like COPD (not always directly used specifically for pain relief). It should be understood that the description of inhaled pharmaceutical agents are intended to be examples and other pharmaceutical agents and combinations of agents including combinations of pharmaceutical agents and non-pharmaceutical agents may be used in inhalation formulations.

In addition to prescription drugs described herein there are also therapeutic agents and specific biologics that can also be administered via inhalation such as protein-based biologics that are available as inhaled treatments. There are biological agents currently available for inhalation and ongoing research is actively being conducted on new inhaled biologic therapies. Examples of currently available inhaled biologic/protein agents include, but are not limited to: non-monoclonal antibody biologics or related protein-based drugs that are administered by inhalation such as dornase alfa (example brand name Pulmozyme®) which is a recombinant human DNase enzyme approved for managing cystic fibrosis (CF); insulin (example brand name Afrezza®) which is an inhaled form of insulin used for managing blood sugar levels in adults with diabetes; mannitol (example brand name Bronchitol®) which is a formulation used in the treatment of CF to improve lung function and reduce exacerbations; zanamivir (example brand name Relenza®) which is an antiviral agent (a neuraminidase inhibitor protein) delivered via inhalation to treat influenza infections. There are also a number of biologics in clinical development for inhalation including, but not limited to: inhaled formulations of monoclonal antibodies (mAbs) such as eclerali-mab (formerly CSJ117) which is an inhaled anti-TSLP (thymic stromal lymphopoietin) antibody fragment currently in clinical trials for asthma; ALX-0171 which is a nanobody targeting the RSV (respiratory syncytial virus) fusion protein, studied as an inhaled treatment in clinical trials. Itepekimab and tozorakimab which are anti-IL-33 antibodies are currently being investigated, with potential for future inhaled applications in asthma and COPD. It should be understood that the description of inhaled pharmaceutical and/or biological agents are intended to be examples and other biological and/or protein based agents and combinations of biological and/or protein agents including combinations of biological and/or protein based agents in combination with pharmaceutical agents and/or non-pharmaceutical agents may be used in inhalation formulations.

In an embodiment, the sensed air flow is correlated to a flow volume and/or flow rate through the vaporizer device (such as any of the vaporizer devices, vaporizers, or vaporizers assemblies described herein) by the controller (such as any of the controllers, control systems, control assemblies, and/or control systems described herein) and flow volume and/or flow rate may be used to deliver a metered dose of an aerosol and/or vapor containing at least one active agent and/or molecule and/or compound such that the controller (such as any of the controllers, control systems, control assemblies, and/or control systems described herein) may prevent the activation of the device once the intended metered dose has been delivered and/or administered and such that the device is configured to only deliver the intended dose and cannot be activated to deliver more than the intended dose. Such an embodiment may be used to prevent the over dosing of certain active agents and/or molecules and/or compounds.

In an embodiment the sensed air flow is correlated to a flow volume and/or flow rate through the vaporizer device (such as any of the vaporizer devices, vaporizers, or vaporizers assemblies described herein) by the controller (such as any of the controllers, control systems, control assemblies, and/or control systems described herein) and flow volume and/or flow rate may be used to deliver a metered dose of an aerosol and/or vapor containing at least one active agent and/or molecule and/or compound the vaporizer device integrates environmental data for the purpose of optimizing the metered dose inhalation cycle including, but not limited to, for example: ambient temperature, ambient pressure, ambient humidity, and temperature of intake airflow, temporal data such time of day, and day of week. Such data may be used in conjunction with user specific data such as inhalation topography profiles including, but not limited to, factoring in user inhalation topography under specific use case, such as the use case relates to environmental conditions such as those described herein and/or temporal factors such as time of day or day of week. The vaporizer device may optimize the activation cycle based on such data from the individual or from aggregate user data, or both individual and aggregate user data. Such data may be used with a machine learning model to predictively optimize the activation cycle. For example, used to select an activation cycle with parameters optimized for a specific user's inhalation topography at a specific time of day and day of week and under specific environmental conditions in order to effect an optimal activation cycle for the metered dose delivery of an aerosol and/or vapor. The optimized activation cycle may be further refined using data relevant to the specific active compound or compounds, active agent or agents, and/or active molecule or molecules and specific formulation of precursor liquid being used. Such data may be general data such as quantitative data or specific data such as user specific behavior including but not limited to the users inhalation topography of a specific formulation. It should be understood that the description of the embodiment provided herein should serve as an example and additional data as well as additional methods and processes for the control and activation of the vaporizing device may be utilized, such as the data, methods, process described herein.

In an embodiment, the precursor liquid formulation comprises free base nicotine at 1-5% weight-to-weight (w/w) or volume-to-volume (v/v) and a terpenoid or terpinoid mixture is present at 1-7% w/w or v/v, and a volatile molecule or mix of molecules is present at 5-30% w/w or v/v, non-volatile flavonoids are present at 1-30% w/w or v/v, water is present at 0-3% w/w or v/v, and PG or VG or a mixture of PG and VG is used for the remainder of the formulation.

In an embodiment, the precursor liquid formulation comprises free base nicotine at 1-5% weight-to-weight (w/w) or volume-to-volume (v/v) and a terpenoid or terpinoid mixture is present at 1-7% w/w or v/v, and a volatile molecule or mix of molecules is present at 5-30% w/w or v/v, non-volatile flavonoids are present at 1-30% w/w or v/v, water is present at 3-30% w/w or v/v, and PG or VG or a mixture of PG and VG is used for the remainder of the formulation.

In an embodiment, the precursor liquid formulation comprises free base nicotine at 1-5% weight-to-weight (w/w) or volume-to-volume (v/v) and a terpenoid or terpinoid mixture is present at 10-30% w/w or v/v, and a volatile molecule or mix of molecules is present at 5-30% w/w or v/v, non-volatile flavonoids are present at 1-30% w/w or v/v, water is present at 3-30% w/w or v/v, and PG or VG or a mixture of PG and VG is used for the remainder of the formulation.

In an embodiment, the precursor liquid formulation comprises a cannabinoid acid or cannabinoid acids at 50-95%, free base nicotine at 1-5% weight-to-weight (w/w) or volume-to-volume (v/v) and a terpenoid or terpenoid mixture is present at 1-7% w/w or v/v, and a volatile molecule or mix of molecules is present at 5-30% w/w or v/v, and non-volatile flavonoids are present at 1-30% w/w or v/v.

In an embodiment, the precursor liquid formulation comprises a THCA at 50-95%, free base nicotine at 1-5% weight-to-weight (w/w) or volume-to-volume (v/v) and a terpenoid or terpenoid mixture is present at 1-7% w/w or v/v, and a volatile molecule or mix of molecules is present at 5-30% w/w or v/v, and non-volatile flavonoids are present at 1-30% w/w or v/v.

In an embodiment, the precursor liquid formulation comprises a CBDA at 50-95%, free base nicotine at 1-5% weight-to-weight (w/w) or volume-to-volume (v/v) and a terpenoid or terpenoid mixture is present at 1-7% w/w or v/v, and a volatile molecule or mix of molecules is present at 5-30% w/w or v/v, and non-volatile flavonoids are present at 1-30% w/w or v/v.

Volatile molecules and/or compounds that may be used in a precursor liquid formulation may also include molecules and/or compounds that can be described as monoterpene alcohols. These include, but are not limited to, for example: linalool, geraniol, borneol, citronellol, α-terpineol, and terpinen-4-ol. These monoterpene alcohols can be acyclic, monocyclic, or bicyclic. Examples of acyclic monoterpene alcohols include, but are not limited to: linalool, geraniol, β-citronellol, nerol, and perillyl alcohol. Examples of monocyclic monoterpene alcohols include, but are not limited to: 5-methyl-2-(propan-2-yl)cyclohexan-1-ol (also called 2-isopropyl-5-methylcyclohexanol, hexahydrothymol, 5-methyl-2-(propan-2-yl)cyclohexan-1-ol, 2-isopropyl-5-methylcyclohexanol, hexahydrothymol, 3-p-Menthanol), α-terpineol, terpinen-4-ol, and/or thymol (technically a phenol, but closely related). Examples of bicyclic monoterpene alcohol include but are not limited to borneol, and sobrerol. It should be understood that the types of molecules and/or compounds described herein are intended to serve as examples and other types of related molecules and/or compounds and/or combinations of related molecules and/or compounds may be utilized in isolation or combination for the purpose of the formation and/or formulation of precursor liquids and/or precursor compounds.

Volatile molecules and/or compounds that may be used in a precursor liquid formulation may also include molecules and/or compounds that can be described as diterpene alcohols. Diterpene alcohols include, but are not limited to: dictyol A, dictyol B, dictyol C, pachydictyol A, isopachydiol A, sclareol, 16α-hydroxy-ent-kaurane, kaurenoic acid and acanthoic acid (considered diterpenes, although some might also be described as carboxylic acids, but their structure can include alcohol functional groups), and alcohol-containing diterpene alkaloids such as peregrine alcohol. Additionally, there are sesquiterpene alcohols (for example, farnesol, nerolidol, and bisabolol). Triterpene alcohols may also be used as a volatile component in a precursor liquid formulation. These include, but are not limited to heliaol, taraxasterol, Psi-taraxasterol, α-amyrin (alpha-amyrin), β-amyrin (beta-amyrin), lupeol, taraxerol, cycloartenol, 24-methylenecycloartanol, tiruccalla-7,24-dienol, and dammaradienol. It should be understood that the types of molecules and/or compounds described herein are intended to serve as examples and other types of related molecules and/or compounds and/or combinations of related molecules and/or compounds may be utilized in isolation or combination for the purpose of the formation and/or formulation of precursor liquids and/or precursor compounds.

Volatile molecules and/or compounds that may be used in a precursor liquid formulation may also include molecules and/or compounds that can be described as terpene esters. These are formed by combining terpenes with a carboxylic acid group. This reaction can be done commercially where terpene esters are produced through an esterification reaction, where an alcohol (the terpene) reacts with a carboxylic acid. This reaction adds an ester group to the terpene molecule. Terpene esters can also be derived and/or isolated from natural sources such as various plants, fruits, and flowers. Terpene esters include, but are not limited to linalyl acetate, geranyl acetate, pinyl acetate, bornyl acetate, and methyl jasmonate. It should be understood that the types of molecules and/or compounds described herein are intended to serve as examples and other types of related molecules and/or compounds and/or combinations of related molecules and/or compounds may be utilized in isolation or combination for the purpose of the formation and/or formulation of precursor liquids and/or precursor compounds.

Volatile molecules and/or compounds that may be used in a precursor liquid formulation may also include molecules and/or compounds that can be described as terpene ketones (or ketonic terpenoids). These include, but are not limited to, for example: camphor, carvone (a monoterpene ketone that occurs in two forms (enantiomers)—the R-form and the S-form), fenchone, menthone, piperitone, pulegone, umbellulone, and verbenone. Additionally, if the ketonic terpenoid contains an acid functional group it can be described as an acidic ketonic terpene and are also are generally referred to by the chemical structure names that reflect both functional groups (ketone and carboxylic acid), most commonly as keto acids or oxoterpenoids. Examples of a keto acid and/or oxoterpenoid include, but are not limited to: camphoric acid which is an oxidation product derived from the bicyclic monoterpene camphor; boswellic acids which are comprised of a series of pentacyclic triterpenoid molecules with a carboxylic acid group; and moronic acid which is a structure comprised of a triterpenoid ketone and an acid. It should be understood that the types of molecules and/or compounds described herein are intended to serve as examples and other types of related molecules and/or compounds and/or combinations of related molecules and/or compounds may be utilized in isolation or combination for the purpose of the formation and/or formulation of precursor liquids and/or precursor compounds.

Volatile molecules and/or compounds that may be used in a precursor liquid formulation may also include molecules and/or compounds that can be described as terpene ethers and are a class of terpenoids (oxygen-containing terpenes) that contain an ether functional group. These include, but are not limited to, for example: 1,8-Cineole (also called eucalyptol) which is a bicyclic monoterpene ether; linalool oxide which is a monoterpene ether derived from the oxidation of the terpene alcohol linalool, (it may exist in furanoid and pyranoid forms); caryophyllene oxide which is a sesquiterpene ether (unique among terpenes for its ability to bind to the CB2 receptors of the endocannabinoid system in humans); 1,4-cineole which is another cyclic monoterpene ether isomer of 1,8-cineole; and perillene which is a monoterpene ether. It should be understood that the types of molecules and/or compounds described herein are intended to serve as examples and other types of related molecules and/or compounds and/or combinations of related molecules and/or compounds may be utilized in isolation or combination for the purpose of the formation and/or formulation of precursor liquids and/or precursor compounds.

Volatile molecules and/or compounds that may be used in a precursor liquid formulation may also include molecules and/or compounds that can be described as terpenophenols. These are compounds composed from both terpenes and phenols. Examples include, but are not limited to, for example: bakuchiol, ferruginol, carnoso, hinokitiol, auraptene, alkannin, ascofuranone, and carnosic acid. Some terpenoids, which are related to terpenes and contain oxygen, also have phenolic structures and include, but are not limited to, for example, carvacrol and thymol. It should be understood that the types of molecules and/or compounds described herein are intended to serve as examples and other types of related molecules and/or compounds and/or combinations of related molecules and/or compounds may be utilized in isolation or combination for the purpose of the formation and/or formulation of precursor liquids and/or precursor compounds.

Volatile molecules and/or compounds that may be used in a precursor liquid formulation may also include molecules and/or compounds that can be described as terpene epoxides. Terpene epoxides are oxygen-containing derivatives (terpenoids) that occur naturally in small amounts and/or are produced synthetically from natural terpene sources. These include, but are not limited to, for example: limonene oxide (also called limonene 1,2-epoxide), limonene dioxide (also called limonene bis-epoxide), α-pinene oxide, β-pinene oxide, caryophyllene oxide, 3-carene epoxide (also called trans-3,4-epoxy-caran), car-3-ene-5,6-epoxide (naturally occurring), glycidyl geraniol ether (a synthetic derivative), myrcene monoepoxide (specifically epoxidized at the 6,7 double bond), and α-terpinene dioxide. It should be understood that the types of molecules and/or compounds described herein are intended to serve as examples and other types of related molecules and/or compounds and/or combinations of related molecules and/or compounds may be utilized in isolation or combination for the purpose of the formation and/or formulation of precursor liquids and/or precursor compounds.

Volatile molecules and/or compounds that may be used in a precursor liquid formulation may also include molecules and/or compounds that can be described as terpene aldehydes (also called aromatic aldehydes). These may be formed when a terpene, which is a hydrocarbon built from isoprene units, is modified to include an aldehyde group. Examples of terpene aldehydes include, but are not limited to, for example: citral, citronellal, vanillin, and cinnamaldehyde. It should be understood that the types of molecules and/or compounds described herein are intended to serve as examples and other types of related molecules and/or compounds and/or combinations of related molecules and/or compounds may be utilized in isolation or combination for the purpose of the formation and/or formulation of precursor liquids and/or precursor compounds.

In the formulation of a precursor liquid and/or precursor compound, that the formulation may contain one or more compounds that contain a terpene as part of the structure of the molecule and/or compound. Examples include, but are not limited to, for example: Terpenes including acyclic terpenes; monocyclic terpenes; dicyclic terpenes; polycyclic terpenes such as tetracyclic terpenes and pentacyclic terpenes; terpenoids including acyclic terpenoids, monocyclic terpenoids, dicyclic terpenoids, and polycyclic terpenoids such as tetracyclic terpenoids and pentacyclic terpenoids; Terpene alcohols; including acyclic terpene alcohols, monocyclic terpene alcohols, dicyclic terpene alcohols, and polycyclic terpene alcohols such as tetracyclic terpene alcohols and pentacyclic terpene alcohols; terpene esters including acyclic terpene esters, monocyclic terpene esters, dicyclic terpene esters, and polycyclic terpene esters such as tetracyclic terpene esters and pentacyclic terpene esters; terpene ethers including acyclic terpene ethers (a subgroup of which are called acyclic terpenyl glycidyl ethers (TGEs)), monocyclic terpene ethers, dicyclic terpene ethers, and polycyclic terpene ethers such as tetracyclic terpene ethers and pentacyclic terpene ethers; Terpene ketones (ketonic terpenes) including acyclic terpene ketones, monocyclic terpene ketones, dicyclic terpene ketones, and polycyclic terpene ketones such as tetracyclic terpene ketones and pentacyclic terpene ketones; terpenophenols including acyclic terpenophenols, monocyclic terpenophenols, dicyclic terpenophenols, and polycyclic terpenophenols such as tetracyclic terpenophenols and pentacyclic terpenophenols; terpene epoxides including acyclic terpene epoxides, monocyclic terpene epoxides, dicyclic terpene epoxides, and polycyclic terpene epoxides such as tetracyclic terpene epoxides and pentacyclic terpene epoxides; and terpene aldehhydes, including acyclic terpene aldehhydes, monocyclic terpene aldehhydes, dicyclic terpene aldehhydes, and polycyclic terpene aldehhydes such as tetracyclic terpene aldehydes and pentacyclic terpene aldehhydes. It should be understood that the types of molecules and/or compounds described herein are intended to serve as examples and other types of related molecules and/or compounds and/or combinations of related molecules and/or compounds may be utilized in isolation or combination for the purpose of the formation and/or formulation of precursor liquids and/or precursor compounds.

In some embodiments of the precursor liquid and/or precursor compound, the formulation of a precursor liquid and/or precursor compound the formulation may contain one or more compounds that contain a terpene as part of the structure of the molecule and/or compound. The molecule or compound may have one more functional groups including, but not limited to, for example: an alcohol functional group containing a hydroxyl (—OH) group (e.g., linalool and geraniol); an aldehydes functional group that has a carbonyl (C═O) group with a hydrogen attached (e.g., citral—a mixture of neral and geranial); a ketone functional group that has a carbonyl (C═O) group bonded to two carbon atoms (e.g., as is present in carvone); an epoxide functional group that has a three-membered ring containing one oxygen atom (e.g., as is present in myrcene monoepoxide); an ester functional group that has a carbonyl group bonded to an oxygen atom (e.g., as is present in bornyl acetate); An ether functional group that has an oxygen atom bonded to two carbon atoms (e.g., as is present in 1,8-cineole); and a phenol functional group that has a hydroxyl group directly attached to an aromatic ring (e.g., thymol and carvacrol). It should be understood that the molecule, molecules, compound, and/or compounds that are composed structurally of a terpene may have a functional group or functional groups as part of the structure, and that multiple functional groups may be present.

In the formulation of a precursor liquid and/or compound containing a volatile molecule or molecules and/or compound or compounds it should be understood that molecules and or compounds may be selected for a precursor liquid formulation that may undergo a reaction or reactions and/or interconversion or interconversions when formulated together in a precursor liquid. This method and/or process may be used to formulate the desired precursor liquid or precursor compound formulation. This method utilizes at least some of the volatile molecule, molecules, volatile compound, and/or compounds (including, but not limited to, molecules and/or compounds that have specific functional groups, and/or a plurality of functional groups such as those described herein) to function as a reactant and/or reagent in order to form the final desired product present in the precursor liquid and/or precursor compound formulation. A simple example would be the use of a terpene ether and a terpenoid as reactant or reagent such that when combined together in a formulation (combination of an ether and a carboxylic acid) the formation of a terpene ester occurs, by an esterification reaction, where the terpene ester is the desired product present in the precursor liquid and/or precursor compound formulation. It should be understood that the types of reactions described herein are intended to serve as examples and other types of reactions, and/or sequences of reactions and/or combinations of reactions and/or interconversion reactions that may be utilized in isolation or combination for the purpose of the formation and/or formulation of precursor liquids and/or precursor compounds.

In some embodiments the liquid precursor or precursor compound is formulated utilizing various types of reactions and/or interconversion reactions (also called conversion reactions), including but not limited to reactions and/or interconversion reactions that change the functional group of the base or parent molecule (such as a terpene), and/or interconvert the base or parent molecule to another species may be utilized to achieve the final desired precursor liquid and/or precursor compound formulation. Examples of the types of reactions that may be used to formulate the desired precursor liquid and/or compound include, but are not limited to: oxidation reactions, reduction reactions, combination of oxidation and reduction reactions (also called redox reactions), hydration reactions, esterification, and various addition reactions. These transformations and/or reactions may be addition reactions, elimination reactions, substitution reactions, oxidation-reduction (redox) reactions, rearrangement reaction, radical reaction, and/or pericyclic reactions or a combination of reactions which may also include but is not limited to enzymatically mediated and/or catalyzed (biosynthesis) and/or synthetic reactions including but not limited to combination reactions, decomposition combination reactions, single replacement combination reactions, double replacement combination reactions, acid-base reactions, Wittig reactions and/or Grignard reaction. It should be understood that the types of reactions described herein are intended to serve as examples and other types of reactions, and/or sequences of reactions and/or combinations of reactions and/or interconversion reactions that may be utilized in isolation or combination for the purpose of the formation and/or formulation of precursor liquids and/or precursor compounds.

The types of reactions that can be utilized can be reactions based on the functional groups present on the molecules and/or compounds being utilized. The type of functional group may influence the potential reaction types that may be used. Using terpenes as an example, examples of reaction types include, but are not limited to: terpenes with double carbon bonds (C═C double bonding, also called Alkenes—such as, for example pinene or limonene) can undergo addition reactions where atoms are added across the double bond. Examples of addition reactions include but are not limited to hydrogenation (adding $H_2$ to form a saturated hydrocarbon), hydration (adding water to form an alcohol), and halogenation (adding halogens like $Br_2$). Another example are oxidation reactions which can be performed in standard atmosphere or enzymatically. In these reactions, the double bonds react with ozone ($O_3$), OH radicals, and ($NO_3$) radicals, producing epoxides, carbonyls, alcohols, and/or carboxylic acids. Another example is cyclization reactions. These reactions, often enzyme-catalyzed, involve the formation of carbocation intermediates that rearrange to form complex cyclic terpene structures. Reactions that occur in molecules or compounds with a hydroxyl group (—OH functional group, also called alcohols) also include oxidation reactions, where the alcohols (e.g., geraniol and/or linalool) can be oxidized to form aldehydes or ketones, and further to carboxylic acids. Another hydroxyl group reaction is esterification, where the hydroxyl group reacts with carboxylic acids (often under acidic conditions) to form esters. Hydroxyl group reactions can also be used for nucleophilic substitution reactions, where the hydroxyl group can be replaced by other groups in substitution reactions. Carbonyl group reactions (C═O functional groups, also called aldehydes and ketones) include reduction reactions where aldehydes and ketones (for example citral and/or carvone) can be reduced back to primary or secondary alcohols, respectively. Carbonyl groups can also undergo nucleophilic addition reactions as the carbonyl carbon is susceptible to attack by nucleophiles, for example, they react with alcohols to form hemiacetals and acetals. Condensation Reactions: carbonyl groups also participate in various condensation reactions (for example aldol condensation) to form more complex molecules. Carboxylic acid functional groups (—COOH functional group) undergo esterification reactions, as described herein, where they react with alcohols to form esters. Carboxylic acid functional groups also undergo reduction reactions and can be reduced to aldehydes or primary alcohols. Another example of a reaction that can utilize a carboxylic acid functional group is the formation of nicotine salt(s), which is formed through a chemical reaction between a nicotine base and an acid (such as a carboxylic acid) and the acid-base reaction creates a salt and lowers the pH. It should be understood that the reactions involving functional groups and interconversion reactions described herein are intended to serve as examples and other types of reactions, and/or sequences of reactions and/or combinations of reactions and/or interconversion reactions may be utilized in isolation or combination for the purpose of the formation and/or formulation of precursor liquids and/or precursor compounds.

Additionally, interconversion reactions also include but are not limited to; functional group interconversion, including multi-step interconversion as for example where an alcohol can be oxidized to an aldehyde, which can be further oxidized to a carboxylic acid. Additionally precursor liquid and/or precursor compound formulations may be optimized to facilitate the interconversion of the phase states of the precursor liquid and/or compound where the chemical composition remains the same; it only changes state (e.g., solid to liquid to gas). It should be understood that the reactions involving functional groups and interconversion reactions described herein are intended to serve as examples and other types of reactions, and/or sequences of reactions and/or combinations of reactions and/or interconversion reactions may be utilized in isolation or combination for the purpose of the formation and/or formulation of precursor liquids and/or precursor compounds.

In some embodiments, the formation and/or formulation of a precursor liquid and/or precursor compound may utilize volatile molecule and/or volatile compounds such as terpenes and their derivatives that are synthesized in order to achieve the desired structure, purity, and/or functional attributes of the molecule and/or compound used in the precursor liquid and/or precursor compound. Chemical reaction methods and processes that may be utilized include, but is not limited to, for example, the combination of an alcohol and an acid to form an ester. This process is also known as esterification (as previously described herein) and specifically, the reaction between an alcohol and a carboxylic acid that is known as Fischer esterification. Fischer esterification is a type of condensation reaction where water is also produced. This reaction is between a carboxylic acid and an alcohol (which may require an acid catalyst). This reaction can also be described as a condensation reaction because a molecule of water is eliminated as a byproduct. In an embodiment, the water byproduct may be used as the water fraction present intentionally in a precursor liquid and/or precursor compound formulation. Another reaction that may be utilized in the formation of a precursor liquid and/or precursor compound formulation is the synthesis of an ether. Ether can be synthesized from an alcohol through reactions including, but not limited to, for example, the Williamson ether synthesis or acid-catalyzed dehydration (with water as a byproduct) where the water byproduct may be used as the water fraction present intentionally in the precursor liquid and/or precursor compound formulation. It should be understood that the reactions involving functional groups and interconversion reactions described herein are intended to serve as examples and other types of reactions, and/or sequences of reactions and/or combinations of reactions and/or interconversion reactions may be utilized in isolation or combination for the purpose of the formation and/or formulation of precursor liquids and/or precursor compounds.

Additionally reactions form hemi-ketals, ketals, and/or polyketals may be utilized to form desired volatile molecules and/or compounds for inclusion in the precursor liquid and/or precursor compound. These may be utilized as an intermediary product that may not be present in the final formulation or alternatively, may be a component of the final formulation. The hemiketal product of the reaction between an alcohol and a ketone and the reaction can proceed further with a second molecule of alcohol to form a ketal (though the term "ketal" has largely been superseded by the more general term acetal). Hemiketal formation is achieved by an initial reaction (which may be under acidic conditions) involving one molecule of an alcohol adding across the carbonyl double bond of the ketone. The resulting functional group features both a hydroxyl (—OH) group and an ether (—OR) group attached to the same carbon atom. This reaction can be used as the basis for the production of acyclic or cyclic hemiketal products (where the cyclic hemiketal is more stable than the acyclic ketal). Ketal (acetal) formation occurs by continuing the reaction with an excess of the alcohol and an acid catalyst where the hydroxyl group is replaced by a second ether group, and a molecule of water is eliminated. The resulting product is a ketal (acetal), which has two ether linkages to the original carbonyl carbon. It should be understood that the reactions described herein are intended to serve as examples and other types of reactions, and/or combinations and/or sequences of reactions and/or interconversion reactions may be utilized in isolation or combination for the purpose of the formation and/or formulation of precursor liquids and/or precursor compounds.

In some embodiments the formation and/or formulation of a precursor liquid and/or precursor compound may utilize volatile molecule and/or volatile compounds such as terpenes and their derivatives that are synthesized in order to achieve the desired structure, purity, and functional attributes of the molecule and/or compound used in the precursor liquid and/or precursor compound. Terpenes and their derivatives can be synthesized using several methods, including, but not limited to, for example: biosynthesis/fermentation, extraction from natural sources, and chemical synthesis. The chosen method utilized may depend on the desired scale, purity, and structural complexity of the target molecule and/or compound. Biosynthesis (also called fermentation) uses engineered microorganisms (like yeast or bacteria) as "cell factories" to produce specific terpenes. This method involves engineering the organism's metabolic pathways (specifically the mevalonate (MVA) or methylerythritol phosphate (MEP) pathways) to overproduce isopentenyl pyrophosphate (IPP) and dimethylallyl pyrophosphate (DMAPP) precursors. Terpene synthase enzymes are then used to convert these IPP and/or DMAPP precursors into the desired terpene skeleton, which can be further modified by other enzymes. This allows for the cost-effective production of rare or complex terpenes on a commercial scale, with high purity and consistency. It should be understood that the methods for the extraction and/or isolation, and/or synthesis of terpenes and terpene derivatives for the purpose of their inclusion into a precursor liquid and/or precursor compound formulation and/or to be used in the formation of a precursor liquid and/or precursor compound formulation are intended to serve as examples, and other methods may be used, and that the methods described herein may be used in isolation or in combination and/or sequence in order to extract, isolate, and/or synthesize the desired terpene and/or terpene derivative molecule or molecules and/or compound or compounds.

Extraction from natural sources may also be utilized where terpenes are naturally produced by plants and can be isolated through various extraction techniques including, but not limited to, for example: steam distillation/hydrodistillation where the plant material is heated with water or steam, the volatile terpenes vaporize, and the mixed vapor is condensed and separated; and vacuum distillation where the plant material containing the terpene or terpenes and/or other desired volatile compound and/or molecules is placed under a controlled vacuum pressure to remove the volatile terpenes which can then undergo further vacuum distillation for isolation of specific terpenes and terpene derivative and/or other volatile compounds present in the plant material. Another method is solvent extraction where organic solvents (e.g., ethanol, hexane, or chloroform) are used to dissolve terpenes from plant material. This can involve maceration (soaking) or Soxhlet extraction (continuous solvent recycling). Supercritical Fluid Extraction (SFE) may also be utilized. This method uses supercritical carbon dioxide as a non-toxic solvent to extract compounds. This allows for high selectivity and efficiency to extract terpenes including, for example, terpenes with complex profiles. Other methods include utilizing chemical synthesis where organic chemistry methods are used to construct terpene skeletons from simpler, often petroleum-derived, precursor chemicals. Types of chemical synthesis include total synthesis and semi-synthesis methods. Total synthesis involves building the complex terpene molecule from simple, commercially available starting materials and may utilize synthetic strategies to control the molecule's stereochemistry. Semi-synthesis uses a naturally abundant, but structurally related, terpene as a starting material and modifies it to produce the desired final product or its analogs. This approach can be more efficient than total synthesis. Enzymatic/Chemoenzymatic synthesis is another method that may be utilized where specific enzymes are used to perform complex chemical transformations and can be used in combination with traditional chemical steps. It should be understood that the methods for the extraction and/or isolation, and/or synthesis of terpenes and terpene derivatives for the purpose of their inclusion into a precursor liquid and/or precursor compound formulation and/or to be used in the formation of a precursor liquid and/or precursor compound formulation are intended to serve as examples, and other methods may be used, and that the methods described herein may be used in isolation or in combination and/or sequence in order to extract, isolate, and/or synthesize the desired terpene and/or terpene derivative molecule, molecules, compound and/or compounds.

In some embodiments the formation and/or formulation of a precursor liquid and/or precursor compound may utilize volatile molecule and/or volatile compounds such as terpenes and their derivatives that are synthesized in order to achieve the desired structure, purity, and functional attributes of the molecule and/or compound used in the precursor liquid and/or precursor compound. In some embodiments the desired volatile molecule or molecules and/or compound or compounds may be terpenes and their derivatives, such as for example a terpenoid or terpenoids that have a complex structure and/or stereochemistry and/or isomerism and/or chirality such that additional methods and processes may be utilized for their synthesis. For example, complex terpenes, terpenoids and/or their derivatives may be synthesized using Wieland-Miescher ketone and its analogs. These may be used as a synthetic building block(s) for creating more complex terpenes and terpenoids. This method uses the Wieland-Miescher ketone to synthesize terpenes by acting as a versatile chiral building block, with its bicyclic structure undergoing various chemical modifications. The Wieland-Miescher ketone functional groups (ketones and the alkene) can be utilized for a range of reactions, such as oxidation, reduction, and alkylation, to progressively build the carbon skeleton of more complex terpene structures. Enantioselective synthesis of the ketone itself is crucial for creating optically pure terpenes with specific biological activities. This method may be utilized to insure the correct isomerism and/or chirality as the Wieland-Miescher ketone can be synthesized in an optically pure form, allowing the synthesis of enantioselective synthesis of complex, and/or bioactive terpenes. It should be understood that the methods the production, modulation, and/or synthesis of terpenes and terpene derivatives for the purpose of their inclusion into a precursor liquid and/or precursor compound formulation and/or to be used in the formation of a precursor liquid and/or precursor compound formulation are intended to serve as examples, and other methods may be used, and that the methods described herein may be used in isolation or in combination and/or sequence in order to produce, modulate, and/or synthesize the desired terpene and/or terpene derivative molecule or molecules and/or compound or compounds.

It may be desirable in the formation of precursor liquid and/or precursor compound formulations to utilize machine learning for the optimization of specific formulations and/or the selection of compounds and/or molecules to be included in the formulation and/or formulations. Machine learning may serve multiple functions in the process or processes of formulating precursor liquids and/or precursor compounds, such as any of the methods and processes described herein, including, but not limited to, for example, the selection of non-volatile and/or volatile components and/or molecules in isolation and/or combination to achieve desired organoleptic properties of the precursor liquid and/or precursor compound formulations. The machine learning process may include the process of first formulating and then qualitatively testing the precursor liquid and/or precursor compound formulation and using the results of the qualitative testing to train the machine learning program in order to further optimize the subsequent precursor formulation. This process and/or a similar process may be repeated a plurality of times or on an ongoing manner in order to optimize the machine learning model.

Machine learning may be used for selection of non-volatile and/or volatile components and/or molecules in isolation and/or combination to achieve desired physiological effects of the precursor liquid and/or precursor compound formulations which may include the process of formulation, qualitatively testing and quantitatively testing (e.g. pharmacokinetic study) the formulation, and using the results of the qualitative testing and quantitative testing to train the machine learning model in order to further optimize the subsequent precursor formulation. This process and/or a similar process may be repeated a plurality of times or on an ongoing manner in order to optimize the machine learning program. It should be understood that this description is intended to provide an example of how machine learning may be used for the formation of precursor liquids and/or precursor compounds formulation or formulations and the optimization of such formulations and that additional methods and process utilizing machine learning may be used individually or in combination with the methods and processes described herein.

Machine learning may be utilized to optimize the formulation process as it relates to the formation of a precursor liquid and/or precursor compound utilizing a database of molecules and compounds (such as those described herein) and a database of known reactions such as for example, but not limited to, organic chemistry reactions and synthetic chemistry reactions. These reactions, and/or databases may be input to the machine learning model, and the machine learning model may output suggested formulation components, component ratios, production methods, and production process(es) (including but not limited to reaction processes and/or methods). Such output suggestions from the machine learning model may be tested and evaluated qualitatively and/or quantitatively with the results being used to train the machine learning model. This process may be repeated a plurality of times or in an ongoing manner in order to optimize the machine learning model. It should be understood that this description is intended to provide an example of how machine learning may be used for the formation of precursor liquids and/or precursor compounds formulation or formulations and the optimization of such formulations and that additional methods and processes utilizing machine learning may be used individually or in combination with the methods and processes described herein.

Machine learning may be used to predict desired physiological interactions and/or physiological effects of the precursor liquid and/or precursor compound formulation. Molecules and/or compounds that may be used in a formulation that have known physiological interactions and/or physiological effects (including, but not limited to, receptor binding and/or interactions) may be used to train the machine learning model. The machine learning model may then output suggested formulations to achieve a desired type of physiological interactions, physiological effects, and/or receptor binding or receptor interaction. Such output suggestions from the machine learning model may be tested and evaluated, including but not limited to in vivo and/or in vitro testing, with the results used to further train the machine learning model. This process may be repeated a plurality of times or in an ongoing manner in order to optimize the machine learning model. It should be understood that this description is intended to provide an example of how machine learning may be used for the formation of precursor liquids and/or precursor compounds formulation or formulations and the optimization of such formulations and that additional methods and processes utilizing machine learning may be used individually or in combination with the methods and processes described herein.

In any application of the machine learning model or models such as those described herein, the machine learning model or models may be taught using existing data, and/or data generated from qualitative testing, data generated from quantitative testing, and/or data generated from in vivo and/or in vitro testing. Such data may include bench-top, laboratory, test instrument generated data, data generated from computer simulation and/or computer modeling, and/or data generated from testing the product with controlled groups of individuals (e.g., blind studies or double blind studies, control group testing, pharmacokinetic studies, and/or other market testing). Training data may include taste testing, user, and/or customer experience testing. Such data may be data gathered from large groups such as consumers and/or select subsets of consumers. Such data may be individual data or aggregated data. It should be understood that this description is intended to provide an example of how machine learning may be used for the formation of precursor liquids and/or precursor compounds formulation or formulations and the optimization of such formulations and that additional methods and process utilizing machine learning may be used individually or in combination with the methods and processes described herein.

In some embodiments the formation and/or formulation of a precursor liquid and/or precursor compound may utilize volatile molecule and/or volatile compounds such as terpenes and their derivatives that are selected based on their interactions with each other and/or their interaction with other molecules and/or compounds present in the precursor liquid and/or precursor compound formulation, as for example nicotine and/or cannabinoids and/or cannabinoid derivatives. The selection of the volatile molecule and/or volatile compounds such as terpenes and their derivatives may also be determined by the interaction of the molecules and/or compound and/or mixture of molecules and/or compounds with human physiology to effect a physiological response or perceived physiological and/or psychological benefit. Terpenes and their derivatives typically react with each other and other compounds to produce a range of synergistic biological effects in the body, a phenomenon known as the entourage effect.

Unlike typical chemical reactions where they form new molecular structures, interaction of the molecules and/or compound and/or mixture of molecules and/or compounds with human physiology to effect a physiological response or perceived physiological and/or psychological benefit are primarily pharmacological interactions that modulate physiological processes. Examples of types of interactions and their outcomes include but are not limited to: Synergistic enhancement (also called the Entourage Effect), where the terpenes and/or their derivatives work together with cannabinoids (like THC and CBD) to enhance or modulate their individual effects. This may result in a more potent and/or balanced overall experience by the user. Specific examples of combinations include, but are not limited to, for example: Limonene and THC in combination which can produce a more energetic and clear-headed effect—potentially reducing the anxiety sometimes associated with high THC doses; Myrcene and THC in combination which may enhance the sedative and relaxing properties of the cannabinoid; and Pinene and THC in combination which may reduce the short-term memory impairment often linked with THC. The selection of the volatile molecule and/or volatile compounds such as terpenes and their derivatives may also be determined by the receptor interaction as specific terpenes can directly interact with the body's neurotransmitter and endocannabinoid receptors. Examples include, but are not limited to: β-caryophyllene (beta-caryophyllene) which binds directly to the CB2 cannabinoid receptor thereby producing anti-inflammatory and pain-relieving effects without psychoactivity; and linalool which binds to GABA receptors, which helps produce calming, anti-anxiety effects similar to the natural neurotransmitter GABA. It should be understood that the description provided herein is intended to serve as examples, and that other combinations of terpenes and their derivatives and/or other molecules and/or compounds and their derivatives may be used individually or in combination in the formation and/or formulation of a precursor liquid or precursor liquids and/or precursor compound or precursor compounds.

The selection of the volatile molecule and/or volatile compounds such as terpenes and their derivatives may also be determined based on increasing the efficacy of the precursor liquid and/or precursor compound by increasing the bioavailability of the active component of the precursor liquid and/or precursor compound such as for example nicotine, cannabinoids, and/or a combination of nicotine and cannabinoids. Some terpenes can increase the permeability of cell membranes, including the blood-brain barrier, allowing other compounds like cannabinoids to be absorbed more efficiently or quickly. The selection of the volatile molecule and/or volatile compounds such as terpenes and their derivatives may also be determined based on the molecule and/or compounds ability to modulate neurotransmitters. For example, terpenes and their derivatives, as an individual species or in combination with other terpenes, and their derivatives, can influence levels of neurotransmitters like serotonin and dopamine thereby affecting mood, motivation, and the perception of experiencing pleasure. For example, limonene has shown the ability to elevate serotonin and dopamine levels thereby contributing to mood enhancement. It should be understood that the description provided herein is intended to serve as examples, and that other combinations of terpenes and their derivatives, other molecules, compounds and/or their derivatives may be used individually or in combination in the formation and/or formulation of a precursor liquid or precursor liquids and/or precursor compound or precursor compounds.

FIG. 49 is a flowchart illustrating an exemplary process for optimizing precursor liquid and/or precursor compound formulations using machine learning. One or more of the steps illustrated in FIG. 49 may use, be used by, and/or or be tailored to, for example, one or more of the vaporizing devices and/or precursor components described herein. A database of candidate molecules and compounds (e.g., including volatile and non-volatile components) and a database of known chemical reactions applicable to precursor formulation is acquired (4902). For example, a database comprising two or more of the substances discussed herein as suitable for precursor formulations for the vaporizing devices discussed herein, and known chemical and/or thermal reactions of those substances may be received, compiled, and/or otherwise obtained.

A machine learning model is utilized to generate one or more candidate precursor liquid and/or precursor compound formulations by selecting specific compounds and/or molecules and proposing component ratios and production methods based on the input databases (4904). For example, the machine learning model may select candidate compounds (e.g., linalool, geraniol, citral, etc.) and propose a formulation ratio and synthesis method based on historical reaction data and desired organoleptic properties. The candidate formulations are prepared and subjected to qualitative and/or quantitative testing to evaluate desired properties such as physiological effects, organoleptic characteristics, and bioavailability (4906). Example types of testing may include, for example, organoleptic assessment, pharmacokinetic studies, receptor binding assays, in vivo/in vitro testing, etc. The candidate formulations generated by the machine learning model may be produced and also or alternatively, for example, tested for aroma, taste, and physiological effect in a controlled laboratory setting, with results recorded for further analysis. The testing may be done, for example, with and/or without using a vaporizing device as discussed herein as part of the testing and/or evaluation process.

The results of the experimental evaluation (e.g., including qualitative and quantitative data) are used to train and optimize the machine learning model, thereby refining subsequent formulation suggestions (4908). This process may be repeated iteratively to further optimize the model and the resulting formulations. For example, the results of taste testing and pharmacokinetic studies may be input into the machine learning model to improve its predictive accuracy for future formulation cycles, thereby improving the model's ability to suggest new combinations or ratios that better meet the desired criteria.

FIG. 50 is a flowchart illustrating an exemplary process for determining mappings from sensor signals to control parameters of a vaporizing device using machine learning. One or more of the steps illustrated in FIG. 49 may use, be used by, and/or or be tailored to, for example, one or more of the vaporizing devices and/or precursor components described herein. Real-time sensor signals during one or more inhalation cycles is received (5002). For example, during some (or all) activation and/or inhalation cycles, controller 480 may collect real-time data from one or more sensors (e.g., airflow sensors, pressure sensors, and/or temperature sensors). These sensors may provide information regarding the user's inhalation profile (e.g., flow rate, duration, frequency) and the operational state of the device (e.g., heater temperature, ambient conditions).

User feedback and/or aggregate user training data is acquired (5004). For example, controller 480 may receive user feedback, which may for example, be explicit (e.g., user input via a button, touchscreen, microphone, and/or mobile application indicating satisfaction or dissatisfaction with the inhalation experience) and/or implicit (e.g., patterns of device usage, inhalation characteristics, time of day, environmental conditions, and/or other usage data). In some examples, controller 480 may aggregate user training data over multiple activation cycles to identify characteristic inhalation profiles. A machine learning model is trained and/or updated using the sensor signals and/or user data (5006). For example, controller 480 may transmit the collected sensor data and user feedback/training data to another computer/system to be utilized to train or update a machine learning model to be used by controller 480. The model may be implemented, for example, using supervised learning (where user feedback provides labels for desired outcomes), unsupervised learning (where patterns are inferred from usage data), and/or reinforcement learning (where the model is rewarded for achieving optimal device performance or user satisfaction). The machine learning model may learn to associate specific sensor signal patterns with optimal control parameters, such as heater power, preheat duration, or flow rate thresholds. The machine learning model may be trained, for example, using data from a plurality (e.g., large number) of users, vaporizing devices, and/or device embodiments, described herein.

Control parameters for device operation based on machine learning model output are generated (5008). For example, controller 480 (or another system) may generate, based on the machine learning model, static control parameters to be used by controller 480 during an inhalation and/or activation cycle. In another example, during subsequent inhalation cycles, controller 480 may apply the trained machine learning model to incoming sensor signals to determine appropriate control parameters in real time. In this example, controller 480 may dynamically adjust the power delivered to the heater based on the detected inhalation strength, duration, or environmental conditions, thereby optimizing vapor or aerosol generation to match the user's preferences or physiological needs. The machine learning model may output control parameters (e.g., heater power, preheat duration, flow thresholds) in response to received sensor signals, thereby enabling adaptive or personalized device operation. The user profile and/or model parameters are stored (5010). For example, controller 480 may store the trained model, static control parameters, and/or user profile data (e.g., user-specific data, model weights, and/or learned mappings) in non-volatile memory thereby enabling persistent personalization across sessions and device power cycles.

FIG. 51 is a flowchart illustrating an exemplary process for detecting properties of a precursor and/or vapor using machine learning and analytical measurements. One or more of the steps illustrated in FIG. 51 may use, be used by, and/or be tailored to, for example, one or more of the vaporizing devices and/or optical analysis subsystems described herein.

Spectral or analytical data from a precursor and/or vapor is acquired (5102). For example, an optical analysis subsystem (e.g., system 4700 or 4800) may acquire spectral data (e.g., UV, IR, visible, or refractive index measurements) from a precursor sample and/or vapor sample using one or more emitters and detectors as described herein. The subsystem may analyze the precursor prior to vaporization, the vapor after vaporization, or both.

The acquired data is preprocessed and/or normalized (5104). For example, the optical analysis subsystem may preprocess the acquired spectral data by performing baseline correction, normalization, noise reduction, or feature extraction to prepare the data for further analysis. This may include comparing the measured spectrum to a reference or applying mathematical transformations to enhance relevant features. A machine learning model is utilized to analyze the data (5106). For example, the preprocessed data may be input to a machine learning model (e.g., a classifier, regression model, or anomaly detector) that has been trained to detect properties such as precursor degradation, authentication (e.g., verifying formulation identity), or reaction completion (e.g., conversion of THC to CBN) as described herein. The model may output a classification, probability, or quantitative estimate of the property of interest.

A property determination or diagnostic output is generated (5108). For example, the system may generate an output indicating the detected property (e.g., "precursor authentic," "precursor degraded," "reaction complete," or "precursor outside specification"). This output may be used to trigger device actions (e.g., enable/disable vaporization, adjust control parameters, notify the user, or log the event). The results and/or model parameters are stored and/or used to update the model or reference data (5110). For example, the system may store the results of the property determination, along with the associated spectral data, in non-volatile memory for future reference, quality assurance, or regulatory compliance. In some embodiments, the stored data may be used to further train or update the machine learning model, either locally or via transmission to a remote server.

FIG. 52 is a flowchart illustrating an exemplary process for adapting heater control parameters of a vaporizing device using machine learning based on environmental conditions, device state, and user profile. One or more of the steps illustrated in FIG. 52 may use, be used by, and/or be tailored to, for example, one or more of the vaporizing devices and/or control systems described herein. Environmental and device state data is acquired (5202). For example, environmental and device state data (e.g., ambient temperature, chamber temperature, chamber preheat temperature, battery state, and/or device usage history) is acquired by one or more sensors coupled with a controller of a vaporizing device described herein.

User profile, preference, or training data is received (5204). For example, user profile data, user preferences (e.g., selected vapor density, flavor, or temperature), and/or user training data (e.g., historical inhalation profiles, satisfaction feedback) is received and/or accessed by the vaporizing device and/or controller. This may include explicit user input or data aggregated over multiple activation cycles. Puff profile and real-time inhalation data is analyzed (5206). For example, during an inhalation cycle, real-time puff profile data (e.g., flow rate, duration, frequency) is analyzed. For example, controller 480 may monitor airflow, pressure, and/or acoustic signals to characterize the user's inhalation pattern in real time.

A machine learning model is utilized to determine or adjust heater control parameters (5208). For example, the system applies a machine learning model (e.g., trained on historical device, environmental, and user data) to determine or adjust heater control parameters (e.g., power level, preheat duration, dynamic setpoints) and or temperature parameter in response to the current environment, device state, and/or user profile. The model may output real-time adjustments to optimize vaporization performance and user experience. Control actions and/or model updates are implemented and stored (X5210). For example, the determined control parameters are implemented by the controller (e.g., adjusting heater power or preheat timing). The system may also store the resulting device state, user response, and/or updated model parameters in non-volatile memory for future adaptation and ongoing personalization.

FIG. 53 illustrates a block diagram of a computer system. Electronics that modulate or control parts of a vaporizing unit may be or include a computer and/or a computer system (e.g., computer system 5300). Computer software may implement one or more of the control functions and/or display functions described herein. Computer system 5300 includes communication interface 5320, processing system 5330, storage system 5340, and user interface 5360. Processing system 5330 is operatively coupled to storage system 5340. Storage system 5340 stores software 5350 and data 5370. Processing system 5330 is operatively coupled to communication interface 5320 and user interface 5360. Computer system 5300 may comprise a programmed general-purpose computer. Computer system 5300 may include a microprocessor. Computer system 5300 may comprise programmable or special purpose circuitry. Computer system 5300 may be distributed among multiple devices, processors, storage, and/or interfaces that together comprise elements 5320-5370.

Communication interface 5320 may comprise a network interface, modem, port, bus, link, transceiver, or other communication device. Communication interface 5320 may be distributed among multiple communication devices. Processing system 5330 may comprise a microprocessor, microcontroller, logic circuit, or other processing device. Processing system 5330 may be distributed among multiple processing devices. User interface 5360 may comprise a keyboard, mouse, voice recognition interface, microphone and speakers, graphical display, touch screen, or other type of user interface device. User interface 5360 may be distributed among multiple interface devices. Storage system 5340 may comprise a disk, tape, integrated circuit, RAM, ROM, EEPROM, flash memory, network storage, server, or other memory function. Storage system 5340 may include computer readable medium. Storage system 5340 may be distributed among multiple memory devices.

Processing system 5330 retrieves and executes software 5350 from storage system 5340. Processing system 5330 may retrieve and store data 5370. Processing system 5330 may also retrieve and store data via communication interface 5320. Processing system 5330 may create or modify software 5350 or data 5370 to achieve a tangible result. Processing system 5330 may control communication interface 5320 or user interface 5360 to achieve a tangible result. Processing system may retrieve and execute remotely stored software via communication interface 5320.

Software 5350 and remotely stored software may comprise an operating system, utilities, drivers, networking software, and other software typically executed by a computer system. Software 5350 may comprise an application program, applet, firmware, or other form of machine-readable processing instructions typically executed by a computer system. When executed by processing system 5330, software 5350 or remotely stored software may direct computer system 5300 to operate.

As used herein, "or" and "and/or" as used in a list of items (for example, a list of items prefaced by a phrase such as "at least one of", "one or more of", or "including, but not limited to") indicates an inclusive list such that, for example, a list of at least one of A, B, and/or C means A or B or C, or AB or AC or BC, or ABC (i.e., A and B and C). Also, as used herein, the phrase "based on" shall not be construed as a reference to a limited set. Thus, as used herein, the phrase "based on" may be construed in the same manner as the phrase "based at least in part on."

The included descriptions, block diagrams, and figures depict specific implementations to instruct those skilled in the art in making and using certain embodiments considered at present to be among the best options. For purposes of illustration, and brevity, some conventional features may have been simplified or omitted. Variations from these implementations that remain within the scope of the vaporizing device described herein may be readily appreciated by those skilled in the art. Features described in connection with any embodiment may be combined in various permutations to create further arrangements, and it should be understood that not all illustrated or described features are required in every embodiment. The present disclosure is not limited to the particular implementations shown or described, but instead encompasses alternatives, modifications, and equivalents as may fall within the scope of the claims and their legal equivalents. The block diagrams and figures are provided for explanatory purposes and should not be construed as limiting, but rather as illustrative of possible arrangements and configurations.

The invention claimed is:

1. A vaporizing device, comprising:

an airflow conduit having a laminar-flow section and a downstream flow-disrupting body configured to, during an inhalation cycle, generate periodic pressure fluctuations in an airflow flowing through the airflow conduit;

a transducer acoustically coupled with the airflow conduit and configured to output a transducer signal responsive to the periodic pressure fluctuations;

a chamber configured to receive a thermoviscous liquid precursor and to generate at least one of a vapor and an aerosol therefrom, the chamber comprising at least one fused silica component providing a chemically inert thermally stable boundary for the thermoviscous liquid precursor;

at least one discrete capillary precursor channel configured to regulate a flow of the thermoviscous liquid precursor into the chamber by thermal and pressure-mediated control, wherein the at least one discrete capillary precursor channel is defined by cooperating solid, non-porous components of the chamber mated to form a flow passage into the chamber, the flow passage including a precursor channel outlet positioned such that airflow through the airflow conduit at least partially entrains the thermoviscous liquid precursor into the chamber;

a vaporization heater thermally coupled to the chamber and physically isolated from the airflow conduit, the thermoviscous liquid precursor, generated vapor, and generated aerosol by the fused silica component; and control circuitry configured to:

process the transducer signal to extract a frequency-domain feature within a predetermined passband corresponding to the periodic pressure fluctuations generated by the downstream flow-disrupting body, the frequency-domain feature comprising at least one of a dominant frequency and a band-limited spectral energy indicator;

derive, based at least in part on the frequency-domain feature, a flow parameter indicative of inhalation; and enable and modulate power delivered to the vaporization heater based at least in part on the flow parameter such that heating of the chamber is conditioned on an inhalation state associated with entrainment of the thermoviscous liquid precursor through the discrete capillary precursor channel.

2. The vaporizing device of claim 1, wherein the downstream flow-disrupting body comprises at least one of a wire, rod, rib, vane, tab, bluff body, perforated plate, and lattice having a hydraulic dimension selected to yield a vortex-shedding frequency within a predetermined passband for an inhalation flow rate range.

3. The vaporizing device of claim 1, wherein the transducer comprises at least one of a MEMS microphone, an absolute pressure sensor, a differential pressure sensor, and a thermal anemometer.

4. The vaporizing device of claim 1, wherein the flow parameter is based on a band-limited spectral energy indicator and the band-limited spectral energy indicator is mapped to a target heater power value that monotonically increases over an operating flow range.

5. The vaporizing device of claim 1, further comprising:

an intake-air heater disposed along the airflow conduit; and a first temperature sensor upstream of the intake-air heater and a second temperature sensor downstream thereof, the device being configured to regulate an intake-air temperature setpoint based on feedback from the first temperature sensor and the second temperature sensor.

6. The vaporizing device of claim 1, wherein the heater is isolated from the chamber by a chemically inert fused-silica interface that prevents contact between the heater and the airflow, precursor, generated vapor, and generated aerosol.

7. The vaporizing device of claim 1, wherein ambient pressure is sensed and the vaporizing device compensates for variable ambient pressure by adjusting one or more of intake-air conditioning, heater power, and precursor entrainment to maintain a desired vaporization profile.

8. A vaporizing device, comprising:

an airflow conduit defining an airflow path and including a laminar-flow section and a downstream flow-disrupting body configured to, during an inhalation cycle, generate periodic pressure fluctuations in airflow through the airflow conduit;

a transducer coupled to the airflow conduit and configured to generate an electrical signal responsive to the periodic pressure fluctuations;

a chamber configured to receive a thermoviscous liquid precursor and to generate at least one of a vapor and an aerosol therefrom, the chamber comprising at least one fused silica component to provide a chemically inert thermally stable boundary for the thermoviscous liquid precursor;

at least one discrete capillary precursor channel configured to regulate a flow of the thermoviscous liquid precursor into the chamber by thermal and pressure-mediated control, wherein the at least one discrete capillary precursor channel is defined by cooperating solid, non-porous components of the chamber mated to form a flow passage into the chamber, the flow passage having a precursor channel outlet positioned to be acted upon by airflow through the airflow conduit;

a vaporization heater thermally coupled to the chamber and physically isolated from the airflow path, the thermoviscous liquid precursor, generated vapor, and generated aerosol by the fused silica component; and control circuitry configured to:

process the electrical signal from the transducer to identify, based on band-limited spectral energy within a predetermined passband corresponding to the periodic pressure fluctuations, an inhalation-dependent operating state of the vaporizing device;

determine, based on the inhalation-dependent operating state, whether airflow through the airflow conduit is sufficient to entrain thermoviscous liquid precursor from the precursor channel outlet; and selectively enable and modulate power delivered to the vaporization heater when the inhalation-dependent operating state indicates airflow sufficient to entrain thermoviscous liquid precursor through the discrete capillary precursor channel, such that liquid delivery and heater power are jointly constrained to an operating regime associated with reduced thermal degradation byproducts in at least one of the generated vapor and the generated aerosol.

9. The vaporizing device of claim 8, wherein the downstream flow-disrupting body comprises at least one of a wire, rod, rib, vane, tab, bluff body, perforated plate, and lattice, and has a geometry selected such that airflow through the airflow conduit during inhalation generates periodic pressure fluctuations having a dominant frequency within the predetermined passband for an inhalation flow rate range.

10. The vaporizing device of claim 8, wherein the transducer comprises at least one of a MEMS microphone, an absolute pressure sensor, a differential pressure sensor, and a thermal anemometer.

11. The vaporizing device of claim 8, wherein the flow parameter is based on a band-limited spectral energy indicator, and the band-limited spectral energy indicator is mapped to a target heater power value that monotonically increases over an operating flow range when the operating state permits heater enabling.

12. The vaporizing device of claim 8, further comprising:

an intake-air heater disposed along the airflow conduit; and a first temperature sensor upstream of an intake-air heater and a second temperature sensor downstream thereof, wherein the control circuitry is configured to regulate an intake-air temperature setpoint based on feedback from the first temperature sensor and the second temperature sensor.

13. The vaporizing device of claim 8, wherein the vaporization heater is isolated from the chamber by a chemically inert fused-silica interface that prevents contact between the vaporization heater and the airflow, the thermoviscous liquid precursor, and the generated vapor and aerosol.

14. The vaporizing device of claim 8, wherein ambient pressure is sensed and the vaporizing device compensates for variable ambient pressure by adjusting at least one of intake-air conditioning, heater power, and precursor entrainment to maintain a desired vaporization profile.

15. The vaporizing device of claim 8, wherein the control circuitry is configured to coordinate the modulation by adjusting power delivered to an intake-air heater and adjusting power delivered to the vaporization heater based on an inhalation-dependent operating state derived from the flow parameter to maintain the chamber within a temperature operating window associated with reduced thermal degradation byproducts.

16. A vaporizing device, comprising:

an airflow conduit defining an airflow path configured to conduct intake air during an inhalation cycle;

a flow-disrupting structure disposed in the airflow path and configured to generate repeating pressure perturbations in the intake air during inhalation;

a sensor coupled to the airflow conduit and configured to produce an electrical signal responsive to the repeating pressure perturbations;

a chamber configured to receive a thermoviscous liquid precursor and to generate at least one of a vapor and an aerosol therefrom;

a precursor delivery arrangement comprising at least one discrete capillary precursor channel configured to regulate a flow of the thermoviscous liquid precursor into the chamber by thermal and pressure-mediated control, wherein the at least one discrete capillary precursor channel is defined by cooperating solid, non-porous components mated to form a flow passage having a precursor channel outlet positioned such that airflow through the airflow conduit at least partially entrains the thermoviscous liquid precursor into the chamber at a rate that correlates with inhalation strength;

a vaporization heater thermally coupled to the chamber and physically isolated from the airflow conduit, the thermoviscous liquid precursor, generated vapor, and generated aerosol; and control circuitry configured to:

process the electrical signal to extract a frequency-domain feature within a predetermined passband corresponding to the repeating pressure perturbations, the frequency-domain feature comprising at least one of a dominant frequency and a band-limited spectral energy indicator;

derive, based at least in part on the frequency-domain feature, a flow parameter indicative of inhalation; and enable and modulate power delivered to the vaporization heater based at least in part on the flow parameter such that heating of the chamber is conditioned on an inhalation state associated with entrainment of the thermoviscous liquid precursor through the discrete capillary precursor channel.

17. The vaporizing device of claim 16, wherein the flow-disrupting structure comprises at least one of a wire, rod, rib, vane, tab, bluff body, perforated plate, and lattice, and has a geometry selected such that the repeating pressure perturbations include a dominant frequency within a predetermined passband for an inhalation flow-rate range.

18. The vaporizing device of claim 17, wherein the sensor comprises at least one of a MEMS microphone, an absolute pressure sensor, a differential pressure sensor, and a thermal anemometer.

19. The vaporizing device of claim 1, wherein processing the transducer signal comprises AC-coupling the transducer signal to a comparator to generate a pulse train corresponding to the periodic pressure fluctuations, and determining the dominant frequency by counting pulses within a predetermined time window.

20. The vaporizing device of claim 1, wherein processing the transducer signal comprises converting the transducer signal to a time-series of digital values and computing at least one of an FFT, Goertzel, filter-bank energies, and wavelet coefficients to obtain the band-limited spectral energy indicator.

21. The vaporizing device of claim 20, further comprising:

an intake-air heater disposed along the airflow path, wherein the control circuitry is configured to regulate power delivered to the intake-air heater in coordination with power delivered to the vaporization heater based on the inhalation-dependent control signal.

22. The vaporizing device of claim 21, further comprising:

a first temperature sensor positioned upstream of the intake-air heater and a second temperature sensor positioned downstream of the intake-air heater, wherein the control circuitry is configured to regulate an intake-air temperature setpoint based on feedback from the first temperature sensor and the second temperature sensor.

23. The vaporizing device of claim 22, wherein ambient pressure is sensed, and the control circuitry compensates for variations in ambient pressure by adjusting at least one of intake-air heater power, vaporization-heater power, and precursor entrainment to maintain the chamber temperature outside of a temperature range associated with thermal degradation of at least one of the thermoviscous liquid precursor, generated vapor, and generated aerosol.

24. A vaporizing device, comprising:

an airflow conduit defining an airflow path and including a laminar-flow section and a downstream flow-disrupting body configured to, during an inhalation cycle, generate periodic pressure fluctuations in airflow through the airflow conduit;

a transducer coupled to the airflow conduit and configured to generate an electrical signal responsive to the periodic pressure fluctuations;

a chamber configured to receive a thermoviscous liquid precursor and to generate at least one of a vapor and an aerosol therefrom;

a precursor feed structure comprising at least one discrete capillary precursor channel configured to regulate a flow of the thermoviscous liquid precursor into the chamber by thermal and pressure-mediated control, wherein the at least one discrete capillary precursor channel is defined by cooperating solid, non-porous components mated to form a flow passage having a precursor channel outlet positioned such that airflow through the airflow conduit at least partially entrains the thermoviscous liquid precursor into the chamber;

a vaporization heater thermally coupled to the chamber and physically isolated from the airflow path, the thermoviscous liquid precursor, generated vapor, and generated aerosol; and control circuitry configured to:

process the electrical signal from the transducer to obtain a band-limited spectral energy indicator within a predetermined passband corresponding to the periodic pressure fluctuations; and enable and modulate power delivered to the vaporization heater based at least in part on the band-limited spectral energy indicator in accordance with a selected one of a plurality of profiles, each profile defining at least one criterion for conditioning heating of the chamber on an inhalation condition associated with entrainment of the thermoviscous liquid precursor through the discrete capillary precursor channel and thermal degradation of the thermoviscous liquid precursor in the chamber.

25. The vaporizing device of claim 24, wherein each of the plurality of inhalation profiles defines, for a respective inhalation pattern category, a relationship mapping a respective inhalation strength metric to a corresponding vaporization-heater power level.

26. The vaporizing device of claim 25, wherein selecting the selected inhalation profile comprises, based on a comparison of the frequency-dependent component indicator to at least one stored profile feature associated with the plurality of inhalation profiles, and selecting the selected inhalation profile is based on a similarity metric indicating a stored profile feature associated with the frequency-dependent component indicator.

27. The vaporizing device of claim 26, wherein the frequency-dependent component indicator is compared to stored profile features for an early portion of an inhalation cycle and the selected inhalation profile comprises predicted characteristics of a remaining portion of the inhalation cycle.

28. The vaporizing device of claim 27, wherein processing the electrical signal comprises obtaining a band-limited spectral energy indicator within a predetermined passband corresponding to the repeating pressure perturbations, where the frequency-dependent component indicator is associated with the band-limited spectral energy indicator, and regulating at least power delivered to the vaporization heater comprises mapping the band-limited spectral energy indicator to a target vaporization-heater power level that monotonically increases over an operating inhalation-strength range.

29. The vaporizing device of claim 28, further comprising:

an intake-air heater disposed along the airflow path, wherein the control relationship for at least one of the inhalation profiles further defines coordinated control outputs including a first power level delivered to the intake-air heater and a second power level delivered to the vaporization heater, the coordinated control outputs being selected to maintain the chamber wall temperature outside of the temperature range associated with thermal degradation across different user inhalation patterns.

30. The vaporizing device of claim 28, wherein the control circuitry is further configured to receive an indicator of ambient pressure and to compensate for variations in ambient pressure by adjusting at least one of power delivered to the vaporization heater and a control relationship defined by the selected inhalation profile, across a plurality of ambient pressure conditions, to maintain the chamber wall temperature outside of the temperature range associated with thermal degradation.

* * * * *